US012668896B2

(12) United States Patent
Asano et al.

(10) Patent No.: US 12,668,896 B2
(45) Date of Patent: Jun. 30, 2026

(54) BLENDED YARN, KNITTED/WOVEN BODY OF SAME, AND METHOD FOR MANUFACTURING SAID KNITTED/WOVEN BODY

(71) Applicants: Hasetora Spinning Co., Ltd., Hashima (JP); Spiber Inc., Tsuruoka (JP)

(72) Inventors: Tetsuhiro Asano, Hashima (JP); Akihiko Ozeki, Tsuruoka (JP)

(73) Assignees: Hasetora Spinning Co., Ltd., Gifu (JP); Crane Inc., Yamagata (JP)

( * ) Notice: Subject to any disclaimer, the term of this patent is extended or adjusted under 35 U.S.C. 154(b) by 272 days.

(21) Appl. No.: 17/044,436

(22) PCT Filed: Apr. 3, 2019

(86) PCT No.: PCT/JP2019/014892
§ 371 (c)(1),
(2) Date: Oct. 1, 2020

(87) PCT Pub. No.: WO2019/194258
PCT Pub. Date: Oct. 10, 2019

(65) Prior Publication Data

US 2021/0032782 A1 Feb. 4, 2021

(30) Foreign Application Priority Data

Apr. 3, 2018 (JP) ..... 2018-071886
Sep. 28, 2018 (JP) ..... 2018-185166

(51) Int. Cl.
*D02G 3/04* (2006.01)
*D01F 4/02* (2006.01)
(Continued)

(52) U.S. Cl.
CPC ..... *D02G 3/04* (2013.01); *D01F 4/02* (2013.01); *D03D 15/225* (2021.01); *D03D 15/41* (2021.01);
(Continued)

(58) Field of Classification Search
CPC ..... D10B 2211/22; D10B 2201/20; D03D 15/233; D03D 15/47; D03D 15/255; D01F 4/02; D02G 3/04; D04B 1/14
See application file for complete search history.

(56) References Cited

U.S. PATENT DOCUMENTS 4,067,927 A * 1/1978 Weil ..... C08K 5/17 525/445
2004/0170827 A1 9/2004 Crighton
(Continued)

FOREIGN PATENT DOCUMENTS

CN 102877176 A 1/2013
CN 103132198 A 6/2013
(Continued)

OTHER PUBLICATIONS

Machine Translation of CN102877176 (Year: 2013).*
(Continued)

*Primary Examiner* — Jenna N Chandhok
(74) *Attorney, Agent, or Firm* — Morgan, Lewis & Bockius LLP

(57) ABSTRACT

The present invention aims at providing a blended yarn with which a knitted or woven body, wherein a decrease in tension and stiffness due to moistness is reduced, can be manufactured, even in a case where the blended yarn is used for the manufacture of the knitted or woven body; a knitted or woven body of the same; and a method for manufacturing
(Continued)

the knitted or woven body. The blended yarn according to the present invention comprises a modified fibroin fiber and a regenerated cellulose fiber.

17 Claims, 9 Drawing Sheets

Specification includes a Sequence Listing.

(51) Int. Cl.

| | |
|---|---|
| ***D03D 15/225*** | (2021.01) |
| ***D03D 15/40*** | (2021.01) |
| ***D03D 15/41*** | (2021.01) |
| ***D03D 15/63*** | (2021.01) |
| ***D04B 1/14*** | (2006.01) |
| ***D06M 11/01*** | (2006.01) |

(52) U.S. Cl.
CPC ..... *D03D 15/497* (2021.01); *D03D 15/63* (2021.01); *D04B 1/14* (2013.01); *D06M 11/01* (2013.01)

(56) References Cited

U.S. PATENT DOCUMENTS

| | | | | |
|---|---|---|---|---|
| 2005/0010035 | A1* | 1/2005 | Lewis | C07K 14/43518 435/325 |
| 2005/0261479 | A1* | 11/2005 | Hoffmann | C07K 14/43518 435/348 |
| 2009/0123967 | A1† | 5/2009 | Scheibel | |
| 2013/0172478 | A1 | 7/2013 | Bausch et al. | |
| 2018/0282937 | A1* | 10/2018 | Bainbridge | D02G 3/38 |
| 2019/0040110 | A1* | 2/2019 | Ittah | C07K 14/43518 |
| 2019/0135880 | A1 | 5/2019 | Morita et al. | |

FOREIGN PATENT DOCUMENTS

| | | | |
|---|---|---|---|
| CN | 103194838 | A | 7/2013 |
| CN | 103349383 | A | † 10/2013 |
| CN | 104178898 | A | † 12/2014 |
| CN | 205416602 | U | 8/2016 |
| JP | H01-213427 | A | 8/1989 |
| JP | H09-310235 | A | 12/1997 |
| JP | 2004-532362 | A | 10/2004 |
| JP | 2014198041 | A | † 10/2014 |
| JP | 6162566 | B2 | 7/2017 |
| WO | 2006/008163 | A2 | 1/2006 |
| WO | 2011/113592 | A1 | 9/2011 |
| WO | 2012/165477 | A1 | 12/2012 |
| WO | 2014/037453 | A1 | 3/2014 |
| WO | 2014/062134 | A1 | 4/2014 |
| WO | 2017/188434 | A1 | 11/2017 |

OTHER PUBLICATIONS

Vijayakumar, H.L. et al. "Development of Silk/Lyocell Blended Yarn on Short Staple Spinning System." Mar. 2007. (Year: 2007).*

Adnan, M. et al. "A Study of Selected Functional Finishes on Silk/Lyocell Blended Fabrics." Anna University: 2014. (Year: 2014).*

International Preliminary Report on Patentability and Written Opinion issued in corresponding International Patent Application No. PCT/JP2019/014892 dated Oct. 15, 2020.

International Search Report issued in corresponding International Patent Application No. PCT/JP2019/014892 dated Jun. 25, 2019.

Mittal et al., "Ultrastrong and bioactive nanostructured bio-based composites," ACS Nano, 11: 5148-5159 (2017).

Bounty et al., "Evolution of supercontraction in spider silk: structure-function relationship from tarantulas to orb-weavers," The Journal of Experimental Biology, 213: 3505-3514 (2010).

Third Party Observations filed in counterpart European Patent Application No. 19782230.7 dated Mar. 16, 2022.

Extended European Search Report issued in counterpart European Patent Application No. 19782230.7 dated Apr. 4, 2022.

Shao et al., "Analysis of spider silk in native and supercontracted state using Raman spectroscopy," Polymer, 40(10):2493-2500 (1999).

Guan et al., "Two Mechanisms for Supercontraction in Nephila Spider Dragline Silk," Biomacromolecules, 12 (11): 4030-4035 (2021).

Blackledge et al., "How super is supercontraction? Persistent versus cyclic responses to humidity in spider dragline silk," Journal of Experimental Biology, 212: 1981-1989 (2009).

Marsano E, Corsini P, Canetti M, Freddi G. Regenerated cellulose-silk fibroin blends fibers. International journal of biological macromolecules. Aug. 15, 2008;43(2):106-14.†

Mittal N, Jansson R, Widhe M, Benselfelt T, Håkansson KM, Lundell F, Hedhammar M, Söderberg LD. Ultrastrong and bioactive nanostructured bio-based composites. ACS nano. May 23, 2017;11(5):5148-59.†

* cited by examiner
† cited by third party

BLENDED YARN, KNITTED/WOVEN BODY OF SAME, AND METHOD FOR MANUFACTURING SAID KNITTED/WOVEN BODY

SEQUENCE LISTING SUBMISSION VIA EFS-WEB

A computer readable text file, entitled "SequenceListing.txt," created on or about Oct. 1, 2020 with a file size of about 244 kb contains the sequence listing for this application and is hereby incorporated by reference in its entirety.

TECHNICAL FIELD

The present invention relates to a blended yarn, a knitted or woven body of the same, and a method for manufacturing the knitted or woven body.

BACKGROUND ART

Fibers such as rayon, cupra, and lyocell, which are regenerated cellulose fibers, have a soft texture, and thus, they are knitted or woven into a knitted or woven body, which is used in various applications such as clothing (see, for example, Patent Literature 1).

CITATION LIST

Patent Literature

[Patent Literature 1] Japanese Patent No. 6162566

SUMMARY OF INVENTION

Technical Problem

The present inventors have conducted various studies on a knitted or woven body for which regenerated cellulose fibers are used, and found that upon wetting with water and drying, the tension and the stiffness of the knitted or woven body of the regenerated cellulose fiber are decreased in some cases. In order to prevent such a decrease in the tension and the stiffness of the knitted or woven body of the regenerated cellulose fibers, it is conceivable, for example, to apply a general waterproof finish such as water-proofing or water-repellent coating to the knitted or woven body. However, in such a case, the soft texture which the regenerated cellulose fibers have may be impaired.

The present invention aims at providing a blended yarn with which a knitted or woven body, wherein a decrease in tension and stiffness due to moistness is reduced, can be manufactured, even in a case where the blended yarn is used for the manufacture of the knitted or woven body; a knitted or woven body of the same; and a method for manufacturing the knitted or woven body.

Solution to Problem

The present invention relates to, for example, each of the following inventions.

[1] A blended yarn comprising:

a modified fibroin fiber; and a regenerated cellulose fiber.

[2] The blended yarn according to [1], wherein a shrinkage rate of the modified fibroin fiber as defined by the following formula is more than 7%:

Shrinkage rate={1−(Length of modified fibroin fiber after being brought into contact with aqueous medium/Length of modified fibroin fiber before being brought into contact with aqueous medium)}×100(%).

[3] The blended yarn according to [1] or [2], wherein an amount of the modified fibroin fiber is 5% to 40% by mass.

[4] The blended yarn according to any one of [1] to [3], wherein the modified fibroin fiber is a modified spider silk fibroin fiber.

[5] The blended yarn according to any one of [1] to [4], wherein the regenerated cellulose fiber is a lyocell fiber.

[6] A knitted or woven body of the blended yarn according to any one of [1] to [5].

[7] A method for manufacturing a knitted or woven body, comprising steps of:

blend-spinning a modified fibroin fiber and a regenerated cellulose fiber to obtain a blended yarn; and knitting or weaving the blended yarn to obtain an unprocessed knitted or woven body.

[8] The manufacturing method according to [7], wherein a shrinkage rate of the modified fibroin fiber as defined by the following formula is more than 7%:

Shrinkage rate={1−(Length of modified fibroin fiber after being brought into contact with aqueous medium/Length of modified fibroin fiber before being brought into contact with aqueous medium)}×100(%).

[9] The manufacturing method according to [7] or [8], further comprising bringing the unprocessed knitted or woven body into contact with an aqueous medium to shrink the modified fibroin fiber contained in the unprocessed knitted or woven body.

[10] The manufacturing method according to any one of [7] to [9], wherein in the step of obtaining the blended yarn, the modified fibroin fiber and the regenerated cellulose fiber are blend-spun so that an amount of the modified fibroin fiber in the blended yarn becomes 5% to 40% by mass.

[11] The manufacturing method according to any one of [7] to [10], wherein the modified fibroin fiber is a modified spider silk fibroin fiber.

[12] The manufacturing method according to any one of [7] to [11], wherein the regenerated cellulose fiber is a lyocell fiber.

[13] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]_m$, and the domain sequence has an amino acid sequence with a reduced content of $(A)_n$ motifs, which corresponds to an amino acid sequence in which at least one or a plurality of $(A)_n$ motifs are deleted, as compared with a naturally occurring fibroin, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[14] The blended yarn, the knitted or woven body, or the manufacturing method according to [13], wherein the domain sequence has an amino acid sequence that corresponds to an amino acid sequence in which at least one $(A)_n$ motif for every one to three $(A)_n$ motifs from the N-terminal side to the C-terminal side is deleted, as compared with a naturally occurring fibroin.

[15] The blended yarn, the knitted or woven body, or the manufacturing method according to [13], wherein the domain sequence has an amino acid sequence that corresponds to an amino acid sequence in which at least deletion of two consecutive $(A)_n$ motifs and deletion of one $(A)_n$ motif are repeated in this order from the N-terminal side to the C-terminal side, as compared with a naturally occurring fibroin.

[16] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]_m$, and when the numbers of amino acid residues of REP of two adjacent $[(A)_n \text{ motif-REP}]$ units are sequentially compared from the N-terminal side to the C-terminal side, x/y is 50% or more, where x is a maximum value of a total value obtained by adding the numbers of amino acid residues of two adjacent $[(A)_n \text{ motif-REP}]$ units wherein when the number of amino acid residues of one REP having less amino acid residues is taken as 1, the ratio of the number of amino acids residues of the other REP satisfies 1.8 to 11.3; and where y is a total number of amino acid residues of the domain sequence, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[17] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]_m$, and the domain sequence has an amino acid sequence with a reduced content of glycine residues, which corresponds to an amino acid sequence in which at least one or a plurality of glycine residues in REP are substituted with other amino acid residues, as compared with a naturally occurring fibroin, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[18] The blended yarn, the knitted or woven body, or the manufacturing method according to [17], wherein the domain sequence has an amino acid sequence that corresponds to an amino acid sequence in which, in at least one motif sequence selected from GGX and GPGXX (where X represents an amino acid residue other than glycine) in REP, at least one glycine residue in one or a plurality of the motif sequences is substituted with another amino acid residue, as compared with a naturally occurring fibroin.

[19] The blended yarn, the knitted or woven body, or the manufacturing method according to [18], wherein a proportion of the motif sequence in which a glycine residue is substituted with another amino acid residue is 10% or more with respect to all motif sequences.

[20] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]_m$, and z/w is 50.9% or more, where z is the total number of amino acid residues of an amino acid sequence consisting of XGX (where X represents an amino acid residue other than glycine) contained in all REPs in the domain sequence excluding the sequence between the $(A)_n$ motif positioned closest to the C-terminal side and the C-terminal of the domain sequence; and where w is the total number of amino acid residues in the domain sequence excluding the sequence between the $(A)_n$ motif positioned closest to the C-terminal side and the C-terminal of the domain sequence, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[21] The blended yarn, the knitted or woven body, or the manufacturing method according to any one of [17] to [20], wherein the modified fibroin has an amino acid sequence that corresponds to an amino acid sequence in which one or a plurality of amino acid residues are further substituted, deleted, inserted, and/or added, in addition to substitution of one or a plurality of glycine residues in REP with other amino acid residues, as compared with a naturally occurring fibroin.

[22] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]_m$, and the domain sequence has an amino acid sequence comprising a region having a locally high hydropathy index, which corresponds to an amino acid sequence in which one or a plurality of amino acid residues in REP are substituted with an amino acid residue having a high hydropathy index and/or one or a plurality of amino acid residues having a high hydropathy index is inserted into REP, as compared with a naturally occurring fibroin, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[23] The blended yarn, the knitted or woven body, or the manufacturing method according to [22], wherein the region having a locally high hydropathy index is composed of 2 to 4 consecutive amino acid residues.

[24] The blended yarn, the knitted or woven body, or the manufacturing method according to [22] or [23], wherein the amino acid residues having a high hydropathy index are selected from isoleucine (I), valine (V), leucine (L), phenylalanine (F), cysteine (C), methionine (M), and alanine (A).

[25] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]_m$, and p/q is 6.2% or more, where p is the total number of amino acid residues contained in a region where an average value of hydropathy indices of the four consecutive amino acid residues is 2.6 or more in all REPs contained in the domain sequence excluding the sequence between the $(A)_n$ motif positioned closest to the C-terminal side and the C-terminal of the domain sequence; and where q is the total number of amino acid residues contained in the domain sequence excluding the sequence between the $(A)_n$ motif positioned closest to the C-terminal side and the C-terminal of the domain sequence, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[26] The blended yarn, the knitted or woven body, or the manufacturing method according to any one of [22] to [25], wherein the modified fibroin has an amino acid sequence that corresponds to an amino acid sequence in which one or a plurality of amino acid residues are substituted, deleted, inserted, and/or added, in addition to substitution of one or a plurality of amino acid residues in REP with amino acid residues having a high hydropathy index and/or insertion of one or a plurality of amino acid residues having a high hydropathy index into REP, as compared with a naturally occurring fibroin.

[27] The blended yarn according to any one of [1] to [5], the knitted or woven body according to [6], or the manufacturing method according to any one of [7] to [12], wherein the modified fibroin fiber comprises a modified fibroin, the modified fibroin comprises a domain sequence represented by Formula 1: $[(A)_n \text{ motif-REP}]m$ or Formula 2: $[(A)_n \text{ motif-REP}]_m\text{–}(A)_n$ motif, and the domain sequence has an amino acid sequence with a reduced content of glutamine residues, which corresponds to an amino acid sequence in which one or a plurality of glutamine residues in REP are deleted or substituted with other amino acid residues, as compared with a naturally occurring fibroin, wherein in Formula 1 and Formula 2, the $(A)_n$ motif represents an amino acid sequence composed of 2 to 27 amino acid residues and the number of alanine residues with respect to a total number of amino acid residues in the $(A)_n$ motif is 80% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

[28] The blended yarn, the knitted or woven body, or the manufacturing method according to [27], wherein the modified fibroin contains a GPGXX (where X represents an amino acid residue other than a glycine residue) motif in REP, and a GPGXX motif content rate is 10% or more.

[29] The blended yarn, the knitted or woven body, or the manufacturing method according to [27] or [28], wherein a glutamine residue content rate of the modified fibroin is 9% or less.

[30] The blended yarn, the knitted or woven body, or the manufacturing method according to any one of [27] to [29], wherein the other amino acid residues are amino acid residues selected from the group consisting of isoleucine (I), valine (V), leucine (L), phenylalanine (F), cysteine (C), methionine (M), alanine (A), glycine (G), threonine (T), serine (S), tryptophan (W), tyrosine (Y), proline (P), and histidine (H).

[31] The blended yarn, the knitted or woven body, or the manufacturing method according to any one of [27] to [30], wherein the modified fibroin has a degree of hydrophobicity of REP of −0.8 or more.

[32] The blended yarn, the knitted or woven body, or the manufacturing method according to any one of [27] to [31], wherein the modified fibroin has an amino acid sequence that corresponds to an amino acid sequence in which one or a plurality of amino acid residues are substituted, deleted, inserted, and/or added, in addition to deletion of one or a plurality of glutamine residues in REP or substitution with other amino acid residues, as compared with a naturally occurring fibroin.

[33] The blended yarn according to any one of [1] to [5], the knitted or woven body according to [6], or the manufacturing method according to any one of [7] to [12], wherein the modified fibroin fiber comprises a modified fibroin, and the modified fibroin has a limiting oxygen index (LOI) value of 26.0 or more.

[34] The blended yarn according to any one of [1] to [5], the knitted or woven body according to [6], or the manufacturing method according to any one of [7] to [12], wherein the modified fibroin fiber comprises a modified fibroin, and a maximum hygroscopic heat generation, as determined according to the following formula A, of the modified fibroin is more than 0.025° C./g:

Maximum hygroscopic heat generation={(Highest temperature of a sample when the sample has been transferred to a high humidity environment after being placed in a low humidity environment until a temperature of the sample reaches equilibrium)−(Temperature of the sample when the sample is being transferred to the high humidity environment after being placed in the low humidity environment until the temperature of the sample reaches equilibrium)} (° C.)/Sample weight (g), Formula A:

wherein in Formula A, the low humidity environment means an environment of a temperature of 20° C. and a relative humidity of 40%, and the high humidity environment means an environment of a temperature of 20° C. and a relative humidity of 90%.

Advantageous Effects of Invention

According to the blended yarn and the method according to the present invention, it is possible to provide a knitted or woven body wherein a decrease in tension and stiffness due to moistness is reduced. Therefore, according to the present invention, it is expected that it becomes possible to control a decrease in the drape property of the knitted or woven body due to the decrease in tension and stiffness. In addition, according to the present invention, it is possible to maintain an excellent texture unique to a regenerated cellulose fiber as much as possible.

DESCRIPTION OF EMBODIMENTS

<Blended Yarn>

Figure 1:
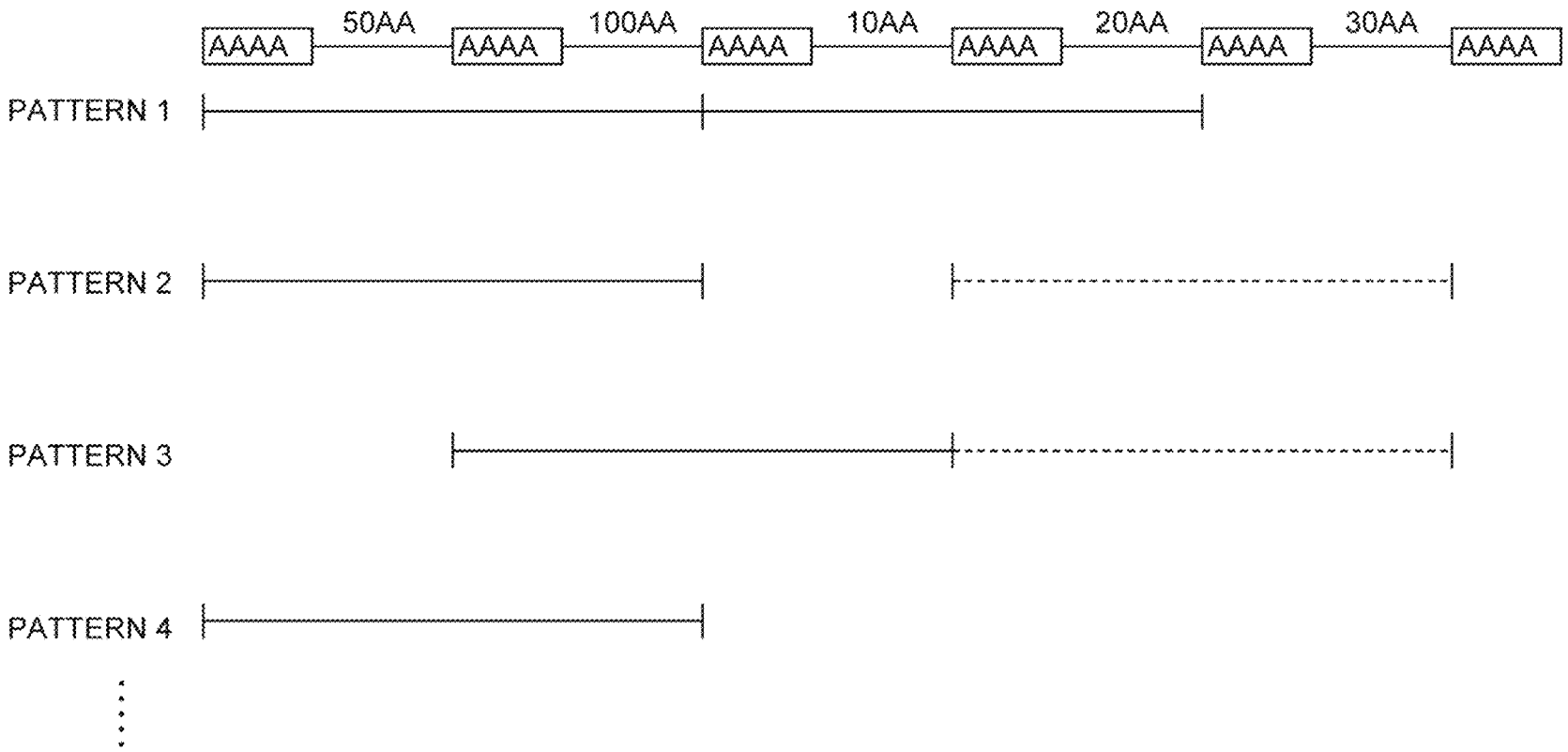
FIG. 1 is a schematic diagram illustrating an example of a domain sequence of a modified fibroin.

One aspect of the invention relates to a blended yarn containing a modified fibroin fiber and a regenerated cellulose fiber. The modified fibroin fiber contains a modified fibroin which will be described later as a main component, and may be a filament (long fiber) or may be a staple (short fiber). The modified fibroin fiber may contain components other than the modified fibroin and impurities, such as proteins other than the modified fibroin. In the present invention, since the modified fibroin fiber having a characteristics of shrinking upon drying after moistening is contained in the blended yarn, it is considered that when a knitted or woven body formed using such a blended yarn is moistened and dried, the knitting density, the weaving density, and the like are increased due to the shrinkage of the modified fibroin fiber, and as a result, the above-described effects can be exhibited.

The modified fibroin fiber may have a shrinkage rate, which will be described later, of more than 7%, 15% or more, 25% or more, 32% or more, 40% or more, 48% or more, 56% or more, 64% or more, or 72% or more, when brought into contact with an aqueous medium. The shrinkage rate is usually 80% or less. Here, the shrinkage rate of the modified fibroin fiber is defined by the following formula:

Shrinkage rate={1−(Length of modified fibroin fiber after being brought into contact with aqueous medium/Length of modified fibroin fiber before being brought into contact with aqueous medium)}×100(%).

The modified fibroin fiber may be a modified fibroin crimped fiber having a crimp. The degree of crimping is not limited, and the number of crimps may be, for example, 10 to 100 crimps/40 mm, or 20 to 40 crimps/40 mm.

The modified fibroin fiber preferably has an excellent flame retardancy, and may have a limiting oxygen index (LOI) value of 18 or more, 20 or more, 22 or more, 24 or more, 26 or more, 28 or more, 29 or more, or 30 or more. In the present specification, the LOI value is a value measured in accordance with "Test Method for Granular or Low-Melting-Point Synthetic Resin" described in "Notice No. 50 of the Office of Hazardous Materials Regulation (as of May 31, 1995)".

In order to exert sufficient flame retardancy, the modified fibroin fiber may contain a hydrophilic modified fibroin and/or may contain a modified fibroin having an average value of the hydropathy index (average HI) of 0 or less.

The modified fibroin fiber preferably has an excellent hygroscopic exothermicity, and may have a maximum hygroscopic heat generation, as determined according to the following Formula A, of more than 0.025° C./g. Here, the sample in Formula A refers to a modified fibroin fiber.

Maximum hygroscopic heat generation={(Highest temperature of a sample when the sample has been transferred to a high humidity environment after being placed in a low humidity environment until a temperature of the sample reaches equilibrium)−(Temperature of the sample when the sample is being transferred to the high humidity environment after being placed in the low humidity environment until the temperature of the sample reaches equilibrium)} (° C.)/Sample weight (g) [in Formula *A*, the low humidity environment means an environment of a temperature of 20° C. and a relative humidity of 40%, and the high humidity environment means an environment of a temperature of 20° C. and a relative humidity of 90%]. Formula A:

The maximum hygroscopic heat generation of the modified fibroin fiber may be 0.026° C./g or more, 0.027° C./g or more, 0.028° C./g or more, 0.029° C./g or more, 0.030° C./g or more, 0.035° C./g or more, or 0.040° C./g or more. The upper limit of the maximum hygroscopic heat generation is not particularly limited, but is usually 0.060° C./g or less.

In order to exert a sufficient hygroscopic exothermicity, the modified fibroin fiber may contain a hydrophobic modified fibroin and/or may contain a modified fibroin having an average value of the hydropathy index (average HI) of more than 0.

The modified fibroin fiber according to the present embodiment preferably has an excellent heat retention, and may have a heat retention index determined according to the following Formula B of 0.20 or more.

Heat retention index=Heat retention rate (%)/Basis weight (g/m$^2$) of sample Formula B:

Here, in the present specification, the heat retention rate means a heat retention rate measured by a dry contact method using a Thermo Labo II type tester (under a wind of 30 cm/sec), and is a value measured by the method described in Reference Examples which will be described later.

The heat retention index of the modified fibroin fiber according to the present embodiment may be 0.22 or more, may be 0.24 or more, may be 0.26 or more, may be 0.28 or more, may be 0.30 or more, and may be 0.32 or more. The upper limit of the heat retention index is not particularly limited, but may be, for example, 0.60 or less, or 0.40 or less.

The regenerated cellulose fiber is not particularly limited, and may be a known regenerated cellulose fiber such as rayon, cupra, lyocell, and acetate. Among the regenerated cellulose fibers, the lyocell fiber is preferable from the viewpoint that it has a softer texture and a higher strength. The regenerated cellulose fiber may be a filament or may be a staple. The regenerated cellulose fiber may be crosslinked with a crosslinking agent such as a compound or resin that reacts with a hydroxy group in a molecule of the regenerated cellulose fiber.

The regenerated cellulose fiber may be a regenerated cellulose crimped fiber having a crimp. The degree of crimping is not limited, and the number of crimps may be, for example, 10 to 100 crimps/40 mm, or 20 to 40 crimps/40 mm. The regenerated cellulose fiber is preferably a lyocell crimped fiber.

The blended yarn may consist only of the modified fibroin fiber and the regenerated cellulose fiber, or may also contain another fiber other than the modified fibroin fiber and the regenerated cellulose fiber. Such another fiber may be a natural fiber or may be a chemical fiber.

The amount of the modified fibroin fiber and the amount of the regenerated cellulose fiber in the blended yarn are not particularly limited, but from the viewpoint of preventing or suppressing a decrease in tension and stiffness due to moistening of the knitted or woven body, the amount of the modified fibroin fiber in the blended yarn may be, for example, 5% to 90% by mass, 5% to 40% by mass, 10% to 70% by mass, 10% to 50% by mass, 20% to 40% by mass, 20% to 30% by mass, or 15% to 25% by mass. Furthermore, from the viewpoint of maintaining an excellent texture unique to the regenerated cellulose fiber, the amount of the regenerated cellulose fiber in the blended yarn may be, for example, 60% to 95% by mass, 70% to 90% by mass, 70% to 85% by mass, or 75% to 85% by mass. The amount of the another fiber in the blended yarn may be, for example, 5% to 30% by mass, 5% to 20% by mass, 5% to 10% by mass, or 5% to 15% by mass.

<Modified Fibroin>

The modified fibroin according to the present embodiment is a protein containing a domain sequence represented by Formula 1: [$(A)_n$ motif-REP]m or Formula 2: [$(A)_n$ motif-REP]$_m$−$(A)_n$ motif. In the modified fibroin, an amino acid sequence (an N-terminal sequence and a C-terminal sequence) may be further added to either or both of the N-terminal side and the C-terminal side of the domain sequence. The N-terminal sequence and the C-terminal sequence are typically, but not limited to, regions that do not have a repetition of amino acid motifs characteristic of a fibroin, and that consist of amino acids of about 100 residues.

The "modified fibroin" in the present specification means an artificially produced fibroin (an artificial fibroin). The modified fibroin may be a fibroin in which the domain sequence is different from an amino acid sequence of a naturally occurring fibroin or the same as the amino acid sequence of a naturally occurring fibroin. The "naturally occurring fibroin" referred to in the present specification also is a protein containing a domain sequence represented by Formula 1: [$(A)_n$ motif-REP]m or Formula 2: [$(A)_n$ motif-REP]$_m$−$(A)_n$ motif.

The "modified fibroin" may be a modified fibroin having an amino acid sequence of a naturally occurring fibroin as it is, may be a modified fibroin whose amino acid sequence has been modified based on the amino acid sequence of a naturally occurring fibroin (for example, a modified fibroin whose amino acid sequence has been modified by altering a cloned gene sequence of a naturally occurring fibroin), or may be a modified fibroin that is artificially designed and synthesized independently of a naturally occurring fibroin (for example, a modified fibroin having a desired amino acid sequence by chemically synthesizing a nucleic acid encoding a designed amino acid sequence).

The "domain sequence" in the present specification is an amino acid sequence that produces a crystalline region (typically corresponding to an $(A)_n$ motif of an amino acid sequence) and an amorphous region (typically corresponding to REP of an amino acid sequence) unique to a fibroin, and refers to an amino acid sequence represented by Formula 1: [$(A)_n$ motif-REP]m or Formula 2: [$(A)_n$ motif-REP]$_m$−$(A)_n$ motif. Here, the $(A)_n$ motif represents an amino acid sequence mainly containing alanine residues, and the number of amino acid residues in the $(A)_n$ motif is 2 to 27. The number of amino acid residues in the $(A)_n$ motif may be an integer of 2 to 20, 4 to 27, 4 to 20, 8 to 20, 10 to 20, 4 to 16, 8 to 16, or 10 to 16. Further, the proportion of the number of alanine residues with respect to the total number of amino acid residues in the $(A)_n$ motif may be 40% or more, and may be 60% or more, 70% or more, 80% or more, 83% or more, 85% or more, 86% or more, 90% or more, 95% or more, or 100% (meaning that the $(A)_n$ motif is composed of only alanine residues). Among a plurality of $(A)_n$ motifs present in the domain sequence, at least seven of the $(A)_n$ motifs may be composed only of alanine residues.

REP represents an amino acid sequence composed of 2 to 200 amino acid residues. REP may be an amino acid sequence composed of 10 to 200 amino acid residues, and may be an amino acid sequence composed of 10 to 40, 10 to 60, 10 to 80, 10 to 100, 10 to 120, 10 to 140, 10 to 160, or 10 to 180 amino acid residues. m represents an integer of 2 to 300, and may be an integer of 8 to 300, 10 to 300, 20 to 300, 40 to 300, 60 to 300, 80 to 300, 100 to 300, 10 to 200, 20 to 200, 20 to 180, 20 to 160, 20 to 140, or 20 to 120. A plurality of $(A)_n$ motifs may have the same amino acid sequence or amino acid sequences different from each other. A plurality of REPs may have the same amino acid sequence or amino acid sequences different from each other.

The modified fibroin according to the present embodiment may be obtained, for example, by subjecting a cloned gene sequence of a naturally occurring fibroin to a modification of an amino acid sequence corresponding to, for example, substitution, deletion, insertion, and/or addition of one or a plurality of amino acid residues. The substitution, deletion, insertion, and/or addition of an amino acid residue may be performed by methods well known to those skilled in the art, such as site-directed mutagenesis. Specifically, the modification may be performed in accordance with the method described in literature such as Nucleic Acid Res. 10, 6487 (1982) and Methods in Enzymology, 100, 448 (1983).

A naturally occurring fibroin is a protein containing a domain sequence represented by Formula 1: $[(A)_n$ motif-REP]m or Formula 2: $[(A)_n$ motif-REP$]_m$–$(A)_n$ motif, and specific examples thereof include a fibroin produced by insects or spiders.

Examples of the fibroin produced by insects include silk proteins produced by silkworms such as *Bombyx mori, Bombyx mandarina, Antheraea yamamai, Anteraea pernyi, Eriogyna pyretorum, Pilosamia Cynthia ricini, Samia cynthia, Caligura japonica, Antheraea mylitta*, and *Antheraea assama*; and hornet silk proteins discharged by larvae of *Vespa simillima xanthoptera*.

More specific examples of the fibroin produced by insects include a silkworm fibroin L chain (GenBank Accession No. M76430 (nucleotide sequence), and AAA27840.1 (amino acid sequence)).

Examples of the fibroin produced by spiders include spider silk proteins produced by spiders belonging to the genus *Araneus* such as *Araneus ventricosus, Araneus diadematus, Araneus pinguis, Araneus pentagrammicus* and *Araneus nojimai*, spiders belonging to the genus *Neoscona* such as *Neoscona scylla, Neoscona nautica, Neoscona adianta* and *Neoscona scylloides*, spiders belonging to the genus *Pronus* such as *Pronous minutes*, spiders belonging to the genus *Cyrtarachne* such as *Cyrtarachne bufo* and *Cyrtarachne inaequalis*, spiders belonging to the genus *Gasteracantha* such as *Gasteracantha kuhli* and *Gasteracantha mammosa*, spiders belonging to the genus *Ordgarius* such as *Ordgarius hobsoni* and *Ordgarius sexspinosus*, spiders belonging to the genus *Argiope* such as *Argiope amoena, Argiope minuta* and *Argiope bruennich*, spiders belonging to the genus *Arachnura* such as *Arachnura logio*, spiders belonging to the genus *Acusilas* such as *Acusilas coccineus*, spiders belonging to the genus *Cytophora* such as *Cytophora moluccensis, Cytophora exanthematica* and *Cytophora unicolor*, spiders belonging to the genus *Poltys* such as *Poltys illepidus*, spiders belonging to the genus *Cyclosa* such as *Cyclosa octotuberculata, Cyclosa sedeculata, Cyclosa vallata* and *Cyclosa atrata*, and spiders belonging to the genus *Chorizopes* such as *Chorizopes nipponicus*; and spider silk proteins produced by spiders belonging to the genus *Tetragnatha* such as *Tetragnatha praedonia, Tetragnatha maxillosa, Tetragnatha extensa* and *Tetragnatha squamata*, spiders belonging to the genus *Leucauge* such as *Leucauge magnifica, Leucauge blanda* and *Leucauge subblanda*, spiders belonging to the genus *Nephila* such as *Nephila clavata* and *Nephila pilipes*, spiders belonging to the genus *Menosira* such as *Menosira ornata*, spiders belonging to the genus *Dyschiriognatha* such as *Dyschiriognatha tenera*, spiders belonging to the genus *Latrodectus* such as *Latrodectus mactans, Latrodectus hasseltii, Latrodectus geometricus* and *Latrodectus tredecimguttatus*, and spiders belonging to the family Tetragnathidae such as spiders belonging to the genus *Euprosthenops*. Examples of the spider silk proteins include traction yarn proteins such as MaSp (MaSp1 and MaSp2) and ADF (ADF3 and ADF4), and MiSp (MiSp1 and MiSp2).

More specific examples of the spider silk protein produced by spiders include fibroin-3 (adf-3) [derived from *Araneus diadematus*](GenBank Accession No. AAC47010 (amino acid sequence), U47855 (nucleotide sequence)), fibroin-4 (adf-4) [derived from *Araneus diadematus*] (GenBank Accession No. AAC47011 (amino acid sequence), U47856 (nucleotide sequence)), dragline silk protein spidroin 1 [derived from *Nephila clavipes*] (GenBank Accession No. AAC04504 (amino acid sequence), U37520 (nucleotide sequence)), major ampullate spidroin 1 [derived from *Latrodectus hesperus*](GenBank Accession No. ABR68856 (amino acid sequence), EF595246 (nucleotide sequence)), dragline silk protein spidroin 2 [derived from *Nephila clavata*] (GenBank Accession No. AAL32472 (amino acid sequence), AF441245 (nucleotide sequence)), major ampullate spidroin 1 [derived from *Euprosthenops australis*] (GenBank Accession No. CAJ00428 (amino acid sequence), AJ973155 (nucleotide sequence)) and major ampullate spidroin 2 [*Euprosthenops australis*] (GenBank Accession No. CAM32249.1 (amino acid sequence), AM490169 (nucleotide sequence)), minor ampullate silk protein 1 [*Nephila clavipes*] (GenBank Accession No. AAC14589.1 (amino acid sequence), minor ampullate silk protein 2 [*Nephila clavipes*] (GenBank Accession No. AAC14591.1 (amino acid sequence)), and minor ampullate spidroin-like protein [*Nephilengys cruentata*] (GenBank Accession No. ABR37278.1 (amino acid sequence)).

More specific examples of the naturally occurring fibroin further include a fibroin whose sequence information is registered in NCBI GenBank. For example, sequences thereof may be confirmed by extracting sequences that has a keyword of spidroin, ampullate, fibroin, "silk and polypeptide", or "silk and protein" in DEFINITION, among sequences containing INV as DIVISION in sequence information registered in NCBI GenBank; sequences that have a specific character string of a product from CDS; or sequences that have a specific character string described for TISSUE TYPE from SOURCE.

The modified fibroin according to the present embodiment may be a modified silk fibroin (a modified fibroin obtained by modifying an amino acid sequence of a silk protein produced by silkworm), or may be a modified spider silk fibroin (a modified fibroin obtained by modifying an amino acid sequence of a spider silk protein produced by spiders). As the modified fibroin, a modified spider silk fibroin is preferable. The modified spider silk fibroin is also excellent in heat retention, hygroscopic exothermicity, and/or flame retardancy.

Specific examples of the modified fibroin include a modified fibroin derived from a large spinal canal thread protein produced in the major ampullate gland of a spider (first modified fibroin), a modified fibroin having a domain sequence with a reduced content of glycine residues (second modified fibroin), a modified fibroin having a domain sequence with a reduced content of $(A)_n$ motifs (third modified fibroin), a modified fibroin with a reduced content of glycine residues and $(A)_n$ motifs (fourth modified fibroin), a modified fibroin having a domain sequence containing a region having a locally high hydropathy index (fifth modified fibroin), and a modified fibroin having a domain sequence with a reduced content of glutamine residues (sixth modified fibroin).

Examples of the first modified fibroin include a protein containing a domain sequence represented by Formula 1: $[(A)_n \text{ motif-REP}]_m$. In the first modified fibroin, the number of amino acid residues of the $(A)_n$ motif is preferably an integer of 3 to 20, more preferably an integer of 4 to 20, still more preferably an integer of 8 to 20, even still more preferably an integer of 10 to 20, further still preferably an integer of 4 to 16, particularly preferably an integer of 8 to 16, and most preferably an integer of 10 to 16. In the first modified fibroin, the number of amino acid residues constituting REP in Formula 1 is preferably 10 to 200 residues, more preferably 10 to 150 residues, still more preferably 20 to 100 residues, and even still more preferably 20 to 75 residues. In the first modified fibroin, the total number of the glycine residues, the serine residues, and the alanine residues contained in the amino acid sequence represented by Formula 1: $[(A)_n \text{ motif-REP}]_m$ is preferably 40% or more, more preferably 60% or more, and still more preferably 70% or more with respect to the total number of amino acid residues.

The first modified fibroin may be a polypeptide that contains a unit of an amino acid sequence represented by Formula 1: $[(A)_n \text{ motif-REP}]_m$, and has the amino acid sequence set forth in any of SEQ ID NOs: 1 to 3 or an amino acid sequence having 90% or more homology with the amino acid sequence set forth in any of SEQ ID NOs: 1 to 3 as the C-terminal sequence.

The amino acid sequence set forth in SEQ ID NO: 1 is the same as the amino acid sequence consisting of 50 amino acid residues at the C-terminal of the amino acid sequence of ADF3 (GI: 1263287, NCBI), the amino acid sequence set forth in SEQ ID NO: 2 is the same as the amino acid sequence obtained by removing 20 residues from the C-terminal of the amino acid sequence set forth in SEQ ID NO: 1, and the amino acid sequence set forth in SEQ ID NO: 3 is the same as the amino acid sequence obtained by removing 29 residues from the C-terminal of the amino acid sequence set forth in SEQ ID NO: 1.

More specific examples of the first modified fibroin include a modified fibroin containing (1-i) the amino acid sequence set forth in SEQ ID NO: 4 (recombinant spider silk protein ADF3KaiLargeNRSH1), or (1-ii) an amino acid sequence having 90% or more sequence identity with the amino acid sequence set forth in SEQ ID NO: 4. The sequence identity is preferably 95% or more.

The amino acid sequence shown in SEQ ID NO 4 is obtained by performing mutation on the amino acid sequence of ADF3 in which an amino acid sequence (SEQ ID NO 5) consisting of a start codon, His10 tag, and HRV3C protease (Human rhinovirus 3C protease) recognition site is added to the N-terminal, such that the 1st to 13th repeat regions are approximately doubled, and the translation terminates at the 1154th amino acid residue. The amino acid sequence of the C-terminal of the amino acid sequence shown in SEQ ID NO 4 is the same as the amino acid sequence shown in SEQ ID NO 3.

The modified fibroin (1-i) may be a modified fibroin consisting of the amino acid sequence set forth in SEQ ID NO: 4.

The second modified fibroin has a domain sequence that has an amino acid sequence with a reduced content of glycine residues, as compared with a naturally occurring fibroin. It can be said that the second modified fibroin is a modified fibroin having an amino acid sequence that corresponds to an amino acid sequence in which, at least one or a plurality of glycine residues in REP are substituted with other amino acid residues, as compared with a naturally occurring fibroin.

The second modified fibroin may have a domain sequence that has an amino acid sequence corresponding to an amino acid sequence in which, in at least one motif sequence selected from GGX and GPGXX (where G represents a glycine residue, P represents a proline residue, and X represents an amino acid residue other than glycine) in REP, at least one glycine residue in one or a plurality of motif sequences is substituted with another amino acid residue, as compared with a naturally occurring fibroin.

In the second modified fibroin, the proportion of the above-described motif sequences in which a glycine residue is substituted with another amino acid residue may be 10% or more with respect to the all motif sequences.

The second modified fibroin may be a modified fibroin that contains a domain sequence represented by Formula 1: $[(A)_n \text{ motif-REP}]_m$, that has an amino acid sequence in which z/w is 30% or more, 40% or more, 50% or more, or 50.9% or more, where z is the total number of amino acid residues of an amino acid sequence consisting of XGX (where X represents an amino acid residue other than glycine) contained in all REPs in the domain sequence excluding the sequence between the $(A)_n$ motif positioned closest to the C-terminal side and the C-terminal of the domain sequence; and where w is the total number of amino acid residues in the domain sequence excluding the sequence between the $(A)_n$ motif positioned closest to the C-terminal side and the C-terminal of the domain sequence. The number of alanine residues with respect to a total number of amino acid residues in the $(A)_n$ motif may be 83% or more, but is preferably 86% or more, more preferably 90% or more, still more preferably 95% or more, and even still more preferably 100% (which means that the $(A)_n$ motif consists only of alanine residues).

The second modified fibroin is preferably a modified fibroin in which one glycine residue of the GGX motif is substituted with another amino acid residue to increase the content ratio of the amino acid sequence consisting of XGX. In the second modified fibroin, the content ratio of the amino acid sequence consisting of GGX in the domain sequence is preferably 30% or less, more preferably 20% or less, still more preferably 10% or less, even still more preferably 6% or less, further still more preferably 4% or less, and particularly preferably 2% or less. The content ratio of the amino acid sequence consisting of GGX in the domain sequence can be calculated by the same method as the method for calculating a content ratio (z/w) of an amino acid sequence consisting of XGX below.

The method for calculating z/w will be described in more detail. First, in a fibroin (a modified fibroin or a naturally occurring fibroin) containing a domain sequence represented by Formula 1: $[(A)_n \text{ motif-REP}]_m$, an amino acid sequence consisting of XGX is extracted from all REPs contained in the domain sequence excluding the sequence between the $(A)_n$ motif positioned closest to the C-terminal side and the C-terminal of the domain sequence. The total number of amino acid residues constituting XGX is z. For example, in a case where 50 amino acid sequences consisting of XGX (without an overlap) are extracted, z is 50×3=150. Further, for example, in a case where there is X contained in two XGXs (X at the center), as in the case of an amino acid sequence consisting of XGXGX, the calculation is performed by deducting the overlap (in the case of XGXGX, 5 amino acid residues). w is the total number of amino acid residues contained in the domain sequence excluding the sequence between the $(A)_n$ motif positioned closest to the C-terminal side and the C-terminal of the domain sequence. For example, in the case of the domain sequence illustrated in FIG. 1, w is 4+50+4+100+4+10+4+20+4+30=230 (the $(A)_n$ motif positioned closest to the C-terminal side is excluded.). Next, z/w (%) can be calculated by dividing z by w.

Figure 2:
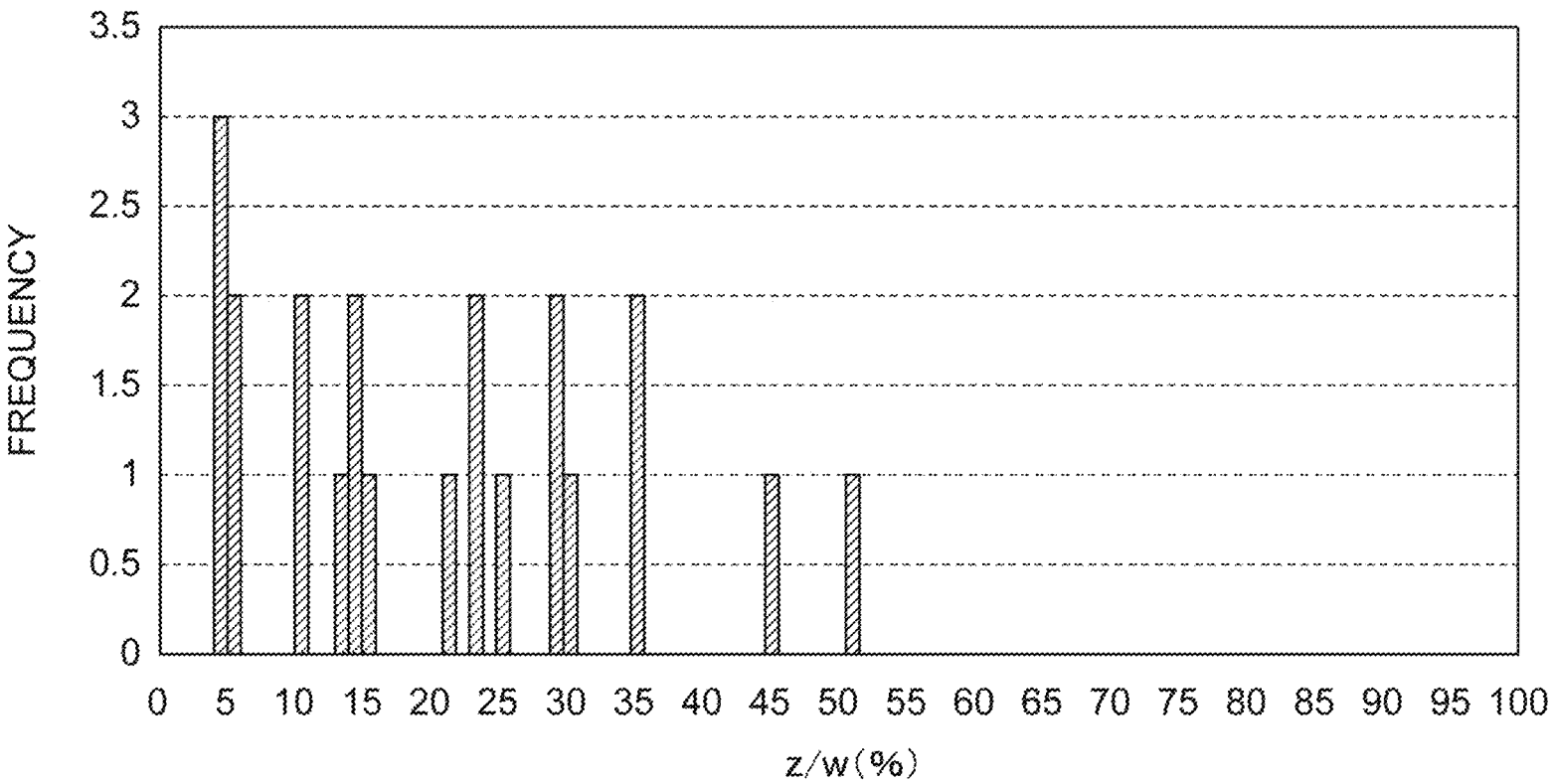
FIG. 2 is a diagram illustrating a distribution of z/w (%) values of a naturally occurring fibroin.

Here, z/w in a naturally occurring fibroin will be described. First, fibroins with amino acid sequence information registered in NCBI GenBank was checked by the exemplified method as described above, and 663 types of fibroins (of which 415 types were fibroins derived from spiders) were extracted. Among all the extracted fibroins, z/w was calculated from an amino acid sequence of a naturally occurring fibroin that contains a domain sequence represented by Formula 1: $[(A)_n \text{ motif-REP}]_m$, and that has a content ratio of the amino acid sequence consisting of GGX in the fibroin of 6% or less, using the above-mentioned calculation method. The results are shown in FIG. 2. In FIG. 2, the horizontal axis represents z/w (%), and the vertical axis represents frequency. As apparent from FIG. 2, z/w in all the naturally occurring fibroin is less than 50.9% (highest value: 50.86%).

In the second modified fibroin, z/w is preferably 50.9% or more, more preferably 56.1% or more, still more preferably 58.7% or more, even still more preferably 70% or more, and further still preferably 80% or more. The upper limit of z/w is not particularly limited, but may be, for example, 95% or less.

The second modified fibroin may be obtained, for example, by modifying a cloned gene sequence of a naturally occurring fibroin such that at least a part of the nucleotide sequence encoding a glycine residue is substituted to encode another amino acid residue. In this case, one glycine residue in the GGX motif and the GPGXX motif may be selected as the glycine residue to be modified, and also, substitution may be performed so that z/w becomes 50.9% or more. In addition, the second modified fibroin may also be obtained, for example, by designing an amino acid sequence that satisfies the above embodiment based on the amino acid sequence of a naturally occurring fibroin, and chemically synthesizing a nucleic acid encoding the designed amino acid sequence. In any case, in addition to the modification that corresponds to substitution of the glycine residue in REP in the amino acid sequence of a naturally occurring fibroin with another amino acid residue, a modification of the amino acid sequence that corresponds to substitution, deletion, insertion, and/or addition of one or a plurality of amino acid residues may further be performed.

The above another amino acid residue is not particularly limited as long as it is an amino acid residue other than the glycine residue, but is preferably a hydrophobic amino acid residue such as a valine (V) residue, a leucine (L) residue, a isoleucine (I) residue, a methionine (M) residue, a proline (P) residue, a phenylalanine (F) residue, and a tryptophan (W) residue, or a hydrophilic amino acid residues such a glutamine (Q) residue, an asparagine (N) residue, a serine (S) residue, a lysine (K) residue, and a glutamic acid (E) residue, more preferably the valine (V) residue, the leucine (L) residue, the isoleucine (I) residue, the phenylalanine (F) residue, and the glutamine (Q) residue, and still more preferably the glutamine (Q) residue.

More specific examples of the second modified fibroin include a modified fibroin containing (2-i) the amino acid sequence set forth in SEQ ID NO: 6 (Met-PRT380), SEQ ID NO: 7 (Met-PRT410), SEQ ID NO: 8 (Met-PRT525), or SEQ ID NO: 9 (Met-PRT799), or (2-ii) an amino acid sequence having 90% or more sequence identity with the amino acid sequence set forth in SEQ ID NO: 6, SEQ ID NO: 7, SEQ ID NO: 8, or SEQ ID NO: 9.

The modified fibroin (2-i) will be described. The amino acid sequence set forth in SEQ ID NO: 6 is an amino acid sequence in which all GGXs in REP of the amino acid sequence set forth in SEQ ID NO: 10 (Met-PRT313) corresponding to a naturally occurring fibroin are substituted with GQXs. The amino acid sequence set forth in SEQ ID NO: 7 is an amino acid sequence in which every third $(A)_n$ motif from the N-terminal side to the C-terminal side is deleted from the amino acid sequence set forth in SEQ ID NO: 6, and further, one $[(A)_n \text{ motif-REP}]$ is inserted before the C-terminal sequence. The amino acid sequence set forth in SEQ ID NO: 8 is an amino acid sequence in which two alanine residues are inserted at the C-terminal side of each $(A)_n$ motif of the amino acid sequence set forth in SEQ ID NO: 7, and further some of the glutamine (Q) residues are substituted with a serine (S) residue, and some of the amino acids on the C-terminal side are deleted so that the molecular weight is almost the same as that of SEQ ID NO 7. The amino acid sequence set forth in SEQ ID NO: 9 is an amino acid sequence in which a predetermined hinge sequence and a His tag sequence are added to the C-terminal of a sequence having four-time repetition of a region of 20 domain sequences present in the amino acid sequence set forth in SEQ ID NO: 7 (however, with several amino acid residues on the C-terminal side of the region are substituted).

The value of z/w in the amino acid sequence set forth SEQ ID NO: 10 (corresponding to a naturally occurring fibroin) is 46.8%. The values of z/w in the amino acid sequence set forth in SEQ ID NO: 6, the amino acid sequence set forth in SEQ ID NO: 7, the amino acid sequence set forth in SEQ ID NO: 8, and the amino acid sequence set forth in SEQ ID NO: 9 are 58.7%, 70.1%, 66.1%, and 70.0%, respectively. In addition, the values of x/y at the Giza ratio (which will be described later) of 1:1.8 to 11.3 in the amino acid sequences set forth in SEQ ID NO: 10, SEQ ID NO: 6, SEQ ID NO: 7, SEQ ID NO: 8, and SEQ ID NO: 9 are 15.0%, 15.0%, 93.4%, 92.7%, and 89.8%, respectively.

The modified fibroin (2-i) may be a modified fibroin consisting of the amino acid sequence set forth in SEQ ID NO: 6, SEQ ID NO: 7, SEQ ID NO: 8, or SEQ ID NO: 9.

The modified fibroin (2-ii) is a modified fibroin containing an amino acid sequence having 90% or more sequence identity with the amino acid sequence set forth in SEQ ID NO: 6, SEQ ID NO: 7, SEQ ID NO: 8, or SEQ ID NO: 9. The modified fibroin (2-ii) also is a protein containing a domain sequence represented by Formula 1: $[(A)_n \text{ motif-REP}]_m$. The sequence identity is preferably 95% or more.

The modified fibroin (2-ii) preferably has 90% or more sequence identity with the amino acid sequence set forth in SEQ ID NO: 6, SEQ ID NO: 7, SEQ ID NO: 8, or SEQ ID NO: 9, and that z/w is 50.9% or more, where z is the total number of amino acid residues in the amino acid sequence consisting of XGX (where X represents an amino acid residue other than glycine) contained in REP; and where w is the total number of amino acid residues in REP in the domain sequence.

The second modified fibroin may contain a tag sequence at either or both of the N-terminal and C-terminal. This makes it possible to isolate, immobilize, detect, and visualize the modified fibroin.

The tag sequence may be, for example, an affinity tag utilizing specific affinity (binding property, affinity) with other molecules. Specific examples of the affinity tag include a histidine tag (His tag). The His tag is a short peptide in which about 4 to 10 histidine residues are arranged and has a property of specifically binding to a metal ion such as nickel, and thus, it can be used for isolation of a modified fibroin by a chelating metal chromatography. Specific examples of the tag sequence include an amino acid sequence set forth in SEQ ID NO: 11 (amino acid sequence containing a His tag sequence and a hinge sequence).

In addition, a tag sequence such as a glutathione-S-transferase (GST) that specifically binds to glutathione and a maltose binding protein (MBP) that specifically binds to maltose may also be used.

Furthermore, an "epitope tag" utilizing an antigen-antibody reaction may also be used. By adding a peptide (an epitope) showing antigenicity as a tag sequence, an antibody against the epitope can be bound. Examples of the epitope tag include an HA (peptide sequence of hemagglutinin of an influenza virus) tag, a myc tag, and a FLAG tag. The modified fibroin can be easily purified with high specificity by utilizing the epitope tag.

It is also possible to further use a tag sequence which can be cleaved with a specific protease. By treating a protein adsorbed via the tag sequence with a protease, it is also possible to recover a modified fibroin cleaved from the tag sequence.

More specific examples of the modified fibroin containing the tag sequence include a modified fibroin containing (2-iii) the amino acid sequence set forth in SEQ ID NO: 12 (PRT380), SEQ ID NO: 13 (PRT410), SEQ ID NO: 14 (PRT525), or SEQ ID NO: 15 (PRT799), or (2-iv) an amino acid sequence having 90% or more sequence identity with the amino acid sequence set forth in SEQ ID NO: 12, SEQ ID NO: 13, SEQ ID NO: 14, or SEQ ID NO: 15.

The amino acid sequences set forth in SEQ ID NO: 16 (PRT313), SEQ ID NO: 12, SEQ ID NO: 13, SEQ ID NO: 14, and SEQ ID NO: 15 are amino acid sequences in which the amino acid sequence (containing a His tag sequence and a hinge sequence) set forth in SEQ ID NO: 11 is added to the N-terminal of the amino acid sequences set forth in SEQ ID NO: 10, SEQ ID NO: 6, SEQ ID NO: 7, SEQ ID NO: 8, and SEQ ID NO: 9, respectively.

The modified fibroin (2-iii) may be a modified fibroin consisting of the amino acid sequence set forth in SEQ ID NO: 12, SEQ ID NO: 13, SEQ ID NO: 14, or SEQ ID NO: 15.

The modified fibroin (2-iv) is a modified fibroin containing an amino acid sequence having 90% or more sequence identity with the amino acid sequence set forth in SEQ ID NO: 12, SEQ ID NO: 13, SEQ ID NO: 14, or SEQ ID NO: 15. The modified fibroin (2-iv) also is a protein containing a domain sequence represented by Formula 1: $[(A)_n$ motif-REP$]_m$. The sequence identity is preferably 95% or more.

It is preferable that the modified fibroin (2-iv) has 90% or more sequence identity with the amino acid sequence set forth in SEQ ID NO: 12, SEQ ID NO: 13, SEQ ID NO: 14, or SEQ ID NO: 15, and that z/w is 50.9% or more, where z is the total number of amino acid residues of the amino acid sequence consisting of XGX (where X represents an amino acid residue other than glycine) contained in REP; and where w is the total number of amino acid residues in REP in the domain sequence.

The second modified fibroin may contain a secretory signal for releasing the protein produced in a recombinant protein production system to the outside of the host. The sequence of the secretory signal may be set as appropriate, depending on the type of the host.

The third modified fibroin has a domain sequence that has an amino acid sequence with a reduced content of $(A)_n$ motifs, as compared with a naturally occurring fibroin. It can be said that the domain sequence of the third modified fibroin is a domain sequence having an amino acid sequence that corresponds to an amino acid sequence in which at least one or a plurality of the $(A)_n$ motifs are deleted, as compared with a naturally occurring fibroin.

The third modified fibroin may be a modified fibroin having an amino acid sequence that corresponds to an amino acid sequence in which 10% to 40% of the $(A)_n$ motifs are deleted from a naturally occurring fibroin.

The domain sequence of the third modified fibroin may be a domain sequence having an amino acid sequence that corresponds to an amino acid sequence in which at least one $(A)_n$ motif for every one to three $(A)_n$ motifs from the N-terminal side to the C-terminal side is deleted, as compared with a naturally occurring fibroin.

The domain sequence of the third modified fibroin may be a domain sequence having an amino acid sequence that corresponds to an amino acid sequence in which at least deletion of two consecutive $(A)_n$ motifs and deletion of one $(A)_n$ motif are repeated in this order from the N-terminal side to the C-terminal side, as compared with a naturally occurring fibroin.

The domain sequence of the third modified fibroin may be a domain sequence having an amino acid sequence that corresponds to an amino acid sequence in which, at least, every third $(A)_n$ motif from the N-terminal side to the C-terminal side is deleted.

The third modified fibroin may be a modified fibroin that contains a domain sequence represented by Formula 1: $[(A)_n$ motif-REP$]_m$, and that has an amino acid sequence in which, when the numbers of amino acid residues of REP of two adjacent $[(A)_n$ motif-REP] units are sequentially compared from the N-terminal side to the C-terminal side, x/y is 20% or more, 30% or more, 40% or more, or 50% or more, where x is a maximum value of a total value obtained by adding the numbers of amino acid residues of two adjacent $[(A)_n$ motif-REP] units wherein when the number of amino acid residues of one REP having less amino acid residues is taken as 1, the ratio of the number of amino acids residues of the other REP satisfies 1.8 to 11.3; and where y is a total number of amino acid residues of the domain sequence. The number of alanine residues with respect to a total number of amino acid residues in the $(A)_n$ motif may be 83% or more, but is preferably 86% or more, more preferably 90% or more, still more preferably 95% or more, and even still more preferably 100% (which means that the $(A)_n$ motif consists only of alanine residues).

A method for calculating x/y will be described in more detail with reference to FIG. 1. FIG. 1 illustrates a domain sequence obtained by removing an N-terminal sequence and a C-terminal sequence from a modified fibroin. The domain sequence has a sequence of, from the N-terminal side (left side), $(A)_n$ motif-the first REP (50 amino acid residues)-$(A)_n$ motif-the second REP (100 amino acid residues)-$(A)_n$ motif-the third REP (10 amino acid residues)-$(A)_n$ motif-the fourth REP (20 amino acid residues)-$(A)_n$ motif-the fifth REP (30 amino acid residues)-$(A)_n$ motif.

The two adjacent [$(A)_n$ motif-REP] units are sequentially selected from the N-terminal side to the C-terminal side so that there is no overlap. There may be [$(A)_n$ motif-REP] unit that is not selected. FIG. 1 illustrates Pattern 1 (a comparison of the first REP and the second REP, and a comparison of the third REP and the fourth REP), Pattern 2 (a comparison of the first REP and the second REP, and a comparison of the fourth REP and the fifth REP), Pattern 3 (a comparison of the second REP and the third REP, and a comparison of the fourth REP and the fifth REP), and Pattern 4 (a comparison of the first REP and the second REP). There are selection methods other than these.

Next, for each pattern, the number of amino acid residues of each REP in the selected adjacent two [$(A)_n$ motif-REP] units is compared. The comparison is performed by determining the ratio, relative to one REP having less amino acid residues taken as 1, of the number of amino acid residues of the other REP. For example, in a case of comparing the first REP (50 amino acid residues) and the second REP (100 amino acid residues), the ratio of the number of amino acid residues of the second REP is 100/50=2, where the first REP having less amino acid residues is taken as 1. Similarly, in a case of comparing the fourth REP (20 amino acid residues) and the fifth REP (30 amino acid residues), the ratio of the number of amino acid residues of the fifth REP is 30/20=1.5, where the fourth REP having less amino acid residues is taken as 1.

In FIG. 1, a set of [$(A)_n$ motif-REP] units in which, where one REP having less amino acid residues is taken as 1, the ratio of the number of amino acid residues of the other REP is 1.8 to 11.3, is indicated by a solid line. In the present specification, this ratio is referred to as a Giza ratio. A set of [$(A)_n$ motif-REP] units in which, where a REP having less amino acid residues is taken as 1, the ratio of the number of amino acid residues of the other REP is less than 1.8 or more than 11.3, is indicated by a dotted line.

In each pattern, the numbers of all amino acid residues (not only REP but also the number of amino acid residues in the $(A)_n$ motif) of the two adjacent [$(A)_n$ motif-REP] units indicated by a solid line are added. Then, the total values obtained by addition are compared, and the total value of the pattern having the highest total value (a maximum value of the total value) is defined as x. In the example illustrated in FIG. 1, the total value of Pattern 1 is the maximum.

Next, x/y (%) can be calculated by dividing x by the total number y of the amino acid residues of the domain sequence.

In the third modified fibroin, x/y is preferably 50% or more, more preferably 60% or more, still more preferably 65% or more, even still more preferably 70% or more, further still preferably 75% or more, and particularly preferably 80% or more. The upper limit of x/y is not particularly limited, but may be, for example, 100% or less. In a case where the Giza ratio is 1:1.9 to 11.3, x/y is preferably 89.6% or more, in a case where the Giza ratio is 1:1.8 to 3.4, x/y is more preferably 77.1% or more, in a case where the Giza ratio is 1:1.9 to 8.4, x/y is still more preferably 75.9% or more, and in a case where the Giza ratio is 1:1.9 to 4.1, x/y is even still more preferably 64.2% or more.

In a case where the third modified fibroin is a modified fibroin in which at least seven of a plurality of $(A)_n$ motifs present in the domain sequence are composed only of alanine residues, x/y is preferably 46.4% or more, more preferably 50% or more, still more preferably 55% or more, even still more preferably 60% or more, further still preferably 70% or more, and particularly preferably 80% or more. The upper limit of x/y is not particularly limited and it only needs to be 100% or less.

Here, x/y in a naturally occurring fibroin will be described. First, fibroins with amino acid sequence information registered in NCBI GenBank was checked by the exemplified method as described above, and 663 types of fibroins (of which 415 types were fibroins derived from spiders) were extracted. Among all the extracted fibroins, x/y was calculated from an amino acid sequence of a naturally occurring fibroin constituted with a domain sequence represented by Formula 1: $[(A)_n \text{ motif-REP}]_m$, using the above-mentioned calculation method. The results in a case where the Giza ratio is 1:1.9 to 4.1 are shown in FIG. 3.

Figure 3:
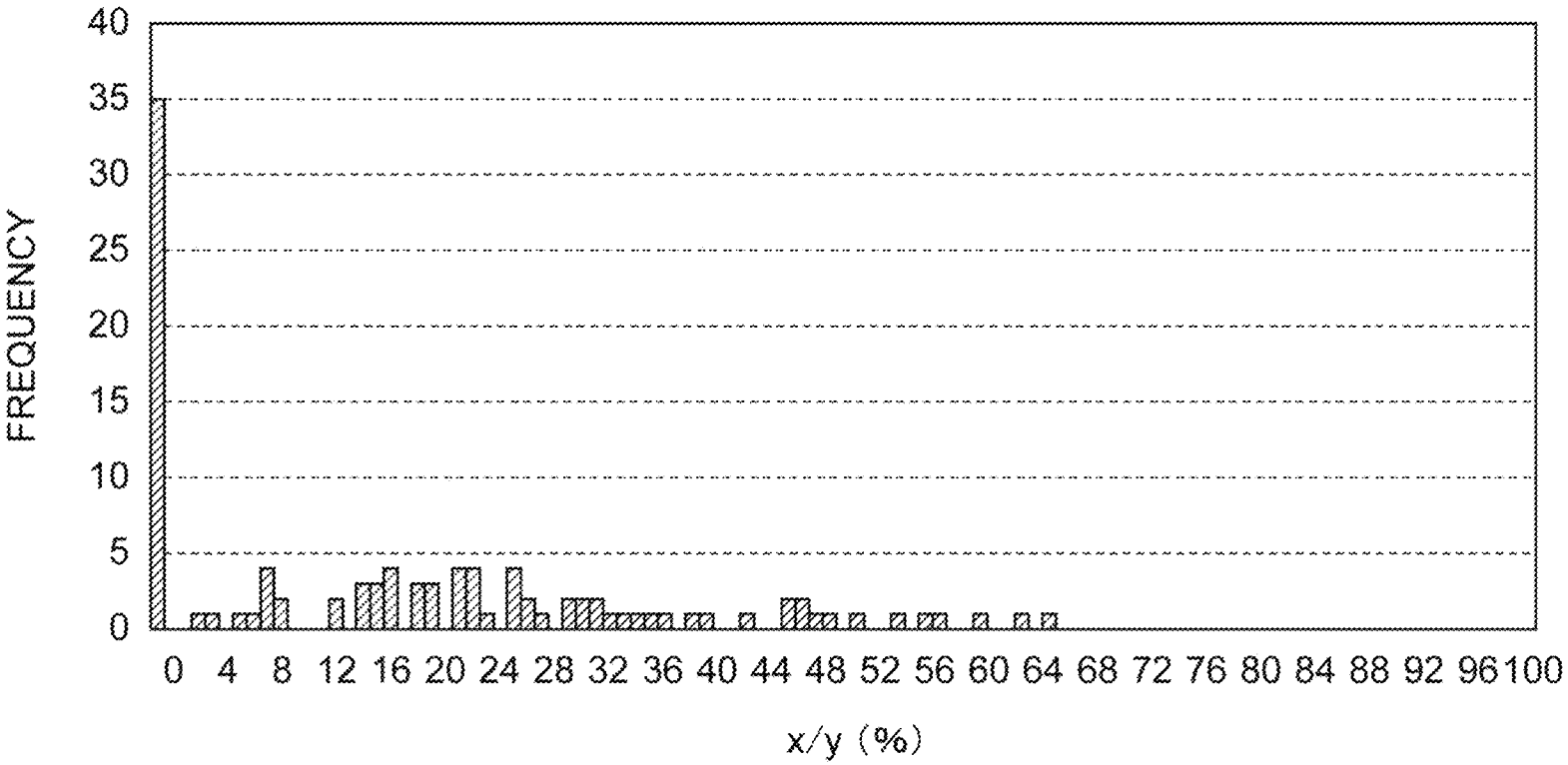
FIG. 3 is a diagram illustrating a distribution of x/y (%) values of a naturally occurring fibroin.

In FIG. 3, the horizontal axis represents x/y (%) and the vertical axis represents a frequency. As apparent from FIG. 3, x/y in all the naturally occurring fibroin is less than 64.2% (highest value: 64.14%).

The third modified fibroin may be obtained, for example, by deleting one or a plurality sequences encoding $(A)_n$ motif from a cloned gene sequence of a naturally occurring fibroin so that x/y is 64.2% or more. In addition, the third modified fibroin may also be obtained, for example, by designing an amino acid sequence that corresponds to an amino acid sequence in which one or a plurality $(A)_n$ motifs are deleted from an amino acid sequence of a naturally occurring fibroin so that x/y becomes 64.2% or more, and chemically synthesizing a nucleic acid encoding the designed amino acid sequence. In any case, in addition to the modification that corresponds to deletion of the $(A)_n$ motif from an amino acid sequence of a naturally occurring fibroin, a modification of the amino acid sequence that corresponds to substitution, deletion, insertion, and/or addition of one or a plurality of amino acid residues may further be performed.

More specific examples of the third modified fibroin include a modified fibroin containing an amino acid sequence having (3-i) the amino acid sequence set forth in SEQ ID NO: 17 (Met-PRT399), SEQ ID NO: 7 (Met-PRT410), SEQ ID NO: 8 (Met-PRT525), or SEQ ID NO: 9 (Met-PRT799), or (3-ii) an amino acid sequence having 90% or more sequence identity with the amino acid sequence set forth in SEQ ID NO: 17, SEQ ID NO: 7, SEQ ID NO: 8, or SEQ ID NO: 9.

The modified fibroin (3-i) will be described. The amino acid sequence set forth in SEQ ID NO: 17 is an amino acid sequence in which every third $(A)_n$ motif from the N-terminal side to the C-terminal side is deleted from the amino acid sequence set forth in SEQ ID NO: 10 (Met-PRT313) corresponding to a naturally occurring fibroin, and further, one [$(A)_n$ motif-REP] is inserted before the C-terminal sequence. The amino acid sequences set forth in SEQ ID NO: 7, SEQ ID NO: 8, or SEQ ID NO: 9 are as described for the second modified fibroin.

The value of x/y at a Giza ratio of 1:1.8 to 11.3 in the amino acid sequence set forth in SEQ ID NO: 10 (corresponding to a naturally occurring fibroin) is 15.0%. Both the values of x/y in the amino acid sequence set forth in SEQ ID NO: 17 and the amino acid sequence set forth in SEQ ID NO: 7 are 93.4%. The value of x/y in the amino acid sequence set forth in SEQ ID NO: 8 is 92.7%. The value of x/y in the amino acid sequence set forth in SEQ ID NO: 9 is 89.8%. The values of z/w in the amino acid sequences set forth in SEQ ID NO: 10, SEQ ID NO: 17, SEQ ID NO: 7, SEQ ID NO: 8, and SEQ ID NO: 9 are 46.8%, 56.2%, 70.1%, 66.1%, and 70.0%, respectively.

The modified fibroin (3-i) may be a modified fibroin consisting of the amino acid sequence set forth in SEQ ID NO: 17, SEQ ID NO: 7, SEQ ID NO: 8, or SEQ ID NO: 9.

The modified fibroin (3-ii) is a modified fibroin containing an amino acid sequence having 90% or more sequence identity with the amino acid sequence set forth in SEQ ID NO: 17, SEQ ID NO: 7, SEQ ID NO: 8, or SEQ ID NO: 9. The modified fibroin (3-ii) also is a protein containing a domain sequence represented by Formula 1: $[(A)_n$ motif-REP$]_m$. The sequence identity is preferably 95% or more.

It is preferable that the modified fibroin (3-ii) has 90% or more sequence identity with the amino acid sequence set forth in SEQ ID NO: 17, SEQ ID NO: 7, SEQ ID NO: 8, or SEQ ID NO: 9, and that, when the numbers of amino acid residues of REP of two adjacent $[(A)_n$ motif-REP] units are sequentially compared from the N-terminal side to the C-terminal side, x/y is 64.2% or more, where x is a maximum value of a total value obtained by adding the numbers of amino acid residues of two adjacent $[(A)_n$ motif-REP] units wherein when the number of amino acid residues of one REP having less amino acid residues is taken as 1, the ratio of the number of amino acids residues of the other REP satisfies 1.8 to 11.3 (the Giza ratio is 1:1.8 to 11.3); and where y is a total number of amino acid residues of the domain sequence.

The third modified fibroin may contain a tag sequence described above at either or both of the N-terminal and C-terminal.

A more specific example of the modified fibroin containing a tag sequence may be a modified fibroin containing (3-iii) the amino acid sequence set forth in SEQ ID NO: 18 (PRT399), SEQ ID NO: 13 (PRT410), SEQ ID NO: 14 (PRT525), or SEQ ID NO: 15 (PRT799), or (3-iv) an amino acid sequence having 90% or more sequence identity with the amino acid sequence set forth in SEQ ID NO: 18, SEQ ID NO: 13, SEQ ID NO: 14, or SEQ ID NO: 15.

The amino acid sequences set forth in SEQ ID NO: 18, SEQ ID NO: 13, SEQ ID NO: 14, and SEQ ID NO: 15 are amino acid sequences in which the amino acid sequence (containing a His tag sequence and a hinge sequence) set forth in SEQ ID NO: 11 is added to the N-terminal of the amino acid sequences set forth in SEQ ID NO: 17, SEQ ID NO: 7, SEQ ID NO: 8, and SEQ ID NO: 9, respectively.

The modified fibroin (3-iii) may be a modified fibroin consisting of the amino acid sequence set forth in SEQ ID NO: 18, SEQ ID NO: 13, SEQ ID NO: 14, or SEQ ID NO: 15.

The modified fibroin (3-iv) is a modified fibroin containing an amino acid sequence having 90% or more sequence identity with the amino acid sequence set forth in SEQ ID NO: 18, SEQ ID NO: 13, SEQ ID NO: 14, or SEQ ID NO: 15. The modified fibroin (3-iv) also is a protein containing a domain sequence represented by Formula 1: $[(A)_n$ motif-REP$]_m$. The sequence identity is preferably 95% or more.

It is preferable that the modified fibroin (3-iv) has 90% or more sequence identity with the amino acid sequence set forth in SEQ ID NO: 18, SEQ ID NO: 13, SEQ ID NO: 14 or SEQ ID NO: 15, and that, when the numbers of amino acid residues of REP of two adjacent $[(A)_n$ motif-REP] units are sequentially compared from the N-terminal side to the C-terminal side, x/y is 64.2% or more, where x is a maximum value of a total value obtained by adding the numbers of amino acid residues of two adjacent $[(A)_n$ motif-REP] units wherein when the number of amino acid residues of one REP having less amino acid residues is taken as 1, the ratio of the number of amino acids residues of the other REP satisfies 1.8 to 11.3; and where y is a total number of amino acid residues of the domain sequence.

The third modified fibroin may contain a secretory signal for releasing the protein produced in a recombinant protein production system to the outside of the host. The sequence of the secretory signal may be set as appropriate, depending on the type of the host.

The fourth modified fibroin has a domain sequence that has an amino acid sequence with a reduced content of glycine residues, in addition to the reduced content of $(A)_n$ motifs, as compared with a naturally occurring fibroin. It can be said that the domain sequence of the fourth modified fibroin is a domain sequence further having an amino acid sequence that corresponds to an amino acid sequence in which at least one or a plurality of glycine residues in REP are substituted with other amino acid residues, in addition to the amino acid sequence in which at least one or a plurality of the $(A)_n$ motifs are deleted, as compared with a naturally occurring fibroin. That is, the fourth modified fibroin is a modified fibroin having both the characteristics of the second modified fibroin and the characteristics of the third modified fibroin described above. Specific embodiments and the like are as described for the second modified fibroin and the third modified fibroin.

More specific examples of the fourth modified fibroin include a modified fibroin containing (4-i) the amino acid sequence set forth in SEQ ID NO: 7 (Met-PRT410), SEQ ID NO: 8 (Met-PRT525), SEQ ID NO: 9 (Met-PRT799), SEQ ID NO: 13 (PRT410), SEQ ID NO: 14 (PRT525), or SEQ ID NO: 15 (PRT799), or (4-ii) an amino acid sequence having 90% or more sequence identity with the amino acid sequence set forth in SEQ ID NO: 7, SEQ ID NO: 8, SEQ ID NO: 9, SEQ ID NO: 13, SEQ ID NO: 14, or SEQ ID NO: 15. Specific embodiments of the modified fibroin containing the amino acid sequence set forth in SEQ ID NO: 7, SEQ ID NO: 8, SEQ ID NO: 9, SEQ ID NO: 13, SEQ ID NO: 14, or SEQ ID NO: 15 are as described above.

The fifth modified fibroin may have a domain sequence that has an amino acid sequence containing a region having a locally high hydropathy index, which corresponds to an amino acid sequence in which one or a plurality of amino acid residues in REP are substituted with an amino acid residue having a high hydropathy index and/or one or a plurality of amino acid residues having a high hydropathy index is inserted into REP, as compared with a naturally occurring fibroin.

It is preferable that the region having a locally high hydropathy index is composed of 2 to 4 consecutive amino acid residues.

It is more preferable that the amino acid residues having a high hydropathy index are selected from isoleucine (I), valine (V), leucine (L), phenylalanine (F), cysteine (C), methionine (M), and alanine (A).

The fifth modified fibroin may further have a modification of an amino acid sequence that corresponds to substitution, deletion, insertion, and/or addition of one or a plurality of amino acid residues, as compared with a naturally occurring fibroin, in addition to the modification that corresponds to substitution of one or a plurality of amino acid residues in REP with amino acid residues having a high hydropathy index and/or insertion of one or a plurality of amino acid residues having a high hydropathy index into REP, as compared with a naturally occurring fibroin.

The fifth modified fibroin may be obtained, for example, from a cloned gene sequence of a naturally occurring fibroin, by substituting one or a plurality of hydrophilic amino acid residues in REP (for example, amino acid residues having a negative hydropathy index) with a hydrophobic amino acid residue (for example, amino acid residues having a positive hydropathy index), and/or inserting one or a plurality of hydrophobic amino acid residues into REP. In addition, the fifth modified fibroin may also be obtained, for example, by designing an amino acid sequence that corresponds to an amino acid sequence in which one or a plurality of hydrophilic amino acid residues in REP are substituted with hydrophobic amino acid residues and/or one or a plurality of hydrophobic amino acid residues are inserted into REP, from an amino acid sequence of a naturally occurring fibroin, and chemically synthesizing a nucleic acid encoding the designed amino acid sequence. In any case, in addition to the modification that corresponds to substitution of one or a plurality of hydrophilic amino acid residues in REP with hydrophobic amino acid residues and/or insertion of one or a plurality of hydrophobic amino acid residues into REP in an amino acid sequence of a naturally occurring fibroin, a modification of an amino acid sequence that corresponds to substitution, deletion, insertion, and/or addition of one or a plurality of amino acid residues may further be performed.

The fifth modified fibroin may be a modified fibroin that contains a domain sequence represented by Formula 1: $[(A)_n$ motif-REP$]_m$, and that has an amino acid sequence in which p/q is 6.2% or more, where p is the total number of amino acid residues contained in a region where an average value of hydropathy indices of the four consecutive amino acid residues is 2.6 or more in all REPs contained in the domain sequence excluding the sequence between the $(A)_n$ motif positioned closest to the C-terminal side and the C-terminal of the domain sequence; and where q is the total number of amino acid residues contained in the domain sequence excluding the sequence between the $(A)_n$ motif positioned closest to the C-terminal side and the C-terminal of the domain sequence.

With regard to the hydropathy index of an amino acid residue, known index from (Hydropathy index: Kyte J, & Doolittle R (1982) "A simple method for displaying the hydropathic character of a protein", J. Mol. Biol., 157, pp. 105-132) may be used. Specifically, the hydropathy index (hereinafter also referred to as "HI") of each amino acid is as shown in Table 1 below.

TABLE 1

| Amino acid | HI | Amino acid | HI |
|---|---|---|---|
| Isoleucine (Ile) | 4.5 | Tryptophan (Trp) | −0.9 |
| Valine (Val) | 4.2 | Tyrosine (Tyr) | −1.3 |
| Leucine (Leu) | 3.8 | Proline (Pro) | −1.6 |
| Phenylalanine (Phe) | 2.8 | Histidine (His) | −3.2 |
| Cysteine (Cys) | 2.5 | Asparagine (Asn) | −3.5 |
| Methionine (Met) | 1.9 | Aspartic acid (Asp) | −3.5 |
| Alanine (Ala) | 1.8 | Glutamine (Gln) | −3.5 |
| Glycine (Gly) | −0.4 | Glutamic acid (Glu) | −3.5 |
| Threonine (Thr) | −0.7 | Lysine (Lys) | −3.9 |
| Serine (Ser) | −0.8 | Arginine (Arg) | −4.5 |

A method for calculating p/q will be described in more detail. For calculation, a sequence (hereinafter also referred to as a "Sequence A") obtained by removing, from domain sequence represented by Formula 1: $[(A)_n$ motif-REP$]_m$, the sequence between the $(A)_n$ motif positioned closest to the C-terminal side and the C-terminal of the domain sequence is used. First, in all REPs contained in Sequence A, average values of hydropathy indices of the four consecutive amino acid residues are calculated. The average value of the hydropathy indices is obtained by dividing the sum of HI of each of the amino acid residues contained in the four consecutive amino acid residues by 4 (the number of amino acid residues). The average value of the hydropathy indices is obtained for all four consecutive amino acid residues (each of the amino acid residues is used for calculating the average value 1 to 4 times). Next, a region where the average value of the hydropathy indices of the four consecutive amino acid residues is 2.6 or more is identified. Even if a certain amino acid residues correspond to a plurality of the "four consecutive amino acid residues having an average value of the hydropathy indices of 2.6 or more", the amino acid residue is counted as one amino acid residue in the region. The total number of amino acid residues contained in the region is p. Further, the total number of amino acid residues contained in Sequence A is q.

Figure 4:
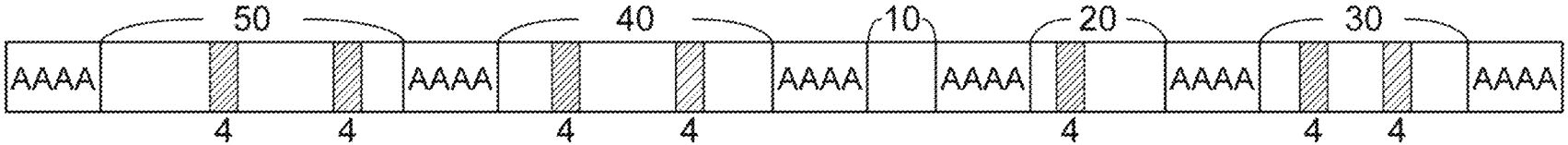
FIG. 4 is a schematic diagram illustrating an example of a domain sequence of a modified fibroin.

For example, in a case where 20 "four consecutive amino acid residues having an average value of the hydropathy indices of 2.6 or more" are extracted (without an overlap), there are 20 of the four consecutive amino acid residues (without an overlap) in the region in which the average value of the hydropathy indices of the four consecutive amino acid residues is 2.6 or more, and thus p is 20×4=80. In addition, for example, in a case where two "four consecutive amino acid residues having an average value of the hydropathy indices of 2.6 or more" overlap by only one amino acid residue, seven amino acid residues are contained in the region in which the average value of the hydropathy indices of the four consecutive amino acid residues is 2.6 or more (p=2×4−1=7; "−1" is deduction for overlap). For example, in a case of the domain sequence shown in FIG. 4, since there are seven "four consecutive amino acid residues having an average value of the hydropathy indices of 2.6 or more" without an overlap, p is 7×4=28. Further, for example, in a case of the domain sequence illustrated in FIG. 4, is 4+50+4+40+4+10+4+20+4+30=170 (the $(A)_n$ motif present at the end of the C-terminal side is not included). Next, p/q (%) can be calculated by dividing p by q. In the case of FIG. 4, p/q (%) is 28/170=16.47%.

In the fifth modified fibroin, p/q is preferably 6.2% or more, more preferably 7% or more, still more preferably 10% or more, even still more preferably 20% or more, and further still preferably 30% or more. The upper limit of p/q is not particularly limited, but may be, for example, 45% or less.

The fifth modified fibroin may be obtained, for example, by modifying an amino acid sequence of a cloned a naturally occurring fibroin to an amino acid sequence containing a region having a locally high hydropathy index, by substituting one or a plurality of hydrophilic amino acid residues in REP (for example, amino acid residues having a negative hydropathy index) with hydrophobic amino acid residues (for example, amino acid residues having a positive hydropathy index), and/or inserting one or a plurality of hydrophobic amino acid residues into REP, so as to satisfy the above condition of p/q. In addition, the modified fibroin may also be obtained, for example, by designing an amino acid sequence satisfying the above-described condition of p/q based on the amino acid sequence of a naturally occurring fibroin, and chemically synthesizing a nucleic acid encoding the designed amino acid sequence. In any case, in addition to the modification that corresponds substitution of one or a plurality of amino acid residues in REP with amino acid residues having a high hydropathy index and/or insertion of one or a plurality of amino acid residues having a high hydropathy index, as compared with a naturally occurring fibroin, a modification that corresponds to substitution, deletion, insertion, and/or addition of one or a plurality of amino acid residues may further be performed.

The amino acid residue having a high hydropathy index is not particularly limited, but is preferably isoleucine (I), valine (V), leucine (L), phenylalanine (F), cysteine (C), methionine (M), and alanine (A), and more preferably valine (V), leucine (L), and isoleucine (I).

More specific examples of the fifth modified fibroin contains a modified fibroin containing an amino acid sequence having (5-i) the amino acid sequence set forth in SEQ ID NO: 19 (Met-PRT720), SEQ ID NO: 20 (Met-PRT665), or SEQ ID NO: 21 (Met-PRT666), or (5-ii) an amino acid sequence having 90% or more sequence identity with the amino acid sequence set forth in SEQ ID NO: 19, SEQ ID NO: 20, or SEQ ID NO: 21.

The modified fibroin (5-i) will be described. The amino acid sequence set forth in SEQ ID NO: 19 is an amino acid sequence in which two amino acid sequences, each consisting of three amino acid residues (VLI), are inserted for every other REP excluding the terminal domain sequence on the C-terminal side; further, some of the glutamine (Q) residues are substituted with serine (S) residues; and some of the amino acids on the C-terminal side are deleted, with respect to the amino acid sequence set forth in SEQ ID NO: 7 (Met-PRT410). The amino acid sequence set forth in SEQ ID NO: 20 is an amino acid sequence in which one amino acid sequence consisting of three amino acid residues (VLI) is inserted for every other REP with respect to the amino acid sequence set forth in SEQ ID NO: 8 (Met-PRT525). The amino acid sequence set forth in SEQ ID NO: 21 is an amino acid sequence in which two amino acid sequences each consisting of three amino acid residues (VLI) are inserted for every other REP with respect to the amino acid sequence set forth in SEQ ID NO: 8.

The modified fibroin (5-i) may be a modified fibroin consisting of the amino acid sequence set forth in SEQ ID NO: 19, SEQ ID NO: 20, or SEQ ID NO: 21.

The modified fibroin (5-ii) is a modified fibroin containing an amino acid sequence having 90% or more sequence identity with the amino acid sequence set forth in SEQ ID NO: 19, SEQ ID NO: 20, or SEQ ID NO: 21. The modified fibroin (5-ii) also is a protein containing a domain sequence represented by Formula 1: $[(A)_n \text{ motif-REP}]_m$. The sequence identity is preferably 95% or more.

It is preferable that the modified fibroin (5-ii) has 90% or more sequence identity with the amino acid sequence set forth in SEQ ID NO: 19, SEQ ID NO: 20, or SEQ ID NO: 21, and that p/q is 6.2% or more, where p is the total number of amino acid residues contained in a region where an average value of hydropathy indices of the four consecutive amino acid residues is 2.6 or more in all REPs contained in the domain sequence excluding the sequence between the $(A)_n$ motif positioned closest to the C-terminal side and the C-terminal of the domain sequence; and where q is the total number of amino acid residues contained in the domain sequence excluding the sequence between the $(A)_n$ motif positioned closest to the C-terminal side and the C-terminal of the domain sequence.

The fifth modified fibroin may contain a tag sequence at either or both of the N-terminal and C-terminal.

More specific examples of the modified fibroin containing a tag sequence include a modified fibroin containing (5-iii) the amino acid sequence set forth in SEQ ID NO: 22 (PRT720), SEQ ID NO: 23 (PRT665), or SEQ ID NO: 24 (PRT666), or (5-iv) an amino acid sequence having 90% or more sequence identity with the amino acid sequence set forth in SEQ ID NO: 22, SEQ ID NO: 23, or SEQ ID NO: 24.

The amino acid sequences set forth in SEQ ID NO: 22, SEQ ID NO: 23, and SEQ ID NO: 24 are amino acid sequences in which the amino acid sequence (containing a His tag sequence and a hinge sequence) set forth in SEQ ID NO: 11 is added to the N-terminal of the amino acid sequences set forth in SEQ ID NO: 19, SEQ ID NO: 20, and SEQ ID NO: 21, respectively.

The modified fibroin (5-iii) may be a modified fibroin consisting of the amino acid sequence set forth in SEQ ID NO: 22, SEQ ID NO: 23, or SEQ ID NO: 24.

The modified fibroin (5-iv) is a modified fibroin containing an amino acid sequence having 90% or more sequence identity with the amino acid sequence set forth in SEQ ID NO: 22, SEQ ID NO: 23, or SEQ ID NO: 24. The modified fibroin (5-iv) also is a protein containing a domain sequence represented by Formula 1: $[(A)_n \text{ motif-REP}]_m$. The sequence identity is preferably 95% or more.

It is preferable that the modified fibroin (5-iv) has 90% or more sequence identity with the amino acid sequence set forth in SEQ ID NO: 22, SEQ ID NO: 23, or SEQ ID NO: 24, and that p/q is 6.2% or more, where p is the total number of amino acid residues contained in a region where an average value of hydropathy indices of the four consecutive amino acid residues is 2.6 or more in all REPs contained in the domain sequence excluding the sequence between the $(A)_n$ motif positioned closest to the C-terminal side and the C-terminal of the domain sequence; and where q is the total number of amino acid residues contained in the domain sequence excluding the sequence between the $(A)_n$ motif positioned closest to the C-terminal side and the C-terminal of the domain sequence.

The fifth modified fibroin may contain a secretory signal for releasing the protein produced in a recombinant protein production system to the outside of the host. The sequence of the secretory signal may be set as appropriate, depending on the type of the host.

The sixth modified fibroin has an amino acid sequence with a reduced content of glutamine residues, as compared with a naturally occurring fibroin.

It is preferable that the sixth modified fibroin contains at least one motif selected from a GGX motif and a GPGXX motif in the amino acid sequence of REP.

In a case where the sixth modified fibroin contains a GPGXX motif in REP, a GPGXX motif content rate is usually 1% or more, may be 5% or more, and is preferably 10% or more. The upper limit of the GPGXX motif content rate is not particularly limited, and it may be 50% or less, and may be 30% or less.

In the present specification, the "GPGXX motif content rate" is a value calculated by the following method.

In a fibroin (a modified fibroin or a naturally occurring fibroin) containing a domain sequence represented by Formula 1: $[(A)_n \text{ motif-REP}]_m$ or Formula 2: $[(A)_n \text{ motif-REP}]_m-(A)_n$ motif, the GPGXX motif content rate is calculated as s/t, where s is the number obtained by tripling the total number of the GPGXX motifs (namely, corresponds to the total number of G and P in the GPGXX motifs) contained in all REPs contained in the domain sequence excluding the sequence between the $(A)_n$ motif positioned closest to the C-terminal side and the C-terminal of the domain sequence; and where t is the total number of amino acid residues in all REPs obtained by excluding the sequence between the $(A)_n$ motif positioned closest to the C-terminal side and the C-terminal of the domain sequence from the domain sequence and further excluding the $(A)_n$ motifs.

For the calculation of the GPGXX motif content rate, a "domain sequence excluding the sequence between the $(A)_n$ motif positioned closest to the C-terminal side and the C-terminal of the domain sequence" is used, because "the sequence between the $(A)_n$ motif positioned closest to the C-terminal side and the C-terminal of the domain sequence (sequence corresponding to REP) may contain a sequence having a low correlation with the sequence characteristic of a fibroin, which influences the calculation result of the GPGXX motif content rate when m is small (that is, when the domain sequence is short), and thus, this effect is to be eliminated. In a case where a "GPGXX motif" is located at the C-terminal of REP, it is treated as "GPGXX motif" even if "XX" is, for example, "AA".

Figure 5:
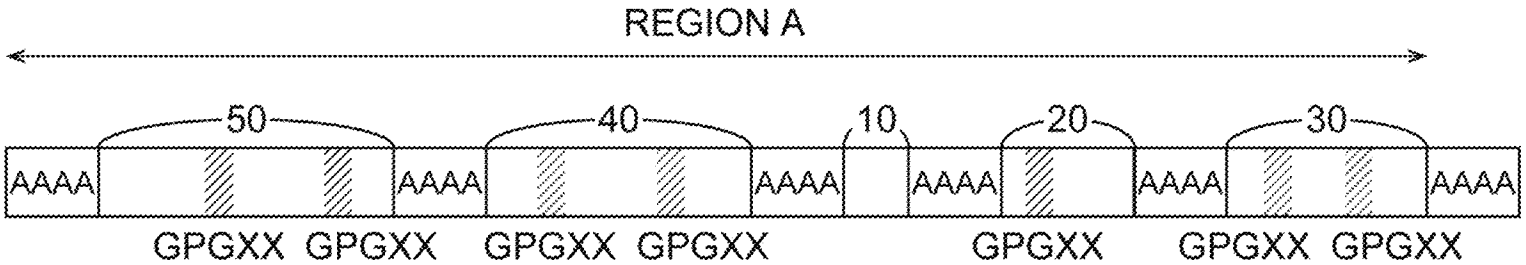
FIG. 5 is a schematic diagram illustrating an example of a domain sequence of a modified fibroin.

FIG. 5 is a schematic diagram illustrating a domain sequence of a modified fibroin. A method for calculating the GPGXX motif content rate will be specifically described with reference to FIG. 5. First, in a domain sequence of the modified fibroin (which is an $[(A)_n$ motif-REP$]_m$–$(A)_n$ motif] type) illustrated in FIG. 5, the number of GPGXX motifs for calculation of s is 7 and s is 7×3=21, because all REPs are contained in the "domain sequence excluding the sequence between the $(A)_n$ motif positioned closest to the C-terminal side and the C-terminal of the domain sequence" (indicated as "REGION A" in FIG. 5). Similarly, since all REPs are contained in the "domain sequence excluding the sequence between the $(A)_n$ motif positioned closest to the C-terminal side and the C-terminal of the domain sequence" (indicated as "REGION A" in FIG. 5), the total number, t, of amino acid residues in all REPs obtained by further excluding the $(A)_n$ motifs from the "domain sequence excluding the sequence between the $(A)_n$ motif positioned closest to the C-terminal side and the C-terminal of the domain sequence" is 50+40+10+20+30=150. Next, s/t (%) can be calculated by dividing s by t, and thus, in a case of the modified fibroin of FIG. 5, s/t (%) is 21/150=14.0%.

In the sixth modified fibroin, the glutamine residue content rate is preferably 9% or less, more preferably 7% or less, still more preferably 4% or less, and particularly preferably 0%.

In the present specification, the "glutamine residue content rate" is a value calculated by the following method.

In a fibroin (a modified fibroin or a naturally occurring fibroin) containing a domain sequence represented by Formula 1: $[(A)_n$ motif-REP$]_m$ or Formula 2: $[(A)_n$ motif-REP$]_m$–$(A)_n$ motif, the glutamine residue content rate is calculated as u/t, where u is the total number of glutamine residues contained in all REPs contained in the domain excluding the sequence between the $(A)_n$ motif positioned closest to the C-terminal side and the C-terminal of the domain sequence (sequence corresponding to the "REGION A" in FIG. 5); and where t is the total number of amino acid residues in all REPs obtained by excluding the sequence between the $(A)_n$ motif positioned closest to the C-terminal side and the C-terminal of the domain sequence from the domain sequence and further excluding the $(A)_n$ motifs. The reason as to why the "domain sequence excluding the sequence between the $(A)_n$ motif positioned closest to the C-terminal side and the C-terminal of the domain sequence" is used for the calculation of the glutamine residue content rate is the same as the reason described above.

The domain sequence of the sixth modified fibroin may be a domain sequence having an amino acid sequence that corresponds to an amino acid sequence in which one or a plurality of glutamine residues in REP are deleted or substituted with other amino acid residues, as compared with a naturally occurring fibroin.

The "other amino acid residues" may be amino acid residues other than the glutamine residue, but are preferably amino acid residues having a higher hydropathy index than that of the glutamine residue. The hydropathy indices of the amino acid residues are as shown in Table 1.

As shown in Table 1, examples of the amino acid residues having a higher hydropathy index than a glutamine residue include an amino acid residue selected from isoleucine (I), valine (V), leucine (L), phenylalanine (F), cysteine (C), methionine (M), alanine (A), glycine (G), threonine (T), serine (S), tryptophan (W), tyrosine (Y), proline (P), and histidine (H). Among these, an amino acid residue selected from isoleucine (I), valine (V), leucine (L), phenylalanine (F), cysteine (C), methionine (M), and alanine (A) is more preferable, and an amino acid residue selected from isoleucine (I), valine (V), leucine (L), and phenylalanine (F) is still more preferable.

In the sixth modified fibroin, the degree of hydrophobicity of REP is preferably −0.8 or more, more preferably −0.7 or more, still more preferably 0 or more, even still more preferably 0.3 or more, and particularly preferably 0.4 or more. The upper limit of the degree of hydrophobicity of REP is not particularly limited, and it may be 1.0 or less, and may be 0.7 or less.

In the present specification, the "degree of hydrophobicity of REP" is a value calculated by the following method.

In a fibroin (a modified fibroin or a naturally occurring fibroin) containing a domain sequence represented by Formula 1: $[(A)_n$ motif-REP$]_m$ or Formula 2: $[(A)_n$ motif-REP$]_m$–$(A)_n$ motif, the degree of hydrophobicity of REP is calculated as v/t, where v is the total sum of the hydropathy index of each amino acid residue contained in all REPs contained in the domain a sequence excluding the sequence between the $(A)_n$ motif positioned closest to the C-terminal side and the C-terminal of the domain sequence (sequence corresponding to a "REGION A" in FIG. 5); and where t is the total number of amino acid residues in all REPs obtained by excluding the sequence between the $(A)_n$ motif positioned closest to the C-terminal side and the C-terminal of the domain sequence from the domain sequence and further excluding the $(A)_n$ motifs. The reason as to why the "domain sequence excluding the sequence between the $(A)_n$ motif positioned closest to the C-terminal side and the C-terminal of the domain sequence" is used for the calculation of the degree of hydrophobicity of REP is the same as the reason described above.

The domain sequence of the sixth modified fibroin may further have a modification of an amino acid sequence that corresponds to substitution, deletion, insertion, and/or addition of one or a plurality of amino acid residues, in addition to the modification that corresponds to deletion of one or a plurality of glutamine residues in REP and/or substitution of one or a plurality of glutamine residues in REP with other amino acid residues, as compared with a naturally occurring fibroin.

The sixth modified fibroin may be obtained, for example, from a cloned gene sequence of a naturally occurring fibroin, by deleting one or a plurality of glutamine residues in REP and/or substituting one or a plurality of glutamine residues in REP with other amino acid residues. In addition, the sixth modified fibroin may also be obtained by designing an amino acid sequence that corresponds to an amino acid sequence in which one or a plurality of glutamine residues in REP are deleted, and/or one or a plurality of glutamine residues in REP are substituted with other amino acid residues, based on the amino acid sequence of a naturally occurring fibroin, and chemically synthesizing a nucleic acid encoding the designed amino acid sequence.

More specific examples of the sixth modified fibroin include (6-i) a modified fibroin containing the amino acid sequence set forth in SEQ ID NO: 25 (Met-PRT888), SEQ ID NO: 26 (Met-PRT965), SEQ ID NO: 27 (Met-PRT889), SEQ ID NO: 28 (Met-PRT916), SEQ ID NO: 29 (Met-PRT918), SEQ ID NO: 30 (Met-PRT699), SEQ ID NO: 31 (Met-PRT698), SEQ ID NO: 32 (Met-PRT966), SEQ ID NO: 41 (Met-PRT917), or SEQ ID NO: 42 (Met-PRT1028), or (6-ii) a modified fibroin containing an amino acid sequence having 90% or more sequence identity with the amino acid sequence set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, or SEQ ID NO: 42.

The modified fibroin (6-i) will be described. The amino acid sequence set forth in SEQ ID NO: 25 is obtained by substituting all QQs in an amino acid sequence (Met-PRT410) set forth in SEQ ID NO: 7 with VLs. The amino acid sequence set forth in SEQ ID NO: 26 is obtained by substituting all QQs in the amino acid sequence set forth in SEQ ID NO: 7 with TSs, and substituting the remaining Qs with As. The amino acid sequence set forth in SEQ ID NO: 27 is obtained by substituting all QQs in the amino acid sequence set forth in SEQ ID NO: 7 with VLs, and substituting the remaining Qs with Is. The amino acid sequence set forth in SEQ ID NO: 28 is obtained by substituting all QQs in the amino acid sequence set forth in SEQ ID NO: 7 with VIs, and substituting the remaining Qs with Ls. The amino acid sequence set forth in SEQ ID NO: 29 is obtained by substituting all QQs in the amino acid sequence set forth in SEQ ID NO: 7 with VFs, and substituting the remaining Qs with Is.

The amino acid sequence set forth in SEQ ID NO: 30 is obtained by substituting all QQs in the amino acid sequence (Met-PRT525) set forth in SEQ ID NO: 8 with VLs. The amino acid sequence set forth in SEQ ID NO: 31 is obtained by substituting all QQs in the amino acid sequence set forth in SEQ ID NO: 8 with VLs, and substituting the remaining Qs with Is.

The amino acid sequence set forth in SEQ ID NO: 32 is a sequence obtained by substituting all QQs in a sequence obtained by repeating twice a region of 20 domain sequences present in the amino acid sequence (Met-PRT410) set forth in SEQ ID NO: 7 with VFs, and substituting the remaining Qs with Is.

The amino acid sequence (Met-PRT917) set forth in SEQ ID NO: 41 is an amino acid sequence in which all QQs are substituted with Us and the remaining Qs are substituted with Vs in the amino acid sequence set forth in SEQ ID NO: 7. The amino acid sequence (Met-PRT1028) set forth in SEQ ID NO: 42 is an amino acid sequence in which all QQs are substituted with IFs and the remaining Qs are substituted with Ts in the amino acid sequence set forth in SEQ ID NO: 7.

The glutamine residue content rate of any of the amino acid sequences set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, and SEQ ID NO: 42 is 9% or less (Table 2).

TABLE 2

| Modified fibroin | Glutamine residue content rate | GPGXX motif content rate | Degree of hydrophobicity of REP |
|---|---|---|---|
| Met-PRT410 (SEQ ID NO: 7) | 17.7% | 27.9% | −1.52 |
| Met-PRT888 (SEQ ID NO: 25) | 6.3% | 27.9% | −0.07 |
| Met-PRT965 (SEQ ID NO: 26) | 0.0% | 27.9% | −0.65 |
| Met-PRT889 (SEQ ID NO: 27) | 0.0% | 27.9% | 0.35 |
| Met-PRT916 (SEQ ID NO: 28) | 0.0% | 27.9% | 0.47 |
| Met-PRT918 (SEQ ID NO: 29) | 0.0% | 27.9% | 0.45 |
| Met-PRT699 (SEQ ID NO: 30) | 3.6% | 26.4% | −0.78 |
| Met-PRT698 (SEQ ID NO: 31) | 0.0% | 26.4% | −0.03 |
| Met-PRT966 (SEQ ID NO: 32) | 0.0% | 28.0% | 0.35 |
| Met-PRT917 (SEQ ID NO: 41) | 0.0% | 27.9% | 0.46 |
| Met-PRT1028 (SEQ ID NO: 42) | 0.0% | 28.1% | 0.05 |

The modified fibroin (6-i) may be a modified fibroin consisting of the amino acid sequence set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, or SEQ ID NO: 42.

The modified fibroin (6-ii) may be a modified fibroin containing an amino acid sequence having 90% or more sequence identity with the amino acid sequence set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, or SEQ ID NO: 42. The modified fibroin (6-ii) also is a protein containing a domain sequence represented by Formula 1: $[(A)_n \text{ motif-REP}]_m$ or Formula 2: $[(A)_n \text{ motif-REP}]_m-(A)_n$ motif. The sequence identity is preferably 95% or more.

The modified fibroin (6-ii) preferably has a glutamine residue content rate of 9% or less. In addition, the modified fibroin (6-ii) preferably has a GPGXX motif content rate of 10% or more.

The sixth modified fibroin may contain a tag sequence at either or both of the N-terminal and C-terminal. This makes it possible to isolate, immobilize, detect, and visualize the modified fibroin.

More specific examples of the modified fibroin containing a tag sequence include a modified fibroin containing (6-iii) the amino acid sequence set forth in SEQ ID NO: 33 (PRT888), SEQ ID NO: 34 (PRT965), SEQ ID NO: 35 (PRT889), SEQ ID NO: 36 (PRT916), SEQ ID NO: 37. (PRT918), SEQ ID NO: 38 (PRT699), SEQ ID NO: 39 (PRT698), SEQ ID NO: 40 (PRT966), SEQ ID NO: 43 (PRT917), or SEQ ID NO: 44 (PRT1028), or a modified fibroin containing (6-iv) an amino acid sequence having 90% or more sequence identity with the amino acid sequence set forth in SEQ ID NO: 33, SEQ ID NO: 34, SEQ ID NO: 35, SEQ ID NO: 36, SEQ ID NO: 37, SEQ ID NO: 38, SEQ ID NO: 39 or SEQ ID NO: 40, SEQ ID NO: 43, or SEQ ID NO: 44.

The amino acid sequences set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, and SEQ ID NO: 44 are amino acid sequences in which the amino acid sequence (containing a His tag sequence and a hinge sequence) set forth in SEQ ID NO: 11 is added to the N-terminal of the amino acid sequences set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, and SEQ ID NO: 42, respectively. Since only the tag sequence is added to the N-terminal, the glutamine residue content rate is not changed, and any of the amino acid sequences set forth in SEQ ID NO:33, SEQ ID NO:34, SEQ ID NO:35, SEQ ID NO:36, SEQ ID NO:37, SEQ ID NO:38, SEQ ID NO:39, SEQ ID NO: 40, SEQ ID NO: 43, and SEQ ID NO: 44 has a glutamine residue content rate of 9% or less (Table 3).

TABLE 3

| Modified fibroin | Glutamine residue content rate | GPGXX motif content rate | Degree of hydrophobicity of REP |
|---|---|---|---|
| PRT888 (SEQ ID NO: 33) | 6.3% | 27.9% | −0.07 |
| PRT965 (SEQ ID NO: 34) | 0.0% | 27.9% | −0.65 |
| PRT889 (SEQ ID NO: 35) | 0.0% | 27.9% | 0.35 |
| PRT916 (SEQ ID NO: 36) | 0.0% | 27.9% | 0.47 |
| PRT918 (SEQ ID NO: 37) | 0.0% | 27.9% | 0.45 |
| PRT699 (SEQ ID NO: 38) | 3.6% | 26.4% | −0.78 |
| PRT698 (SEQ ID NO: 39) | 0.0% | 26.4% | −0.03 |
| PRT966 (SEQ ID NO: 40) | 0.0% | 28.0% | 0.35 |
| PRT917 (SEQ ID NO: 43) | 0.0% | 27.9% | 0.46 |
| PRT1028 (SEQ ID NO: 44) | 0.0% | 28.1% | 0.05 |

The modified fibroin (6-iii) may be a modified fibroin consisting of the amino acid sequence set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, or SEQ ID NO: 44.

The modified fibroin (6-iv) is a modified fibroin containing an amino acid sequence having 90% or more sequence identity with the amino acid sequence set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, or SEQ ID NO: 44. The modified fibroin (6-iv) also is a protein containing a domain sequence represented by Formula 1: $[(A)_n \text{ motif-REP}]_m$ or Formula 2: $[(A)_n \text{ motif-REP}]_m-(A)_n$ motif. The sequence identity is preferably 95% or more.

The modified fibroin (6-iv) preferably has a glutamine residue content rate of 9% or less. In addition, the modified fibroin (6-iv) preferably has a GPGXX motif content rate of 10% or more.

The sixth modified fibroin may contain a secretory signal for releasing the protein produced in a recombinant protein production system to the outside of the host. The sequence of the secretory signal may be set as appropriate, depending on the type of the host.

The modified fibroin may be a modified fibroin simultaneously pertaining at least two or more characteristics among the characteristics of the first modified fibroin, the second modified fibroin, the third modified fibroin, the fourth modified fibroin, the fifth modified fibroin, and the sixth modified fibroin.

From the viewpoint of securing excellent flame retardancy, the modified fibroin may be a hydrophilic modified fibroin. The hydrophilic modified fibroin is preferably, for example, a modified fibroin in which a value (average HI) obtained by obtaining a total sum of hydropathy indices (HI) of all amino acid residues constituting the modified fibroin, and then dividing the total sum by the total number of amino acid residues is 0 or less. The HI is as shown in Table 1.

Examples of the hydrophilic modified fibroin include a modified fibroin containing the amino acid sequence set forth in SEQ ID NO: 4, the amino acid sequence set forth in SEQ ID NO: 6, SEQ ID NO: 7, SEQ ID NO: 8, or SEQ ID NO: 9, the amino acid sequence set forth in SEQ ID NO: 13, SEQ ID NO: 11, SEQ ID NO: 14, or SEQ ID NO: 15, the amino acid sequence set forth in SEQ ID NO: 18, SEQ ID NO: 7, SEQ ID NO: 8, or SEQ ID NO: 9, the amino acid sequence set forth in SEQ ID NO: 17, SEQ ID NO: 11, SEQ ID NO: 14, or SEQ ID NO: 15, or the amino acid sequence set forth in SEQ ID NO: 19, SEQ ID NO: 20, or SEQ ID NO: 21.

The LOI value of the modified fibroin according to the present embodiment may be 18 or more, 20 or more, 22 or more, 24 or more, 26 or more, 28 or more, 29 or more, or 30 or more. In the present specification, the LOI value is a value measured in accordance with "Test Method for Granular or Low-Melting-Point Synthetic Resin" described in "Notice No. 50 of the Office of Hazardous Materials Regulation (as of May 31, 1995)".

The modified fibroin may be a hydrophobic modified fibroin from the viewpoint of obtaining high hygroscopic exothermicity. The hydrophobic modified fibroin is preferably, for example, a modified fibroin having an average HI of more than 0.

Examples of the hydrophobic modified fibroin include a modified fibroin containing the amino acid sequence set forth in SEQ ID NO: 27, SEQ ID NO: 28, SEQ ID NO: 29, SEQ ID NO: 30, SEQ ID NO: 31, SEQ ID NO: 32, SEQ ID NO: 33, or SEQ ID NO: 43, or the amino acid sequence of SEQ ID NO: 35, SEQ ID NO: 37, SEQ ID NO: 38, SEQ ID NO: 39, SEQ ID NO: 40, SEQ ID NO: 41, or SEQ ID NO: 44.

The maximum hygroscopic heat generation of the modified fibroin according to the present embodiment, which is determined according to Formula A, may be more than 0.025° C./g.

Formula A: Maximum hygroscopic heat generation={(Highest temperature of a sample when the sample has been transferred to a high humidity environment after being placed in a low humidity environment until a temperature of the sample reaches equilibrium)−(Temperature of the sample when the sample is being transferred to the high humidity environment after being placed in the low humidity environment until the temperature of the sample reaches equilibrium)} (° C.)/Sample weight (g)

Furthermore, in Formula A, the low humidity environment means an environment of a temperature of 20° C. and a relative humidity of 40%, and the high humidity environment means an environment of a temperature of 20° C. and a relative humidity of 90%.

The maximum hygroscopic heat generation of the modified fibroin according to the present embodiment is 0.026° C./g or more, 0.027° C./g or more, 0.028° C./g or more, 0.029° C./g or more, 0.030° C./g or more, 0.035° C./g or more, or 0.040° C./g or more. The upper limit of the maximum hygroscopic heat generation is not particularly limited, but is usually 0.060° C./g or less.

(Method for Manufacturing Modified Fibroin)

The modified fibroin (hereinafter also simply referred to as a "protein") according to any of the embodiments may also be produced, for example, by expressing a nucleic acid by a host transformed with an expression vector having the nucleic acid sequence encoding the protein and one or a plurality of regulatory sequences operably linked to the nucleic acid sequence.

A method for producing a nucleic acid encoding a modified fibroin is not particularly limited. For example, the nucleic acid may be produced by a method in which a gene encoding a natural fibroin is cloned by amplification with a polymerase chain reaction (PCR) or the like, and subjected to a modification by a genetic engineering technique, or a method of chemically synthesizing a nucleic acid. The method for chemically synthesizing a nucleic acid is not particularly limited, and for example, a gene may be chemically synthesized by a method in which oligonucleotides are automatically synthesized by AKTA oligopilot plus 10/100 (GE Healthcare Japan Corporation) or the like, and are linked by PCR or the like, based on the amino acid sequence information of a protein obtained from the NCBI web database or the like. At this time, in order to facilitate purification and/or confirmation of the modified fibroin, a nucleic acid encoding a modified fibroin consisting of an amino acid sequence obtained by adding an amino acid sequence consisting of a start codon and a His10 tag to the N-terminal of the above-described amino acid sequence may be synthesized.

The regulatory sequence is a sequence (for example, a promoter, an enhancer, a ribosome binding sequence, or a transcription termination sequence) that controls the expression of a modified fibroin in a host, and may be selected as appropriate, depending on the type of the host. As a promoter, an inducible promoter that functions in a host cell and is capable of inducing the expression of a modified fibroin may be used. The inducible promoter is a promoter that can control transcription by the presence of an inducer (expression inducer), the absence of a repressor molecule, or physical factors such as an increase or decrease in a temperature, an osmotic pressure, or a pH value.

The type of the expression vector such as a plasmid vector, a viral vector, a cosmid vector, a fosmid vector, or an artificial chromosome vector may be selected as appropriate, depending on the type of the host. As the expression vector, an expression vector that can autonomously replicate in a host cell or can be incorporated into a chromosome of a host and which contains a promoter at a position capable of transcribing the nucleic acid that encodes a modified fibroin is suitably used.

Both prokaryotes and eukaryotes such as yeast, filamentous fungi, insect cells, animal cells, and plant cells may be suitably used as a host.

Preferred examples of the prokaryotic host cells include bacteria belonging to the genus *Escherichia*, the genus *Brevibacillus*, the genus *Serratia*, the genus *Bacillus*, the genus *Microbacterium*, the genus *Brevibacterium*, the genus *Corynebacterium*, and the genus *Pseudomonas*. Examples of microorganisms belonging to the genus *Escherichia* include *Escherichia coli*. Examples of microorganisms belonging to the genus *Brevibacillus* include *Brevibacillus agri*. *Examples of microorganisms belonging to the genus Serratia* include *Serratia liquefaciens*. Examples of microorganisms belonging to the genus *Bacillus* include *Bacillus subtilis*. Examples of microorganisms belonging to the genus *Microbacterium* include *Microbacterium ammoniaphilum*. Examples of microorganisms belonging to the genus *Brevibacterium* include *Brevibacterium divaricatum*. Examples of microorganisms belonging to the genus *Corynebacterium* include *Corynebacterium ammoniagenes*. Examples of microorganisms belonging to the genus *Pseudomonas* include *Pseudomonas putida*.

In a case where a prokaryote is used as a host, examples of a vector into which a nucleic acid encoding a modified fibroin is introduced include pBTrp2 (manufactured by Boehringer Mannheim), pGEX (manufactured by Pharmacia), pUC18, pBluescriptII, pSupex, pET22b, pCold, pUB110, and pNCO2 (Japanese Unexamined Patent Publication No. 2002-238569).

Examples of the eukaryotic hosts include yeast and filamentous fungi (mold and the like). Examples of the yeasts include yeasts belonging to the genus *Saccharomyces*, the genus *Pichia*, and the genus *Schizosaccharomyces*. Examples of the filamentous fungi include filamentous fungi belonging to the genus *Aspergillus*, the genus *Penicillium*, and the genus *Trichoderma*.

In a case where the eukaryote is used as a host, examples of the vector into which a nucleic acid encoding a modified fibroin is introduced include YEp13 (ATCC37115) and YEp24 (ATCC37051). As a method for introducing an expression vector into the host cell, any of methods of introducing DNA into the host cell may be used. Examples thereof include a method using calcium ions [Proc. Natl. Acad. Sci. USA, 69, 2110 (1972)], electroporation method, spheroplast method, protoplast method, lithium acetate method, and competent method.

As for the method for expressing a nucleic acid using a host transformed with an expression vector, secretory production, fusion protein expression, or the like, in addition to the direct expression, may be performed in accordance with the method described in Molecular Cloning, $2^{nd}$ edition, and the like.

The modified fibroin may be produced, for example, by culturing a host transformed with the expression vector in a culture medium, producing and accumulating the protein in the culture medium, and then collecting the modified fibroin from the culture medium. The method for culturing a host in a culture medium may be performed in accordance with a method commonly used for culturing a host.

In a case where the host is a prokaryote such as *Escherichia coli* or a eukaryote such as yeast, any of a natural medium and a synthetic medium may be used as a culture medium of the host as long as the medium contains a carbon source, a nitrogen source, inorganic salts, and the like which may be utilized by the host and the medium may be used for efficiently culturing the host.

The carbon source may be any of carbon sources which can be assimilated by a transformed microorganism, and for example, carbohydrates such as glucose, fructose, sucrose, and molasses, starch, and starch hydrolysates containing these, organic acids such as acetic acid and propionic acid, and alcohols such as ethanol and propanol may be used. As the nitrogen source, for example, ammonium salts of inorganic or organic acids such as ammonia, ammonium chloride, ammonium sulfate, ammonium acetate, and ammonium phosphate, other nitrogen-containing compounds, peptone, meat extract, yeast extract, corn steep liquor, casein hydrolysate, soybean cake and soybean cake hydrolysate, and various fermented microbial cells and digested products thereof may be used. As the inorganic salts, for example, potassium dihydrogen phosphate, dipotassium phosphate, magnesium phosphate, magnesium sulfate, sodium chloride, ferrous sulfate, manganese sulfate, copper sulfate, and calcium carbonate may be used.

Culture of a prokaryote such as *Escherichia coli* or a eukaryote such as a yeast may be performed under aerobic conditions such as shaking culture or deep aeration stirring culture. The culture temperature is, for example, 15° C. to 40° C. The culture time is usually 16 hours to 7 days. It is preferable to maintain the pH of the culture medium during the culture at 3.0 to 9.0. The pH of the culture medium may be adjusted using an inorganic acid, an organic acid, an alkali solution, urea, calcium carbonate, ammonia, or the like.

In addition, antibiotics such as ampicillin and tetracycline may be added to the culture medium as necessary during the culture. In a case of culturing a microorganism transformed with an expression vector using an inducible promoter as the promoter, an inducer may be added to the medium as necessary. For example, in a case of culturing a microorganism transformed with an expression vector using a lac promoter, isopropyl-β-D-thiogalactopyranoside or the like may be added to the medium, and in a case of culturing a microorganism transformed with an expression vector using a trp promoter, indole acrylic acid or the like may be added to the medium.

Isolation and purification of the expressed modified fibroin may be performed by a commonly used method. For example, in a case where the protein is expressed in a dissolved state in cells, the host cells are recovered by centrifugation after the completion of the culture, suspended in an aqueous buffer solution, and then disrupted using an ultrasonicator, a French press, a Manton-Gaulin homogenizer, a Dyno-Mill, or the like to obtain a cell-free extract. From the supernatant obtained by centrifuging the cell-free extract, a purified preparation may be obtained by a method commonly used for protein isolation and purification, that is, a solvent extraction method, a salting-out method using ammonium sulfate or the like, a desalting method, a precipitation method using an organic solvent, an anion exchange chromatography method using a resin such as diethylaminoethyl (DEAE)-Sepharose or DIAION HPA-75 (manufactured by Mitsubishi Kasei Kogyo Kabushiki Kaisha), an cation exchange chromatography method using a resin such as S-Sepharose FF (manufactured by Pharmacia Corporation), a hydrophobic chromatography method using a resin such as butyl sepharose or phenyl sepharose, a gel filtration method using a molecular sieve, an affinity chromatography method, a chromatofocusing method, or an electrophoresis method such as isoelectric focusing or the like, using the above-mentioned methods singly or in combination thereof.

In addition, in a case where the modified fibroin is expressed to form an insoluble body in the cell, similarly, the host cells are recovered, disrupted, and centrifuged to recover the insoluble body of the modified fibroin as a precipitated fraction. The recovered insoluble body of the modified fibroin may be solubilized with a protein denaturing agent. After this operation, a purified preparation of the modified fibroin may be obtained by the same isolation and purification method as described above. In a case where the protein is secreted extracellularly, the protein may be recovered from the culture supernatant. That is, a culture supernatant is obtained by treating the culture by a technique such as centrifugation, and a purified preparation may be obtained from the culture supernatant by using the same isolation and purification method as described above.

(Method for Manufacturing Modified Fibroin Fiber)

In a case where the modified fibroin fiber is a modified fibroin filament, the modified fibroin filament may be manufactured by a known spinning method. That is, for example, in a case of manufacturing a modified fibroin filament containing a modified fibroin as the main component, first, the modified fibroin produced in accordance with the above-mentioned method is added to a solvent such as dimethyl sulfoxide (DMSO), N,N-dimethylformamide (DMF), formic acid, or hexafluoroisopropanol (HFIP), as necessary, together with an inorganic salt as a dissolution accelerator and dissolved to prepare a doping liquid. Then, using the doping liquid, spinning may be performed by a known spinning method such as wet-type spinning, dry-type spinning, dry-wet-type spinning, or melt spinning to obtain the modified fibroin filament. Preferred examples of the spinning method include wet-type spinning and dry-wet-type spinning.

Figure 6:
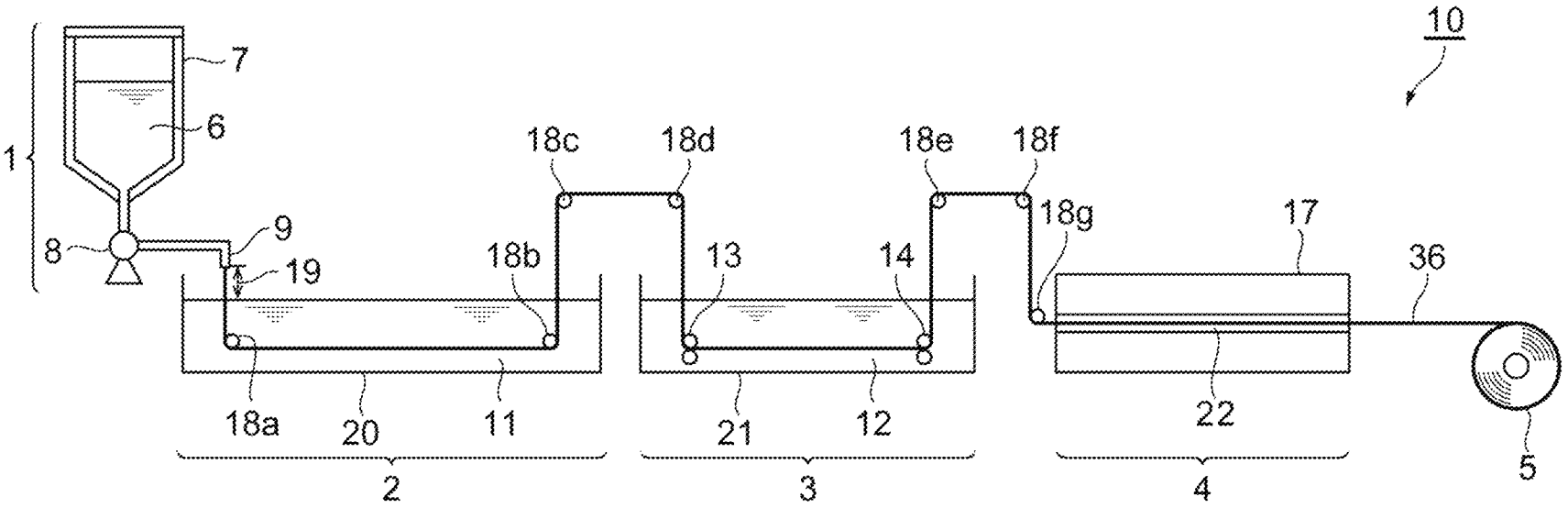
FIG. 6 is an explanatory diagram schematically illustrating an example of a spinning device for manufacturing a modified fibroin filament.

FIG. 6 is an explanatory view schematically illustrating one example of a spinning device for manufacturing a modified fibroin filament. A spinning device 10 shown in FIG. 6 is an example of a spinning device for dry-wet-type spinning, and includes an extrusion device 1, an undrawn yarn manufacturing device 2, a wet heat drawing device 3, and a drying device 4.

A spinning method using the spinning device 10 will be described. First, a doping liquid 6 stored in a storage tank 7 is pushed out from a spinneret 9 by a gear pump 8. In the laboratory scale, the doping liquid may be filled in a cylinder and extruded from a nozzle using a syringe pump. Next, the extruded doping liquid 6 is supplied into a coagulation liquid 11 in a coagulation liquid bath 20 via an air gap 19, the solvent is removed, the modified fibroin is coagulated, and a fibrous coagulate is formed. Then, the fibrous coagulate is supplied into warm water 12 in a drawing bath 21 and is drawn. A drawing ratio is determined according to a speed ratio of a supply nip roller 13 to a withdrawing nip roller 14. Thereafter, the drawn fibrous coagulate is supplied to a drying device 4 and dried in a yarn path 22 in enclosure 17 to obtain a modified fibroin filament 36 as a wound yarn body 5. Reference signs 18*a* to 18*g* are yarn guides.

The coagulation liquid 11 may be any solvent that can be desolvated, and examples thereof include lower alcohols having 1 to 5 carbon atoms such as methanol, ethanol, and 2-propanol, and acetone. The coagulation liquid 11 may include water as appropriate. The temperature of the coagulation liquid 11 is preferably 0° C. to 30° C. In a case where a syringe pump having a nozzle with a diameter of 0.1 to 0.6 mm is used as the spinneret 9, the extrusion speed is preferably 0.2 to 6.0 mL/hour, and more preferably 1.4 to 4.0 mL/hour, per hole. A distance that the coagulated modified fibroin passes through the coagulation liquid 11 (substantially a distance from the yarn guide 18*a* to the yarn guide 18*b*) may be a length that allows efficient desolvation, and is, for example, 200 to 500 mm. The withdrawing speed of the undrawn yarn may be, for example, 1 to 20 m/min, and is preferably 1 to 3 m/min. The residence time in the coagulation liquid 11 may be, for example, 0.01 to 3 minutes, and is preferably 0.05 to 0.15 minutes.

In addition, drawing (pre-drawing) may be performed in the coagulation liquid 11. The coagulation liquid bath 20 may be provided in multiple stages, and the drawing may be performed in each stage or in a specific stage as necessary.

Moreover, as the drawing to be carried out in a case of obtaining a modified fibroin filament, for example, a pre-drawing performed in the coagulation liquid bath 20 and a wet heat drawing performed in the drawing bath 21 are employed, and a dry heat drawing is also employed.

The wet heat drawing may be performed in warm water, in a solution obtained by adding an organic solvent or the like to warm water, or in heated steam. The temperature may be, for example, 50° C. to 90° C., and is preferably 75° C. to 85° C. In the wet heat drawing, the undrawn yarn (or pre-drawn yarn) may be drawn, for example, by 1 to 10 times, and preferably by 2 to 8 times.

The dry heat drawing may be performed using an electric tubular furnace, a dry heat plate, or the like. The temperature may be, for example, 140° C. to 270° C., and is preferably 160° C. to 230° C. In the dry heat drawing, the undrawn yarn (or pre-drawn yarn) may be drawn, for example, by 0.5 to 8 times, and is preferably drawn by 1 to 4 times.

The wet heat drawing and the dry heat drawing may be performed independently or in combination, or may be performed in multiple stages. That is, the wet heat drawing and the dry heat drawing may be performed in a suitable combination, for example, in a manner in which a first stage drawing is performed by wet heat drawing and a second stage drawing is performed by dry heat drawing or in a manner in which the first stage drawing is performed by wet heat drawing, the second stage drawing is performed by wet heat drawing, and a third stage drawing is performed by dry heat drawing.

The lower limit value of the final drawing ratio with respect to the undrawn yarn (or pre-drawn yarn) is preferably any of more than 1 time, 2 times or more, 3 times or more, 4 times or more, 5 times or more, 6 times or more, 7 times or more, 8 times or more, or 9 times or more, and the upper limit value is preferably 40 times or less, 30 times or less, 20 times or less, 15 times or less, 14 times or less, 13 times or less 12 times or less, 11 times or less, or 10 times or less.

The length of the modified fibroin filament obtained by the above-mentioned method may be adjusted by the spinning conditions as appropriate. The length of the modified fibroin filament is not particularly limited, but may be, for example, more than 1,500 m, and may be 10,000 m or more, 15,000 m or more, or 20,000 m or more.

(Cutting Step)

In a case where the modified fibroin fiber is a modified fibroin staple, the modified fibroin staple may be manufactured by cutting a modified fibroin filament produced by the above-described method. Further, cutting of the modified fibroin filament may be performed after a crimping step or after a drying step, which will be described later. The length of the modified fibroin staple is not particularly limited, but may be 20 mm or more, 20 to 140 mm, 70 to 140 mm, or 20 to 70 mm.

(Crimping Step)

In a case where the modified fibroin fiber is a modified fibroin crimped fiber (modified fibroin crimped staple or modified fibroin crimped staple), the modified fibroin crimped fiber may be produced, for example, by crimping a non-crimped modified fibroin fiber. The modified fibroin fiber may be crimped by a mechanical crimping process in the related art or may be crimped by being brought into contact with an aqueous medium. In addition, these processing methods may be used in combination.

Examples of the mechanical crimping processing method include a false twist method, an indentation method, a rubbing method, an air jet method (high-pressure air jet method), and a shaping method.

The modified fibroin fiber in the invention shrinks by being brought into contact with water, and is thus crimped. Therefore, according to the processing method of bringing the modified fibroin fiber into contact with the aqueous medium, the modified fibroin fiber can be crimped without depending on an external force. The aqueous medium is a medium of a liquid or gas (steam) including water (including a water vapor). The aqueous medium may be water or may be a mixed liquid of water and a hydrophilic solvent. Further, as the hydrophilic solvent, for example, a volatile solvent such as ethanol and methanol or a vapor thereof may be used. The aqueous medium is preferably a mixed solution of water and ethanol. By using an aqueous medium including a volatile solvent or a vapor thereof, the modified fibroin fiber dries quickly, and is finished to have a soft feel. The ratio of water to the volatile solvent or a vapor thereof is not particularly limited, and water:the volatile solvent or a vapor thereof may be, for example, 10:90 to 90:10 in terms of a mass ratio.

In a case where the aqueous medium is a liquid, a known oil agent such as an oil agent for process passability (for example, for antistatic properties) or for finishing may be dispersed in the aqueous medium. That is, instead of the aqueous medium, an oil agent dispersion liquid including an aqueous medium and an oil agent dispersed in the aqueous medium may be used. By using such an oil agent dispersion liquid, the modified fibroin fiber may be crimped, and the oil agent can be attached to the modified fibroin fiber. By attaching the oil agent to the modified fibroin fiber, various properties can be imparted to the modified fibroin fiber. Further, the amount of the oil agent is not particularly limited and may be, for example, 1% to 10% by mass or 2% to 5% by mass with respect to the total amount of the aqueous medium and the oil agent.

The temperature of the aqueous medium may be 10° C. or higher, 25° C. or higher, 40° C. or higher, 60° C. or higher, or 100° C. or higher, and may be 230° C. or lower, 120° C. or lower, or 100° C. or lower. More specifically, in a case where the aqueous medium is a gas (steam), the temperature of the aqueous medium is preferably 100° C. to 230° C., and more preferably 100° C. to 120° C. In a case where the steam of the aqueous medium is 230° C. or lower, the heat denaturation of the modified fibroin fiber can be prevented. In a case where the aqueous medium is a liquid, the temperature of the aqueous medium is preferably 10° C. or higher, 25° C. or higher, or 40° C. or higher from the viewpoint of efficiently imparting crimpness, and is preferably 60° C. or lower from the viewpoint of maintaining a high fiber strength of the modified fibroin fiber. The time of bringing the modified fibroin fiber into contact with the aqueous medium is not particularly limited, but may be 30 seconds or longer, 1 minute or longer, or 2 minutes or longer, and is preferably 10 minutes or shorter from the viewpoint of productivity. The contact of the aqueous medium with the modified fibroin fiber may be performed under normal pressure or under reduced pressure (for example, vacuum).

Examples of a method of bringing the modified fibroin fiber into contact with the aqueous medium include a method of immersing a modified fibroin fiber in water, a method of spraying steam of an aqueous medium onto a modified fibroin fiber, and a method of exposing a modified fibroin fiber to an environment filled with steam in an aqueous medium. In a case where the aqueous medium is steam, a contact of the aqueous medium with the modified fibroin fiber may be performed using a general steam setting device. Specific examples of the steam setting device include a device of product name: FMSA type steam setter (manufactured by Fukushin Kyougyo Co., Ltd.) and a device of a product name: EPS-400 (manufactured by Tsujii Dyeing Machine Manufacturing Co., Ltd.). Specific examples of the method for crimping the modified fibroin fiber with the steam of the aqueous medium include a method of accommodating a modified fibroin fiber in a predetermined accommodating chamber and also bringing the modified fibroin fiber into contact with steam while introducing the steam of an aqueous medium into the accommodating chamber to adjust the temperature inside the accommodating chamber to a predetermined temperature (for example, 100° C. to 230° C.).

Moreover, the crimping step of the modified fibroin fiber by the contact with the aqueous medium is preferably carried out in a state where no tensile force is applied to a modified fibroin fiber (not tensioned in the fiber axis direction) or in a state where a predetermined amount of tensile force is applied (tensioned by a predetermined amount in the fiber axis direction). At this time, the degree of crimpness may be controlled by adjusting the tensile force applied to the modified fibroin fiber. Examples of the method for adjusting the tensile force applied to the modified fibroin fiber include a method of adjusting a load applied to a modified fibroin fiber, for example, by hanging weight units of various weights on the modified fibroin fiber, and the like, a method of fixing both ends of a modified fibroin fiber in a state where the modified fibroin fiber is slackened while changing the amount of slackness in various ways, and a method of winding a modified fibroin fiber around a wound body such as a paper tube or a bobbin so that a winding force is changed as appropriate, (a tightening force on the paper tube or the bobbin).

(Drying Step)

After bringing the modified fibroin fiber into contact with the aqueous medium, the modified fibroin fiber may be dried. The drying method is not particularly limited, and the modified fibroin fiber may be naturally dried or may be forcibly dried using a drying facility. Crimping with the aqueous medium and subsequent drying may be continuously performed. Specifically, for example, the modified fibroin fiber may be dried by immersing the modified fibroin fiber in the aqueous medium while sending out the modified fibroin fiber from a bobbin, and then blowing hot air or sending the modified fibroin fiber out on a hot roller. The drying temperature is not particularly limited, may be, for example, 20° C. to 150° C., and is preferably 40° C. to 120° C., and more preferably 60° C. to 100° C.

<Knitted or Woven Body>

One aspect of the present invention relates to a knitted or woven body of the blended yarn. The knitted or woven body is a generic term for a knitted fabric and a woven fabric. The blended yarn constituting the knitted or woven body may be a single yarn or may be a double yarn. The knitted fabric may be any of a knitted fabric having a weft knitted structure (also simply referred to as a "weft knitted fabric") such as a flat knit and a circular knit, and a knitted fabric having a warp knitted structure (also simply referred to as a "warp knitted fabric") such as tricot and russell. The woven fabric may be a woven fabric having any structure of a plain weave, a twill weave, and a satin weave. The knitted or woven body may be an unprocessed knitted or woven body itself obtained by knitting or weaving, or may be a knitted or woven body which has been subjected to a process such as a shrinking process after knitting or weaving.

<Method for Manufacturing Knitted or Woven Body>

The knitted or woven body according to the present invention may be manufactured by a method including steps of: blend-spinning a modified fibroin fiber and a regenerated cellulose fiber to obtain a blended yarn (blend-spinning step); and knitting or weaving the blended yarn to obtain an unprocessed knitted or woven body (knitting or weaving step).

(Blend-Spinning Step)

In the present step, a modified fibroin fiber and a regenerated cellulose fiber are blend-spun to obtain a blended yarn. Details of the modified fibroin fiber, the regenerated cellulose fiber, and the blended yarn are as described above. The blend-spinning method is not particularly limited and a known spinning method may be adopted.

(Knitting or Weaving Step)

In the present step, the blended yarn is knitted or woven to obtain an unprocessed knitted or woven body (an unprocessed knitted fabric or an unprocessed woven fabric). As the knitting method and the weaving method, known methods may be used. As a knitting machine to be used, for example, a circular knitting machine, a warp knitting machine, a flat knitting machine, or the like may be used, and from the viewpoint of productivity, the circular knitting machine is preferably used. As a flat knitting machine, there are a molding knitting machine, a non-sewing knitting machine, and the like, but in particular, the use of non-sewing knitting machine is more preferable since an unprocessed knitted fabric may be manufactured in the form of a final product. Examples of a weaving machine to be used include a shuttle weaving machine, and a shuttleless weaving machine such as a gripper weaving machine, a rapier weaving machine, a water jet weaving machine, and an air jet weaving machine.

(Shrinking Step)

The obtained unprocessed knitted or woven body may be optionally subjected to various types of processing. An example of the processing is a processing in which an unprocessed knitted or woven body is brought into contact with an aqueous medium to cause a modified fibroin fiber contained in the unprocessed knitted or woven body to shrink. This processing may be carried out by a method similar to the method of crimping a modified fibroin fiber by bringing the modified fibroin fiber into contact with an aqueous medium. That is, the modified fibroin fiber contained in the unprocessed knitted or woven body may be shrunk by a method such as a method of immersing an unprocessed knitted or woven body in water, a method of spraying steam of an aqueous medium onto an unprocessed knitted or woven body, a method of exposing an unprocessed knitted or woven body to an environment filled with steam of an aqueous medium, or the like, and the details of the aqueous medium and the respective conditions are as described above. More specifically, the modified fibroin fiber contained in the unprocessed knitted or woven body may be shrunk by bringing the unprocessed knitted or woven body into contact with the aqueous medium, followed by drying. The knitted or woven body obtained through shrinking has a high density, and a decrease in tension and stiffness due to moistness is further reduced.

EXAMPLES

Hereinafter, the present invention will be more specifically described, based on Examples. However, the present invention is not limited to the following Examples.

<Manufacture of Modified Spider Silk Fibroin>

(1) Preparation of Plasmid Expressing Strain

Based on the nucleotide sequence and the amino acid sequence of a fibroin (GenBank Accession No.: P46804.1, GI: 1174415) derived from *Nephila clavipes*, a modified fibroin having the amino acid sequence set forth in SEQ ID NO: 15 (PRT799) was designed. In addition, a modified fibroin having the amino acid sequence set forth in SEQ ID NO: 37 (PRT918) and a modified fibroin having the amino acid sequence set forth in SEQ ID NO: 40 (PRT966) were also designed.

Next, a nucleic acid encoding the designed modified fibroin was synthesized. In the nucleic acid, an NdeI site was added to the 5' end and an EcoRI site was added downstream of the stop codon. The nucleic acid was cloned into a cloning vector (pUC118). Thereafter, the nucleic acid was cleaved by a restriction enzyme treatment with NdeI and EcoRI, and then recombined into a protein expression vector pET-22b (+) to obtain an expression vector.

(2) Expression of Protein

*Escherichia coli* BLR(DE3) was transformed with a pET22b(+) expression vector containing the designed nucleic acid encoding a modified fibroin. The transformed *Escherichia coli* was cultured in 2 mL of an LB medium containing ampicillin for 15 hours. The culture solution was added to 100 mL of a seed culture medium (Table 4) containing ampicillin so that the $OD_{600}$ was 0.005. While maintaining the temperature of the culture solution at 30° C., flask culturing was performed (for about 15 hours) until the $OD_{600}$ reached 5, thereby obtaining a seed culture solution.

TABLE 4

| Seed culture medium | |
|---|---|
| Reagent | Concentration (g/L) |
| Glucose | 5.0 |
| $KH_2PO_4$ | 4.0 |
| $K_2HPO_4$ | 9.3 |
| Yeast Extract | 6.0 |
| Ampicillin | 0.1 |

To a jar fermenter to which 500 mL of a production medium (Table 5) had been added, the seed culture solution was added so that the $OD_{600}$ was 0.05. The culture was performed while keeping the culture solution temperature at 37° C. and controlling the pH constant at 6.9. Further, the concentration of dissolved oxygen in the culture solution was maintained at 20% of the dissolved oxygen saturation concentration.

TABLE 5

| Production medium | |
|---|---|
| Reagent | Concentration (g/L) |
| Glucose | 12.0 |
| $KH_2PO_4$ | 9.0 |
| $MgSO_4 \cdot 7H_2O$ | 2.4 |
| Yeast Extract | 15 |
| $FeSO_4 \cdot 7H_2O$ | 0.04 |
| $MnSO_4 \cdot 5H_2O$ | 0.04 |
| $CaCl_2 \cdot 2H_2O$ | 0.04 |
| GD-113 (antifoamer) | 0.1 (mL/L) |

Immediately after glucose in the production medium was completely consumed, a feed solution (455 g/l L of glucose and 120 g/l L of Yeast Extract) was added at a rate of 1 mL/min. The culture was performed while keeping the culture solution temperature at 37° C. and controlling the pH constant at 6.9. Further, the concentration of dissolved oxygen in the culture solution was maintained at 20% of the dissolved oxygen saturation concentration, and the culture was performed for 20 hours. Thereafter, 1 M isopropyl-β-thiogalactopyranoside (IPTG) was added to the culture solution to a final concentration of 1 mM to induce the expression of the modified fibroin. After the lapse of 20 hours from the addition of IPTG, the culture solution was centrifuged to recover the bacterial cell pellet. SDS-PAGE was performed using bacterial cell pellets prepared from the culture solution before the addition of IPTG and after the addition of IPTG, and the expression of the target modified fibroin was checked by the IPTG addition-dependent appearance of a band corresponding to the size of the target modified fibroin.

(3) Purification of Protein

The bacterial cell pellet recovered after 2 hours from the addition of IPTG was washed with a 20 mM Tris-HCl buffer solution (pH 7.4). The bacterial cell pellet after washing was suspended in a 20 mM Tris-HCl buffer solution (pH 7.4) containing about 1 mM PMSF, and the cell suspension was disrupted with a high-pressure homogenizer (manufactured by GEA Niro Soavi SpA). The disrupted cells were centrifuged to obtain a precipitate. The obtained precipitate was washed with a 20 mM Tris-HCl buffer solution (pH 7.4) until the obtained precipitate became highly pure. The precipitate after washing was suspended in an 8 M guanidine buffer solution (8 M guanidine hydrochloride, 10 mM sodium dihydrogen phosphate, 20 mM NaCl, 1 mM Tris-HCl, pH 7.0) so that the concentration was 100 mg/mL, and dissolved by stirring with a stirrer at 60° C. for 30 minutes. After dissolution, dialysis was performed in water using a dialysis tube (cellulose tube 36/32 manufactured by Sanko Junyaku Co., Ltd.). The white protein aggregate obtained after dialysis was recovered by centrifugation, the moisture was removed with a lyophilizer, and the lyophilized powder was recovered to obtain modified spider silk fibroins "PRT799", "PRT918", and "PRT966".

<Manufacture of Modified Fibroin Filament>

(1) Preparation of Doping Liquid

The above-described modified fibroin (PRT799, PRT918, or PRT966) was added to DMSO so that the concentration was 24% by mass, and then LiCl was added thereto as a dissolution accelerator so that the concentration was 4.0% by mass. Then, the modified fibroin was dissolved for 3 hours using a shaker to obtain a DMSO solution of the modified fibroin. The insoluble matter and foams in the obtained DMSO solution were removed to obtain a doping liquid. The solution viscosity of the doping liquid was 5,000 centipoises (cP) at 90° C.

(2) Spinning

Known dry-wet-type spinning was performed using the doping liquid obtained as described above and the spinning device 10 shown in FIG. 6 to obtain a modified fibroin filament. The obtained modified fibroin filament was wound on a bobbin. Further, the dry-wet-type spinning was performed here under the following conditions.

Temperature of coagulation liquid (methanol): 5° C. to 10° C.

Drawing ratio: 4.52 times

Drying temperature: 80° C.

Example

A plurality of modified fibroin filaments obtained as described above were bundled and cut into a length of 38 mm with a tabletop-type fiber cutting machine to prepare a modified fibroin staple. The modified fibroin staple thus prepared was immersed in water at 40° C. for 1 minute to be crimped, and then dried at 40° C. for 18 hours to obtain a modified fibroin crimped staple. The shrinkage rate of the modified fibroin staple by immersion in water was 50%. This modified fibroin crimped staple and a commercially available lyocell crimped staple were spun using known spinning equipment to obtain a double yarn of a blended yarn having a fineness of 2/30 Nm and a twist number of 570 T/m. The proportion of the modified fibroin crimped staple in the blended yarn was 20% by mass. A knitted fabric was prepared by performing plain knitting with a flat knitting machine, using a double yarn of the blended yarn.

Figure 7:
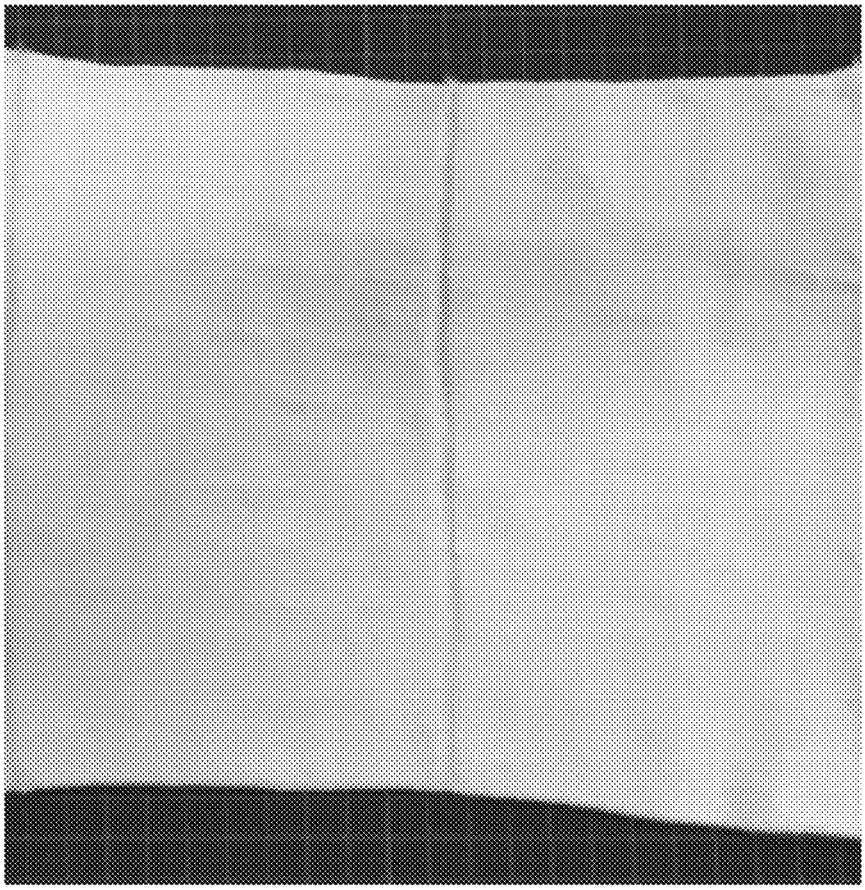
FIG. 7 is a photograph of a knitted fabric in Examples.

The knitted fabric was immersed in water, and changes in the tension and the stiffness after drying were observed. Specifically, first, the knitted fabric whose weight (initial weight) had been measured in advance was immersed in water at a temperature of 37.5° C. After 90 seconds, the knitted fabric was taken out of water and the moisture of the knitted fabric was removed with a paper towel. The knitted fabric was dried with a dryer (EH5101P manufactured by Panasonic) until the weight returned to the initial weight. A photograph of the knitted fabric after drying is shown in FIG. 7. The knitted fabric after drying was in a slightly thicker and firmer state than before being immersed in water.

COMPARATIVE EXAMPLE

Figure 8:
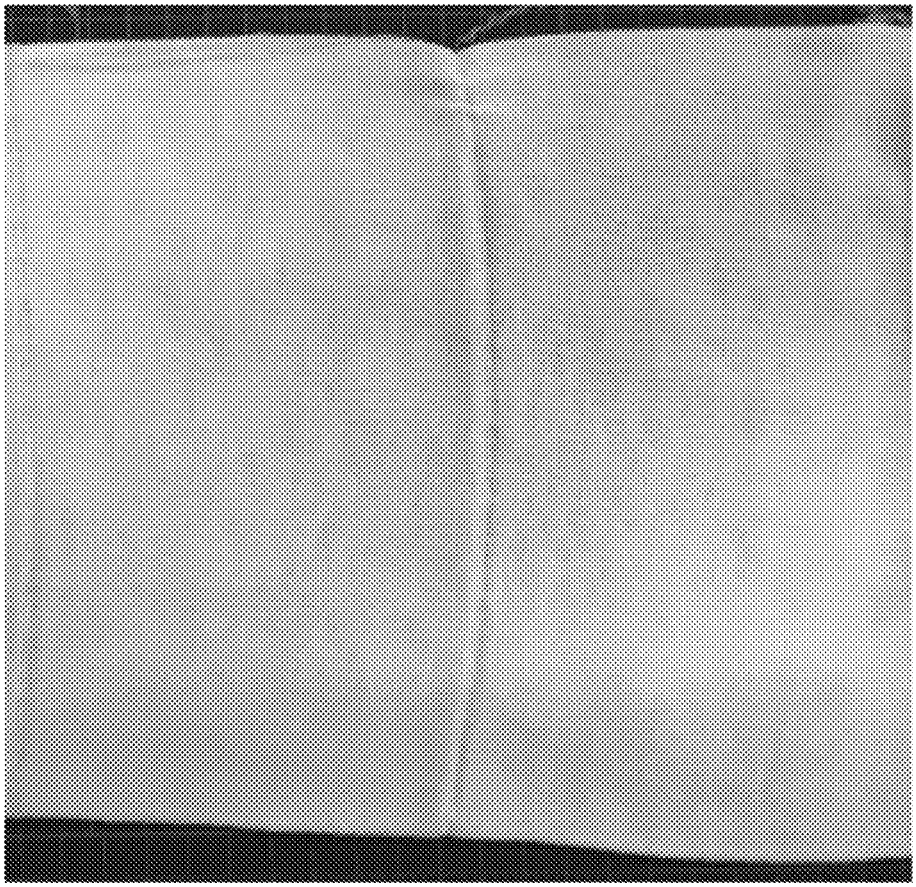
FIG. 8 is a photograph of a knitted fabric in Comparative Examples.

A knitted fabric was prepared by performing plain knitting with a flat knitting machine, using a double yarn of a commercially available lyocell spun yarn having a fineness of 2/30 Nm and a twist number of 295 T/m. In a similar manner to Examples, the knitted fabric was immersed in water, and changes in the tension and the stiffness after drying were observed. A photograph of the knitted fabric after drying is shown in FIG. 8.

In the knitted fabric of Example, decrease in the tension and the stiffness after immersion in water and drying was suppressed, as compared with the knitted fabric of Comparative Examples.

Reference Example 1

A doping liquid of the modified fibroin PRT799 obtained in the same manner as in Example above was filtered through a metal filter having an opening of 5 μm at 60° C., then allowed to stand in a 30 mL stainless steel syringe, defoamed, and then discharged from a solid nozzle having a needle diameter of 0.2 mm into a 100%-by-mass methanol coagulation bath. The discharge temperature was 60° C. After coagulation, the obtained raw yarn was wound and naturally dried to obtain a modified fibroin fiber.

A knitted fabric was manufactured by circular knitting using a circular knitting machine, using the obtained raw material fiber. The knitted fabric had a thickness of 180 denier and a gauge number of 18. 20 g of a piece was cut out from the obtained knitted fabric and used as a test piece.

A flammability test was performed in accordance with "Test Method for Granular or Low-Melting-Point Synthetic Resin" described in "Notice No. 50 of the Office of Hazardous Materials Regulation (as of May 31, 1995)". The test was performed under the conditions of a temperature of 22° C., a relative humidity of 45%, and an atmospheric pressure of 1,021 hPa. The measurement results (oxygen concentration (%), combustion rate (%), and converted combustion rate (%)) are shown in Table 6.

TABLE 6

| Oxygen concentration (%) | Combustion rate (%) | Converted combustion rate (%) |
|---|---|---|
| 20.0 | 39.1 | 40.1 |
| 27.0 | 48.1 | 49.3 |
| 28.0 | 51.9 | 53.2 |
| 30.0 | 53.6 | 54.9 |
| 50.0 | 61.2 | 62.7 |
| 70.0 | 91.1 | 93.3 |
| 100.0 | 97.6 | 100.0 |

As a result of the flammability test, the knitted fabric knitted with the modified fibroin (PRT799) fiber had a limiting oxygen index (LOI) value of 27.2. Generally, LOI value of 26 or more is considered as having flame retardancy. It can be seen that the modified fibroin has an excellent flame retardancy. Therefore, it can be said that a blended yarn containing such a modified fibroin fiber and a knitted or woven body of the same have excellent flame retardancy.

Reference Example 2

A doping liquid of the modified fibroin (PRT799 or PRT918) obtained in the same manner as in Example above was filtered through a metal filter having an opening of 5 μm at 60° C., then allowed to stand in a 30 mL stainless steel syringe, defoamed, and then discharged from a solid nozzle having a needle diameter of 0.2 mm into a 100%-by-mass methanol coagulation bath. The discharge temperature was 60° C. After coagulation, the obtained raw yarn was wound and naturally dried to obtain a modified fibroin fiber (raw material fiber).

For comparison, commercially available wool fibers, cotton fibers, tencel fibers, rayon fibers, and polyester fibers were prepared as the raw material fibers.

Each raw material fiber was used to manufacture a knitted fabric by flat knitting using a flat knitting machine. The knitted fabric using the PRT918 fiber as the raw material fiber had a thickness of 1/30 N (single wool count yarn) and a gauge number of 18. The knitted fabric using the PRT799 fiber as the raw material fiber had a thickness of 1/30 N (single wool count yarn) and a gauge number of 16. The thickness and the gauge number of the knitted fabric for which such other raw material fibers were used were adjusted so that the cover factor was almost the same as that of the knitted fabric using the PRT918 fiber and the PRT799 fiber. Further, the thickness and the gauge number of a knitted fabric using a fiber other than the modified fibroin fiber were adjusted as follows.

- Wool fiber thickness: 2/30 N (double yarn), gauge number: 14
- Cotton fiber thickness: 2/34 N (double yarn), gauge number: 14
- Tencel fiber thickness: 2/30 N (double yarn), gauge number: 15
- Rayon fiber thickness: 1/38 N (single yarn), gauge number: 14
- Polyester fiber thickness: 1/60 N (single yarn), gauge number: 14

Two sheets of the knitted fabric cut into 10 cm×10 cm were put together and the four sides were sewn together to obtain a test piece (sample). The test piece was left to stand in a low humidity environment (temperature of 20° C.±2° C., relative humidity of 40% 5%) for 4 hours or longer and then transferred to a high humidity environment (temperature of 20° C.±2° C., relative humidity of 90% 5%), and measurement of the temperature was performed at an interval of 1 minute for 30 minutes with a temperature sensor mounted at the center of the inside of the test piece.

From the measurement results, the maximum hygroscopic heat generation was obtained according to the following Formula A.

Figure 9:
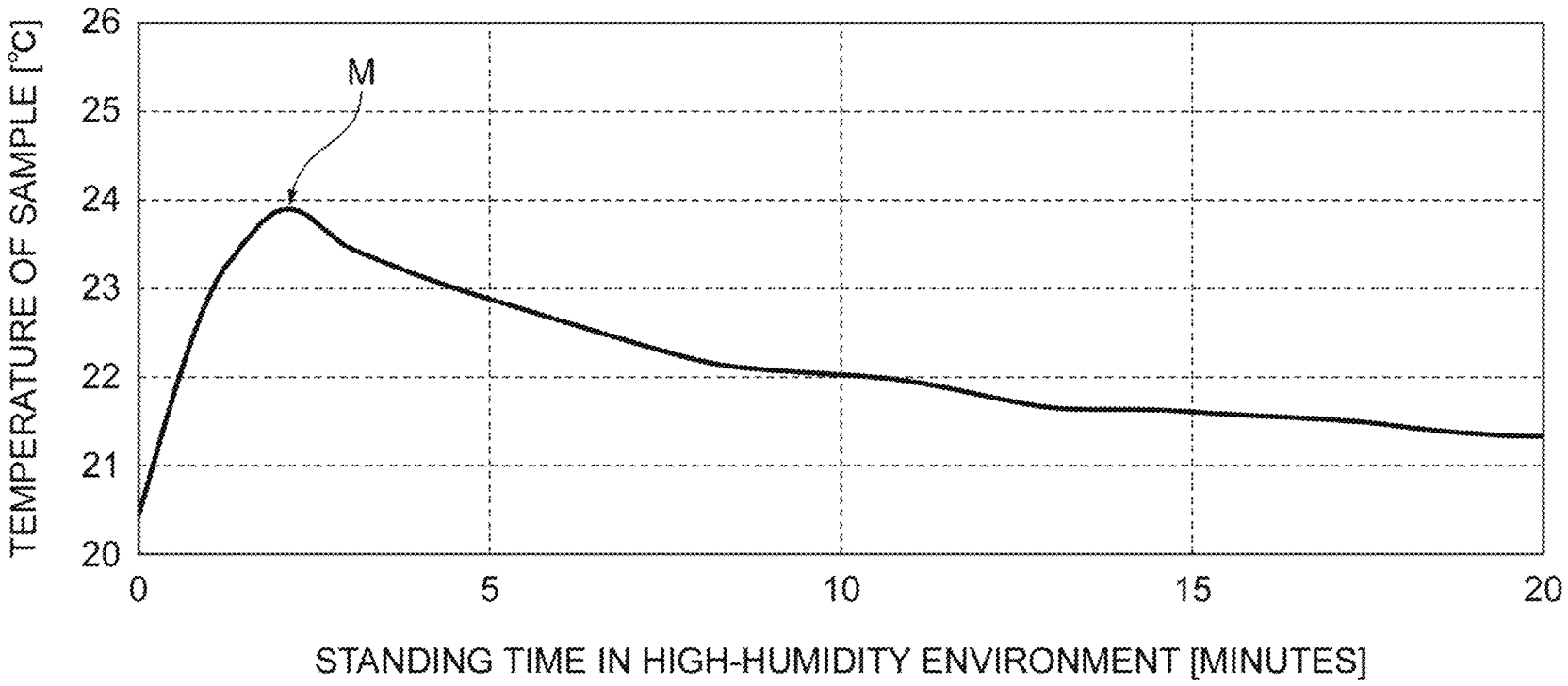
FIG. 9 is a graph illustrating an example of the results of a hygroscopic heat generation test.

Maximum hygroscopic heat generation={(Highest temperature of a sample when the sample has been transferred to a high humidity environment after being placed in a low humidity environment until a temperature of the sample reaches equilibrium)−(Temperature of the sample when the sample is being transferred to the high humidity environment after being placed in the low humidity environment until the temperature of the sample reaches equilibrium)} (° C.)/Sample weight (g) Formula A:

FIG. 9 is a graph illustrating an example of the results of the hygroscopic heat generation test. The horizontal axis of the graph indicates a standing time (minutes) in the high humidity environment, with a point of time of transferring the sample from the low humidity environment to the high humidity environment being set to 0. The vertical axis of the graph indicates a temperature (temperature of a sample) measured with a temperature sensor. In the graph illustrated in FIG. 9, a point indicated by M corresponds to a highest value of the sample temperature.

The calculation results for the maximum hygroscopic heat generation are shown in Table 7.

TABLE 7

| Raw material fiber | Maximum hygroscopic heat generation (° C./g) |
|---|---|
| PRT918 | 0.040 |
| PRT799 | 0.031 |
| Wool | 0.020 |
| Cotton | 0.021 |
| Tencel | 0.018 |
| Rayon | 0.025 |
| Polyester | 0.010 |

As shown in Table 7, it can be seen that the modified fibroin (PRT918 and PRT799) fibers have a high value of the maximum hygroscopic heat generation and excellent hygroscopic exothermicity, as compared with the existing materials. Accordingly, it can be said that the blended yarn containing such a modified fibroin fiber and a knitted or woven body of the same have excellent hygroscopic exothermicity.

Reference Example 3

A doping liquid of the modified fibroins PRT799 and PRT966 obtained in the same manner as in Example above was filtered through a metal filter having an opening of 5 μm at 60° C., then allowed to stand in a 30 mL stainless steel syringe, defoamed, and then discharged from a solid nozzle having a needle diameter of 0.2 mm into a 100%-by-mass methanol coagulation bath. The discharge temperature was 60° C. After coagulation, the obtained raw yarn was wound and naturally dried to obtain a modified fibroin fiber (raw material fiber).

For comparison, commercially available wool fibers, silk fibers, cotton fibers, rayon fibers, and polyester fibers were prepared as raw material fibers.

Each raw material fiber was used to manufacture a knitted fabric by flat knitting using a flat knitting machine. The count, the number of twists, the gauge number, and the basis weight of the knitted fabric using the PRT966 fiber and the PRT799 fiber are shown in Table 8. The thickness and the gauge number of the knitted fabric using other raw material fibers were adjusted so that the cover factor was almost the same as the cover factor of the knitted fabric of the modified fibroin fiber. Specifically, the values are as shown in Table 8.

TABLE 8

| Raw material fiber | Count [Nm] | Number of twists | Gauge number [GG] | Basis weight [g/m$^2$] |
|---|---|---|---|---|
| PRT966 | 30 | 1 | 18 | 90.1 |
| PRT799 | 30 | 1 | 16 | 111.0 |
| Wool | 30 | 2 | 14 | 242.6 |
| Silk | 60 | 2 | 14 | 225.2 |
| Cotton | 34 | 2 | 14 | 194.1 |
| Rayon | 38 | 1 | 14 | 181.8 |
| Polyester | 60 | 1 | 14 | 184.7 |

The heat retention was evaluated by a dry contact method, using a KES-F7 Thermo Labo II tester manufactured by Kato Tech Co., Ltd. The dry contact method is a method assuming a direct contact between the skin and clothes in a dry state. One sheet of the knitted fabric cut into a rectangle of 20 cm×20 cm was used as a test piece (sample). The test piece was set on a hot plate set to a constant temperature (30° C.), and the quantity of heat (a) dissipated through the test piece was determined under the conditions of a wind velocity in a wind tunnel of 30 cm/sec. The quantity of heat (b) dissipated through the test piece under the same conditions as above in a state where the test piece was not set was determined, and the heat retention rate (%) was calculated according to the following formula.

$$\text{Heat retention rate (\%)}=(1-a/b)\times 100$$

From the measurement results, the heat retention index was calculated according to the following Formula B.

Heat retention index=Heat retention rate (%)/Basis weight(g/m$^2$) of sample Formula B:

The calculation results of the heat retention indices are shown in Table 9. The materials having a higher heat retention index can be evaluated to have more excellent heat retention.

TABLE 9

| Raw material fiber | Heat retention index |
|---|---|
| PRT966 | 0.33 |
| PRT799 | 0.22 |
| Wool | 0.16 |
| Silk | 0.11 |
| Cotton | 0.13 |
| Rayon | 0.02 |
| Polyester | 0.18 |

As shown in Table 9, it can be seen that the modified fibroin (PRT966 and PRT799) fibers have higher heat retention indices and excellent heat retention, as compared with the existing materials.

REFERENCE SIGNS LIST

1 . . . extrusion device, 2 . . . undrawn yarn manufacturing device, 3 . . . wet heat drawing device, 4 . . . drying device, 6 . . . doping liquid-, 10 . . . spinning device, 20 . . . coagulation liquid bath, 21 . . . drawing bath, 36 . . . modified fibroin filament.

SEQUENCE LISTING

<160> NUMBER OF SEQ ID NOS: 44

<210> SEQ ID NO 1
<211> LENGTH: 50
<212> TYPE: PRT
<213> ORGANISM: Araneus diadematus

<400> SEQUENCE: 1

Ser Gly Cys Asp Val Leu Val Gln Ala Leu Leu Glu Val Val Ser Ala
1 5 10 15

Leu Val Ser Ile Leu Gly Ser Ser Ser Ile Gly Gln Ile Asn Tyr Gly
20 25 30

Ala Ser Ala Gln Tyr Thr Gln Met Val Gly Gln Ser Val Ala Gln Ala
35 40 45

Leu Ala
50

<210> SEQ ID NO 2
<211> LENGTH: 30
<212> TYPE: PRT
<213> ORGANISM: Araneus diadematus

<400> SEQUENCE: 2

Ser Gly Cys Asp Val Leu Val Gln Ala Leu Leu Glu Val Val Ser Ala
1 5 10 15

Leu Val Ser Ile Leu Gly Ser Ser Ser Ile Gly Gln Ile Asn
20 25 30

<210> SEQ ID NO 3
<211> LENGTH: 21
<212> TYPE: PRT
<213> ORGANISM: Araneus diadematus

<400> SEQUENCE: 3

Ser Gly Cys Asp Val Leu Val Gln Ala Leu Leu Glu Val Val Ser Ala
1 5 10 15

Leu Val Ser Ile Leu
20

<210> SEQ ID NO 4
<211> LENGTH: 1154
<212> TYPE: PRT
<213> ORGANISM: Artificial Sequence
<220> FEATURE:
<223> OTHER INFORMATION: recombinant spider silk protein
ADF3KaiLargeNRSH1

<400> SEQUENCE: 4

Met His His His His His His His His His His Ser Ser Gly Ser Ser
1 5 10 15

Leu Glu Val Leu Phe Gln Gly Pro Ala Arg Ala Gly Ser Gly Gln Gln
20 25 30

Gly Pro Gly Gln Gln Gly Pro Gly Gln Gln Gly Pro Gly Gln Gln Gly
35 40 45

Pro Tyr Gly Pro Gly Ala Ser Ala Ala Ala Ala Ala Ala Gly Gly Tyr
50 55 60

Gly Pro Gly Ser Gly Gln Gln Gly Pro Ser Gln Gln Gly Pro Gly Gln
65 70 75 80

Gln Gly Pro Gly Gly Gln Gly Pro Tyr Gly Pro Gly Ala Ser Ala Ala
85 90 95

```
Ala Ala Ala Ala Gly Gly Tyr Gly Pro Gly Ser Gly Gln Gln Gly Pro
            100                 105                 110

Gly Gly Gln Gly Pro Tyr Gly Pro Gly Ser Ser Ala Ala Ala Ala Ala
        115                 120                 125

Ala Gly Gly Asn Gly Pro Gly Ser Gly Gln Gln Gly Ala Gly Gln Gln
    130                 135                 140

Gly Pro Gly Gln Gln Gly Pro Gly Ala Ser Ala Ala Ala Ala Ala Ala
145                 150                 155                 160

Gly Gly Tyr Gly Pro Gly Ser Gly Gln Gln Gly Pro Gly Gln Gln Gly
                165                 170                 175

Pro Gly Gly Gln Gly Pro Tyr Gly Pro Gly Ala Ser Ala Ala Ala Ala
            180                 185                 190

Ala Ala Gly Gly Tyr Gly Pro Gly Ser Gly Gln Gly Pro Gly Gln Gln
        195                 200                 205

Gly Pro Gly Gly Gln Gly Pro Tyr Gly Pro Gly Ala Ser Ala Ala Ala
    210                 215                 220

Ala Ala Ala Gly Gly Tyr Gly Pro Gly Ser Gly Gln Gln Gly Pro Gly
225                 230                 235                 240

Gln Gln Gly Pro Gly Gln Gln Gly Pro Gly Gly Gln Gly Pro Tyr Gly
                245                 250                 255

Pro Gly Ala Ser Ala Ala Ala Ala Ala Ala Gly Gly Tyr Gly Pro Gly
            260                 265                 270

Tyr Gly Gln Gln Gly Pro Gly Gln Gln Gly Pro Gly Gly Gln Gly Pro
        275                 280                 285

Tyr Gly Pro Gly Ala Ser Ala Ala Ser Ala Ala Ser Gly Gly Tyr Gly
    290                 295                 300

Pro Gly Ser Gly Gln Gln Gly Pro Gly Gln Gln Gly Pro Gly Gly Gln
305                 310                 315                 320

Gly Pro Tyr Gly Pro Gly Ala Ser Ala Ala Ala Ala Ala Ala Gly Gly
                325                 330                 335

Tyr Gly Pro Gly Ser Gly Gln Gln Gly Pro Gly Gln Gln Gly Pro Gly
            340                 345                 350

Gln Gln Gly Pro Gly Gln Gln Gly Pro Gly Gly Gln Gly Pro Tyr Gly
        355                 360                 365

Pro Gly Ala Ser Ala Ala Ala Ala Ala Ala Gly Gly Tyr Gly Pro Gly
    370                 375                 380

Ser Gly Gln Gln Gly Pro Gly Gln Gln Gly Pro Gly Gln Gln Gly Pro
385                 390                 395                 400

Gly Gln Gln Gly Pro Gly Gln Gln Gly Pro Gly Gln Gln Gly Pro Gly
                405                 410                 415

Gln Gln Gly Pro Gly Gln Gln Gly Pro Gly Gln Gln Gly Pro Gly Gly
            420                 425                 430

Gln Gly Ala Tyr Gly Pro Gly Ala Ser Ala Ala Ala Gly Ala Ala Gly
        435                 440                 445

Gly Tyr Gly Pro Gly Ser Gly Gln Gln Gly Pro Gly Gln Gln Gly Pro
    450                 455                 460

Gly Gln Gln Gly Pro Gly Gln Gln Gly Pro Gly Gln Gln Gly Pro Gly
465                 470                 475                 480

Gln Gln Gly Pro Gly Gln Gln Gly Pro Gly Gln Gln Gly Pro Tyr Gly
                485                 490                 495

Pro Gly Ala Ser Ala Ala Ala Ala Ala Ala Gly Gly Tyr Gly Pro Gly
            500                 505                 510

Ser Gly Gln Gln Gly Pro Gly Gln Gln Gly Pro Gly Gln Gln Gly Pro
```

```
        515                 520                 525

Gly Gly Gln Gly Pro Tyr Gly Pro Gly Ala Ala Ser Ala Ala Val Ser
    530                 535                 540

Val Ser Arg Ala Arg Ala Gly Ser Gly Gln Gln Gly Pro Gly Gln Gln
545                 550                 555                 560

Gly Pro Gly Gln Gln Gly Pro Gly Gln Gln Gly Pro Tyr Gly Pro Gly
                565                 570                 575

Ala Ser Ala Ala Ala Ala Ala Ala Gly Gly Tyr Gly Pro Gly Ser Gly
            580                 585                 590

Gln Gln Gly Pro Ser Gln Gln Gly Pro Gly Gln Gln Gly Pro Gly Gly
        595                 600                 605

Gln Gly Pro Tyr Gly Pro Gly Ala Ser Ala Ala Ala Ala Ala Ala Gly
    610                 615                 620

Gly Tyr Gly Pro Gly Ser Gly Gln Gln Gly Pro Gly Gly Gln Gly Pro
625                 630                 635                 640

Tyr Gly Pro Gly Ser Ser Ala Ala Ala Ala Ala Ala Gly Gly Asn Gly
                645                 650                 655

Pro Gly Ser Gly Gln Gln Gly Ala Gly Gln Gln Gly Pro Gly Gln Gln
            660                 665                 670

Gly Pro Gly Ala Ser Ala Ala Ala Ala Ala Ala Gly Gly Tyr Gly Pro
        675                 680                 685

Gly Ser Gly Gln Gln Gly Pro Gly Gln Gln Gly Pro Gly Gly Gln Gly
    690                 695                 700

Pro Tyr Gly Pro Gly Ala Ser Ala Ala Ala Ala Ala Ala Gly Gly Tyr
705                 710                 715                 720

Gly Pro Gly Ser Gly Gln Gly Pro Gly Gln Gln Gly Pro Gly Gly Gln
                725                 730                 735

Gly Pro Tyr Gly Pro Gly Ala Ser Ala Ala Ala Ala Ala Ala Gly Gly
            740                 745                 750

Tyr Gly Pro Gly Ser Gly Gln Gln Gly Pro Gly Gln Gln Gly Pro Gly
        755                 760                 765

Gln Gln Gly Pro Gly Gly Gln Gly Pro Tyr Gly Pro Gly Ala Ser Ala
    770                 775                 780

Ala Ala Ala Ala Ala Gly Gly Tyr Gly Pro Gly Tyr Gly Gln Gln Gly
785                 790                 795                 800

Pro Gly Gln Gln Gly Pro Gly Gly Gln Gly Pro Tyr Gly Pro Gly Ala
                805                 810                 815

Ser Ala Ala Ser Ala Ala Ser Gly Gly Tyr Gly Pro Gly Ser Gly Gln
            820                 825                 830

Gln Gly Pro Gly Gln Gln Gly Pro Gly Gly Gln Gly Pro Tyr Gly Pro
        835                 840                 845

Gly Ala Ser Ala Ala Ala Ala Ala Ala Gly Gly Tyr Gly Pro Gly Ser
    850                 855                 860

Gly Gln Gln Gly Pro Gly Gln Gln Gly Pro Gly Gln Gln Gly Pro Gly
865                 870                 875                 880

Gln Gln Gly Pro Gly Gly Gln Gly Pro Tyr Gly Pro Gly Ala Ser Ala
                885                 890                 895

Ala Ala Ala Ala Ala Gly Gly Tyr Gly Pro Gly Ser Gly Gln Gln Gly
            900                 905                 910

Pro Gly Gln Gln Gly Pro Gly Gln Gln Gly Pro Gly Gln Gln Gly Pro
        915                 920                 925

Gly Gln Gln Gly Pro Gly Gln Gln Gly Pro Gly Gln Gln Gly Pro Gly
    930                 935                 940
```

```
Gln Gln Gly Pro Gly Gln Gln Gly Pro Gly Gly Gln Gly Ala Tyr Gly
945                 950                 955                 960

Pro Gly Ala Ser Ala Ala Ala Gly Ala Ala Gly Gly Tyr Gly Pro Gly
                965                 970                 975

Ser Gly Gln Gln Gly Pro Gly Gln Gln Gly Pro Gly Gln Gln Gly Pro
            980                 985                 990

Gly Gln Gln Gly Pro Gly Gln Gln  Gly Pro Gly Gln Gln  Gly Pro Gly
        995                 1000                1005

Gln Gln  Gly Pro Gly Gln Gln  Gly Pro Tyr Gly Pro  Gly Ala Ser
    1010                1015                1020

Ala Ala  Ala Ala Ala Ala Gly  Gly Tyr Gly Pro Gly  Ser Gly Gln
    1025                1030                1035

Gln Gly  Pro Gly Gln Gln Gly  Pro Gly Gln Gln Gly  Pro Gly Gly
    1040                1045                1050

Gln Gly  Pro Tyr Gly Pro Gly  Ala Ala Ser Ala Ala  Val Ser Val
    1055                1060                1065

Gly Gly  Tyr Gly Pro Gln Ser  Ser Ser Val Pro Val  Ala Ser Ala
    1070                1075                1080

Val Ala  Ser Arg Leu Ser Ser  Pro Ala Ala Ser Ser  Arg Val Ser
    1085                1090                1095

Ser Ala  Val Ser Ser Leu Val  Ser Ser Gly Pro Thr  Lys His Ala
    1100                1105                1110

Ala Leu  Ser Asn Thr Ile Ser  Ser Val Val Ser Gln  Val Ser Ala
    1115                1120                1125

Ser Asn  Pro Gly Leu Ser Gly  Cys Asp Val Leu Val  Gln Ala Leu
    1130                1135                1140

Leu Glu  Val Val Ser Ala Leu  Val Ser Ile Leu
    1145                1150


<210> SEQ ID NO 5
<211> LENGTH: 24
<212> TYPE: PRT
<213> ORGANISM: Artificial Sequence
<220> FEATURE:
<223> OTHER INFORMATION: His tag and start codon

<400> SEQUENCE: 5

Met His His His His His His His His His His Ser Ser Gly Ser Ser
1               5                   10                  15

Leu Glu Val Leu Phe Gln Gly Pro
            20


<210> SEQ ID NO 6
<211> LENGTH: 597
<212> TYPE: PRT
<213> ORGANISM: Artificial Sequence
<220> FEATURE:
<223> OTHER INFORMATION: Met-PRT380

<400> SEQUENCE: 6

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Ala Ala Ala Ala Ala Gly Gln Tyr Gly Pro Gly Gln Gln Gly
        35                  40                  45

Pro Gly Gln Gln Gly Pro Gly Ser Ser Ala Ala Ala Ala Ala Gly Pro
```

```
    50                  55                  60

Gly Gln Tyr Gly Pro Gly Gln Gln Gly Pro Ser Ala Ser Ala Ala Ala
65                  70                  75                  80

Ala Ala Gly Pro Gly Ser Gly Gln Gln Gly Pro Gly Ala Ser Ala Ala
                85                  90                  95

Ala Ala Ala Gly Gln Tyr Gly Pro Gly Gln Gln Gly Pro Gly Gln Gln
            100                 105                 110

Gly Pro Gly Ser Ser Ala Ala Ala Ala Ala Gly Gln Tyr Gly Ser Gly
        115                 120                 125

Pro Gly Gln Gln Gly Pro Tyr Gly Ser Ala Ala Ala Ala Ala Gly Pro
    130                 135                 140

Gly Ser Gly Gln Tyr Gly Gln Gly Pro Tyr Gly Pro Gly Ala Ser Ala
145                 150                 155                 160

Ala Ala Ala Ala Gly Pro Gly Gln Tyr Gly Pro Gly Gln Gln Gly Pro
                165                 170                 175

Ser Ala Ser Ala Ala Ala Ala Ala Gly Ser Gly Gln Gln Gly Pro Gly
            180                 185                 190

Gln Tyr Gly Pro Tyr Ala Ser Ala Ala Ala Ala Ala Gly Gln Tyr Gly
        195                 200                 205

Ser Gly Pro Gly Gln Gln Gly Pro Tyr Gly Pro Gly Gln Ser Ala Ala
    210                 215                 220

Ala Ala Ala Gly Ser Gly Gln Gln Gly Pro Gly Gln Gln Gly Pro Tyr
225                 230                 235                 240

Ala Ser Ala Ala Ala Ala Ala Gly Pro Gly Gln Gln Gly Pro Tyr Gly
                245                 250                 255

Pro Gly Ser Ser Ala Ala Ala Ala Ala Gly Gln Tyr Gly Tyr Gly Pro
            260                 265                 270

Gly Gln Gln Gly Pro Tyr Gly Pro Gly Ala Ser Ala Ala Ala Ala Ala
        275                 280                 285

Gly Gln Asn Gly Pro Gly Ser Gly Gln Tyr Gly Pro Gly Gln Gln Gly
    290                 295                 300

Pro Gly Gln Ser Ala Ala Ala Ala Ala Gly Pro Gly Gln Gln Gly Pro
305                 310                 315                 320

Tyr Gly Pro Gly Ala Ser Ala Ala Ala Ala Ala Gly Gln Tyr Gly Pro
                325                 330                 335

Gly Gln Gln Gly Pro Gly Gln Tyr Gly Pro Gly Ser Ser Ala Ala Ala
            340                 345                 350

Ala Ala Gly Pro Gly Gln Gln Gly Pro Tyr Gly Pro Gly Ser Ser Ala
        355                 360                 365

Ala Ala Ala Ala Gly Gln Tyr Gly Pro Gly Gln Gln Gly Pro Tyr Gly
    370                 375                 380

Pro Gly Gln Ser Ala Ala Ala Ala Ala Gly Gln Tyr Gln Gln Gly Pro
385                 390                 395                 400

Gly Gln Gln Gly Pro Tyr Gly Pro Gly Ala Ser Ala Ala Ala Ala Ala
                405                 410                 415

Gly Pro Gly Gln Gln Gly Pro Tyr Gly Pro Gly Ala Ser Ala Ala Ala
            420                 425                 430

Ala Ala Gly Pro Gly Gln Tyr Gly Pro Gly Gln Gln Gly Pro Ser Ala
        435                 440                 445

Ser Ala Ala Ala Ala Ala Gly Gln Tyr Gly Ser Gly Pro Gly Gln Tyr
    450                 455                 460

Gly Pro Tyr Gly Pro Gly Gln Ser Ala Ala Ala Ala Ala Gly Pro Gly
465                 470                 475                 480
```

```
Ser Gly Gln Gln Gly Gln Gly Pro Tyr Gly Pro Gly Ala Ser Ala Ala
                485                 490                 495

Ala Ala Ala Gly Gln Tyr Gly Pro Gly Gln Gln Gly Pro Tyr Gly Pro
            500                 505                 510

Gly Gln Ser Ala Ala Ala Ala Ala Gly Pro Gly Ser Gly Gln Tyr Gly
        515                 520                 525

Pro Gly Ala Ser Ala Ala Ala Ala Ala Gly Gln Asn Gly Pro Gly Ser
    530                 535                 540

Gly Gln Tyr Gly Pro Gly Gln Gln Gly Pro Gly Gln Ser Ala Ala Ala
545                 550                 555                 560

Ala Ala Gly Gln Tyr Gln Gln Gly Pro Gly Gln Gln Gly Pro Tyr Gly
                565                 570                 575

Pro Gly Ala Ser Ala Ala Ala Ala Ala Gly Pro Gly Ser Gly Gln Gln
            580                 585                 590

Gly Pro Gly Ala Ser
        595


<210> SEQ ID NO 7
<211> LENGTH: 590
<212> TYPE: PRT
<213> ORGANISM: Artificial Sequence
<220> FEATURE:
<223> OTHER INFORMATION: Met-PRT410

<400> SEQUENCE: 7

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Gly Gln Tyr Gly Pro Gly Gln Gln Gly Pro Gly Gln Gln Gly
        35                  40                  45

Pro Gly Ser Ser Ala Ala Ala Ala Ala Gly Pro Gly Gln Tyr Gly Pro
    50                  55                  60

Gly Gln Gln Gly Pro Ser Ala Ser Ala Ala Ala Ala Ala Gly Pro Gly
65                  70                  75                  80

Ser Gly Gln Gln Gly Pro Gly Ala Ser Gly Gln Tyr Gly Pro Gly Gln
                85                  90                  95

Gln Gly Pro Gly Gln Gln Gly Pro Gly Ser Ser Ala Ala Ala Ala Ala
            100                 105                 110

Gly Gln Tyr Gly Ser Gly Pro Gly Gln Gln Gly Pro Tyr Gly Ser Ala
        115                 120                 125

Ala Ala Ala Ala Gly Pro Gly Ser Gly Gln Tyr Gly Gln Gly Pro Tyr
    130                 135                 140

Gly Pro Gly Ala Ser Gly Pro Gly Gln Tyr Gly Pro Gly Gln Gln Gly
145                 150                 155                 160

Pro Ser Ala Ser Ala Ala Ala Ala Ala Gly Ser Gly Gln Gln Gly Pro
                165                 170                 175

Gly Gln Tyr Gly Pro Tyr Ala Ser Ala Ala Ala Ala Ala Gly Gln Tyr
            180                 185                 190

Gly Ser Gly Pro Gly Gln Gln Gly Pro Tyr Gly Pro Gly Gln Ser Gly
        195                 200                 205

Ser Gly Gln Gln Gly Pro Gly Gln Gln Gly Pro Tyr Ala Ser Ala Ala
    210                 215                 220

Ala Ala Ala Gly Pro Gly Gln Gln Gly Pro Tyr Gly Pro Gly Ser Ser
225                 230                 235                 240
```

```
Ala Ala Ala Ala Ala Gly Gln Tyr Gly Tyr Gly Pro Gly Gln Gln Gly
                245                 250                 255

Pro Tyr Gly Pro Gly Ala Ser Gly Gln Asn Gly Pro Gly Ser Gly Gln
            260                 265                 270

Tyr Gly Pro Gly Gln Gln Gly Pro Gly Gln Ser Ala Ala Ala Ala Ala
        275                 280                 285

Gly Pro Gly Gln Gln Gly Pro Tyr Gly Pro Gly Ala Ser Ala Ala Ala
    290                 295                 300

Ala Ala Gly Gln Tyr Gly Pro Gly Gln Gln Gly Pro Gly Gln Tyr Gly
305                 310                 315                 320

Pro Gly Ser Ser Gly Pro Gly Gln Gln Gly Pro Tyr Gly Pro Gly Ser
                325                 330                 335

Ser Ala Ala Ala Ala Ala Gly Gln Tyr Gly Pro Gly Gln Gln Gly Pro
            340                 345                 350

Tyr Gly Pro Gly Gln Ser Ala Ala Ala Ala Ala Gly Gln Tyr Gln Gln
        355                 360                 365

Gly Pro Gly Gln Gln Gly Pro Tyr Gly Pro Gly Ala Ser Gly Pro Gly
    370                 375                 380

Gln Gln Gly Pro Tyr Gly Pro Gly Ala Ser Ala Ala Ala Ala Ala Gly
385                 390                 395                 400

Pro Gly Gln Tyr Gly Pro Gly Gln Gln Gly Pro Ser Ala Ser Ala Ala
                405                 410                 415

Ala Ala Ala Gly Gln Tyr Gly Ser Gly Pro Gly Gln Tyr Gly Pro Tyr
            420                 425                 430

Gly Pro Gly Gln Ser Gly Pro Gly Ser Gly Gln Gln Gly Gln Gly Pro
        435                 440                 445

Tyr Gly Pro Gly Ala Ser Ala Ala Ala Ala Ala Gly Gln Tyr Gly Pro
    450                 455                 460

Gly Gln Gln Gly Pro Tyr Gly Pro Gly Gln Ser Ala Ala Ala Ala Ala
465                 470                 475                 480

Gly Pro Gly Ser Gly Gln Tyr Gly Pro Gly Ala Ser Gly Gln Asn Gly
                485                 490                 495

Pro Gly Ser Gly Gln Tyr Gly Pro Gly Gln Gln Gly Pro Gly Gln Ser
            500                 505                 510

Ala Ala Ala Ala Ala Gly Gln Tyr Gln Gln Gly Pro Gly Gln Gln Gly
        515                 520                 525

Pro Tyr Gly Pro Gly Ala Ser Ala Ala Ala Ala Ala Gly Gln Tyr Gly
    530                 535                 540

Ser Gly Pro Gly Gln Gln Gly Pro Tyr Gly Pro Gly Gln Ser Gly Ser
545                 550                 555                 560

Gly Gln Gln Gly Pro Gly Gln Gln Gly Pro Tyr Ala Ser Ala Ala Ala
                565                 570                 575

Ala Ala Gly Pro Gly Ser Gly Gln Gln Gly Pro Gly Ala Ser
            580                 585                 590


<210> SEQ ID NO 8
<211> LENGTH: 565
<212> TYPE: PRT
<213> ORGANISM: Artificial Sequence
<220> FEATURE:
<223> OTHER INFORMATION: Met-PRT525

<400> SEQUENCE: 8

Met Gly Pro Gly Gln Gln Gly Pro Tyr Gly Pro Gly Ala Ser Ala Ala
1               5                   10                  15
```

```
Ala Ala Ala Ala Ala Gly Ser Asn Gly Pro Gly Ser Gly Gln Gln Gly
            20                  25                  30

Pro Gly Gln Ser Gly Gln Tyr Gly Pro Gly Gln Gln Gly Pro Gly Gln
        35                  40                  45

Gln Gly Pro Gly Ser Ser Ala Ala Ala Ala Ala Ala Ala Gly Pro Gly
    50                  55                  60

Gln Tyr Gly Pro Gly Gln Gln Gly Pro Ser Ala Ser Ala Ala Ala Ala
65                  70                  75                  80

Ala Ala Ala Gly Pro Gly Ser Gly Gln Gln Gly Pro Gly Ala Ser Gly
                85                  90                  95

Gln Tyr Gly Pro Gly Gln Gln Gly Pro Gly Gln Gln Gly Pro Gly Ser
            100                 105                 110

Ser Ala Ala Ala Ala Ala Ala Ala Gly Ser Tyr Gly Ser Gly Pro Gly
        115                 120                 125

Gln Gln Gly Pro Tyr Gly Ser Ala Ala Ala Ala Ala Ala Ala Gly Pro
    130                 135                 140

Gly Ser Gly Gln Tyr Gly Gln Gly Pro Tyr Gly Pro Gly Ala Ser Gly
145                 150                 155                 160

Pro Gly Gln Tyr Gly Pro Gly Gln Gln Gly Pro Ser Ala Ser Ala Ala
                165                 170                 175

Ala Ala Ala Ala Ala Gly Ser Gly Gln Gln Gly Pro Gly Gln Tyr Gly
            180                 185                 190

Pro Tyr Ala Ser Ala Ala Ala Ala Ala Ala Ala Gly Ser Tyr Gly Ser
        195                 200                 205

Gly Pro Gly Gln Gln Gly Pro Tyr Gly Pro Gly Gln Ser Gly Ser Gly
    210                 215                 220

Gln Gln Gly Pro Gly Gln Gln Gly Pro Tyr Ala Ser Ala Ala Ala Ala
225                 230                 235                 240

Ala Ala Ala Gly Pro Gly Gln Gln Gly Pro Tyr Gly Pro Gly Ser Ser
                245                 250                 255

Ala Ala Ala Ala Ala Ala Ala Gly Ser Tyr Gly Tyr Gly Pro Gly Gln
            260                 265                 270

Gln Gly Pro Tyr Gly Pro Gly Ala Ser Gly Gln Asn Gly Pro Gly Ser
        275                 280                 285

Gly Gln Tyr Gly Pro Gly Gln Gln Gly Pro Gly Pro Ser Ala Ala Ala
    290                 295                 300

Ala Ala Ala Ala Gly Pro Gly Gln Gln Gly Pro Tyr Gly Pro Gly Ala
305                 310                 315                 320

Ser Ala Ala Ala Ala Ala Ala Ala Gly Ser Tyr Gly Pro Gly Gln Gln
                325                 330                 335

Gly Pro Gly Gln Tyr Gly Pro Gly Ser Ser Gly Pro Gly Gln Gln Gly
            340                 345                 350

Pro Tyr Gly Pro Gly Ser Ser Ala Ala Ala Ala Ala Ala Ala Gly Ser
        355                 360                 365

Tyr Gly Pro Gly Gln Gln Gly Pro Tyr Gly Pro Gly Pro Ser Ala Ala
    370                 375                 380

Ala Ala Ala Ala Ala Gly Ser Tyr Gln Gln Gly Pro Gly Gln Gln Gly
385                 390                 395                 400

Pro Tyr Gly Pro Gly Ala Ser Gly Pro Gly Gln Gln Gly Pro Tyr Gly
                405                 410                 415

Pro Gly Ala Ser Ala Ala Ala Ala Ala Ala Ala Gly Pro Gly Gln Tyr
            420                 425                 430
```

```
Gly Pro Gly Gln Gln Gly Pro Ser Ala Ser Ala Ala Ala Ala Ala Ala
        435                 440                 445

Ala Gly Ser Tyr Gly Ser Gly Pro Gly Gln Tyr Gly Pro Tyr Gly Pro
    450                 455                 460

Gly Gln Ser Gly Pro Gly Ser Gly Gln Gln Gly Gln Gly Pro Tyr Gly
465                 470                 475                 480

Pro Gly Ala Ser Ala Ala Ala Ala Ala Ala Ala Gly Ser Tyr Gly Pro
                485                 490                 495

Gly Gln Gln Gly Pro Tyr Gly Pro Gly Pro Ser Ala Ala Ala Ala Ala
            500                 505                 510

Ala Ala Gly Pro Gly Ser Gly Gln Tyr Gly Pro Gly Ala Ser Gly Gln
        515                 520                 525

Asn Gly Pro Gly Ser Gly Gln Tyr Gly Pro Gly Gln Gln Gly Pro Gly
    530                 535                 540

Pro Ser Ala Ala Ala Ala Ala Ala Ala Gly Pro Gly Ser Gly Gln Gln
545                 550                 555                 560

Gly Pro Gly Ala Ser
                565


<210> SEQ ID NO 9
<211> LENGTH: 2364
<212> TYPE: PRT
<213> ORGANISM: Artificial Sequence
<220> FEATURE:
<223> OTHER INFORMATION: Met-PRT799

<400> SEQUENCE: 9

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Gly Gln Tyr Gly Pro Gly Gln Gln Gly Pro Gly Gln Gln Gly
        35                  40                  45

Pro Gly Ser Ser Ala Ala Ala Ala Ala Gly Pro Gly Gln Tyr Gly Pro
    50                  55                  60

Gly Gln Gln Gly Pro Ser Ala Ser Ala Ala Ala Ala Ala Gly Pro Gly
65                  70                  75                  80

Ser Gly Gln Gln Gly Pro Gly Ala Ser Gly Gln Tyr Gly Pro Gly Gln
                85                  90                  95

Gln Gly Pro Gly Gln Gln Gly Pro Gly Ser Ser Ala Ala Ala Ala Ala
            100                 105                 110

Gly Gln Tyr Gly Ser Gly Pro Gly Gln Gln Gly Pro Tyr Gly Ser Ala
        115                 120                 125

Ala Ala Ala Ala Gly Pro Gly Ser Gly Gln Tyr Gly Gln Gly Pro Tyr
    130                 135                 140

Gly Pro Gly Ala Ser Gly Pro Gly Gln Tyr Gly Pro Gly Gln Gln Gly
145                 150                 155                 160

Pro Ser Ala Ser Ala Ala Ala Ala Ala Gly Ser Gly Gln Gln Gly Pro
                165                 170                 175

Gly Gln Tyr Gly Pro Tyr Ala Ser Ala Ala Ala Ala Ala Gly Gln Tyr
            180                 185                 190

Gly Ser Gly Pro Gly Gln Gln Gly Pro Tyr Gly Pro Gly Gln Ser Gly
        195                 200                 205

Ser Gly Gln Gln Gly Pro Gly Gln Gln Gly Pro Tyr Ala Ser Ala Ala
    210                 215                 220
```

```
Ala Ala Ala Gly Pro Gly Gln Gln Gly Pro Tyr Gly Pro Gly Ser Ser
225                 230                 235                 240

Ala Ala Ala Ala Ala Gly Gln Tyr Gly Tyr Gly Pro Gly Gln Gln Gly
                245                 250                 255

Pro Tyr Gly Pro Gly Ala Ser Gly Gln Asn Gly Pro Gly Ser Gly Gln
            260                 265                 270

Tyr Gly Pro Gly Gln Gln Gly Pro Gly Gln Ser Ala Ala Ala Ala Ala
        275                 280                 285

Gly Pro Gly Gln Gln Gly Pro Tyr Gly Pro Gly Ala Ser Ala Ala Ala
    290                 295                 300

Ala Ala Gly Gln Tyr Gly Pro Gly Gln Gln Gly Pro Gly Gln Tyr Gly
305                 310                 315                 320

Pro Gly Ser Ser Gly Pro Gly Gln Gln Gly Pro Tyr Gly Pro Gly Ser
                325                 330                 335

Ser Ala Ala Ala Ala Ala Gly Gln Tyr Gly Pro Gly Gln Gln Gly Pro
            340                 345                 350

Tyr Gly Pro Gly Gln Ser Ala Ala Ala Ala Ala Gly Gln Tyr Gln Gln
        355                 360                 365

Gly Pro Gly Gln Gln Gly Pro Tyr Gly Pro Gly Ala Ser Gly Pro Gly
    370                 375                 380

Gln Gln Gly Pro Tyr Gly Pro Gly Ala Ser Ala Ala Ala Ala Ala Gly
385                 390                 395                 400

Pro Gly Gln Tyr Gly Pro Gly Gln Gln Gly Pro Ser Ala Ser Ala Ala
                405                 410                 415

Ala Ala Ala Gly Gln Tyr Gly Ser Gly Pro Gly Gln Tyr Gly Pro Tyr
            420                 425                 430

Gly Pro Gly Gln Ser Gly Pro Gly Ser Gly Gln Gln Gly Gln Gly Pro
        435                 440                 445

Tyr Gly Pro Gly Ala Ser Ala Ala Ala Ala Ala Gly Gln Tyr Gly Pro
    450                 455                 460

Gly Gln Gln Gly Pro Tyr Gly Pro Gly Gln Ser Ala Ala Ala Ala Ala
465                 470                 475                 480

Gly Pro Gly Ser Gly Gln Tyr Gly Pro Gly Ala Ser Gly Gln Asn Gly
                485                 490                 495

Pro Gly Ser Gly Gln Tyr Gly Pro Gly Gln Gln Gly Pro Gly Gln Ser
            500                 505                 510

Ala Ala Ala Ala Ala Gly Gln Tyr Gln Gln Gly Pro Gly Gln Gln Gly
        515                 520                 525

Pro Tyr Gly Pro Gly Ala Ser Ala Ala Ala Ala Ala Gly Gln Tyr Gly
    530                 535                 540

Ser Gly Pro Gly Gln Gln Gly Pro Tyr Gly Pro Gly Gln Ser Gly Ser
545                 550                 555                 560

Gly Gln Gln Gly Pro Gly Gln Gln Gly Pro Tyr Ala Ser Ala Ala Ala
                565                 570                 575

Ala Ala Gly Pro Gly Ser Gly Gln Gln Gly Pro Gly Ala Ser Gly Gln
            580                 585                 590

Gln Gly Pro Tyr Gly Pro Gly Ala Ser Ala Ala Ala Ala Ala Gly Gln
        595                 600                 605

Asn Gly Pro Gly Ser Gly Gln Gln Gly Pro Gly Gln Ser Gly Gln Tyr
    610                 615                 620

Gly Pro Gly Gln Gln Gly Pro Gly Gln Gln Gly Pro Gly Ser Ser Ala
625                 630                 635                 640

Ala Ala Ala Ala Gly Pro Gly Gln Tyr Gly Pro Gly Gln Gln Gly Pro
```

```
                645                 650                 655

Ser Ala Ser Ala Ala Ala Ala Ala Gly Pro Gly Ser Gly Gln Gln Gly
            660                 665                 670

Pro Gly Ala Ser Gly Gln Tyr Gly Pro Gly Gln Gln Gly Pro Gly Gln
        675                 680                 685

Gln Gly Pro Gly Ser Ser Ala Ala Ala Ala Ala Gly Gln Tyr Gly Ser
    690                 695                 700

Gly Pro Gly Gln Gln Gly Pro Tyr Gly Ser Ala Ala Ala Ala Ala Gly
705                 710                 715                 720

Pro Gly Ser Gly Gln Tyr Gly Gln Gly Pro Tyr Gly Pro Gly Ala Ser
                725                 730                 735

Gly Pro Gly Gln Tyr Gly Pro Gly Gln Gln Gly Pro Ser Ala Ser Ala
            740                 745                 750

Ala Ala Ala Ala Gly Ser Gly Gln Gln Gly Pro Gly Gln Tyr Gly Pro
        755                 760                 765

Tyr Ala Ser Ala Ala Ala Ala Ala Gly Gln Tyr Gly Ser Gly Pro Gly
    770                 775                 780

Gln Gln Gly Pro Tyr Gly Pro Gly Gln Ser Gly Ser Gly Gln Gln Gly
785                 790                 795                 800

Pro Gly Gln Gln Gly Pro Tyr Ala Ser Ala Ala Ala Ala Ala Gly Pro
                805                 810                 815

Gly Gln Gln Gly Pro Tyr Gly Pro Gly Ser Ser Ala Ala Ala Ala Ala
            820                 825                 830

Gly Gln Tyr Gly Tyr Gly Pro Gly Gln Gln Gly Pro Tyr Gly Pro Gly
        835                 840                 845

Ala Ser Gly Gln Asn Gly Pro Gly Ser Gly Gln Tyr Gly Pro Gly Gln
    850                 855                 860

Gln Gly Pro Gly Gln Ser Ala Ala Ala Ala Ala Gly Pro Gly Gln Gln
865                 870                 875                 880

Gly Pro Tyr Gly Pro Gly Ala Ser Ala Ala Ala Ala Ala Gly Gln Tyr
                885                 890                 895

Gly Pro Gly Gln Gln Gly Pro Gly Gln Tyr Gly Pro Gly Ser Ser Gly
            900                 905                 910

Pro Gly Gln Gln Gly Pro Tyr Gly Pro Gly Ser Ser Ala Ala Ala Ala
        915                 920                 925

Ala Gly Gln Tyr Gly Pro Gly Gln Gln Gly Pro Tyr Gly Pro Gly Gln
    930                 935                 940

Ser Ala Ala Ala Ala Ala Gly Gln Tyr Gln Gln Gly Pro Gly Gln Gln
945                 950                 955                 960

Gly Pro Tyr Gly Pro Gly Ala Ser Gly Pro Gly Gln Gln Gly Pro Tyr
                965                 970                 975

Gly Pro Gly Ala Ser Ala Ala Ala Ala Ala Gly Pro Gly Gln Tyr Gly
            980                 985                 990

Pro Gly Gln Gln Gly Pro Ser Ala  Ser Ala Ala Ala Ala  Ala Gly Gln
        995                 1000                1005

Tyr Gly  Ser Gly Pro Gly Gln  Tyr Gly Pro Tyr Gly  Pro Gly Gln
    1010                1015                1020

Ser Gly  Pro Gly Ser Gly Gln  Gln Gly Gln Gly Pro  Tyr Gly Pro
    1025                1030                1035

Gly Ala  Ser Ala Ala Ala Ala  Ala Gly Gln Tyr Gly  Pro Gly Gln
    1040                1045                1050

Gln Gly  Pro Tyr Gly Pro Gly  Gln Ser Ala Ala Ala  Ala Ala Gly
    1055                1060                1065
```

```
Pro Gly  Ser Gly Gln Tyr Gly  Pro Gly Ala Ser Gly  Gln Asn Gly
    1070                 1075                 1080

Pro Gly  Ser Gly Gln Tyr Gly  Pro Gly Gln Gln Gly  Pro Gly Gln
    1085                 1090                 1095

Ser Ala  Ala Ala Ala Ala Gly  Gln Tyr Gln Gln Gly  Pro Gly Gln
    1100                 1105                 1110

Gln Gly  Pro Tyr Gly Pro Gly  Ala Ser Ala Ala Ala  Ala Ala Gly
    1115                 1120                 1125

Gln Tyr  Gly Ser Gly Pro Gly  Gln Gln Gly Pro Tyr  Gly Pro Gly
    1130                 1135                 1140

Gln Ser  Gly Ser Gly Gln Gln  Gly Pro Gly Gln Gln  Gly Pro Tyr
    1145                 1150                 1155

Ala Ser  Ala Ala Ala Ala Ala  Gly Pro Gly Ser Gly  Gln Gln Gly
    1160                 1165                 1170

Pro Gly  Ala Ser Gly Gln Gln  Gly Pro Tyr Gly Pro  Gly Ala Ser
    1175                 1180                 1185

Ala Ala  Ala Ala Ala Gly Gln  Asn Gly Pro Gly Ser  Gly Gln Gln
    1190                 1195                 1200

Gly Pro  Gly Gln Ser Gly Gln  Tyr Gly Pro Gly Gln  Gln Gly Pro
    1205                 1210                 1215

Gly Gln  Gln Gly Pro Gly Ser  Ser Ala Ala Ala Ala  Ala Gly Pro
    1220                 1225                 1230

Gly Gln  Tyr Gly Pro Gly Gln  Gln Gly Pro Ser Ala  Ser Ala Ala
    1235                 1240                 1245

Ala Ala  Ala Gly Pro Gly Ser  Gly Gln Gln Gly Pro  Gly Ala Ser
    1250                 1255                 1260

Gly Gln  Tyr Gly Pro Gly Gln  Gln Gly Pro Gly Gln  Gln Gly Pro
    1265                 1270                 1275

Gly Ser  Ser Ala Ala Ala Ala  Ala Gly Gln Tyr Gly  Ser Gly Pro
    1280                 1285                 1290

Gly Gln  Gln Gly Pro Tyr Gly  Ser Ala Ala Ala Ala  Ala Gly Pro
    1295                 1300                 1305

Gly Ser  Gly Gln Tyr Gly Gln  Gly Pro Tyr Gly Pro  Gly Ala Ser
    1310                 1315                 1320

Gly Pro  Gly Gln Tyr Gly Pro  Gly Gln Gln Gly Pro  Ser Ala Ser
    1325                 1330                 1335

Ala Ala  Ala Ala Ala Gly Ser  Gly Gln Gln Gly Pro  Gly Gln Tyr
    1340                 1345                 1350

Gly Pro  Tyr Ala Ser Ala Ala  Ala Ala Ala Gly Gln  Tyr Gly Ser
    1355                 1360                 1365

Gly Pro  Gly Gln Gln Gly Pro  Tyr Gly Pro Gly Gln  Ser Gly Ser
    1370                 1375                 1380

Gly Gln  Gln Gly Pro Gly Gln  Gln Gly Pro Tyr Ala  Ser Ala Ala
    1385                 1390                 1395

Ala Ala  Ala Gly Pro Gly Gln  Gln Gly Pro Tyr Gly  Pro Gly Ser
    1400                 1405                 1410

Ser Ala  Ala Ala Ala Ala Gly  Gln Tyr Gly Tyr Gly  Pro Gly Gln
    1415                 1420                 1425

Gln Gly  Pro Tyr Gly Pro Gly  Ala Ser Gly Gln Asn  Gly Pro Gly
    1430                 1435                 1440

Ser Gly  Gln Tyr Gly Pro Gly  Gln Gln Gly Pro Gly  Gln Ser Ala
    1445                 1450                 1455
```

```
Ala Ala  Ala Ala Gly Pro Gly  Gln Gln Gly Pro Tyr  Gly Pro Gly
    1460                 1465                 1470

Ala Ser  Ala Ala Ala Ala Ala  Gly Gln Tyr Gly Pro  Gly Gln Gln
    1475                 1480                 1485

Gly Pro  Gly Gln Tyr Gly Pro  Gly Ser Ser Gly Pro  Gly Gln Gln
    1490                 1495                 1500

Gly Pro  Tyr Gly Pro Gly Ser  Ser Ala Ala Ala Ala  Ala Gly Gln
    1505                 1510                 1515

Tyr Gly  Pro Gly Gln Gln Gly  Pro Tyr Gly Pro Gly  Gln Ser Ala
    1520                 1525                 1530

Ala Ala  Ala Ala Gly Gln Tyr  Gln Gln Gly Pro Gly  Gln Gln Gly
    1535                 1540                 1545

Pro Tyr  Gly Pro Gly Ala Ser  Gly Pro Gly Gln Gln  Gly Pro Tyr
    1550                 1555                 1560

Gly Pro  Gly Ala Ser Ala Ala  Ala Ala Ala Gly Pro  Gly Gln Tyr
    1565                 1570                 1575

Gly Pro  Gly Gln Gln Gly Pro  Ser Ala Ser Ala Ala  Ala Ala Ala
    1580                 1585                 1590

Gly Gln  Tyr Gly Ser Gly Pro  Gly Gln Tyr Gly Pro  Tyr Gly Pro
    1595                 1600                 1605

Gly Gln  Ser Gly Pro Gly Ser  Gly Gln Gln Gly Gln  Gly Pro Tyr
    1610                 1615                 1620

Gly Pro  Gly Ala Ser Ala Ala  Ala Ala Ala Gly Gln  Tyr Gly Pro
    1625                 1630                 1635

Gly Gln  Gln Gly Pro Tyr Gly  Pro Gly Gln Ser Ala  Ala Ala Ala
    1640                 1645                 1650

Ala Gly  Pro Gly Ser Gly Gln  Tyr Gly Pro Gly Ala  Ser Gly Gln
    1655                 1660                 1665

Asn Gly  Pro Gly Ser Gly Gln  Tyr Gly Pro Gly Gln  Gln Gly Pro
    1670                 1675                 1680

Gly Gln  Ser Ala Ala Ala Ala  Ala Gly Gln Tyr Gln  Gln Gly Pro
    1685                 1690                 1695

Gly Gln  Gln Gly Pro Tyr Gly  Pro Gly Ala Ser Ala  Ala Ala Ala
    1700                 1705                 1710

Ala Gly  Gln Tyr Gly Ser Gly  Pro Gly Gln Gln Gly  Pro Tyr Gly
    1715                 1720                 1725

Pro Gly  Gln Ser Gly Ser Gly  Gln Gln Gly Pro Gly  Gln Gln Gly
    1730                 1735                 1740

Pro Tyr  Ala Ser Ala Ala Ala  Ala Ala Gly Pro Gly  Ser Gly Gln
    1745                 1750                 1755

Gln Gly  Pro Gly Ala Ser Gly  Gln Gln Gly Pro Tyr  Gly Pro Gly
    1760                 1765                 1770

Ala Ser  Ala Ala Ala Ala Ala  Gly Gln Asn Gly Pro  Gly Ser Gly
    1775                 1780                 1785

Gln Gln  Gly Pro Gly Gln Ser  Gly Gln Tyr Gly Pro  Gly Gln Gln
    1790                 1795                 1800

Gly Pro  Gly Gln Gln Gly Pro  Gly Ser Ser Ala Ala  Ala Ala Ala
    1805                 1810                 1815

Gly Pro  Gly Gln Tyr Gly Pro  Gly Gln Gln Gly Pro  Ser Ala Ser
    1820                 1825                 1830

Ala Ala  Ala Ala Ala Gly Pro  Gly Ser Gly Gln Gln  Gly Pro Gly
    1835                 1840                 1845

Ala Ser  Gly Gln Tyr Gly Pro  Gly Gln Gln Gly Pro  Gly Gln Gln
```

```
    1850                1855                1860

Gly Pro  Gly Ser Ser Ala Ala  Ala Ala Ala Gly Gln  Tyr Gly Ser
    1865                1870                1875

Gly Pro  Gly Gln Gln Gly Pro  Tyr Gly Ser Ala Ala  Ala Ala Ala
    1880                1885                1890

Gly Pro  Gly Ser Gly Gln Tyr  Gly Gln Gly Pro Tyr  Gly Pro Gly
    1895                1900                1905

Ala Ser  Gly Pro Gly Gln Tyr  Gly Pro Gly Gln Gln  Gly Pro Ser
    1910                1915                1920

Ala Ser  Ala Ala Ala Ala Ala  Gly Ser Gly Gln Gln  Gly Pro Gly
    1925                1930                1935

Gln Tyr  Gly Pro Tyr Ala Ser  Ala Ala Ala Ala Ala  Gly Gln Tyr
    1940                1945                1950

Gly Ser  Gly Pro Gly Gln Gln  Gly Pro Tyr Gly Pro  Gly Gln Ser
    1955                1960                1965

Gly Ser  Gly Gln Gln Gly Pro  Gly Gln Gln Gly Pro  Tyr Ala Ser
    1970                1975                1980

Ala Ala  Ala Ala Ala Gly Pro  Gly Gln Gln Gly Pro  Tyr Gly Pro
    1985                1990                1995

Gly Ser  Ser Ala Ala Ala Ala  Ala Gly Gln Tyr Gly  Tyr Gly Pro
    2000                2005                2010

Gly Gln  Gln Gly Pro Tyr Gly  Pro Gly Ala Ser Gly  Gln Asn Gly
    2015                2020                2025

Pro Gly  Ser Gly Gln Tyr Gly  Pro Gly Gln Gln Gly  Pro Gly Gln
    2030                2035                2040

Ser Ala  Ala Ala Ala Ala Gly  Pro Gly Gln Gln Gly  Pro Tyr Gly
    2045                2050                2055

Pro Gly  Ala Ser Ala Ala Ala  Ala Ala Gly Gln Tyr  Gly Pro Gly
    2060                2065                2070

Gln Gln  Gly Pro Gly Gln Tyr  Gly Pro Gly Ser Ser  Gly Pro Gly
    2075                2080                2085

Gln Gln  Gly Pro Tyr Gly Pro  Gly Ser Ser Ala Ala  Ala Ala Ala
    2090                2095                2100

Gly Gln  Tyr Gly Pro Gly Gln  Gln Gly Pro Tyr Gly  Pro Gly Gln
    2105                2110                2115

Ser Ala  Ala Ala Ala Ala Gly  Gln Tyr Gln Gln Gly  Pro Gly Gln
    2120                2125                2130

Gln Gly  Pro Tyr Gly Pro Gly  Ala Ser Gly Pro Gly  Gln Gln Gly
    2135                2140                2145

Pro Tyr  Gly Pro Gly Ala Ser  Ala Ala Ala Ala Ala  Gly Pro Gly
    2150                2155                2160

Gln Tyr  Gly Pro Gly Gln Gln  Gly Pro Ser Ala Ser  Ala Ala Ala
    2165                2170                2175

Ala Ala  Gly Gln Tyr Gly Ser  Gly Pro Gly Gln Tyr  Gly Pro Tyr
    2180                2185                2190

Gly Pro  Gly Gln Ser Gly Pro  Gly Ser Gly Gln Gln  Gly Gln Gly
    2195                2200                2205

Pro Tyr  Gly Pro Gly Ala Ser  Ala Ala Ala Ala Ala  Gly Gln Tyr
    2210                2215                2220

Gly Pro  Gly Gln Gln Gly Pro  Tyr Gly Pro Gly Gln  Ser Ala Ala
    2225                2230                2235

Ala Ala  Ala Gly Pro Gly Ser  Gly Gln Tyr Gly Pro  Gly Ala Ser
    2240                2245                2250
```

```
Gly Gln  Asn Gly Pro Gly Ser  Gly Gln Tyr Gly Pro  Gly Gln Gln
    2255                 2260                 2265

Gly Pro  Gly Gln Ser Ala Ala  Ala Ala Ala Gly Gln  Tyr Gln Gln
    2270                 2275                 2280

Gly Pro  Gly Gln Gln Gly Pro  Tyr Gly Pro Gly Ala  Ser Ala Ala
    2285                 2290                 2295

Ala Ala  Ala Gly Gln Tyr Gly  Ser Gly Pro Gly Gln  Gln Gly Pro
    2300                 2305                 2310

Tyr Gly  Pro Gly Gln Ser Gly  Ser Gly Gln Gln Gly  Pro Gly Gln
    2315                 2320                 2325

Gln Gly  Pro Tyr Ala Ser Ala  Ala Ala Ala Ala Gly  Pro Gly Ser
    2330                 2335                 2340

Gly Gln  Gln Gly Ser Ser Val  Asp Lys Leu Ala Ala  Ala Leu Glu
    2345                 2350                 2355

His His  His His His His
    2360


<210> SEQ ID NO 10
<211> LENGTH: 597
<212> TYPE: PRT
<213> ORGANISM: Artificial Sequence
<220> FEATURE:
<223> OTHER INFORMATION: Met-PRT313

<400> SEQUENCE: 10

Met Gly Pro Gly Gly Gln Gly Pro Tyr Gly Pro Gly Ala Ser Ala Ala
1               5                   10                  15

Ala Ala Ala Gly Gly Asn Gly Pro Gly Ser Gly Gln Gln Gly Pro Gly
            20                  25                  30

Gly Ser Ala Ala Ala Ala Ala Gly Gly Tyr Gly Pro Gly Gly Gln Gly
        35                  40                  45

Pro Gly Gln Gln Gly Pro Gly Ser Ser Ala Ala Ala Ala Ala Gly Pro
    50                  55                  60

Gly Gly Tyr Gly Pro Gly Gly Gln Gly Pro Ser Ala Ser Ala Ala Ala
65                  70                  75                  80

Ala Ala Gly Pro Gly Ser Gly Gln Gln Gly Pro Gly Ala Ser Ala Ala
                85                  90                  95

Ala Ala Ala Gly Gly Tyr Gly Pro Gly Gly Gln Gly Pro Gly Gln Gln
            100                 105                 110

Gly Pro Gly Ser Ser Ala Ala Ala Ala Ala Gly Gly Tyr Gly Ser Gly
        115                 120                 125

Pro Gly Gln Gln Gly Pro Tyr Gly Ser Ala Ala Ala Ala Ala Gly Pro
    130                 135                 140

Gly Ser Gly Gly Tyr Gly Gln Gly Pro Tyr Gly Pro Gly Ala Ser Ala
145                 150                 155                 160

Ala Ala Ala Ala Gly Pro Gly Gly Tyr Gly Pro Gly Gly Gln Gly Pro
                165                 170                 175

Ser Ala Ser Ala Ala Ala Ala Ala Gly Ser Gly Gln Gln Gly Pro Gly
            180                 185                 190

Gly Tyr Gly Pro Tyr Ala Ser Ala Ala Ala Ala Ala Gly Gly Tyr Gly
        195                 200                 205

Ser Gly Pro Gly Gln Gln Gly Pro Tyr Gly Pro Gly Gly Ser Ala Ala
    210                 215                 220

Ala Ala Ala Gly Ser Gly Gln Gln Gly Pro Gly Gln Gln Gly Pro Tyr
225                 230                 235                 240
```

```
Ala Ser Ala Ala Ala Ala Ala Gly Pro Gly Gly Gln Gly Pro Tyr Gly
                245                 250                 255

Pro Gly Ser Ser Ala Ala Ala Ala Ala Gly Gly Tyr Gly Tyr Gly Pro
            260                 265                 270

Gly Gly Gln Gly Pro Tyr Gly Pro Gly Ala Ser Ala Ala Ala Ala Ala
        275                 280                 285

Gly Gly Asn Gly Pro Gly Ser Gly Gly Tyr Gly Pro Gly Gln Gln Gly
    290                 295                 300

Pro Gly Gly Ser Ala Ala Ala Ala Ala Gly Pro Gly Gly Gln Gly Pro
305                 310                 315                 320

Tyr Gly Pro Gly Ala Ser Ala Ala Ala Ala Ala Gly Gly Tyr Gly Pro
                325                 330                 335

Gly Gly Gln Gly Pro Gly Gly Tyr Gly Pro Gly Ser Ser Ala Ala Ala
            340                 345                 350

Ala Ala Gly Pro Gly Gly Gln Gly Pro Tyr Gly Pro Gly Ser Ser Ala
        355                 360                 365

Ala Ala Ala Ala Gly Gly Tyr Gly Pro Gly Gln Gln Gly Pro Tyr Gly
    370                 375                 380

Pro Gly Gly Ser Ala Ala Ala Ala Ala Gly Gly Tyr Gln Gln Gly Pro
385                 390                 395                 400

Gly Gly Gln Gly Pro Tyr Gly Pro Gly Ala Ser Ala Ala Ala Ala Ala
                405                 410                 415

Gly Pro Gly Gly Gln Gly Pro Tyr Gly Pro Gly Ala Ser Ala Ala Ala
            420                 425                 430

Ala Ala Gly Pro Gly Gly Tyr Gly Pro Gly Gly Gln Gly Pro Ser Ala
        435                 440                 445

Ser Ala Ala Ala Ala Ala Gly Gly Tyr Gly Ser Gly Pro Gly Gly Tyr
    450                 455                 460

Gly Pro Tyr Gly Pro Gly Gly Ser Ala Ala Ala Ala Ala Gly Pro Gly
465                 470                 475                 480

Ser Gly Gln Gln Gly Gln Gly Pro Tyr Gly Pro Gly Ala Ser Ala Ala
                485                 490                 495

Ala Ala Ala Gly Gly Tyr Gly Pro Gly Gln Gln Gly Pro Tyr Gly Pro
            500                 505                 510

Gly Gly Ser Ala Ala Ala Ala Ala Gly Pro Gly Ser Gly Gly Tyr Gly
        515                 520                 525

Pro Gly Ala Ser Ala Ala Ala Ala Ala Gly Gly Asn Gly Pro Gly Ser
    530                 535                 540

Gly Gly Tyr Gly Pro Gly Gln Gln Gly Pro Gly Gly Ser Ala Ala Ala
545                 550                 555                 560

Ala Ala Gly Gly Tyr Gln Gln Gly Pro Gly Gly Gln Gly Pro Tyr Gly
                565                 570                 575

Pro Gly Ala Ser Ala Ala Ala Ala Ala Gly Pro Gly Ser Gly Gln Gln
            580                 585                 590

Gly Pro Gly Ala Ser
        595


<210> SEQ ID NO 11
<211> LENGTH: 12
<212> TYPE: PRT
<213> ORGANISM: Artificial Sequence
<220> FEATURE:
<223> OTHER INFORMATION: HisTag

<400> SEQUENCE: 11
```

```
Met His His His His His His Ser Ser Gly Ser Ser
1               5                   10


<210> SEQ ID NO 12
<211> LENGTH: 608
<212> TYPE: PRT
<213> ORGANISM: Artificial Sequence
<220> FEATURE:
<223> OTHER INFORMATION: PRT380

<400> SEQUENCE: 12

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Ala Ala Ala
        35                  40                  45

Ala Ala Gly Gln Tyr Gly Pro Gly Gln Gln Gly Pro Gly Gln Gln Gly
    50                  55                  60

Pro Gly Ser Ser Ala Ala Ala Ala Ala Gly Pro Gly Gln Tyr Gly Pro
65                  70                  75                  80

Gly Gln Gln Gly Pro Ser Ala Ser Ala Ala Ala Ala Ala Gly Pro Gly
                85                  90                  95

Ser Gly Gln Gln Gly Pro Gly Ala Ser Ala Ala Ala Ala Ala Gly Gln
            100                 105                 110

Tyr Gly Pro Gly Gln Gln Gly Pro Gly Gln Gln Gly Pro Gly Ser Ser
        115                 120                 125

Ala Ala Ala Ala Ala Gly Gln Tyr Gly Ser Gly Pro Gly Gln Gln Gly
    130                 135                 140

Pro Tyr Gly Ser Ala Ala Ala Ala Ala Gly Pro Gly Ser Gly Gln Tyr
145                 150                 155                 160

Gly Gln Gly Pro Tyr Gly Pro Gly Ala Ser Ala Ala Ala Ala Ala Gly
                165                 170                 175

Pro Gly Gln Tyr Gly Pro Gly Gln Gln Gly Pro Ser Ala Ser Ala Ala
            180                 185                 190

Ala Ala Ala Gly Ser Gly Gln Gln Gly Pro Gly Gln Tyr Gly Pro Tyr
        195                 200                 205

Ala Ser Ala Ala Ala Ala Ala Gly Gln Tyr Gly Ser Gly Pro Gly Gln
    210                 215                 220

Gln Gly Pro Tyr Gly Pro Gly Gln Ser Ala Ala Ala Ala Ala Gly Ser
225                 230                 235                 240

Gly Gln Gln Gly Pro Gly Gln Gln Gly Pro Tyr Ala Ser Ala Ala Ala
                245                 250                 255

Ala Ala Gly Pro Gly Gln Gln Gly Pro Tyr Gly Pro Gly Ser Ser Ala
            260                 265                 270

Ala Ala Ala Ala Gly Gln Tyr Gly Tyr Gly Pro Gly Gln Gln Gly Pro
        275                 280                 285

Tyr Gly Pro Gly Ala Ser Ala Ala Ala Ala Ala Gly Gln Asn Gly Pro
    290                 295                 300

Gly Ser Gly Gln Tyr Gly Pro Gly Gln Gln Gly Pro Gly Gln Ser Ala
305                 310                 315                 320

Ala Ala Ala Ala Gly Pro Gly Gln Gln Gly Pro Tyr Gly Pro Gly Ala
                325                 330                 335

Ser Ala Ala Ala Ala Ala Gly Gln Tyr Gly Pro Gly Gln Gln Gly Pro
            340                 345                 350
```

```
Gly Gln Tyr Gly Pro Gly Ser Ser Ala Ala Ala Ala Ala Gly Pro Gly
        355                 360                 365

Gln Gln Gly Pro Tyr Gly Pro Gly Ser Ser Ala Ala Ala Ala Ala Gly
    370                 375                 380

Gln Tyr Gly Pro Gly Gln Gln Gly Pro Tyr Gly Pro Gly Gln Ser Ala
385                 390                 395                 400

Ala Ala Ala Ala Gly Gln Tyr Gln Gln Gly Pro Gly Gln Gln Gly Pro
                405                 410                 415

Tyr Gly Pro Gly Ala Ser Ala Ala Ala Ala Ala Gly Pro Gly Gln Gln
            420                 425                 430

Gly Pro Tyr Gly Pro Gly Ala Ser Ala Ala Ala Ala Ala Gly Pro Gly
        435                 440                 445

Gln Tyr Gly Pro Gly Gln Gln Gly Pro Ser Ala Ser Ala Ala Ala Ala
    450                 455                 460

Ala Gly Gln Tyr Gly Ser Gly Pro Gly Gln Tyr Gly Pro Tyr Gly Pro
465                 470                 475                 480

Gly Gln Ser Ala Ala Ala Ala Ala Gly Pro Gly Ser Gly Gln Gln Gly
                485                 490                 495

Gln Gly Pro Tyr Gly Pro Gly Ala Ser Ala Ala Ala Ala Ala Gly Gln
            500                 505                 510

Tyr Gly Pro Gly Gln Gln Gly Pro Tyr Gly Pro Gly Gln Ser Ala Ala
        515                 520                 525

Ala Ala Ala Gly Pro Gly Ser Gly Gln Tyr Gly Pro Gly Ala Ser Ala
    530                 535                 540

Ala Ala Ala Ala Gly Gln Asn Gly Pro Gly Ser Gly Gln Tyr Gly Pro
545                 550                 555                 560

Gly Gln Gln Gly Pro Gly Gln Ser Ala Ala Ala Ala Ala Gly Gln Tyr
                565                 570                 575

Gln Gln Gly Pro Gly Gln Gln Gly Pro Tyr Gly Pro Gly Ala Ser Ala
            580                 585                 590

Ala Ala Ala Ala Gly Pro Gly Ser Gly Gln Gln Gly Pro Gly Ala Ser
        595                 600                 605


<210> SEQ ID NO 13
<211> LENGTH: 601
<212> TYPE: PRT
<213> ORGANISM: Artificial Sequence
<220> FEATURE:
<223> OTHER INFORMATION: PRT410

<400> SEQUENCE: 13

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Gly Gln Tyr
        35                  40                  45

Gly Pro Gly Gln Gln Gly Pro Gly Gln Gln Gly Pro Gly Ser Ser Ala
    50                  55                  60

Ala Ala Ala Ala Gly Pro Gly Gln Tyr Gly Pro Gly Gln Gln Gly Pro
65                  70                  75                  80

Ser Ala Ser Ala Ala Ala Ala Ala Gly Pro Gly Ser Gly Gln Gln Gly
                85                  90                  95

Pro Gly Ala Ser Gly Gln Tyr Gly Pro Gly Gln Gln Gly Pro Gly Gln
            100                 105                 110
```

```
Gln Gly Pro Gly Ser Ser Ala Ala Ala Ala Ala Gly Gln Tyr Gly Ser
        115                 120                 125

Gly Pro Gly Gln Gln Gly Pro Tyr Gly Ser Ala Ala Ala Ala Ala Gly
    130                 135                 140

Pro Gly Ser Gly Gln Tyr Gly Gln Gly Pro Tyr Gly Pro Gly Ala Ser
145                 150                 155                 160

Gly Pro Gly Gln Tyr Gly Pro Gly Gln Gln Gly Pro Ser Ala Ser Ala
                165                 170                 175

Ala Ala Ala Ala Gly Ser Gly Gln Gln Gly Pro Gly Gln Tyr Gly Pro
            180                 185                 190

Tyr Ala Ser Ala Ala Ala Ala Ala Gly Gln Tyr Gly Ser Gly Pro Gly
        195                 200                 205

Gln Gln Gly Pro Tyr Gly Pro Gly Gln Ser Gly Ser Gly Gln Gln Gly
    210                 215                 220

Pro Gly Gln Gln Gly Pro Tyr Ala Ser Ala Ala Ala Ala Ala Gly Pro
225                 230                 235                 240

Gly Gln Gln Gly Pro Tyr Gly Pro Gly Ser Ser Ala Ala Ala Ala Ala
                245                 250                 255

Gly Gln Tyr Gly Tyr Gly Pro Gly Gln Gln Gly Pro Tyr Gly Pro Gly
            260                 265                 270

Ala Ser Gly Gln Asn Gly Pro Gly Ser Gly Gln Tyr Gly Pro Gly Gln
        275                 280                 285

Gln Gly Pro Gly Gln Ser Ala Ala Ala Ala Ala Gly Pro Gly Gln Gln
    290                 295                 300

Gly Pro Tyr Gly Pro Gly Ala Ser Ala Ala Ala Ala Ala Gly Gln Tyr
305                 310                 315                 320

Gly Pro Gly Gln Gln Gly Pro Gly Gln Tyr Gly Pro Gly Ser Ser Gly
                325                 330                 335

Pro Gly Gln Gln Gly Pro Tyr Gly Pro Gly Ser Ser Ala Ala Ala Ala
            340                 345                 350

Ala Gly Gln Tyr Gly Pro Gly Gln Gln Gly Pro Tyr Gly Pro Gly Gln
        355                 360                 365

Ser Ala Ala Ala Ala Ala Gly Gln Tyr Gln Gln Gly Pro Gly Gln Gln
    370                 375                 380

Gly Pro Tyr Gly Pro Gly Ala Ser Gly Pro Gly Gln Gln Gly Pro Tyr
385                 390                 395                 400

Gly Pro Gly Ala Ser Ala Ala Ala Ala Ala Gly Pro Gly Gln Tyr Gly
                405                 410                 415

Pro Gly Gln Gln Gly Pro Ser Ala Ser Ala Ala Ala Ala Ala Gly Gln
            420                 425                 430

Tyr Gly Ser Gly Pro Gly Gln Tyr Gly Pro Tyr Gly Pro Gly Gln Ser
        435                 440                 445

Gly Pro Gly Ser Gly Gln Gln Gly Gln Gly Pro Tyr Gly Pro Gly Ala
    450                 455                 460

Ser Ala Ala Ala Ala Ala Gly Gln Tyr Gly Pro Gly Gln Gln Gly Pro
465                 470                 475                 480

Tyr Gly Pro Gly Gln Ser Ala Ala Ala Ala Ala Gly Pro Gly Ser Gly
                485                 490                 495

Gln Tyr Gly Pro Gly Ala Ser Gly Gln Asn Gly Pro Gly Ser Gly Gln
            500                 505                 510

Tyr Gly Pro Gly Gln Gln Gly Pro Gly Gln Ser Ala Ala Ala Ala Ala
        515                 520                 525
```

```
Gly Gln Tyr Gln Gln Gly Pro Gly Gln Gln Gly Pro Tyr Gly Pro Gly
    530                 535                 540

Ala Ser Ala Ala Ala Ala Ala Gly Gln Tyr Gly Ser Gly Pro Gly Gln
545                 550                 555                 560

Gln Gly Pro Tyr Gly Pro Gly Gln Ser Gly Ser Gly Gln Gln Gly Pro
                565                 570                 575

Gly Gln Gln Gly Pro Tyr Ala Ser Ala Ala Ala Ala Ala Gly Pro Gly
            580                 585                 590

Ser Gly Gln Gln Gly Pro Gly Ala Ser
        595                 600


<210> SEQ ID NO 14
<211> LENGTH: 576
<212> TYPE: PRT
<213> ORGANISM: Artificial Sequence
<220> FEATURE:
<223> OTHER INFORMATION: PRT525

<400> SEQUENCE: 14

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Ala Ala
            20                  25                  30

Gly Ser Asn Gly Pro Gly Ser Gly Gln Gln Gly Pro Gly Gln Ser Gly
        35                  40                  45

Gln Tyr Gly Pro Gly Gln Gln Gly Pro Gly Gln Gln Gly Pro Gly Ser
    50                  55                  60

Ser Ala Ala Ala Ala Ala Ala Ala Gly Pro Gly Gln Tyr Gly Pro Gly
65                  70                  75                  80

Gln Gln Gly Pro Ser Ala Ser Ala Ala Ala Ala Ala Ala Ala Gly Pro
                85                  90                  95

Gly Ser Gly Gln Gln Gly Pro Gly Ala Ser Gly Gln Tyr Gly Pro Gly
            100                 105                 110

Gln Gln Gly Pro Gly Gln Gln Gly Pro Gly Ser Ser Ala Ala Ala Ala
        115                 120                 125

Ala Ala Ala Gly Ser Tyr Gly Ser Gly Pro Gly Gln Gln Gly Pro Tyr
    130                 135                 140

Gly Ser Ala Ala Ala Ala Ala Ala Ala Gly Pro Gly Ser Gly Gln Tyr
145                 150                 155                 160

Gly Gln Gly Pro Tyr Gly Pro Gly Ala Ser Gly Pro Gly Gln Tyr Gly
                165                 170                 175

Pro Gly Gln Gln Gly Pro Ser Ala Ser Ala Ala Ala Ala Ala Ala Ala
            180                 185                 190

Gly Ser Gly Gln Gln Gly Pro Gly Gln Tyr Gly Pro Tyr Ala Ser Ala
        195                 200                 205

Ala Ala Ala Ala Ala Ala Gly Ser Tyr Gly Ser Gly Pro Gly Gln Gln
    210                 215                 220

Gly Pro Tyr Gly Pro Gly Gln Ser Gly Ser Gly Gln Gln Gly Pro Gly
225                 230                 235                 240

Gln Gln Gly Pro Tyr Ala Ser Ala Ala Ala Ala Ala Ala Ala Gly Pro
                245                 250                 255

Gly Gln Gln Gly Pro Tyr Gly Pro Gly Ser Ser Ala Ala Ala Ala Ala
            260                 265                 270

Ala Ala Gly Ser Tyr Gly Tyr Gly Pro Gly Gln Gln Gly Pro Tyr Gly
        275                 280                 285
```

```
Pro Gly Ala Ser Gly Gln Asn Gly Pro Gly Ser Gly Gln Tyr Gly Pro
    290                 295                 300

Gly Gln Gln Gly Pro Gly Pro Ser Ala Ala Ala Ala Ala Ala Ala Gly
305                 310                 315                 320

Pro Gly Gln Gln Gly Pro Tyr Gly Pro Gly Ala Ser Ala Ala Ala Ala
                325                 330                 335

Ala Ala Ala Gly Ser Tyr Gly Pro Gly Gln Gln Gly Pro Gly Gln Tyr
            340                 345                 350

Gly Pro Gly Ser Ser Gly Pro Gly Gln Gln Gly Pro Tyr Gly Pro Gly
        355                 360                 365

Ser Ser Ala Ala Ala Ala Ala Ala Ala Gly Ser Tyr Gly Pro Gly Gln
    370                 375                 380

Gln Gly Pro Tyr Gly Pro Gly Pro Ser Ala Ala Ala Ala Ala Ala Ala
385                 390                 395                 400

Gly Ser Tyr Gln Gln Gly Pro Gly Gln Gln Gly Pro Tyr Gly Pro Gly
                405                 410                 415

Ala Ser Gly Pro Gly Gln Gln Gly Pro Tyr Gly Pro Gly Ala Ser Ala
            420                 425                 430

Ala Ala Ala Ala Ala Ala Gly Pro Gly Gln Tyr Gly Pro Gly Gln Gln
        435                 440                 445

Gly Pro Ser Ala Ser Ala Ala Ala Ala Ala Ala Ala Gly Ser Tyr Gly
    450                 455                 460

Ser Gly Pro Gly Gln Tyr Gly Pro Tyr Gly Pro Gly Gln Ser Gly Pro
465                 470                 475                 480

Gly Ser Gly Gln Gln Gly Gln Gly Pro Tyr Gly Pro Gly Ala Ser Ala
                485                 490                 495

Ala Ala Ala Ala Ala Ala Gly Ser Tyr Gly Pro Gly Gln Gln Gly Pro
            500                 505                 510

Tyr Gly Pro Gly Pro Ser Ala Ala Ala Ala Ala Ala Ala Gly Pro Gly
        515                 520                 525

Ser Gly Gln Tyr Gly Pro Gly Ala Ser Gly Gln Asn Gly Pro Gly Ser
    530                 535                 540

Gly Gln Tyr Gly Pro Gly Gln Gln Gly Pro Gly Pro Ser Ala Ala Ala
545                 550                 555                 560

Ala Ala Ala Ala Gly Pro Gly Ser Gly Gln Gln Gly Pro Gly Ala Ser
                565                 570                 575


<210> SEQ ID NO 15
<211> LENGTH: 2375
<212> TYPE: PRT
<213> ORGANISM: Artificial Sequence
<220> FEATURE:
<223> OTHER INFORMATION: PRT799

<400> SEQUENCE: 15

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Gly Gln Tyr
        35                  40                  45

Gly Pro Gly Gln Gln Gly Pro Gly Gln Gln Gly Pro Gly Ser Ser Ala
    50                  55                  60

Ala Ala Ala Ala Gly Pro Gly Gln Tyr Gly Pro Gly Gln Gln Gly Pro
65                  70                  75                  80
```

```
Ser Ala Ser Ala Ala Ala Ala Ala Gly Pro Gly Ser Gly Gln Gln Gly
                85                  90                  95

Pro Gly Ala Ser Gly Gln Tyr Gly Pro Gly Gln Gln Gly Pro Gly Gln
            100                 105                 110

Gln Gly Pro Gly Ser Ser Ala Ala Ala Ala Ala Gly Gln Tyr Gly Ser
        115                 120                 125

Gly Pro Gly Gln Gln Gly Pro Tyr Gly Ser Ala Ala Ala Ala Ala Gly
    130                 135                 140

Pro Gly Ser Gly Gln Tyr Gly Gln Gly Pro Tyr Gly Pro Gly Ala Ser
145                 150                 155                 160

Gly Pro Gly Gln Tyr Gly Pro Gly Gln Gln Gly Pro Ser Ala Ser Ala
                165                 170                 175

Ala Ala Ala Ala Gly Ser Gly Gln Gln Gly Pro Gly Gln Tyr Gly Pro
            180                 185                 190

Tyr Ala Ser Ala Ala Ala Ala Ala Gly Gln Tyr Gly Ser Gly Pro Gly
        195                 200                 205

Gln Gln Gly Pro Tyr Gly Pro Gly Gln Ser Gly Ser Gly Gln Gln Gly
    210                 215                 220

Pro Gly Gln Gln Gly Pro Tyr Ala Ser Ala Ala Ala Ala Ala Gly Pro
225                 230                 235                 240

Gly Gln Gln Gly Pro Tyr Gly Pro Gly Ser Ser Ala Ala Ala Ala Ala
                245                 250                 255

Gly Gln Tyr Gly Tyr Gly Pro Gly Gln Gln Gly Pro Tyr Gly Pro Gly
            260                 265                 270

Ala Ser Gly Gln Asn Gly Pro Gly Ser Gly Gln Tyr Gly Pro Gly Gln
        275                 280                 285

Gln Gly Pro Gly Gln Ser Ala Ala Ala Ala Ala Gly Pro Gly Gln Gln
    290                 295                 300

Gly Pro Tyr Gly Pro Gly Ala Ser Ala Ala Ala Ala Ala Gly Gln Tyr
305                 310                 315                 320

Gly Pro Gly Gln Gln Gly Pro Gly Gln Tyr Gly Pro Gly Ser Ser Gly
                325                 330                 335

Pro Gly Gln Gln Gly Pro Tyr Gly Pro Gly Ser Ser Ala Ala Ala Ala
            340                 345                 350

Ala Gly Gln Tyr Gly Pro Gly Gln Gln Gly Pro Tyr Gly Pro Gly Gln
        355                 360                 365

Ser Ala Ala Ala Ala Ala Gly Gln Tyr Gln Gln Gly Pro Gly Gln Gln
    370                 375                 380

Gly Pro Tyr Gly Pro Gly Ala Ser Gly Pro Gly Gln Gln Gly Pro Tyr
385                 390                 395                 400

Gly Pro Gly Ala Ser Ala Ala Ala Ala Ala Gly Pro Gly Gln Tyr Gly
                405                 410                 415

Pro Gly Gln Gln Gly Pro Ser Ala Ser Ala Ala Ala Ala Ala Gly Gln
            420                 425                 430

Tyr Gly Ser Gly Pro Gly Gln Tyr Gly Pro Tyr Gly Pro Gly Gln Ser
        435                 440                 445

Gly Pro Gly Ser Gly Gln Gln Gly Gln Gly Pro Tyr Gly Pro Gly Ala
    450                 455                 460

Ser Ala Ala Ala Ala Ala Gly Gln Tyr Gly Pro Gly Gln Gln Gly Pro
465                 470                 475                 480

Tyr Gly Pro Gly Gln Ser Ala Ala Ala Ala Ala Gly Pro Gly Ser Gly
                485                 490                 495

Gln Tyr Gly Pro Gly Ala Ser Gly Gln Asn Gly Pro Gly Ser Gly Gln
```

```
            500                 505                 510

Tyr Gly Pro Gly Gln Gln Gly Pro Gly Gln Ser Ala Ala Ala Ala Ala
        515                 520                 525

Gly Gln Tyr Gln Gln Gly Pro Gly Gln Gln Gly Pro Tyr Gly Pro Gly
    530                 535                 540

Ala Ser Ala Ala Ala Ala Ala Gly Gln Tyr Gly Ser Gly Pro Gly Gln
545                 550                 555                 560

Gln Gly Pro Tyr Gly Pro Gly Gln Ser Gly Ser Gly Gln Gln Gly Pro
                565                 570                 575

Gly Gln Gln Gly Pro Tyr Ala Ser Ala Ala Ala Ala Ala Gly Pro Gly
            580                 585                 590

Ser Gly Gln Gln Gly Pro Gly Ala Ser Gly Gln Gln Gly Pro Tyr Gly
        595                 600                 605

Pro Gly Ala Ser Ala Ala Ala Ala Ala Gly Gln Asn Gly Pro Gly Ser
    610                 615                 620

Gly Gln Gln Gly Pro Gly Gln Ser Gly Gln Tyr Gly Pro Gly Gln Gln
625                 630                 635                 640

Gly Pro Gly Gln Gln Gly Pro Gly Ser Ser Ala Ala Ala Ala Ala Gly
                645                 650                 655

Pro Gly Gln Tyr Gly Pro Gly Gln Gln Gly Pro Ser Ala Ser Ala Ala
            660                 665                 670

Ala Ala Ala Gly Pro Gly Ser Gly Gln Gln Gly Pro Gly Ala Ser Gly
        675                 680                 685

Gln Tyr Gly Pro Gly Gln Gln Gly Pro Gly Gln Gln Gly Pro Gly Ser
    690                 695                 700

Ser Ala Ala Ala Ala Ala Gly Gln Tyr Gly Ser Gly Pro Gly Gln Gln
705                 710                 715                 720

Gly Pro Tyr Gly Ser Ala Ala Ala Ala Ala Gly Pro Gly Ser Gly Gln
                725                 730                 735

Tyr Gly Gln Gly Pro Tyr Gly Pro Gly Ala Ser Gly Pro Gly Gln Tyr
            740                 745                 750

Gly Pro Gly Gln Gln Gly Pro Ser Ala Ser Ala Ala Ala Ala Ala Gly
        755                 760                 765

Ser Gly Gln Gln Gly Pro Gly Gln Tyr Gly Pro Tyr Ala Ser Ala Ala
    770                 775                 780

Ala Ala Ala Gly Gln Tyr Gly Ser Gly Pro Gly Gln Gln Gly Pro Tyr
785                 790                 795                 800

Gly Pro Gly Gln Ser Gly Ser Gly Gln Gln Gly Pro Gly Gln Gln Gly
                805                 810                 815

Pro Tyr Ala Ser Ala Ala Ala Ala Ala Gly Pro Gly Gln Gln Gly Pro
            820                 825                 830

Tyr Gly Pro Gly Ser Ser Ala Ala Ala Ala Ala Gly Gln Tyr Gly Tyr
        835                 840                 845

Gly Pro Gly Gln Gln Gly Pro Tyr Gly Pro Gly Ala Ser Gly Gln Asn
    850                 855                 860

Gly Pro Gly Ser Gly Gln Tyr Gly Pro Gly Gln Gln Gly Pro Gly Gln
865                 870                 875                 880

Ser Ala Ala Ala Ala Ala Gly Pro Gly Gln Gln Gly Pro Tyr Gly Pro
                885                 890                 895

Gly Ala Ser Ala Ala Ala Ala Ala Gly Gln Tyr Gly Pro Gly Gln Gln
            900                 905                 910

Gly Pro Gly Gln Tyr Gly Pro Gly Ser Ser Gly Pro Gly Gln Gln Gly
        915                 920                 925
```

```
Pro Tyr Gly Pro Gly Ser Ser Ala Ala Ala Ala Ala Gly Gln Tyr Gly
    930                 935                 940

Pro Gly Gln Gln Gly Pro Tyr Gly Pro Gly Gln Ser Ala Ala Ala Ala
945                 950                 955                 960

Ala Gly Gln Tyr Gln Gln Gly Pro Gly Gln Gln Gly Pro Tyr Gly Pro
                965                 970                 975

Gly Ala Ser Gly Pro Gly Gln Gln Gly Pro Tyr Gly Pro Gly Ala Ser
            980                 985                 990

Ala Ala Ala Ala Ala Gly Pro Gly  Gln Tyr Gly Pro Gly  Gln Gln Gly
        995                 1000                1005

Pro Ser  Ala Ser Ala Ala Ala  Ala Ala Gly Gln Tyr  Gly Ser Gly
    1010                1015                1020

Pro Gly  Gln Tyr Gly Pro Tyr  Gly Pro Gly Gln Ser  Gly Pro Gly
    1025                1030                1035

Ser Gly  Gln Gln Gly Gln Gly  Pro Tyr Gly Pro Gly  Ala Ser Ala
    1040                1045                1050

Ala Ala  Ala Ala Gly Gln Tyr  Gly Pro Gly Gln Gln  Gly Pro Tyr
    1055                1060                1065

Gly Pro  Gly Gln Ser Ala Ala  Ala Ala Ala Gly Pro  Gly Ser Gly
    1070                1075                1080

Gln Tyr  Gly Pro Gly Ala Ser  Gly Gln Asn Gly Pro  Gly Ser Gly
    1085                1090                1095

Gln Tyr  Gly Pro Gly Gln Gln  Gly Pro Gly Gln Ser  Ala Ala Ala
    1100                1105                1110

Ala Ala  Gly Gln Tyr Gln Gln  Gly Pro Gly Gln Gln  Gly Pro Tyr
    1115                1120                1125

Gly Pro  Gly Ala Ser Ala Ala  Ala Ala Ala Gly Gln  Tyr Gly Ser
    1130                1135                1140

Gly Pro  Gly Gln Gln Gly Pro  Tyr Gly Pro Gly Gln  Ser Gly Ser
    1145                1150                1155

Gly Gln  Gln Gly Pro Gly Gln  Gln Gly Pro Tyr Ala  Ser Ala Ala
    1160                1165                1170

Ala Ala  Ala Gly Pro Gly Ser  Gly Gln Gln Gly Pro  Gly Ala Ser
    1175                1180                1185

Gly Gln  Gln Gly Pro Tyr Gly  Pro Gly Ala Ser Ala  Ala Ala Ala
    1190                1195                1200

Ala Gly  Gln Asn Gly Pro Gly  Ser Gly Gln Gln Gly  Pro Gly Gln
    1205                1210                1215

Ser Gly  Gln Tyr Gly Pro Gly  Gln Gln Gly Pro Gly  Gln Gln Gly
    1220                1225                1230

Pro Gly  Ser Ser Ala Ala Ala  Ala Ala Gly Pro Gly  Gln Tyr Gly
    1235                1240                1245

Pro Gly  Gln Gln Gly Pro Ser  Ala Ser Ala Ala Ala  Ala Ala Gly
    1250                1255                1260

Pro Gly  Ser Gly Gln Gln Gly  Pro Gly Ala Ser Gly  Gln Tyr Gly
    1265                1270                1275

Pro Gly  Gln Gln Gly Pro Gly  Gln Gln Gly Pro Gly  Ser Ser Ala
    1280                1285                1290

Ala Ala  Ala Ala Gly Gln Tyr  Gly Ser Gly Pro Gly  Gln Gln Gly
    1295                1300                1305

Pro Tyr  Gly Ser Ala Ala Ala  Ala Ala Gly Pro Gly  Ser Gly Gln
    1310                1315                1320
```

```
Tyr Gly  Gln Gly Pro Tyr Gly  Pro Gly Ala Ser Gly  Pro Gly Gln
    1325                 1330                 1335

Tyr Gly  Pro Gly Gln Gln Gly  Pro Ser Ala Ser Ala  Ala Ala Ala
    1340                 1345                 1350

Ala Gly  Ser Gly Gln Gln Gly  Pro Gly Gln Tyr Gly  Pro Tyr Ala
    1355                 1360                 1365

Ser Ala  Ala Ala Ala Ala Gly  Gln Tyr Gly Ser Gly  Pro Gly Gln
    1370                 1375                 1380

Gln Gly  Pro Tyr Gly Pro Gly  Gln Ser Gly Ser Gly  Gln Gln Gly
    1385                 1390                 1395

Pro Gly  Gln Gln Gly Pro Tyr  Ala Ser Ala Ala Ala  Ala Ala Gly
    1400                 1405                 1410

Pro Gly  Gln Gln Gly Pro Tyr  Gly Pro Gly Ser Ser  Ala Ala Ala
    1415                 1420                 1425

Ala Ala  Gly Gln Tyr Gly Tyr  Gly Pro Gly Gln Gln  Gly Pro Tyr
    1430                 1435                 1440

Gly Pro  Gly Ala Ser Gly Gln  Asn Gly Pro Gly Ser  Gly Gln Tyr
    1445                 1450                 1455

Gly Pro  Gly Gln Gln Gly Pro  Gly Gln Ser Ala Ala  Ala Ala Ala
    1460                 1465                 1470

Gly Pro  Gly Gln Gln Gly Pro  Tyr Gly Pro Gly Ala  Ser Ala Ala
    1475                 1480                 1485

Ala Ala  Ala Gly Gln Tyr Gly  Pro Gly Gln Gln Gly  Pro Gly Gln
    1490                 1495                 1500

Tyr Gly  Pro Gly Ser Ser Gly  Pro Gly Gln Gln Gly  Pro Tyr Gly
    1505                 1510                 1515

Pro Gly  Ser Ser Ala Ala Ala  Ala Ala Gly Gln Tyr  Gly Pro Gly
    1520                 1525                 1530

Gln Gln  Gly Pro Tyr Gly Pro  Gly Gln Ser Ala Ala  Ala Ala Ala
    1535                 1540                 1545

Gly Gln  Tyr Gln Gln Gly Pro  Gly Gln Gln Gly Pro  Tyr Gly Pro
    1550                 1555                 1560

Gly Ala  Ser Gly Pro Gly Gln  Gln Gly Pro Tyr Gly  Pro Gly Ala
    1565                 1570                 1575

Ser Ala  Ala Ala Ala Ala Gly  Pro Gly Gln Tyr Gly  Pro Gly Gln
    1580                 1585                 1590

Gln Gly  Pro Ser Ala Ser Ala  Ala Ala Ala Ala Gly  Gln Tyr Gly
    1595                 1600                 1605

Ser Gly  Pro Gly Gln Tyr Gly  Pro Tyr Gly Pro Gly  Gln Ser Gly
    1610                 1615                 1620

Pro Gly  Ser Gly Gln Gln Gly  Gln Gly Pro Tyr Gly  Pro Gly Ala
    1625                 1630                 1635

Ser Ala  Ala Ala Ala Ala Gly  Gln Tyr Gly Pro Gly  Gln Gln Gly
    1640                 1645                 1650

Pro Tyr  Gly Pro Gly Gln Ser  Ala Ala Ala Ala Ala  Gly Pro Gly
    1655                 1660                 1665

Ser Gly  Gln Tyr Gly Pro Gly  Ala Ser Gly Gln Asn  Gly Pro Gly
    1670                 1675                 1680

Ser Gly  Gln Tyr Gly Pro Gly  Gln Gln Gly Pro Gly  Gln Ser Ala
    1685                 1690                 1695

Ala Ala  Ala Ala Gly Gln Tyr  Gln Gln Gly Pro Gly  Gln Gln Gly
    1700                 1705                 1710

Pro Tyr  Gly Pro Gly Ala Ser  Ala Ala Ala Ala Ala  Gly Gln Tyr
```

```
    1715                1720                1725

Gly Ser  Gly Pro Gly Gln Gln  Gly Pro Tyr Gly Pro  Gly Gln Ser
    1730                1735                1740

Gly Ser  Gly Gln Gln Gly Pro  Gly Gln Gln Gly Pro  Tyr Ala Ser
    1745                1750                1755

Ala Ala  Ala Ala Ala Gly Pro  Gly Ser Gly Gln Gln  Gly Pro Gly
    1760                1765                1770

Ala Ser  Gly Gln Gln Gly Pro  Tyr Gly Pro Gly Ala  Ser Ala Ala
    1775                1780                1785

Ala Ala  Ala Gly Gln Asn Gly  Pro Gly Ser Gly Gln  Gln Gly Pro
    1790                1795                1800

Gly Gln  Ser Gly Gln Tyr Gly  Pro Gly Gln Gln Gly  Pro Gly Gln
    1805                1810                1815

Gln Gly  Pro Gly Ser Ser Ala  Ala Ala Ala Ala Gly  Pro Gly Gln
    1820                1825                1830

Tyr Gly  Pro Gly Gln Gln Gly  Pro Ser Ala Ser Ala  Ala Ala Ala
    1835                1840                1845

Ala Gly  Pro Gly Ser Gly Gln  Gln Gly Pro Gly Ala  Ser Gly Gln
    1850                1855                1860

Tyr Gly  Pro Gly Gln Gln Gly  Pro Gly Gln Gln Gly  Pro Gly Ser
    1865                1870                1875

Ser Ala  Ala Ala Ala Ala Gly  Gln Tyr Gly Ser Gly  Pro Gly Gln
    1880                1885                1890

Gln Gly  Pro Tyr Gly Ser Ala  Ala Ala Ala Ala Gly  Pro Gly Ser
    1895                1900                1905

Gly Gln  Tyr Gly Gln Gly Pro  Tyr Gly Pro Gly Ala  Ser Gly Pro
    1910                1915                1920

Gly Gln  Tyr Gly Pro Gly Gln  Gln Gly Pro Ser Ala  Ser Ala Ala
    1925                1930                1935

Ala Ala  Ala Gly Ser Gly Gln  Gln Gly Pro Gly Gln  Tyr Gly Pro
    1940                1945                1950

Tyr Ala  Ser Ala Ala Ala Ala  Ala Gly Gln Tyr Gly  Ser Gly Pro
    1955                1960                1965

Gly Gln  Gln Gly Pro Tyr Gly  Pro Gly Gln Ser Gly  Ser Gly Gln
    1970                1975                1980

Gln Gly  Pro Gly Gln Gln Gly  Pro Tyr Ala Ser Ala  Ala Ala Ala
    1985                1990                1995

Ala Gly  Pro Gly Gln Gln Gly  Pro Tyr Gly Pro Gly  Ser Ser Ala
    2000                2005                2010

Ala Ala  Ala Ala Gly Gln Tyr  Gly Tyr Gly Pro Gly  Gln Gln Gly
    2015                2020                2025

Pro Tyr  Gly Pro Gly Ala Ser  Gly Gln Asn Gly Pro  Gly Ser Gly
    2030                2035                2040

Gln Tyr  Gly Pro Gly Gln Gln  Gly Pro Gly Gln Ser  Ala Ala Ala
    2045                2050                2055

Ala Ala  Gly Pro Gly Gln Gln  Gly Pro Tyr Gly Pro  Gly Ala Ser
    2060                2065                2070

Ala Ala  Ala Ala Ala Gly Gln  Tyr Gly Pro Gly Gln  Gln Gly Pro
    2075                2080                2085

Gly Gln  Tyr Gly Pro Gly Ser  Ser Gly Pro Gly Gln  Gln Gly Pro
    2090                2095                2100

Tyr Gly  Pro Gly Ser Ser Ala  Ala Ala Ala Ala Gly  Gln Tyr Gly
    2105                2110                2115
```

```
Pro Gly  Gln Gln Gly Pro Tyr  Gly Pro Gly Gln Ser  Ala Ala Ala
    2120                 2125                 2130

Ala Ala  Gly Gln Tyr Gln Gln  Gly Pro Gly Gln Gln  Gly Pro Tyr
    2135                 2140                 2145

Gly Pro  Gly Ala Ser Gly Pro  Gly Gln Gln Gly Pro  Tyr Gly Pro
    2150                 2155                 2160

Gly Ala  Ser Ala Ala Ala Ala  Ala Gly Pro Gly Gln  Tyr Gly Pro
    2165                 2170                 2175

Gly Gln  Gln Gly Pro Ser Ala  Ser Ala Ala Ala Ala  Ala Gly Gln
    2180                 2185                 2190

Tyr Gly  Ser Gly Pro Gly Gln  Tyr Gly Pro Tyr Gly  Pro Gly Gln
    2195                 2200                 2205

Ser Gly  Pro Gly Ser Gly Gln  Gln Gly Gln Gly Pro  Tyr Gly Pro
    2210                 2215                 2220

Gly Ala  Ser Ala Ala Ala Ala  Ala Gly Gln Tyr Gly  Pro Gly Gln
    2225                 2230                 2235

Gln Gly  Pro Tyr Gly Pro Gly  Gln Ser Ala Ala Ala  Ala Ala Gly
    2240                 2245                 2250

Pro Gly  Ser Gly Gln Tyr Gly  Pro Gly Ala Ser Gly  Gln Asn Gly
    2255                 2260                 2265

Pro Gly  Ser Gly Gln Tyr Gly  Pro Gly Gln Gln Gly  Pro Gly Gln
    2270                 2275                 2280

Ser Ala  Ala Ala Ala Ala Gly  Gln Tyr Gln Gln Gly  Pro Gly Gln
    2285                 2290                 2295

Gln Gly  Pro Tyr Gly Pro Gly  Ala Ser Ala Ala Ala  Ala Ala Gly
    2300                 2305                 2310

Gln Tyr  Gly Ser Gly Pro Gly  Gln Gln Gly Pro Tyr  Gly Pro Gly
    2315                 2320                 2325

Gln Ser  Gly Ser Gly Gln Gln  Gly Pro Gly Gln Gln  Gly Pro Tyr
    2330                 2335                 2340

Ala Ser  Ala Ala Ala Ala Ala  Gly Pro Gly Ser Gly  Gln Gln Gly
    2345                 2350                 2355

Ser Ser  Val Asp Lys Leu Ala  Ala Ala Leu Glu His  His His His
    2360                 2365                 2370

His His
    2375


<210> SEQ ID NO 16
<211> LENGTH: 608
<212> TYPE: PRT
<213> ORGANISM: Artificial Sequence
<220> FEATURE:
<223> OTHER INFORMATION: PRT313

<400> SEQUENCE: 16

Met His His His His His His Ser Ser Gly Ser Ser Gly Pro Gly Gly
1               5                   10                  15

Gln Gly Pro Tyr Gly Pro Gly Ala Ser Ala Ala Ala Ala Ala Gly Gly
            20                  25                  30

Asn Gly Pro Gly Ser Gly Gln Gln Gly Pro Gly Gly Ser Ala Ala Ala
        35                  40                  45

Ala Ala Gly Gly Tyr Gly Pro Gly Gly Gln Gly Pro Gly Gln Gln Gly
    50                  55                  60

Pro Gly Ser Ser Ala Ala Ala Ala Ala Gly Pro Gly Gly Tyr Gly Pro
65                  70                  75                  80
```

```
Gly Gly Gln Gly Pro Ser Ala Ser Ala Ala Ala Ala Ala Gly Pro Gly
                85                  90                  95

Ser Gly Gln Gln Gly Pro Gly Ala Ser Ala Ala Ala Ala Ala Gly Gly
            100                 105                 110

Tyr Gly Pro Gly Gly Gln Gly Pro Gly Gln Gln Gly Pro Gly Ser Ser
        115                 120                 125

Ala Ala Ala Ala Ala Gly Gly Tyr Gly Ser Gly Pro Gly Gln Gln Gly
    130                 135                 140

Pro Tyr Gly Ser Ala Ala Ala Ala Ala Gly Pro Gly Ser Gly Gly Tyr
145                 150                 155                 160

Gly Gln Gly Pro Tyr Gly Pro Gly Ala Ser Ala Ala Ala Ala Ala Gly
                165                 170                 175

Pro Gly Gly Tyr Gly Pro Gly Gly Gln Gly Pro Ser Ala Ser Ala Ala
            180                 185                 190

Ala Ala Ala Gly Ser Gly Gln Gln Gly Pro Gly Gly Tyr Gly Pro Tyr
        195                 200                 205

Ala Ser Ala Ala Ala Ala Ala Gly Gly Tyr Gly Ser Gly Pro Gly Gln
    210                 215                 220

Gln Gly Pro Tyr Gly Pro Gly Gly Ser Ala Ala Ala Ala Ala Gly Ser
225                 230                 235                 240

Gly Gln Gln Gly Pro Gly Gln Gln Gly Pro Tyr Ala Ser Ala Ala Ala
                245                 250                 255

Ala Ala Gly Pro Gly Gly Gln Gly Pro Tyr Gly Pro Gly Ser Ser Ala
            260                 265                 270

Ala Ala Ala Ala Gly Gly Tyr Gly Tyr Gly Pro Gly Gly Gln Gly Pro
        275                 280                 285

Tyr Gly Pro Gly Ala Ser Ala Ala Ala Ala Ala Gly Gly Asn Gly Pro
    290                 295                 300

Gly Ser Gly Gly Tyr Gly Pro Gly Gln Gln Gly Pro Gly Gly Ser Ala
305                 310                 315                 320

Ala Ala Ala Ala Gly Pro Gly Gly Gln Gly Pro Tyr Gly Pro Gly Ala
                325                 330                 335

Ser Ala Ala Ala Ala Ala Gly Gly Tyr Gly Pro Gly Gly Gln Gly Pro
            340                 345                 350

Gly Gly Tyr Gly Pro Gly Ser Ser Ala Ala Ala Ala Ala Gly Pro Gly
        355                 360                 365

Gly Gln Gly Pro Tyr Gly Pro Gly Ser Ser Ala Ala Ala Ala Ala Gly
    370                 375                 380

Gly Tyr Gly Pro Gly Gln Gln Gly Pro Tyr Gly Pro Gly Gly Ser Ala
385                 390                 395                 400

Ala Ala Ala Ala Gly Gly Tyr Gln Gln Gly Pro Gly Gly Gln Gly Pro
                405                 410                 415

Tyr Gly Pro Gly Ala Ser Ala Ala Ala Ala Ala Gly Pro Gly Gly Gln
            420                 425                 430

Gly Pro Tyr Gly Pro Gly Ala Ser Ala Ala Ala Ala Ala Gly Pro Gly
        435                 440                 445

Gly Tyr Gly Pro Gly Gly Gln Gly Pro Ser Ala Ser Ala Ala Ala Ala
    450                 455                 460

Ala Gly Gly Tyr Gly Ser Gly Pro Gly Gly Tyr Gly Pro Tyr Gly Pro
465                 470                 475                 480

Gly Gly Ser Ala Ala Ala Ala Ala Gly Pro Gly Ser Gly Gln Gln Gly
                485                 490                 495
```

```
Gln Gly Pro Tyr Gly Pro Gly Ala Ser Ala Ala Ala Ala Ala Gly Gly
            500                 505                 510

Tyr Gly Pro Gly Gln Gln Gly Pro Tyr Gly Pro Gly Gly Ser Ala Ala
        515                 520                 525

Ala Ala Ala Gly Pro Gly Ser Gly Gly Tyr Gly Pro Gly Ala Ser Ala
    530                 535                 540

Ala Ala Ala Ala Gly Gly Asn Gly Pro Gly Ser Gly Gly Tyr Gly Pro
545                 550                 555                 560

Gly Gln Gln Gly Pro Gly Gly Ser Ala Ala Ala Ala Ala Gly Gly Tyr
                565                 570                 575

Gln Gln Gly Pro Gly Gly Gln Gly Pro Tyr Gly Pro Gly Ala Ser Ala
            580                 585                 590

Ala Ala Ala Ala Gly Pro Gly Ser Gly Gln Gln Gly Pro Gly Ala Ser
        595                 600                 605


<210> SEQ ID NO 17
<211> LENGTH: 590
<212> TYPE: PRT
<213> ORGANISM: Artificial Sequence
<220> FEATURE:
<223> OTHER INFORMATION: Met-PRT399

<400> SEQUENCE: 17

Met Gly Pro Gly Gly Gln Gly Pro Tyr Gly Pro Gly Ala Ser Ala Ala
1               5                   10                  15

Ala Ala Ala Gly Gly Asn Gly Pro Gly Ser Gly Gln Gln Gly Pro Gly
            20                  25                  30

Gly Ser Gly Gly Tyr Gly Pro Gly Gly Gln Gly Pro Gly Gln Gln Gly
        35                  40                  45

Pro Gly Ser Ser Ala Ala Ala Ala Ala Gly Pro Gly Gly Tyr Gly Pro
    50                  55                  60

Gly Gly Gln Gly Pro Ser Ala Ser Ala Ala Ala Ala Ala Gly Pro Gly
65                  70                  75                  80

Ser Gly Gln Gln Gly Pro Gly Ala Ser Gly Gly Tyr Gly Pro Gly Gly
                85                  90                  95

Gln Gly Pro Gly Gln Gln Gly Pro Gly Ser Ser Ala Ala Ala Ala Ala
            100                 105                 110

Gly Gly Tyr Gly Ser Gly Pro Gly Gln Gln Gly Pro Tyr Gly Ser Ala
        115                 120                 125

Ala Ala Ala Ala Gly Pro Gly Ser Gly Gly Tyr Gly Gln Gly Pro Tyr
    130                 135                 140

Gly Pro Gly Ala Ser Gly Pro Gly Gly Tyr Gly Pro Gly Gly Gln Gly
145                 150                 155                 160

Pro Ser Ala Ser Ala Ala Ala Ala Ala Gly Ser Gly Gln Gln Gly Pro
                165                 170                 175

Gly Gly Tyr Gly Pro Tyr Ala Ser Ala Ala Ala Ala Ala Gly Gly Tyr
            180                 185                 190

Gly Ser Gly Pro Gly Gln Gln Gly Pro Tyr Gly Pro Gly Gly Ser Gly
        195                 200                 205

Ser Gly Gln Gln Gly Pro Gly Gln Gln Gly Pro Tyr Ala Ser Ala Ala
    210                 215                 220

Ala Ala Ala Gly Pro Gly Gly Gln Gly Pro Tyr Gly Pro Gly Ser Ser
225                 230                 235                 240

Ala Ala Ala Ala Ala Gly Gly Tyr Gly Tyr Gly Pro Gly Gly Gln Gly
                245                 250                 255
```

```
Pro Tyr Gly Pro Gly Ala Ser Gly Gly Asn Gly Pro Gly Ser Gly Gly
            260                 265                 270

Tyr Gly Pro Gly Gln Gln Gly Pro Gly Gly Ser Ala Ala Ala Ala Ala
        275                 280                 285

Gly Pro Gly Gly Gln Gly Pro Tyr Gly Pro Gly Ala Ser Ala Ala Ala
    290                 295                 300

Ala Ala Gly Gly Tyr Gly Pro Gly Gly Gln Gly Pro Gly Gly Tyr Gly
305                 310                 315                 320

Pro Gly Ser Ser Gly Pro Gly Gly Gln Gly Pro Tyr Gly Pro Gly Ser
                325                 330                 335

Ser Ala Ala Ala Ala Ala Gly Gly Tyr Gly Pro Gly Gln Gln Gly Pro
            340                 345                 350

Tyr Gly Pro Gly Gly Ser Ala Ala Ala Ala Ala Gly Gly Tyr Gln Gln
        355                 360                 365

Gly Pro Gly Gly Gln Gly Pro Tyr Gly Pro Gly Ala Ser Gly Pro Gly
    370                 375                 380

Gly Gln Gly Pro Tyr Gly Pro Gly Ala Ser Ala Ala Ala Ala Ala Gly
385                 390                 395                 400

Pro Gly Gly Tyr Gly Pro Gly Gly Gln Gly Pro Ser Ala Ser Ala Ala
                405                 410                 415

Ala Ala Ala Gly Gly Tyr Gly Ser Gly Pro Gly Gly Tyr Gly Pro Tyr
            420                 425                 430

Gly Pro Gly Gly Ser Gly Pro Gly Ser Gly Gln Gln Gly Gln Gly Pro
        435                 440                 445

Tyr Gly Pro Gly Ala Ser Ala Ala Ala Ala Ala Gly Gly Tyr Gly Pro
    450                 455                 460

Gly Gln Gln Gly Pro Tyr Gly Pro Gly Gly Ser Ala Ala Ala Ala Ala
465                 470                 475                 480

Gly Pro Gly Ser Gly Gly Tyr Gly Pro Gly Ala Ser Gly Gly Asn Gly
                485                 490                 495

Pro Gly Ser Gly Gly Tyr Gly Pro Gly Gln Gln Gly Pro Gly Gly Ser
            500                 505                 510

Ala Ala Ala Ala Ala Gly Gly Tyr Gln Gln Gly Pro Gly Gly Gln Gly
        515                 520                 525

Pro Tyr Gly Pro Gly Ala Ser Ala Ala Ala Ala Ala Gly Gly Tyr Gly
    530                 535                 540

Ser Gly Pro Gly Gln Gln Gly Pro Tyr Gly Pro Gly Gly Ser Gly Ser
545                 550                 555                 560

Gly Gln Gln Gly Pro Gly Gln Gln Gly Pro Tyr Ala Ser Ala Ala Ala
                565                 570                 575

Ala Ala Gly Pro Gly Ser Gly Gln Gln Gly Pro Gly Ala Ser
            580                 585                 590


<210> SEQ ID NO 18
<211> LENGTH: 601
<212> TYPE: PRT
<213> ORGANISM: Artificial Sequence
<220> FEATURE:
<223> OTHER INFORMATION: PRT399

<400> SEQUENCE: 18

Met His His His His His His Ser Ser Gly Ser Ser Gly Pro Gly Gly
1               5                   10                  15

Gln Gly Pro Tyr Gly Pro Gly Ala Ser Ala Ala Ala Ala Ala Gly Gly
            20                  25                  30
```

```
Asn Gly Pro Gly Ser Gly Gln Gln Gly Pro Gly Gly Ser Gly Gly Tyr
        35                  40                  45

Gly Pro Gly Gly Gln Gly Pro Gly Gln Gln Gly Pro Gly Ser Ser Ala
    50                  55                  60

Ala Ala Ala Ala Gly Pro Gly Gly Tyr Gly Pro Gly Gly Gln Gly Pro
65                  70                  75                  80

Ser Ala Ser Ala Ala Ala Ala Ala Gly Pro Gly Ser Gly Gln Gln Gly
                85                  90                  95

Pro Gly Ala Ser Gly Gly Tyr Gly Pro Gly Gly Gln Gly Pro Gly Gln
            100                 105                 110

Gln Gly Pro Gly Ser Ser Ala Ala Ala Ala Ala Gly Gly Tyr Gly Ser
        115                 120                 125

Gly Pro Gly Gln Gln Gly Pro Tyr Gly Ser Ala Ala Ala Ala Ala Gly
    130                 135                 140

Pro Gly Ser Gly Gly Tyr Gly Gln Gly Pro Tyr Gly Pro Gly Ala Ser
145                 150                 155                 160

Gly Pro Gly Gly Tyr Gly Pro Gly Gly Gln Gly Pro Ser Ala Ser Ala
                165                 170                 175

Ala Ala Ala Ala Gly Ser Gly Gln Gln Gly Pro Gly Gly Tyr Gly Pro
            180                 185                 190

Tyr Ala Ser Ala Ala Ala Ala Ala Gly Gly Tyr Gly Ser Gly Pro Gly
        195                 200                 205

Gln Gln Gly Pro Tyr Gly Pro Gly Gly Ser Gly Ser Gly Gln Gln Gly
    210                 215                 220

Pro Gly Gln Gln Gly Pro Tyr Ala Ser Ala Ala Ala Ala Ala Gly Pro
225                 230                 235                 240

Gly Gly Gln Gly Pro Tyr Gly Pro Gly Ser Ser Ala Ala Ala Ala Ala
                245                 250                 255

Gly Gly Tyr Gly Tyr Gly Pro Gly Gly Gln Gly Pro Tyr Gly Pro Gly
            260                 265                 270

Ala Ser Gly Gly Asn Gly Pro Gly Ser Gly Gly Tyr Gly Pro Gly Gln
        275                 280                 285

Gln Gly Pro Gly Gly Ser Ala Ala Ala Ala Ala Gly Pro Gly Gly Gln
    290                 295                 300

Gly Pro Tyr Gly Pro Gly Ala Ser Ala Ala Ala Ala Ala Gly Gly Tyr
305                 310                 315                 320

Gly Pro Gly Gly Gln Gly Pro Gly Gly Tyr Gly Pro Gly Ser Ser Gly
                325                 330                 335

Pro Gly Gly Gln Gly Pro Tyr Gly Pro Gly Ser Ser Ala Ala Ala Ala
            340                 345                 350

Ala Gly Gly Tyr Gly Pro Gly Gln Gln Gly Pro Tyr Gly Pro Gly Gly
        355                 360                 365

Ser Ala Ala Ala Ala Ala Gly Gly Tyr Gln Gln Gly Pro Gly Gly Gln
    370                 375                 380

Gly Pro Tyr Gly Pro Gly Ala Ser Gly Pro Gly Gly Gln Gly Pro Tyr
385                 390                 395                 400

Gly Pro Gly Ala Ser Ala Ala Ala Ala Ala Gly Pro Gly Gly Tyr Gly
                405                 410                 415

Pro Gly Gly Gln Gly Pro Ser Ala Ser Ala Ala Ala Ala Ala Gly Gly
            420                 425                 430

Tyr Gly Ser Gly Pro Gly Gly Tyr Gly Pro Tyr Gly Pro Gly Gly Ser
        435                 440                 445

Gly Pro Gly Ser Gly Gln Gln Gly Gln Gly Pro Tyr Gly Pro Gly Ala
```

```
    450                 455                 460

Ser Ala Ala Ala Ala Ala Gly Gly Tyr Gly Pro Gly Gln Gln Gly Pro
465                 470                 475                 480

Tyr Gly Pro Gly Gly Ser Ala Ala Ala Ala Ala Gly Pro Gly Ser Gly
                485                 490                 495

Gly Tyr Gly Pro Gly Ala Ser Gly Gly Asn Gly Pro Gly Ser Gly Gly
            500                 505                 510

Tyr Gly Pro Gly Gln Gln Gly Pro Gly Gly Ser Ala Ala Ala Ala Ala
        515                 520                 525

Gly Gly Tyr Gln Gln Gly Pro Gly Gly Gln Gly Pro Tyr Gly Pro Gly
    530                 535                 540

Ala Ser Ala Ala Ala Ala Ala Gly Gly Tyr Gly Ser Gly Pro Gly Gln
545                 550                 555                 560

Gln Gly Pro Tyr Gly Pro Gly Gly Ser Gly Ser Gly Gln Gln Gly Pro
                565                 570                 575

Gly Gln Gln Gly Pro Tyr Ala Ser Ala Ala Ala Ala Ala Gly Pro Gly
            580                 585                 590

Ser Gly Gln Gln Gly Pro Gly Ala Ser
        595                 600


<210> SEQ ID NO 19
<211> LENGTH: 612
<212> TYPE: PRT
<213> ORGANISM: Artificial Sequence
<220> FEATURE:
<223> OTHER INFORMATION: Met-PRT720

<400> SEQUENCE: 19

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Gly Gln Tyr Gly Pro Gly Gln Gln Gly Pro Gly Gln Gln Gly
        35                  40                  45

Pro Gly Ser Ser Ala Ala Ala Ala Ala Gly Pro Gly Gln Tyr Val Leu
    50                  55                  60

Ile Gly Pro Gly Gln Gln Val Leu Ile Gly Pro Ser Ala Ser Ala Ala
65                  70                  75                  80

Ala Ala Ala Gly Pro Gly Ser Gly Gln Gln Gly Pro Gly Ala Ser Gly
                85                  90                  95

Gln Tyr Gly Pro Gly Gln Gln Gly Pro Gly Gln Gln Gly Pro Gly Ser
            100                 105                 110

Ser Ala Ala Ala Ala Ala Gly Ser Tyr Gly Ser Val Leu Ile Gly Pro
        115                 120                 125

Gly Gln Gln Val Leu Ile Gly Pro Tyr Gly Ser Ala Ala Ala Ala Ala
    130                 135                 140

Gly Pro Gly Ser Gly Gln Tyr Gly Gln Gly Pro Tyr Gly Pro Gly Ala
145                 150                 155                 160

Ser Gly Pro Gly Gln Tyr Gly Pro Gly Gln Gln Gly Pro Ser Ala Ser
                165                 170                 175

Ala Ala Ala Ala Ala Gly Ser Gly Gln Gln Val Leu Ile Gly Pro Gly
            180                 185                 190

Gln Tyr Val Leu Ile Gly Pro Tyr Ala Ser Ala Ala Ala Ala Ala Gly
        195                 200                 205

Gln Tyr Gly Ser Gly Pro Gly Gln Gln Gly Pro Tyr Gly Pro Gly Gln
```

```
    210                 215                 220

Ser Gly Ser Gly Gln Gln Gly Pro Gly Gln Gln Gly Pro Tyr Ala Ser
225                 230                 235                 240

Ala Ala Ala Ala Ala Gly Pro Gly Gln Gln Val Leu Ile Gly Pro Tyr
                245                 250                 255

Val Leu Ile Gly Pro Gly Ser Ser Ala Ala Ala Ala Ala Gly Gln Tyr
            260                 265                 270

Gly Tyr Gly Pro Gly Gln Gln Gly Pro Tyr Gly Pro Gly Ala Ser Gly
        275                 280                 285

Gln Asn Gly Pro Gly Ser Gly Gln Tyr Gly Pro Gly Gln Gln Gly Pro
    290                 295                 300

Gly Gln Ser Ala Ala Ala Ala Ala Gly Pro Gly Gln Gln Val Leu Ile
305                 310                 315                 320

Gly Pro Tyr Val Leu Ile Gly Pro Gly Ala Ser Ala Ala Ala Ala Ala
                325                 330                 335

Gly Gln Tyr Gly Pro Gly Gln Gln Gly Pro Gly Gln Tyr Gly Pro Gly
            340                 345                 350

Ser Ser Gly Pro Gly Gln Gln Gly Pro Tyr Gly Pro Gly Ser Ser Ala
        355                 360                 365

Ala Ala Ala Ala Gly Ser Tyr Gly Pro Gly Gln Gln Val Leu Ile Gly
    370                 375                 380

Pro Tyr Val Leu Ile Gly Pro Gly Pro Ser Ala Ala Ala Ala Ala Gly
385                 390                 395                 400

Gln Tyr Gln Gln Gly Pro Gly Gln Gln Gly Pro Tyr Gly Pro Gly Ala
                405                 410                 415

Ser Gly Pro Gly Gln Gln Gly Pro Tyr Gly Pro Gly Ala Ser Ala Ala
            420                 425                 430

Ala Ala Ala Gly Pro Gly Gln Tyr Val Leu Ile Gly Pro Gly Gln Gln
        435                 440                 445

Val Leu Ile Gly Pro Ser Ala Ser Ala Ala Ala Ala Ala Gly Gln Tyr
    450                 455                 460

Gly Ser Gly Pro Gly Gln Tyr Gly Pro Tyr Gly Pro Gly Gln Ser Gly
465                 470                 475                 480

Pro Gly Ser Gly Gln Gln Gly Gln Gly Pro Tyr Gly Pro Gly Ala Ser
                485                 490                 495

Ala Ala Ala Ala Ala Gly Ser Tyr Gly Pro Gly Gln Gln Val Leu Ile
            500                 505                 510

Gly Pro Tyr Val Leu Ile Gly Pro Gly Pro Ser Ala Ala Ala Ala Ala
        515                 520                 525

Gly Pro Gly Ser Gly Gln Tyr Gly Pro Gly Ala Ser Gly Gln Asn Gly
    530                 535                 540

Pro Gly Ser Gly Gln Tyr Gly Pro Gly Gln Gln Gly Pro Gly Gln Ser
545                 550                 555                 560

Ala Ala Ala Ala Ala Gly Gln Tyr Gln Gln Val Leu Ile Gly Pro Gly
                565                 570                 575

Gln Gln Gly Pro Tyr Val Leu Ile Gly Pro Gly Ala Ser Ala Ala Ala
            580                 585                 590

Ala Ala Gly Pro Gly Ser Gly Gln Gln Val Leu Ile Gly Pro Gly Ala
        595                 600                 605

Ser Val Leu Ile
    610
```

<210> SEQ ID NO 20

<211> LENGTH: 592
<212> TYPE: PRT
<213> ORGANISM: Artificial Sequence
<220> FEATURE:
<223> OTHER INFORMATION: Met-PRT665

<400> SEQUENCE: 20

Met Gly Pro Gly Gln Gln Gly Pro Tyr Gly Pro Gly Ala Ser Ala Ala
1 5 10 15

Ala Ala Ala Ala Ala Gly Ser Asn Gly Pro Gly Ser Gly Gln Gln Gly
20 25 30

Pro Gly Gln Ser Gly Gln Tyr Gly Pro Gly Gln Gln Gly Pro Gly Gln
35 40 45

Gln Gly Pro Gly Ser Ser Ala Ala Ala Ala Ala Ala Ala Gly Pro Gly
50 55 60

Gln Tyr Val Leu Ile Gly Pro Gly Gln Gln Gly Pro Ser Ala Ser Ala
65 70 75 80

Ala Ala Ala Ala Ala Ala Gly Pro Gly Ser Gly Gln Gln Gly Pro Gly
85 90 95

Ala Ser Gly Gln Tyr Gly Pro Gly Gln Gln Gly Pro Gly Gln Gln Gly
100 105 110

Pro Gly Ser Ser Ala Ala Ala Ala Ala Ala Ala Gly Ser Tyr Gly Ser
115 120 125

Val Leu Ile Gly Pro Gly Gln Gln Gly Pro Tyr Gly Ser Ala Ala Ala
130 135 140

Ala Ala Ala Ala Gly Pro Gly Ser Gly Gln Tyr Gly Gln Gly Pro Tyr
145 150 155 160

Gly Pro Gly Ala Ser Gly Pro Gly Gln Tyr Gly Pro Gly Gln Gln Gly
165 170 175

Pro Ser Ala Ser Ala Ala Ala Ala Ala Ala Ala Gly Ser Gly Gln Gln
180 185 190

Val Leu Ile Gly Pro Gly Gln Tyr Gly Pro Tyr Ala Ser Ala Ala Ala
195 200 205

Ala Ala Ala Ala Gly Ser Tyr Gly Ser Gly Pro Gly Gln Gln Gly Pro
210 215 220

Tyr Gly Pro Gly Gln Ser Gly Ser Gly Gln Gln Gly Pro Gly Gln Gln
225 230 235 240

Gly Pro Tyr Ala Ser Ala Ala Ala Ala Ala Ala Ala Gly Pro Gly Gln
245 250 255

Gln Val Leu Ile Gly Pro Tyr Gly Pro Gly Ser Ser Ala Ala Ala Ala
260 265 270

Ala Ala Ala Gly Ser Tyr Gly Tyr Gly Pro Gly Gln Gln Gly Pro Tyr
275 280 285

Gly Pro Gly Ala Ser Gly Gln Asn Gly Pro Gly Ser Gly Gln Tyr Gly
290 295 300

Pro Gly Gln Gln Gly Pro Gly Pro Ser Ala Ala Ala Ala Ala Ala Ala
305 310 315 320

Gly Pro Gly Gln Gln Val Leu Ile Gly Pro Tyr Gly Pro Gly Ala Ser
325 330 335

Ala Ala Ala Ala Ala Ala Ala Gly Ser Tyr Gly Pro Gly Gln Gln Gly
340 345 350

Pro Gly Gln Tyr Gly Pro Gly Ser Ser Gly Pro Gly Gln Gln Gly Pro
355 360 365

Tyr Gly Pro Gly Ser Ser Ala Ala Ala Ala Ala Ala Ala Gly Ser Tyr
370 375 380

```
Gly Pro Gly Gln Gln Val Leu Ile Gly Pro Tyr Gly Pro Gly Pro Ser
385                 390                 395                 400

Ala Ala Ala Ala Ala Ala Ala Gly Ser Tyr Gln Gln Gly Pro Gly Gln
                405                 410                 415

Gln Gly Pro Tyr Gly Pro Gly Ala Ser Gly Pro Gly Gln Gln Gly Pro
            420                 425                 430

Tyr Gly Pro Gly Ala Ser Ala Ala Ala Ala Ala Ala Ala Gly Pro Gly
        435                 440                 445

Gln Tyr Val Leu Ile Gly Pro Gly Gln Gln Gly Pro Ser Ala Ser Ala
    450                 455                 460

Ala Ala Ala Ala Ala Ala Gly Ser Tyr Gly Ser Gly Pro Gly Gln Tyr
465                 470                 475                 480

Gly Pro Tyr Gly Pro Gly Gln Ser Gly Pro Gly Ser Gly Gln Gln Gly
                485                 490                 495

Gln Gly Pro Tyr Gly Pro Gly Ala Ser Ala Ala Ala Ala Ala Ala Ala
            500                 505                 510

Gly Ser Tyr Gly Pro Gly Gln Gln Val Leu Ile Gly Pro Tyr Gly Pro
        515                 520                 525

Gly Pro Ser Ala Ala Ala Ala Ala Ala Ala Gly Pro Gly Ser Gly Gln
    530                 535                 540

Tyr Gly Pro Gly Ala Ser Gly Gln Asn Gly Pro Gly Ser Gly Gln Tyr
545                 550                 555                 560

Gly Pro Gly Gln Gln Gly Pro Gly Pro Ser Ala Ala Ala Ala Ala Ala
                565                 570                 575

Ala Gly Pro Gly Ser Gly Gln Gln Gly Pro Gly Ala Ser Val Leu Ile
            580                 585                 590


<210> SEQ ID NO 21
<211> LENGTH: 619
<212> TYPE: PRT
<213> ORGANISM: Artificial Sequence
<220> FEATURE:
<223> OTHER INFORMATION: Met-PRT666

<400> SEQUENCE: 21

Met Gly Pro Gly Gln Gln Gly Pro Tyr Gly Pro Gly Ala Ser Ala Ala
1               5                   10                  15

Ala Ala Ala Ala Ala Gly Ser Asn Gly Pro Gly Ser Gly Gln Gln Gly
            20                  25                  30

Pro Gly Gln Ser Gly Gln Tyr Gly Pro Gly Gln Gln Gly Pro Gly Gln
        35                  40                  45

Gln Gly Pro Gly Ser Ser Ala Ala Ala Ala Ala Ala Ala Gly Pro Gly
    50                  55                  60

Gln Tyr Val Leu Ile Gly Pro Gly Gln Gln Val Leu Ile Gly Pro Ser
65                  70                  75                  80

Ala Ser Ala Ala Ala Ala Ala Ala Ala Gly Pro Gly Ser Gly Gln Gln
                85                  90                  95

Gly Pro Gly Ala Ser Gly Gln Tyr Gly Pro Gly Gln Gln Gly Pro Gly
            100                 105                 110

Gln Gln Gly Pro Gly Ser Ser Ala Ala Ala Ala Ala Ala Ala Gly Ser
        115                 120                 125

Tyr Gly Ser Val Leu Ile Gly Pro Gly Gln Gln Val Leu Ile Gly Pro
    130                 135                 140

Tyr Gly Ser Ala Ala Ala Ala Ala Ala Ala Gly Pro Gly Ser Gly Gln
145                 150                 155                 160
```

```
Tyr Gly Gln Gly Pro Tyr Gly Pro Gly Ala Ser Gly Pro Gly Gln Tyr
                165                 170                 175

Gly Pro Gly Gln Gln Gly Pro Ser Ala Ser Ala Ala Ala Ala Ala Ala
            180                 185                 190

Ala Gly Ser Gly Gln Gln Val Leu Ile Gly Pro Gly Gln Tyr Val Leu
        195                 200                 205

Ile Gly Pro Tyr Ala Ser Ala Ala Ala Ala Ala Ala Ala Gly Ser Tyr
    210                 215                 220

Gly Ser Gly Pro Gly Gln Gln Gly Pro Tyr Gly Pro Gly Gln Ser Gly
225                 230                 235                 240

Ser Gly Gln Gln Gly Pro Gly Gln Gln Gly Pro Tyr Ala Ser Ala Ala
                245                 250                 255

Ala Ala Ala Ala Ala Gly Pro Gly Gln Gln Val Leu Ile Gly Pro Tyr
            260                 265                 270

Val Leu Ile Gly Pro Gly Ser Ser Ala Ala Ala Ala Ala Ala Ala Gly
        275                 280                 285

Ser Tyr Gly Tyr Gly Pro Gly Gln Gln Gly Pro Tyr Gly Pro Gly Ala
    290                 295                 300

Ser Gly Gln Asn Gly Pro Gly Ser Gly Gln Tyr Gly Pro Gly Gln Gln
305                 310                 315                 320

Gly Pro Gly Pro Ser Ala Ala Ala Ala Ala Ala Ala Gly Pro Gly Gln
                325                 330                 335

Gln Val Leu Ile Gly Pro Tyr Val Leu Ile Gly Pro Gly Ala Ser Ala
            340                 345                 350

Ala Ala Ala Ala Ala Ala Gly Ser Tyr Gly Pro Gly Gln Gln Gly Pro
        355                 360                 365

Gly Gln Tyr Gly Pro Gly Ser Ser Gly Pro Gly Gln Gln Gly Pro Tyr
    370                 375                 380

Gly Pro Gly Ser Ser Ala Ala Ala Ala Ala Ala Ala Gly Ser Tyr Gly
385                 390                 395                 400

Pro Gly Gln Gln Val Leu Ile Gly Pro Tyr Val Leu Ile Gly Pro Gly
                405                 410                 415

Pro Ser Ala Ala Ala Ala Ala Ala Ala Gly Ser Tyr Gln Gln Gly Pro
            420                 425                 430

Gly Gln Gln Gly Pro Tyr Gly Pro Gly Ala Ser Gly Pro Gly Gln Gln
        435                 440                 445

Gly Pro Tyr Gly Pro Gly Ala Ser Ala Ala Ala Ala Ala Ala Ala Gly
    450                 455                 460

Pro Gly Gln Tyr Val Leu Ile Gly Pro Gly Gln Gln Val Leu Ile Gly
465                 470                 475                 480

Pro Ser Ala Ser Ala Ala Ala Ala Ala Ala Ala Gly Ser Tyr Gly Ser
                485                 490                 495

Gly Pro Gly Gln Tyr Gly Pro Tyr Gly Pro Gly Gln Ser Gly Pro Gly
            500                 505                 510

Ser Gly Gln Gln Gly Gln Gly Pro Tyr Gly Pro Gly Ala Ser Ala Ala
        515                 520                 525

Ala Ala Ala Ala Ala Gly Ser Tyr Gly Pro Gly Gln Gln Val Leu Ile
    530                 535                 540

Gly Pro Tyr Val Leu Ile Gly Pro Gly Pro Ser Ala Ala Ala Ala Ala
545                 550                 555                 560

Ala Ala Gly Pro Gly Ser Gly Gln Tyr Gly Pro Gly Ala Ser Gly Gln
                565                 570                 575
```

```
Asn Gly Pro Gly Ser Gly Gln Tyr Gly Pro Gly Gln Gln Gly Pro Gly
            580                 585                 590

Pro Ser Ala Ala Ala Ala Ala Ala Ala Gly Pro Gly Ser Gly Gln Gln
        595                 600                 605

Val Leu Ile Gly Pro Gly Ala Ser Val Leu Ile
    610                 615


<210> SEQ ID NO 22
<211> LENGTH: 623
<212> TYPE: PRT
<213> ORGANISM: Artificial Sequence
<220> FEATURE:
<223> OTHER INFORMATION: PRT720

<400> SEQUENCE: 22

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Gly Gln Tyr
        35                  40                  45

Gly Pro Gly Gln Gln Gly Pro Gly Gln Gln Gly Pro Gly Ser Ser Ala
    50                  55                  60

Ala Ala Ala Ala Gly Pro Gly Gln Tyr Val Leu Ile Gly Pro Gly Gln
65                  70                  75                  80

Gln Val Leu Ile Gly Pro Ser Ala Ser Ala Ala Ala Ala Ala Gly Pro
                85                  90                  95

Gly Ser Gly Gln Gln Gly Pro Gly Ala Ser Gly Gln Tyr Gly Pro Gly
            100                 105                 110

Gln Gln Gly Pro Gly Gln Gln Gly Pro Gly Ser Ser Ala Ala Ala Ala
        115                 120                 125

Ala Gly Ser Tyr Gly Ser Val Leu Ile Gly Pro Gly Gln Gln Val Leu
    130                 135                 140

Ile Gly Pro Tyr Gly Ser Ala Ala Ala Ala Ala Gly Pro Gly Ser Gly
145                 150                 155                 160

Gln Tyr Gly Gln Gly Pro Tyr Gly Pro Gly Ala Ser Gly Pro Gly Gln
                165                 170                 175

Tyr Gly Pro Gly Gln Gln Gly Pro Ser Ala Ser Ala Ala Ala Ala Ala
            180                 185                 190

Gly Ser Gly Gln Gln Val Leu Ile Gly Pro Gly Gln Tyr Val Leu Ile
        195                 200                 205

Gly Pro Tyr Ala Ser Ala Ala Ala Ala Ala Gly Gln Tyr Gly Ser Gly
    210                 215                 220

Pro Gly Gln Gln Gly Pro Tyr Gly Pro Gly Gln Ser Gly Ser Gly Gln
225                 230                 235                 240

Gln Gly Pro Gly Gln Gln Gly Pro Tyr Ala Ser Ala Ala Ala Ala Ala
                245                 250                 255

Gly Pro Gly Gln Gln Val Leu Ile Gly Pro Tyr Val Leu Ile Gly Pro
            260                 265                 270

Gly Ser Ser Ala Ala Ala Ala Ala Gly Gln Tyr Gly Tyr Gly Pro Gly
        275                 280                 285

Gln Gln Gly Pro Tyr Gly Pro Gly Ala Ser Gly Gln Asn Gly Pro Gly
    290                 295                 300

Ser Gly Gln Tyr Gly Pro Gly Gln Gln Gly Pro Gly Gln Ser Ala Ala
305                 310                 315                 320
```

```
Ala Ala Ala Gly Pro Gly Gln Gln Val Leu Ile Gly Pro Tyr Val Leu
                325                 330                 335

Ile Gly Pro Gly Ala Ser Ala Ala Ala Ala Ala Gly Gln Tyr Gly Pro
            340                 345                 350

Gly Gln Gln Gly Pro Gly Gln Tyr Gly Pro Gly Ser Ser Gly Pro Gly
        355                 360                 365

Gln Gln Gly Pro Tyr Gly Pro Gly Ser Ser Ala Ala Ala Ala Ala Gly
    370                 375                 380

Ser Tyr Gly Pro Gly Gln Gln Val Leu Ile Gly Pro Tyr Val Leu Ile
385                 390                 395                 400

Gly Pro Gly Pro Ser Ala Ala Ala Ala Ala Gly Gln Tyr Gln Gln Gly
                405                 410                 415

Pro Gly Gln Gln Gly Pro Tyr Gly Pro Gly Ala Ser Gly Pro Gly Gln
            420                 425                 430

Gln Gly Pro Tyr Gly Pro Gly Ala Ser Ala Ala Ala Ala Ala Gly Pro
        435                 440                 445

Gly Gln Tyr Val Leu Ile Gly Pro Gly Gln Gln Val Leu Ile Gly Pro
    450                 455                 460

Ser Ala Ser Ala Ala Ala Ala Ala Gly Gln Tyr Gly Ser Gly Pro Gly
465                 470                 475                 480

Gln Tyr Gly Pro Tyr Gly Pro Gly Gln Ser Gly Pro Gly Ser Gly Gln
                485                 490                 495

Gln Gly Gln Gly Pro Tyr Gly Pro Gly Ala Ser Ala Ala Ala Ala Ala
            500                 505                 510

Gly Ser Tyr Gly Pro Gly Gln Gln Val Leu Ile Gly Pro Tyr Val Leu
        515                 520                 525

Ile Gly Pro Gly Pro Ser Ala Ala Ala Ala Ala Gly Pro Gly Ser Gly
    530                 535                 540

Gln Tyr Gly Pro Gly Ala Ser Gly Gln Asn Gly Pro Gly Ser Gly Gln
545                 550                 555                 560

Tyr Gly Pro Gly Gln Gln Gly Pro Gly Gln Ser Ala Ala Ala Ala Ala
                565                 570                 575

Gly Gln Tyr Gln Gln Val Leu Ile Gly Pro Gly Gln Gln Gly Pro Tyr
            580                 585                 590

Val Leu Ile Gly Pro Gly Ala Ser Ala Ala Ala Ala Ala Gly Pro Gly
        595                 600                 605

Ser Gly Gln Gln Val Leu Ile Gly Pro Gly Ala Ser Val Leu Ile
    610                 615                 620


<210> SEQ ID NO 23
<211> LENGTH: 603
<212> TYPE: PRT
<213> ORGANISM: Artificial Sequence
<220> FEATURE:
<223> OTHER INFORMATION: PRT665

<400> SEQUENCE: 23

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Ala Ala
            20                  25                  30

Gly Ser Asn Gly Pro Gly Ser Gly Gln Gln Gly Pro Gly Gln Ser Gly
        35                  40                  45

Gln Tyr Gly Pro Gly Gln Gln Gly Pro Gly Gln Gln Gly Pro Gly Ser
    50                  55                  60
```

```
Ser Ala Ala Ala Ala Ala Ala Ala Gly Pro Gly Gln Tyr Val Leu Ile
65                  70                  75                  80

Gly Pro Gly Gln Gln Gly Pro Ser Ala Ser Ala Ala Ala Ala Ala Ala
                85                  90                  95

Ala Gly Pro Gly Ser Gly Gln Gln Gly Pro Gly Ala Ser Gly Gln Tyr
            100                 105                 110

Gly Pro Gly Gln Gln Gly Pro Gly Gln Gln Gly Pro Gly Ser Ser Ala
        115                 120                 125

Ala Ala Ala Ala Ala Ala Gly Ser Tyr Gly Ser Val Leu Ile Gly Pro
    130                 135                 140

Gly Gln Gln Gly Pro Tyr Gly Ser Ala Ala Ala Ala Ala Ala Ala Gly
145                 150                 155                 160

Pro Gly Ser Gly Gln Tyr Gly Gln Gly Pro Tyr Gly Pro Gly Ala Ser
                165                 170                 175

Gly Pro Gly Gln Tyr Gly Pro Gly Gln Gln Gly Pro Ser Ala Ser Ala
            180                 185                 190

Ala Ala Ala Ala Ala Ala Gly Ser Gly Gln Gln Val Leu Ile Gly Pro
        195                 200                 205

Gly Gln Tyr Gly Pro Tyr Ala Ser Ala Ala Ala Ala Ala Ala Ala Gly
    210                 215                 220

Ser Tyr Gly Ser Gly Pro Gly Gln Gln Gly Pro Tyr Gly Pro Gly Gln
225                 230                 235                 240

Ser Gly Ser Gly Gln Gln Gly Pro Gly Gln Gln Gly Pro Tyr Ala Ser
                245                 250                 255

Ala Ala Ala Ala Ala Ala Ala Gly Pro Gly Gln Gln Val Leu Ile Gly
            260                 265                 270

Pro Tyr Gly Pro Gly Ser Ser Ala Ala Ala Ala Ala Ala Ala Gly Ser
        275                 280                 285

Tyr Gly Tyr Gly Pro Gly Gln Gln Gly Pro Tyr Gly Pro Gly Ala Ser
    290                 295                 300

Gly Gln Asn Gly Pro Gly Ser Gly Gln Tyr Gly Pro Gly Gln Gln Gly
305                 310                 315                 320

Pro Gly Pro Ser Ala Ala Ala Ala Ala Ala Ala Gly Pro Gly Gln Gln
                325                 330                 335

Val Leu Ile Gly Pro Tyr Gly Pro Gly Ala Ser Ala Ala Ala Ala Ala
            340                 345                 350

Ala Ala Gly Ser Tyr Gly Pro Gly Gln Gln Gly Pro Gly Gln Tyr Gly
        355                 360                 365

Pro Gly Ser Ser Gly Pro Gly Gln Gln Gly Pro Tyr Gly Pro Gly Ser
    370                 375                 380

Ser Ala Ala Ala Ala Ala Ala Ala Gly Ser Tyr Gly Pro Gly Gln Gln
385                 390                 395                 400

Val Leu Ile Gly Pro Tyr Gly Pro Gly Pro Ser Ala Ala Ala Ala Ala
                405                 410                 415

Ala Ala Gly Ser Tyr Gln Gln Gly Pro Gly Gln Gln Gly Pro Tyr Gly
            420                 425                 430

Pro Gly Ala Ser Gly Pro Gly Gln Gln Gly Pro Tyr Gly Pro Gly Ala
        435                 440                 445

Ser Ala Ala Ala Ala Ala Ala Ala Gly Pro Gly Gln Tyr Val Leu Ile
    450                 455                 460

Gly Pro Gly Gln Gln Gly Pro Ser Ala Ser Ala Ala Ala Ala Ala Ala
465                 470                 475                 480

Ala Gly Ser Tyr Gly Ser Gly Pro Gly Gln Tyr Gly Pro Tyr Gly Pro
```

```
                485                 490                 495

Gly Gln Ser Gly Pro Gly Ser Gly Gln Gln Gly Gln Gly Pro Tyr Gly
            500                 505                 510

Pro Gly Ala Ser Ala Ala Ala Ala Ala Ala Ala Gly Ser Tyr Gly Pro
        515                 520                 525

Gly Gln Gln Val Leu Ile Gly Pro Tyr Gly Pro Gly Pro Ser Ala Ala
    530                 535                 540

Ala Ala Ala Ala Ala Gly Pro Gly Ser Gly Gln Tyr Gly Pro Gly Ala
545                 550                 555                 560

Ser Gly Gln Asn Gly Pro Gly Ser Gly Gln Tyr Gly Pro Gly Gln Gln
                565                 570                 575

Gly Pro Gly Pro Ser Ala Ala Ala Ala Ala Ala Ala Gly Pro Gly Ser
            580                 585                 590

Gly Gln Gln Gly Pro Gly Ala Ser Val Leu Ile
        595                 600


<210> SEQ ID NO 24
<211> LENGTH: 630
<212> TYPE: PRT
<213> ORGANISM: Artificial Sequence
<220> FEATURE:
<223> OTHER INFORMATION: PRT666

<400> SEQUENCE: 24

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Ala Ala
            20                  25                  30

Gly Ser Asn Gly Pro Gly Ser Gly Gln Gln Gly Pro Gly Gln Ser Gly
        35                  40                  45

Gln Tyr Gly Pro Gly Gln Gln Gly Pro Gly Gln Gln Gly Pro Gly Ser
    50                  55                  60

Ser Ala Ala Ala Ala Ala Ala Ala Gly Pro Gly Gln Tyr Val Leu Ile
65                  70                  75                  80

Gly Pro Gly Gln Gln Val Leu Ile Gly Pro Ser Ala Ser Ala Ala Ala
                85                  90                  95

Ala Ala Ala Ala Gly Pro Gly Ser Gly Gln Gln Gly Pro Gly Ala Ser
            100                 105                 110

Gly Gln Tyr Gly Pro Gly Gln Gln Gly Pro Gly Gln Gln Gly Pro Gly
        115                 120                 125

Ser Ser Ala Ala Ala Ala Ala Ala Ala Gly Ser Tyr Gly Ser Val Leu
    130                 135                 140

Ile Gly Pro Gly Gln Gln Val Leu Ile Gly Pro Tyr Gly Ser Ala Ala
145                 150                 155                 160

Ala Ala Ala Ala Ala Gly Pro Gly Ser Gly Gln Tyr Gly Gln Gly Pro
                165                 170                 175

Tyr Gly Pro Gly Ala Ser Gly Pro Gly Gln Tyr Gly Pro Gly Gln Gln
            180                 185                 190

Gly Pro Ser Ala Ser Ala Ala Ala Ala Ala Ala Ala Gly Ser Gly Gln
        195                 200                 205

Gln Val Leu Ile Gly Pro Gly Gln Tyr Val Leu Ile Gly Pro Tyr Ala
    210                 215                 220

Ser Ala Ala Ala Ala Ala Ala Ala Gly Ser Tyr Gly Ser Gly Pro Gly
225                 230                 235                 240

Gln Gln Gly Pro Tyr Gly Pro Gly Gln Ser Gly Ser Gly Gln Gln Gly
```

```
                245                 250                 255

Pro Gly Gln Gln Gly Pro Tyr Ala Ser Ala Ala Ala Ala Ala Ala Ala
            260                 265                 270

Gly Pro Gly Gln Gln Val Leu Ile Gly Pro Tyr Val Leu Ile Gly Pro
        275                 280                 285

Gly Ser Ser Ala Ala Ala Ala Ala Ala Ala Gly Ser Tyr Gly Tyr Gly
    290                 295                 300

Pro Gly Gln Gln Gly Pro Tyr Gly Pro Gly Ala Ser Gly Gln Asn Gly
305                 310                 315                 320

Pro Gly Ser Gly Gln Tyr Gly Pro Gly Gln Gln Gly Pro Gly Pro Ser
                325                 330                 335

Ala Ala Ala Ala Ala Ala Ala Gly Pro Gly Gln Gln Val Leu Ile Gly
            340                 345                 350

Pro Tyr Val Leu Ile Gly Pro Gly Ala Ser Ala Ala Ala Ala Ala Ala
        355                 360                 365

Ala Gly Ser Tyr Gly Pro Gly Gln Gln Gly Pro Gly Gln Tyr Gly Pro
    370                 375                 380

Gly Ser Ser Gly Pro Gly Gln Gln Gly Pro Tyr Gly Pro Gly Ser Ser
385                 390                 395                 400

Ala Ala Ala Ala Ala Ala Ala Gly Ser Tyr Gly Pro Gly Gln Gln Val
                405                 410                 415

Leu Ile Gly Pro Tyr Val Leu Ile Gly Pro Gly Pro Ser Ala Ala Ala
            420                 425                 430

Ala Ala Ala Ala Gly Ser Tyr Gln Gln Gly Pro Gly Gln Gln Gly Pro
        435                 440                 445

Tyr Gly Pro Gly Ala Ser Gly Pro Gly Gln Gln Gly Pro Tyr Gly Pro
    450                 455                 460

Gly Ala Ser Ala Ala Ala Ala Ala Ala Ala Gly Pro Gly Gln Tyr Val
465                 470                 475                 480

Leu Ile Gly Pro Gly Gln Gln Val Leu Ile Gly Pro Ser Ala Ser Ala
                485                 490                 495

Ala Ala Ala Ala Ala Ala Gly Ser Tyr Gly Ser Gly Pro Gly Gln Tyr
            500                 505                 510

Gly Pro Tyr Gly Pro Gly Gln Ser Gly Pro Gly Ser Gly Gln Gln Gly
        515                 520                 525

Gln Gly Pro Tyr Gly Pro Gly Ala Ser Ala Ala Ala Ala Ala Ala Ala
    530                 535                 540

Gly Ser Tyr Gly Pro Gly Gln Gln Val Leu Ile Gly Pro Tyr Val Leu
545                 550                 555                 560

Ile Gly Pro Gly Pro Ser Ala Ala Ala Ala Ala Ala Ala Gly Pro Gly
                565                 570                 575

Ser Gly Gln Tyr Gly Pro Gly Ala Ser Gly Gln Asn Gly Pro Gly Ser
            580                 585                 590

Gly Gln Tyr Gly Pro Gly Gln Gln Gly Pro Gly Pro Ser Ala Ala Ala
        595                 600                 605

Ala Ala Ala Ala Gly Pro Gly Ser Gly Gln Gln Val Leu Ile Gly Pro
    610                 615                 620

Gly Ala Ser Val Leu Ile
625                 630
```

<210> SEQ ID NO 25
<211> LENGTH: 593
<212> TYPE: PRT
<213> ORGANISM: Artificial Sequence <220> FEATURE:
<223> OTHER INFORMATION: Met-PRT888

<400> SEQUENCE: 25

Met Gly Ser Ser Gly Pro Gly Val Leu Gly Pro Tyr Gly Pro Gly Ala
1 5 10 15

Ser Ala Ala Ala Ala Ala Gly Gln Asn Gly Pro Gly Ser Gly Val Leu
20 25 30

Gly Pro Gly Gln Ser Gly Gln Tyr Gly Pro Gly Val Leu Gly Pro Gly
35 40 45

Val Leu Gly Pro Gly Ser Ser Ala Ala Ala Ala Ala Gly Pro Gly Gln
50 55 60

Tyr Gly Pro Gly Val Leu Gly Pro Ser Ala Ser Ala Ala Ala Ala Ala
65 70 75 80

Gly Pro Gly Ser Gly Val Leu Gly Pro Gly Ala Ser Gly Gln Tyr Gly
85 90 95

Pro Gly Val Leu Gly Pro Gly Val Leu Gly Pro Gly Ser Ser Ala Ala
100 105 110

Ala Ala Ala Gly Gln Tyr Gly Ser Gly Pro Gly Val Leu Gly Pro Tyr
115 120 125

Gly Ser Ala Ala Ala Ala Ala Gly Pro Gly Ser Gly Gln Tyr Gly Gln
130 135 140

Gly Pro Tyr Gly Pro Gly Ala Ser Gly Pro Gly Gln Tyr Gly Pro Gly
145 150 155 160

Val Leu Gly Pro Ser Ala Ser Ala Ala Ala Ala Ala Gly Ser Gly Val
165 170 175

Leu Gly Pro Gly Gln Tyr Gly Pro Tyr Ala Ser Ala Ala Ala Ala Ala
180 185 190

Gly Gln Tyr Gly Ser Gly Pro Gly Val Leu Gly Pro Tyr Gly Pro Gly
195 200 205

Gln Ser Gly Ser Gly Val Leu Gly Pro Gly Val Leu Gly Pro Tyr Ala
210 215 220

Ser Ala Ala Ala Ala Ala Gly Pro Gly Val Leu Gly Pro Tyr Gly Pro
225 230 235 240

Gly Ser Ser Ala Ala Ala Ala Ala Gly Gln Tyr Gly Tyr Gly Pro Gly
245 250 255

Val Leu Gly Pro Tyr Gly Pro Gly Ala Ser Gly Gln Asn Gly Pro Gly
260 265 270

Ser Gly Gln Tyr Gly Pro Gly Val Leu Gly Pro Gly Gln Ser Ala Ala
275 280 285

Ala Ala Ala Gly Pro Gly Val Leu Gly Pro Tyr Gly Pro Gly Ala Ser
290 295 300

Ala Ala Ala Ala Ala Gly Gln Tyr Gly Pro Gly Val Leu Gly Pro Gly
305 310 315 320

Gln Tyr Gly Pro Gly Ser Ser Gly Pro Gly Val Leu Gly Pro Tyr Gly
325 330 335

Pro Gly Ser Ser Ala Ala Ala Ala Ala Gly Gln Tyr Gly Pro Gly Val
340 345 350

Leu Gly Pro Tyr Gly Pro Gly Gln Ser Ala Ala Ala Ala Ala Gly Gln
355 360 365

Tyr Val Leu Gly Pro Gly Val Leu Gly Pro Tyr Gly Pro Gly Ala Ser
370 375 380

Gly Pro Gly Val Leu Gly Pro Tyr Gly Pro Gly Ala Ser Ala Ala Ala
385 390 395 400

```
Ala Ala Gly Pro Gly Gln Tyr Gly Pro Gly Val Leu Gly Pro Ser Ala
                405                 410                 415

Ser Ala Ala Ala Ala Ala Gly Gln Tyr Gly Ser Gly Pro Gly Gln Tyr
            420                 425                 430

Gly Pro Tyr Gly Pro Gly Gln Ser Gly Pro Gly Ser Gly Val Leu Gly
        435                 440                 445

Gln Gly Pro Tyr Gly Pro Gly Ala Ser Ala Ala Ala Ala Ala Gly Gln
    450                 455                 460

Tyr Gly Pro Gly Val Leu Gly Pro Tyr Gly Pro Gly Gln Ser Ala Ala
465                 470                 475                 480

Ala Ala Ala Gly Pro Gly Ser Gly Gln Tyr Gly Pro Gly Ala Ser Gly
                485                 490                 495

Gln Asn Gly Pro Gly Ser Gly Gln Tyr Gly Pro Gly Val Leu Gly Pro
            500                 505                 510

Gly Gln Ser Ala Ala Ala Ala Ala Gly Gln Tyr Val Leu Gly Pro Gly
        515                 520                 525

Val Leu Gly Pro Tyr Gly Pro Gly Ala Ser Ala Ala Ala Ala Ala Gly
    530                 535                 540

Gln Tyr Gly Ser Gly Pro Gly Val Leu Gly Pro Tyr Gly Pro Gly Gln
545                 550                 555                 560

Ser Gly Ser Gly Val Leu Gly Pro Gly Val Leu Gly Pro Tyr Ala Ser
                565                 570                 575

Ala Ala Ala Ala Ala Gly Pro Gly Ser Gly Val Leu Gly Pro Gly Ala
            580                 585                 590

Ser


<210> SEQ ID NO 26
<211> LENGTH: 590
<212> TYPE: PRT
<213> ORGANISM: Artificial Sequence
<220> FEATURE:
<223> OTHER INFORMATION: Met-PRT965

<400> SEQUENCE: 26

Met Gly Pro Gly Thr Ser Gly Pro Tyr Gly Pro Gly Ala Ser Ala Ala
1               5                   10                  15

Ala Ala Ala Gly Ala Asn Gly Pro Gly Ser Gly Thr Ser Gly Pro Gly
            20                  25                  30

Ala Ser Gly Ala Tyr Gly Pro Gly Thr Ser Gly Pro Gly Thr Ser Gly
        35                  40                  45

Pro Gly Ser Ser Ala Ala Ala Ala Ala Gly Pro Gly Ala Tyr Gly Pro
    50                  55                  60

Gly Thr Ser Gly Pro Ser Ala Ser Ala Ala Ala Ala Ala Gly Pro Gly
65                  70                  75                  80

Ser Gly Thr Ser Gly Pro Gly Ala Ser Gly Ala Tyr Gly Pro Gly Thr
                85                  90                  95

Ser Gly Pro Gly Thr Ser Gly Pro Gly Ser Ser Ala Ala Ala Ala Ala
            100                 105                 110

Gly Ala Tyr Gly Ser Gly Pro Gly Thr Ser Gly Pro Tyr Gly Ser Ala
        115                 120                 125

Ala Ala Ala Ala Gly Pro Gly Ser Gly Ala Tyr Gly Ala Gly Pro Tyr
    130                 135                 140

Gly Pro Gly Ala Ser Gly Pro Gly Ala Tyr Gly Pro Gly Thr Ser Gly
145                 150                 155                 160
```

```
Pro Ser Ala Ser Ala Ala Ala Ala Ala Gly Ser Gly Thr Ser Gly Pro
                165                 170                 175

Gly Ala Tyr Gly Pro Tyr Ala Ser Ala Ala Ala Ala Ala Gly Ala Tyr
            180                 185                 190

Gly Ser Gly Pro Gly Thr Ser Gly Pro Tyr Gly Pro Gly Ala Ser Gly
        195                 200                 205

Ser Gly Thr Ser Gly Pro Gly Thr Ser Gly Pro Tyr Ala Ser Ala Ala
    210                 215                 220

Ala Ala Ala Gly Pro Gly Thr Ser Gly Pro Tyr Gly Pro Gly Ser Ser
225                 230                 235                 240

Ala Ala Ala Ala Ala Gly Ala Tyr Gly Tyr Gly Pro Gly Thr Ser Gly
                245                 250                 255

Pro Tyr Gly Pro Gly Ala Ser Gly Ala Asn Gly Pro Gly Ser Gly Ala
            260                 265                 270

Tyr Gly Pro Gly Thr Ser Gly Pro Gly Ala Ser Ala Ala Ala Ala Ala
        275                 280                 285

Gly Pro Gly Thr Ser Gly Pro Tyr Gly Pro Gly Ala Ser Ala Ala Ala
    290                 295                 300

Ala Ala Gly Ala Tyr Gly Pro Gly Thr Ser Gly Pro Gly Ala Tyr Gly
305                 310                 315                 320

Pro Gly Ser Ser Gly Pro Gly Thr Ser Gly Pro Tyr Gly Pro Gly Ser
                325                 330                 335

Ser Ala Ala Ala Ala Ala Gly Ala Tyr Gly Pro Gly Thr Ser Gly Pro
            340                 345                 350

Tyr Gly Pro Gly Ala Ser Ala Ala Ala Ala Ala Gly Ala Tyr Thr Ser
        355                 360                 365

Gly Pro Gly Thr Ser Gly Pro Tyr Gly Pro Gly Ala Ser Gly Pro Gly
    370                 375                 380

Thr Ser Gly Pro Tyr Gly Pro Gly Ala Ser Ala Ala Ala Ala Ala Gly
385                 390                 395                 400

Pro Gly Ala Tyr Gly Pro Gly Thr Ser Gly Pro Ser Ala Ser Ala Ala
                405                 410                 415

Ala Ala Ala Gly Ala Tyr Gly Ser Gly Pro Gly Ala Tyr Gly Pro Tyr
            420                 425                 430

Gly Pro Gly Ala Ser Gly Pro Gly Ser Gly Thr Ser Gly Ala Gly Pro
        435                 440                 445

Tyr Gly Pro Gly Ala Ser Ala Ala Ala Ala Ala Gly Ala Tyr Gly Pro
    450                 455                 460

Gly Thr Ser Gly Pro Tyr Gly Pro Gly Ala Ser Ala Ala Ala Ala Ala
465                 470                 475                 480

Gly Pro Gly Ser Gly Ala Tyr Gly Pro Gly Ala Ser Gly Ala Asn Gly
                485                 490                 495

Pro Gly Ser Gly Ala Tyr Gly Pro Gly Thr Ser Gly Pro Gly Ala Ser
            500                 505                 510

Ala Ala Ala Ala Ala Gly Ala Tyr Thr Ser Gly Pro Gly Thr Ser Gly
        515                 520                 525

Pro Tyr Gly Pro Gly Ala Ser Ala Ala Ala Ala Ala Gly Ala Tyr Gly
    530                 535                 540

Ser Gly Pro Gly Thr Ser Gly Pro Tyr Gly Pro Gly Ala Ser Gly Ser
545                 550                 555                 560

Gly Thr Ser Gly Pro Gly Thr Ser Gly Pro Tyr Ala Ser Ala Ala Ala
                565                 570                 575

Ala Ala Gly Pro Gly Ser Gly Thr Ser Gly Pro Gly Ala Ser
```

580 585 590

<210> SEQ ID NO 27
<211> LENGTH: 593
<212> TYPE: PRT
<213> ORGANISM: Artificial Sequence
<220> FEATURE:
<223> OTHER INFORMATION: Met-PRT889

<400> SEQUENCE: 27

Met Gly Ser Ser Gly Pro Gly Val Leu Gly Pro Tyr Gly Pro Gly Ala
1 5 10 15

Ser Ala Ala Ala Ala Ala Gly Ile Asn Gly Pro Gly Ser Gly Val Leu
20 25 30

Gly Pro Gly Ile Ser Gly Ile Tyr Gly Pro Gly Val Leu Gly Pro Gly
35 40 45

Val Leu Gly Pro Gly Ser Ser Ala Ala Ala Ala Ala Gly Pro Gly Ile
50 55 60

Tyr Gly Pro Gly Val Leu Gly Pro Ser Ala Ser Ala Ala Ala Ala Ala
65 70 75 80

Gly Pro Gly Ser Gly Val Leu Gly Pro Gly Ala Ser Gly Ile Tyr Gly
85 90 95

Pro Gly Val Leu Gly Pro Gly Val Leu Gly Pro Gly Ser Ser Ala Ala
100 105 110

Ala Ala Ala Gly Ile Tyr Gly Ser Gly Pro Gly Val Leu Gly Pro Tyr
115 120 125

Gly Ser Ala Ala Ala Ala Ala Gly Pro Gly Ser Gly Ile Tyr Gly Ile
130 135 140

Gly Pro Tyr Gly Pro Gly Ala Ser Gly Pro Gly Ile Tyr Gly Pro Gly
145 150 155 160

Val Leu Gly Pro Ser Ala Ser Ala Ala Ala Ala Ala Gly Ser Gly Val
165 170 175

Leu Gly Pro Gly Ile Tyr Gly Pro Tyr Ala Ser Ala Ala Ala Ala Ala
180 185 190

Gly Ile Tyr Gly Ser Gly Pro Gly Val Leu Gly Pro Tyr Gly Pro Gly
195 200 205

Ile Ser Gly Ser Gly Val Leu Gly Pro Gly Val Leu Gly Pro Tyr Ala
210 215 220

Ser Ala Ala Ala Ala Ala Gly Pro Gly Val Leu Gly Pro Tyr Gly Pro
225 230 235 240

Gly Ser Ser Ala Ala Ala Ala Ala Gly Ile Tyr Gly Tyr Gly Pro Gly
245 250 255

Val Leu Gly Pro Tyr Gly Pro Gly Ala Ser Gly Ile Asn Gly Pro Gly
260 265 270

Ser Gly Ile Tyr Gly Pro Gly Val Leu Gly Pro Gly Ile Ser Ala Ala
275 280 285

Ala Ala Ala Gly Pro Gly Val Leu Gly Pro Tyr Gly Pro Gly Ala Ser
290 295 300

Ala Ala Ala Ala Ala Gly Ile Tyr Gly Pro Gly Val Leu Gly Pro Gly
305 310 315 320

Ile Tyr Gly Pro Gly Ser Ser Gly Pro Gly Val Leu Gly Pro Tyr Gly
325 330 335

Pro Gly Ser Ser Ala Ala Ala Ala Ala Gly Ile Tyr Gly Pro Gly Val
340 345 350

Leu Gly Pro Tyr Gly Pro Gly Ile Ser Ala Ala Ala Ala Ala Gly Ile

```
        355                 360                 365

Tyr Val Leu Gly Pro Gly Val Leu Gly Pro Tyr Gly Pro Gly Ala Ser
    370                 375                 380

Gly Pro Gly Val Leu Gly Pro Tyr Gly Pro Gly Ala Ser Ala Ala Ala
385                 390                 395                 400

Ala Ala Gly Pro Gly Ile Tyr Gly Pro Gly Val Leu Gly Pro Ser Ala
                405                 410                 415

Ser Ala Ala Ala Ala Ala Gly Ile Tyr Gly Ser Gly Pro Gly Ile Tyr
            420                 425                 430

Gly Pro Tyr Gly Pro Gly Ile Ser Gly Pro Gly Ser Gly Val Leu Gly
        435                 440                 445

Ile Gly Pro Tyr Gly Pro Gly Ala Ser Ala Ala Ala Ala Ala Gly Ile
    450                 455                 460

Tyr Gly Pro Gly Val Leu Gly Pro Tyr Gly Pro Gly Ile Ser Ala Ala
465                 470                 475                 480

Ala Ala Ala Gly Pro Gly Ser Gly Ile Tyr Gly Pro Gly Ala Ser Gly
                485                 490                 495

Ile Asn Gly Pro Gly Ser Gly Ile Tyr Gly Pro Gly Val Leu Gly Pro
            500                 505                 510

Gly Ile Ser Ala Ala Ala Ala Ala Gly Ile Tyr Val Leu Gly Pro Gly
        515                 520                 525

Val Leu Gly Pro Tyr Gly Pro Gly Ala Ser Ala Ala Ala Ala Ala Gly
    530                 535                 540

Ile Tyr Gly Ser Gly Pro Gly Val Leu Gly Pro Tyr Gly Pro Gly Ile
545                 550                 555                 560

Ser Gly Ser Gly Val Leu Gly Pro Gly Val Leu Gly Pro Tyr Ala Ser
                565                 570                 575

Ala Ala Ala Ala Ala Gly Pro Gly Ser Gly Val Leu Gly Pro Gly Ala
            580                 585                 590

Ser


<210> SEQ ID NO 28
<211> LENGTH: 590
<212> TYPE: PRT
<213> ORGANISM: Artificial Sequence
<220> FEATURE:
<223> OTHER INFORMATION: Met-PRT916

<400> SEQUENCE: 28

Met Gly Pro Gly Val Ile Gly Pro Tyr Gly Pro Gly Ala Ser Ala Ala
1               5                   10                  15

Ala Ala Ala Gly Leu Asn Gly Pro Gly Ser Gly Val Ile Gly Pro Gly
            20                  25                  30

Leu Ser Gly Leu Tyr Gly Pro Gly Val Ile Gly Pro Gly Val Ile Gly
        35                  40                  45

Pro Gly Ser Ser Ala Ala Ala Ala Ala Gly Pro Gly Leu Tyr Gly Pro
    50                  55                  60

Gly Val Ile Gly Pro Ser Ala Ser Ala Ala Ala Ala Ala Gly Pro Gly
65                  70                  75                  80

Ser Gly Val Ile Gly Pro Gly Ala Ser Gly Leu Tyr Gly Pro Gly Val
                85                  90                  95

Ile Gly Pro Gly Val Ile Gly Pro Gly Ser Ser Ala Ala Ala Ala Ala
            100                 105                 110

Gly Leu Tyr Gly Ser Gly Pro Gly Val Ile Gly Pro Tyr Gly Ser Ala
        115                 120                 125
```

```
Ala Ala Ala Ala Gly Pro Gly Ser Gly Leu Tyr Gly Leu Gly Pro Tyr
    130                 135                 140

Gly Pro Gly Ala Ser Gly Pro Gly Leu Tyr Gly Pro Gly Val Ile Gly
145                 150                 155                 160

Pro Ser Ala Ser Ala Ala Ala Ala Ala Gly Ser Gly Val Ile Gly Pro
                165                 170                 175

Gly Leu Tyr Gly Pro Tyr Ala Ser Ala Ala Ala Ala Ala Gly Leu Tyr
            180                 185                 190

Gly Ser Gly Pro Gly Val Ile Gly Pro Tyr Gly Pro Gly Leu Ser Gly
        195                 200                 205

Ser Gly Val Ile Gly Pro Gly Val Ile Gly Pro Tyr Ala Ser Ala Ala
    210                 215                 220

Ala Ala Ala Gly Pro Gly Val Ile Gly Pro Tyr Gly Pro Gly Ser Ser
225                 230                 235                 240

Ala Ala Ala Ala Ala Gly Leu Tyr Gly Tyr Gly Pro Gly Val Ile Gly
                245                 250                 255

Pro Tyr Gly Pro Gly Ala Ser Gly Leu Asn Gly Pro Gly Ser Gly Leu
            260                 265                 270

Tyr Gly Pro Gly Val Ile Gly Pro Gly Leu Ser Ala Ala Ala Ala Ala
        275                 280                 285

Gly Pro Gly Val Ile Gly Pro Tyr Gly Pro Gly Ala Ser Ala Ala Ala
    290                 295                 300

Ala Ala Gly Leu Tyr Gly Pro Gly Val Ile Gly Pro Gly Leu Tyr Gly
305                 310                 315                 320

Pro Gly Ser Ser Gly Pro Gly Val Ile Gly Pro Tyr Gly Pro Gly Ser
                325                 330                 335

Ser Ala Ala Ala Ala Ala Gly Leu Tyr Gly Pro Gly Val Ile Gly Pro
            340                 345                 350

Tyr Gly Pro Gly Leu Ser Ala Ala Ala Ala Ala Gly Leu Tyr Val Ile
        355                 360                 365

Gly Pro Gly Val Ile Gly Pro Tyr Gly Pro Gly Ala Ser Gly Pro Gly
    370                 375                 380

Val Ile Gly Pro Tyr Gly Pro Gly Ala Ser Ala Ala Ala Ala Ala Gly
385                 390                 395                 400

Pro Gly Leu Tyr Gly Pro Gly Val Ile Gly Pro Ser Ala Ser Ala Ala
                405                 410                 415

Ala Ala Ala Gly Leu Tyr Gly Ser Gly Pro Gly Leu Tyr Gly Pro Tyr
            420                 425                 430

Gly Pro Gly Leu Ser Gly Pro Gly Ser Gly Val Ile Gly Leu Gly Pro
        435                 440                 445

Tyr Gly Pro Gly Ala Ser Ala Ala Ala Ala Ala Gly Leu Tyr Gly Pro
    450                 455                 460

Gly Val Ile Gly Pro Tyr Gly Pro Gly Leu Ser Ala Ala Ala Ala Ala
465                 470                 475                 480

Gly Pro Gly Ser Gly Leu Tyr Gly Pro Gly Ala Ser Gly Leu Asn Gly
                485                 490                 495

Pro Gly Ser Gly Leu Tyr Gly Pro Gly Val Ile Gly Pro Gly Leu Ser
            500                 505                 510

Ala Ala Ala Ala Ala Gly Leu Tyr Val Ile Gly Pro Gly Val Ile Gly
        515                 520                 525

Pro Tyr Gly Pro Gly Ala Ser Ala Ala Ala Ala Ala Gly Leu Tyr Gly
    530                 535                 540
```

```
Ser Gly Pro Gly Val Ile Gly Pro Tyr Gly Pro Gly Leu Ser Gly Ser
545                 550                 555                 560

Gly Val Ile Gly Pro Gly Val Ile Gly Pro Tyr Ala Ser Ala Ala Ala
                565                 570                 575

Ala Ala Gly Pro Gly Ser Gly Val Ile Gly Pro Gly Ala Ser
            580                 585                 590


<210> SEQ ID NO 29
<211> LENGTH: 590
<212> TYPE: PRT
<213> ORGANISM: Artificial Sequence
<220> FEATURE:
<223> OTHER INFORMATION: Met-PRT918

<400> SEQUENCE: 29

Met Gly Pro Gly Val Phe Gly Pro Tyr Gly Pro Gly Ala Ser Ala Ala
1               5                   10                  15

Ala Ala Ala Gly Ile Asn Gly Pro Gly Ser Gly Val Phe Gly Pro Gly
            20                  25                  30

Ile Ser Gly Ile Tyr Gly Pro Gly Val Phe Gly Pro Gly Val Phe Gly
        35                  40                  45

Pro Gly Ser Ser Ala Ala Ala Ala Ala Gly Pro Gly Ile Tyr Gly Pro
    50                  55                  60

Gly Val Phe Gly Pro Ser Ala Ser Ala Ala Ala Ala Ala Gly Pro Gly
65                  70                  75                  80

Ser Gly Val Phe Gly Pro Gly Ala Ser Gly Ile Tyr Gly Pro Gly Val
                85                  90                  95

Phe Gly Pro Gly Val Phe Gly Pro Gly Ser Ser Ala Ala Ala Ala Ala
            100                 105                 110

Gly Ile Tyr Gly Ser Gly Pro Gly Val Phe Gly Pro Tyr Gly Ser Ala
        115                 120                 125

Ala Ala Ala Ala Gly Pro Gly Ser Gly Ile Tyr Gly Ile Gly Pro Tyr
    130                 135                 140

Gly Pro Gly Ala Ser Gly Pro Gly Ile Tyr Gly Pro Gly Val Phe Gly
145                 150                 155                 160

Pro Ser Ala Ser Ala Ala Ala Ala Ala Gly Ser Gly Val Phe Gly Pro
                165                 170                 175

Gly Ile Tyr Gly Pro Tyr Ala Ser Ala Ala Ala Ala Ala Gly Ile Tyr
            180                 185                 190

Gly Ser Gly Pro Gly Val Phe Gly Pro Tyr Gly Pro Gly Ile Ser Gly
        195                 200                 205

Ser Gly Val Phe Gly Pro Gly Val Phe Gly Pro Tyr Ala Ser Ala Ala
    210                 215                 220

Ala Ala Ala Gly Pro Gly Val Phe Gly Pro Tyr Gly Pro Gly Ser Ser
225                 230                 235                 240

Ala Ala Ala Ala Ala Gly Ile Tyr Gly Tyr Gly Pro Gly Val Phe Gly
                245                 250                 255

Pro Tyr Gly Pro Gly Ala Ser Gly Ile Asn Gly Pro Gly Ser Gly Ile
            260                 265                 270

Tyr Gly Pro Gly Val Phe Gly Pro Gly Ile Ser Ala Ala Ala Ala Ala
        275                 280                 285

Gly Pro Gly Val Phe Gly Pro Tyr Gly Pro Gly Ala Ser Ala Ala Ala
    290                 295                 300

Ala Ala Gly Ile Tyr Gly Pro Gly Val Phe Gly Pro Gly Ile Tyr Gly
305                 310                 315                 320
```

```
Pro Gly Ser Ser Gly Pro Gly Val Phe Gly Pro Tyr Gly Pro Gly Ser
                325                 330                 335

Ser Ala Ala Ala Ala Ala Gly Ile Tyr Gly Pro Gly Val Phe Gly Pro
            340                 345                 350

Tyr Gly Pro Gly Ile Ser Ala Ala Ala Ala Ala Gly Ile Tyr Val Phe
        355                 360                 365

Gly Pro Gly Val Phe Gly Pro Tyr Gly Pro Gly Ala Ser Gly Pro Gly
    370                 375                 380

Val Phe Gly Pro Tyr Gly Pro Gly Ala Ser Ala Ala Ala Ala Ala Gly
385                 390                 395                 400

Pro Gly Ile Tyr Gly Pro Gly Val Phe Gly Pro Ser Ala Ser Ala Ala
                405                 410                 415

Ala Ala Ala Gly Ile Tyr Gly Ser Gly Pro Gly Ile Tyr Gly Pro Tyr
            420                 425                 430

Gly Pro Gly Ile Ser Gly Pro Gly Ser Gly Val Phe Gly Ile Gly Pro
        435                 440                 445

Tyr Gly Pro Gly Ala Ser Ala Ala Ala Ala Ala Gly Ile Tyr Gly Pro
    450                 455                 460

Gly Val Phe Gly Pro Tyr Gly Pro Gly Ile Ser Ala Ala Ala Ala Ala
465                 470                 475                 480

Gly Pro Gly Ser Gly Ile Tyr Gly Pro Gly Ala Ser Gly Ile Asn Gly
                485                 490                 495

Pro Gly Ser Gly Ile Tyr Gly Pro Gly Val Phe Gly Pro Gly Ile Ser
            500                 505                 510

Ala Ala Ala Ala Ala Gly Ile Tyr Val Phe Gly Pro Gly Val Phe Gly
        515                 520                 525

Pro Tyr Gly Pro Gly Ala Ser Ala Ala Ala Ala Ala Gly Ile Tyr Gly
    530                 535                 540

Ser Gly Pro Gly Val Phe Gly Pro Tyr Gly Pro Gly Ile Ser Gly Ser
545                 550                 555                 560

Gly Val Phe Gly Pro Gly Val Phe Gly Pro Tyr Ala Ser Ala Ala Ala
                565                 570                 575

Ala Ala Gly Pro Gly Ser Gly Val Phe Gly Pro Gly Ala Ser
            580                 585                 590


<210> SEQ ID NO 30
<211> LENGTH: 565
<212> TYPE: PRT
<213> ORGANISM: Artificial Sequence
<220> FEATURE:
<223> OTHER INFORMATION: Met-PRT699

<400> SEQUENCE: 30

Met Gly Pro Gly Val Leu Gly Pro Tyr Gly Pro Gly Ala Ser Ala Ala
1               5                   10                  15

Ala Ala Ala Ala Ala Gly Ser Asn Gly Pro Gly Ser Gly Val Leu Gly
            20                  25                  30

Pro Gly Gln Ser Gly Gln Tyr Gly Pro Gly Val Leu Gly Pro Gly Val
        35                  40                  45

Leu Gly Pro Gly Ser Ser Ala Ala Ala Ala Ala Ala Ala Gly Pro Gly
    50                  55                  60

Gln Tyr Gly Pro Gly Val Leu Gly Pro Ser Ala Ser Ala Ala Ala Ala
65                  70                  75                  80

Ala Ala Ala Gly Pro Gly Ser Gly Val Leu Gly Pro Gly Ala Ser Gly
                85                  90                  95
```

```
Gln Tyr Gly Pro Gly Val Leu Gly Pro Gly Val Leu Gly Pro Gly Ser
            100                 105                 110

Ser Ala Ala Ala Ala Ala Ala Ala Gly Ser Tyr Gly Ser Gly Pro Gly
        115                 120                 125

Val Leu Gly Pro Tyr Gly Ser Ala Ala Ala Ala Ala Ala Ala Gly Pro
    130                 135                 140

Gly Ser Gly Gln Tyr Gly Gln Gly Pro Tyr Gly Pro Gly Ala Ser Gly
145                 150                 155                 160

Pro Gly Gln Tyr Gly Pro Gly Val Leu Gly Pro Ser Ala Ser Ala Ala
                165                 170                 175

Ala Ala Ala Ala Ala Gly Ser Gly Val Leu Gly Pro Gly Gln Tyr Gly
            180                 185                 190

Pro Tyr Ala Ser Ala Ala Ala Ala Ala Ala Ala Gly Ser Tyr Gly Ser
        195                 200                 205

Gly Pro Gly Val Leu Gly Pro Tyr Gly Pro Gly Gln Ser Gly Ser Gly
    210                 215                 220

Val Leu Gly Pro Gly Val Leu Gly Pro Tyr Ala Ser Ala Ala Ala Ala
225                 230                 235                 240

Ala Ala Ala Gly Pro Gly Val Leu Gly Pro Tyr Gly Pro Gly Ser Ser
                245                 250                 255

Ala Ala Ala Ala Ala Ala Ala Gly Ser Tyr Gly Tyr Gly Pro Gly Val
            260                 265                 270

Leu Gly Pro Tyr Gly Pro Gly Ala Ser Gly Gln Asn Gly Pro Gly Ser
        275                 280                 285

Gly Gln Tyr Gly Pro Gly Val Leu Gly Pro Gly Pro Ser Ala Ala Ala
    290                 295                 300

Ala Ala Ala Ala Gly Pro Gly Val Leu Gly Pro Tyr Gly Pro Gly Ala
305                 310                 315                 320

Ser Ala Ala Ala Ala Ala Ala Ala Gly Ser Tyr Gly Pro Gly Val Leu
                325                 330                 335

Gly Pro Gly Gln Tyr Gly Pro Gly Ser Ser Gly Pro Gly Val Leu Gly
            340                 345                 350

Pro Tyr Gly Pro Gly Ser Ser Ala Ala Ala Ala Ala Ala Ala Gly Ser
        355                 360                 365

Tyr Gly Pro Gly Val Leu Gly Pro Tyr Gly Pro Gly Pro Ser Ala Ala
    370                 375                 380

Ala Ala Ala Ala Ala Gly Ser Tyr Val Leu Gly Pro Gly Val Leu Gly
385                 390                 395                 400

Pro Tyr Gly Pro Gly Ala Ser Gly Pro Gly Val Leu Gly Pro Tyr Gly
                405                 410                 415

Pro Gly Ala Ser Ala Ala Ala Ala Ala Ala Ala Gly Pro Gly Gln Tyr
            420                 425                 430

Gly Pro Gly Val Leu Gly Pro Ser Ala Ser Ala Ala Ala Ala Ala Ala
        435                 440                 445

Ala Gly Ser Tyr Gly Ser Gly Pro Gly Gln Tyr Gly Pro Tyr Gly Pro
    450                 455                 460

Gly Gln Ser Gly Pro Gly Ser Gly Val Leu Gly Gln Gly Pro Tyr Gly
465                 470                 475                 480

Pro Gly Ala Ser Ala Ala Ala Ala Ala Ala Ala Gly Ser Tyr Gly Pro
                485                 490                 495

Gly Val Leu Gly Pro Tyr Gly Pro Gly Pro Ser Ala Ala Ala Ala Ala
            500                 505                 510

Ala Ala Gly Pro Gly Ser Gly Gln Tyr Gly Pro Gly Ala Ser Gly Gln
```

```
        515                 520                 525

Asn Gly Pro Gly Ser Gly Gln Tyr Gly Pro Gly Val Leu Gly Pro Gly
    530                 535                 540

Pro Ser Ala Ala Ala Ala Ala Ala Ala Gly Pro Gly Ser Gly Val Leu
545                 550                 555                 560

Gly Pro Gly Ala Ser
                565


<210> SEQ ID NO 31
<211> LENGTH: 565
<212> TYPE: PRT
<213> ORGANISM: Artificial Sequence
<220> FEATURE:
<223> OTHER INFORMATION: Met-PRT698

<400> SEQUENCE: 31

Met Gly Pro Gly Val Leu Gly Pro Tyr Gly Pro Gly Ala Ser Ala Ala
1               5                   10                  15

Ala Ala Ala Ala Ala Gly Ser Asn Gly Pro Gly Ser Gly Val Leu Gly
            20                  25                  30

Pro Gly Ile Ser Gly Ile Tyr Gly Pro Gly Val Leu Gly Pro Gly Val
        35                  40                  45

Leu Gly Pro Gly Ser Ser Ala Ala Ala Ala Ala Ala Ala Gly Pro Gly
    50                  55                  60

Ile Tyr Gly Pro Gly Val Leu Gly Pro Ser Ala Ser Ala Ala Ala Ala
65                  70                  75                  80

Ala Ala Ala Gly Pro Gly Ser Gly Val Leu Gly Pro Gly Ala Ser Gly
                85                  90                  95

Ile Tyr Gly Pro Gly Val Leu Gly Pro Gly Val Leu Gly Pro Gly Ser
            100                 105                 110

Ser Ala Ala Ala Ala Ala Ala Ala Gly Ser Tyr Gly Ser Gly Pro Gly
        115                 120                 125

Val Leu Gly Pro Tyr Gly Ser Ala Ala Ala Ala Ala Ala Ala Gly Pro
    130                 135                 140

Gly Ser Gly Ile Tyr Gly Ile Gly Pro Tyr Gly Pro Gly Ala Ser Gly
145                 150                 155                 160

Pro Gly Ile Tyr Gly Pro Gly Val Leu Gly Pro Ser Ala Ser Ala Ala
                165                 170                 175

Ala Ala Ala Ala Ala Gly Ser Gly Val Leu Gly Pro Gly Ile Tyr Gly
            180                 185                 190

Pro Tyr Ala Ser Ala Ala Ala Ala Ala Ala Ala Gly Ser Tyr Gly Ser
        195                 200                 205

Gly Pro Gly Val Leu Gly Pro Tyr Gly Pro Gly Ile Ser Gly Ser Gly
    210                 215                 220

Val Leu Gly Pro Gly Val Leu Gly Pro Tyr Ala Ser Ala Ala Ala Ala
225                 230                 235                 240

Ala Ala Ala Gly Pro Gly Val Leu Gly Pro Tyr Gly Pro Gly Ser Ser
                245                 250                 255

Ala Ala Ala Ala Ala Ala Ala Gly Ser Tyr Gly Tyr Gly Pro Gly Val
            260                 265                 270

Leu Gly Pro Tyr Gly Pro Gly Ala Ser Gly Ile Asn Gly Pro Gly Ser
        275                 280                 285

Gly Ile Tyr Gly Pro Gly Val Leu Gly Pro Gly Pro Ser Ala Ala Ala
    290                 295                 300

Ala Ala Ala Ala Gly Pro Gly Val Leu Gly Pro Tyr Gly Pro Gly Ala
```

305 310 315 320

Ser Ala Ala Ala Ala Ala Ala Ala Gly Ser Tyr Gly Pro Gly Val Leu
325 330 335

Gly Pro Gly Ile Tyr Gly Pro Gly Ser Ser Gly Pro Gly Val Leu Gly
340 345 350

Pro Tyr Gly Pro Gly Ser Ser Ala Ala Ala Ala Ala Ala Ala Gly Ser
355 360 365

Tyr Gly Pro Gly Val Leu Gly Pro Tyr Gly Pro Gly Pro Ser Ala Ala
370 375 380

Ala Ala Ala Ala Ala Gly Ser Tyr Val Leu Gly Pro Gly Val Leu Gly
385 390 395 400

Pro Tyr Gly Pro Gly Ala Ser Gly Pro Gly Val Leu Gly Pro Tyr Gly
405 410 415

Pro Gly Ala Ser Ala Ala Ala Ala Ala Ala Ala Gly Pro Gly Ile Tyr
420 425 430

Gly Pro Gly Val Leu Gly Pro Ser Ala Ser Ala Ala Ala Ala Ala Ala
435 440 445

Ala Gly Ser Tyr Gly Ser Gly Pro Gly Ile Tyr Gly Pro Tyr Gly Pro
450 455 460

Gly Ile Ser Gly Pro Gly Ser Gly Val Leu Gly Ile Gly Pro Tyr Gly
465 470 475 480

Pro Gly Ala Ser Ala Ala Ala Ala Ala Ala Ala Gly Ser Tyr Gly Pro
485 490 495

Gly Val Leu Gly Pro Tyr Gly Pro Gly Pro Ser Ala Ala Ala Ala Ala
500 505 510

Ala Ala Gly Pro Gly Ser Gly Ile Tyr Gly Pro Gly Ala Ser Gly Ile
515 520 525

Asn Gly Pro Gly Ser Gly Ile Tyr Gly Pro Gly Val Leu Gly Pro Gly
530 535 540

Pro Ser Ala Ala Ala Ala Ala Ala Ala Gly Pro Gly Ser Gly Val Leu
545 550 555 560

Gly Pro Gly Ala Ser
565

<210> SEQ ID NO 32
<211> LENGTH: 1179
<212> TYPE: PRT
<213> ORGANISM: Artificial Sequence
<220> FEATURE:
<223> OTHER INFORMATION: Met-PRT966

<400> SEQUENCE: 32

Met Gly Pro Gly Val Phe Gly Pro Tyr Gly Pro Gly Ala Ser Ala Ala
1 5 10 15

Ala Ala Ala Gly Ile Asn Gly Pro Gly Ser Gly Val Phe Gly Pro Gly
20 25 30

Ile Ser Gly Ile Tyr Gly Pro Gly Val Phe Gly Pro Gly Val Phe Gly
35 40 45

Pro Gly Ser Ser Ala Ala Ala Ala Ala Gly Pro Gly Ile Tyr Gly Pro
50 55 60

Gly Val Phe Gly Pro Ser Ala Ser Ala Ala Ala Ala Ala Gly Pro Gly
65 70 75 80

Ser Gly Val Phe Gly Pro Gly Ala Ser Gly Ile Tyr Gly Pro Gly Val
85 90 95

Phe Gly Pro Gly Val Phe Gly Pro Gly Ser Ser Ala Ala Ala Ala Ala

```
            100                 105                 110

Gly Ile Tyr Gly Ser Gly Pro Gly Val Phe Gly Pro Tyr Gly Ser Ala
        115                 120                 125

Ala Ala Ala Ala Gly Pro Gly Ser Gly Ile Tyr Gly Ile Gly Pro Tyr
    130                 135                 140

Gly Pro Gly Ala Ser Gly Pro Gly Ile Tyr Gly Pro Gly Val Phe Gly
145                 150                 155                 160

Pro Ser Ala Ser Ala Ala Ala Ala Ala Gly Ser Gly Val Phe Gly Pro
                165                 170                 175

Gly Ile Tyr Gly Pro Tyr Ala Ser Ala Ala Ala Ala Ala Gly Ile Tyr
            180                 185                 190

Gly Ser Gly Pro Gly Val Phe Gly Pro Tyr Gly Pro Gly Ile Ser Gly
        195                 200                 205

Ser Gly Val Phe Gly Pro Gly Val Phe Gly Pro Tyr Ala Ser Ala Ala
    210                 215                 220

Ala Ala Ala Gly Pro Gly Val Phe Gly Pro Tyr Gly Pro Gly Ser Ser
225                 230                 235                 240

Ala Ala Ala Ala Ala Gly Ile Tyr Gly Tyr Gly Pro Gly Val Phe Gly
                245                 250                 255

Pro Tyr Gly Pro Gly Ala Ser Gly Ile Asn Gly Pro Gly Ser Gly Ile
            260                 265                 270

Tyr Gly Pro Gly Val Phe Gly Pro Gly Ile Ser Ala Ala Ala Ala Ala
        275                 280                 285

Gly Pro Gly Val Phe Gly Pro Tyr Gly Pro Gly Ala Ser Ala Ala Ala
    290                 295                 300

Ala Ala Gly Ile Tyr Gly Pro Gly Val Phe Gly Pro Gly Ile Tyr Gly
305                 310                 315                 320

Pro Gly Ser Ser Gly Pro Gly Val Phe Gly Pro Tyr Gly Pro Gly Ser
                325                 330                 335

Ser Ala Ala Ala Ala Ala Gly Ile Tyr Gly Pro Gly Val Phe Gly Pro
            340                 345                 350

Tyr Gly Pro Gly Ile Ser Ala Ala Ala Ala Ala Gly Ile Tyr Val Phe
        355                 360                 365

Gly Pro Gly Val Phe Gly Pro Tyr Gly Pro Gly Ala Ser Gly Pro Gly
    370                 375                 380

Val Phe Gly Pro Tyr Gly Pro Gly Ala Ser Ala Ala Ala Ala Ala Gly
385                 390                 395                 400

Pro Gly Ile Tyr Gly Pro Gly Val Phe Gly Pro Ser Ala Ser Ala Ala
                405                 410                 415

Ala Ala Ala Gly Ile Tyr Gly Ser Gly Pro Gly Ile Tyr Gly Pro Tyr
            420                 425                 430

Gly Pro Gly Ile Ser Gly Pro Gly Ser Gly Val Phe Gly Ile Gly Pro
        435                 440                 445

Tyr Gly Pro Gly Ala Ser Ala Ala Ala Ala Ala Gly Ile Tyr Gly Pro
    450                 455                 460

Gly Val Phe Gly Pro Tyr Gly Pro Gly Ile Ser Ala Ala Ala Ala Ala
465                 470                 475                 480

Gly Pro Gly Ser Gly Ile Tyr Gly Pro Gly Ala Ser Gly Ile Asn Gly
                485                 490                 495

Pro Gly Ser Gly Ile Tyr Gly Pro Gly Val Phe Gly Pro Gly Ile Ser
            500                 505                 510

Ala Ala Ala Ala Ala Gly Ile Tyr Val Phe Gly Pro Gly Val Phe Gly
        515                 520                 525
```

```
Pro Tyr Gly Pro Gly Ala Ser Ala Ala Ala Ala Ala Gly Ile Tyr Gly
    530                 535                 540

Ser Gly Pro Gly Val Phe Gly Pro Tyr Gly Pro Gly Ile Ser Gly Ser
545                 550                 555                 560

Gly Val Phe Gly Pro Gly Val Phe Gly Pro Tyr Ala Ser Ala Ala Ala
                565                 570                 575

Ala Ala Gly Pro Gly Ser Gly Val Phe Gly Pro Gly Ala Ser Gly Pro
            580                 585                 590

Gly Val Phe Gly Pro Tyr Gly Pro Gly Ala Ser Ala Ala Ala Ala Ala
        595                 600                 605

Gly Ile Asn Gly Pro Gly Ser Gly Val Phe Gly Pro Gly Ile Ser Gly
    610                 615                 620

Ile Tyr Gly Pro Gly Val Phe Gly Pro Gly Val Phe Gly Pro Gly Ser
625                 630                 635                 640

Ser Ala Ala Ala Ala Ala Gly Pro Gly Ile Tyr Gly Pro Gly Val Phe
                645                 650                 655

Gly Pro Ser Ala Ser Ala Ala Ala Ala Ala Gly Pro Gly Ser Gly Val
            660                 665                 670

Phe Gly Pro Gly Ala Ser Gly Ile Tyr Gly Pro Gly Val Phe Gly Pro
        675                 680                 685

Gly Val Phe Gly Pro Gly Ser Ser Ala Ala Ala Ala Ala Gly Ile Tyr
    690                 695                 700

Gly Ser Gly Pro Gly Val Phe Gly Pro Tyr Gly Ser Ala Ala Ala Ala
705                 710                 715                 720

Ala Gly Pro Gly Ser Gly Ile Tyr Gly Ile Gly Pro Tyr Gly Pro Gly
                725                 730                 735

Ala Ser Gly Pro Gly Ile Tyr Gly Pro Gly Val Phe Gly Pro Ser Ala
            740                 745                 750

Ser Ala Ala Ala Ala Ala Gly Ser Gly Val Phe Gly Pro Gly Ile Tyr
        755                 760                 765

Gly Pro Tyr Ala Ser Ala Ala Ala Ala Ala Gly Ile Tyr Gly Ser Gly
    770                 775                 780

Pro Gly Val Phe Gly Pro Tyr Gly Pro Gly Ile Ser Gly Ser Gly Val
785                 790                 795                 800

Phe Gly Pro Gly Val Phe Gly Pro Tyr Ala Ser Ala Ala Ala Ala Ala
                805                 810                 815

Gly Pro Gly Val Phe Gly Pro Tyr Gly Pro Gly Ser Ser Ala Ala Ala
            820                 825                 830

Ala Ala Gly Ile Tyr Gly Tyr Gly Pro Gly Val Phe Gly Pro Tyr Gly
        835                 840                 845

Pro Gly Ala Ser Gly Ile Asn Gly Pro Gly Ser Gly Ile Tyr Gly Pro
    850                 855                 860

Gly Val Phe Gly Pro Gly Ile Ser Ala Ala Ala Ala Ala Gly Pro Gly
865                 870                 875                 880

Val Phe Gly Pro Tyr Gly Pro Gly Ala Ser Ala Ala Ala Ala Ala Gly
                885                 890                 895

Ile Tyr Gly Pro Gly Val Phe Gly Pro Gly Ile Tyr Gly Pro Gly Ser
            900                 905                 910

Ser Gly Pro Gly Val Phe Gly Pro Tyr Gly Pro Gly Ser Ser Ala Ala
        915                 920                 925

Ala Ala Ala Gly Ile Tyr Gly Pro Gly Val Phe Gly Pro Tyr Gly Pro
    930                 935                 940
```

```
Gly Ile Ser Ala Ala Ala Ala Ala Gly Ile Tyr Val Phe Gly Pro Gly
945                 950                 955                 960

Val Phe Gly Pro Tyr Gly Pro Gly Ala Ser Gly Pro Gly Val Phe Gly
                965                 970                 975

Pro Tyr Gly Pro Gly Ala Ser Ala Ala Ala Ala Ala Gly Pro Gly Ile
            980                 985                 990

Tyr Gly Pro Gly Val Phe Gly Pro  Ser Ala Ser Ala Ala  Ala Ala Ala
        995                 1000                1005

Gly Ile  Tyr Gly Ser Gly Pro  Gly Ile Tyr Gly Pro  Tyr Gly Pro
    1010                1015                1020

Gly Ile  Ser Gly Pro Gly Ser  Gly Val Phe Gly Ile  Gly Pro Tyr
    1025                1030                1035

Gly Pro  Gly Ala Ser Ala Ala  Ala Ala Ala Gly Ile  Tyr Gly Pro
    1040                1045                1050

Gly Val  Phe Gly Pro Tyr Gly  Pro Gly Ile Ser Ala  Ala Ala Ala
    1055                1060                1065

Ala Gly  Pro Gly Ser Gly Ile  Tyr Gly Pro Gly Ala  Ser Gly Ile
    1070                1075                1080

Asn Gly  Pro Gly Ser Gly Ile  Tyr Gly Pro Gly Val  Phe Gly Pro
    1085                1090                1095

Gly Ile  Ser Ala Ala Ala Ala  Ala Gly Ile Tyr Val  Phe Gly Pro
    1100                1105                1110

Gly Val  Phe Gly Pro Tyr Gly  Pro Gly Ala Ser Ala  Ala Ala Ala
    1115                1120                1125

Ala Gly  Ile Tyr Gly Ser Gly  Pro Gly Val Phe Gly  Pro Tyr Gly
    1130                1135                1140

Pro Gly  Ile Ser Gly Ser Gly  Val Phe Gly Pro Gly  Val Phe Gly
    1145                1150                1155

Pro Tyr  Ala Ser Ala Ala Ala  Ala Ala Gly Pro Gly  Ser Gly Val
    1160                1165                1170

Phe Gly  Pro Gly Ala Ser
    1175


<210> SEQ ID NO 33
<211> LENGTH: 601
<212> TYPE: PRT
<213> ORGANISM: Artificial Sequence
<220> FEATURE:
<223> OTHER INFORMATION: PRT888

<400> SEQUENCE: 33

Met His His His His His His Ser Ser Gly Ser Ser Gly Pro Gly Val
1               5                   10                  15

Leu Gly Pro Tyr Gly Pro Gly Ala Ser Ala Ala Ala Ala Ala Gly Gln
            20                  25                  30

Asn Gly Pro Gly Ser Gly Val Leu Gly Pro Gly Gln Ser Gly Gln Tyr
        35                  40                  45

Gly Pro Gly Val Leu Gly Pro Gly Val Leu Gly Pro Gly Ser Ser Ala
    50                  55                  60

Ala Ala Ala Ala Gly Pro Gly Gln Tyr Gly Pro Gly Val Leu Gly Pro
65                  70                  75                  80

Ser Ala Ser Ala Ala Ala Ala Ala Gly Pro Gly Ser Gly Val Leu Gly
                85                  90                  95

Pro Gly Ala Ser Gly Gln Tyr Gly Pro Gly Val Leu Gly Pro Gly Val
            100                 105                 110
```

```
Leu Gly Pro Gly Ser Ser Ala Ala Ala Ala Ala Gly Gln Tyr Gly Ser
        115                 120                 125

Gly Pro Gly Val Leu Gly Pro Tyr Gly Ser Ala Ala Ala Ala Ala Gly
    130                 135                 140

Pro Gly Ser Gly Gln Tyr Gly Gln Gly Pro Tyr Gly Pro Gly Ala Ser
145                 150                 155                 160

Gly Pro Gly Gln Tyr Gly Pro Gly Val Leu Gly Pro Ser Ala Ser Ala
                165                 170                 175

Ala Ala Ala Ala Gly Ser Gly Val Leu Gly Pro Gly Gln Tyr Gly Pro
            180                 185                 190

Tyr Ala Ser Ala Ala Ala Ala Ala Gly Gln Tyr Gly Ser Gly Pro Gly
        195                 200                 205

Val Leu Gly Pro Tyr Gly Pro Gly Gln Ser Gly Ser Gly Val Leu Gly
    210                 215                 220

Pro Gly Val Leu Gly Pro Tyr Ala Ser Ala Ala Ala Ala Ala Gly Pro
225                 230                 235                 240

Gly Val Leu Gly Pro Tyr Gly Pro Gly Ser Ser Ala Ala Ala Ala Ala
                245                 250                 255

Gly Gln Tyr Gly Tyr Gly Pro Gly Val Leu Gly Pro Tyr Gly Pro Gly
            260                 265                 270

Ala Ser Gly Gln Asn Gly Pro Gly Ser Gly Gln Tyr Gly Pro Gly Val
        275                 280                 285

Leu Gly Pro Gly Gln Ser Ala Ala Ala Ala Ala Gly Pro Gly Val Leu
    290                 295                 300

Gly Pro Tyr Gly Pro Gly Ala Ser Ala Ala Ala Ala Ala Gly Gln Tyr
305                 310                 315                 320

Gly Pro Gly Val Leu Gly Pro Gly Gln Tyr Gly Pro Gly Ser Ser Gly
                325                 330                 335

Pro Gly Val Leu Gly Pro Tyr Gly Pro Gly Ser Ser Ala Ala Ala Ala
            340                 345                 350

Ala Gly Gln Tyr Gly Pro Gly Val Leu Gly Pro Tyr Gly Pro Gly Gln
        355                 360                 365

Ser Ala Ala Ala Ala Ala Gly Gln Tyr Val Leu Gly Pro Gly Val Leu
    370                 375                 380

Gly Pro Tyr Gly Pro Gly Ala Ser Gly Pro Gly Val Leu Gly Pro Tyr
385                 390                 395                 400

Gly Pro Gly Ala Ser Ala Ala Ala Ala Ala Gly Pro Gly Gln Tyr Gly
                405                 410                 415

Pro Gly Val Leu Gly Pro Ser Ala Ser Ala Ala Ala Ala Ala Gly Gln
            420                 425                 430

Tyr Gly Ser Gly Pro Gly Gln Tyr Gly Pro Tyr Gly Pro Gly Gln Ser
        435                 440                 445

Gly Pro Gly Ser Gly Val Leu Gly Gln Gly Pro Tyr Gly Pro Gly Ala
    450                 455                 460

Ser Ala Ala Ala Ala Ala Gly Gln Tyr Gly Pro Gly Val Leu Gly Pro
465                 470                 475                 480

Tyr Gly Pro Gly Gln Ser Ala Ala Ala Ala Ala Gly Pro Gly Ser Gly
                485                 490                 495

Gln Tyr Gly Pro Gly Ala Ser Gly Gln Asn Gly Pro Gly Ser Gly Gln
            500                 505                 510

Tyr Gly Pro Gly Val Leu Gly Pro Gly Gln Ser Ala Ala Ala Ala Ala
        515                 520                 525

Gly Gln Tyr Val Leu Gly Pro Gly Val Leu Gly Pro Tyr Gly Pro Gly
```

```
    530                 535                 540

Ala Ser Ala Ala Ala Ala Ala Gly Gln Tyr Gly Ser Gly Pro Gly Val
545                 550                 555                 560

Leu Gly Pro Tyr Gly Pro Gly Gln Ser Gly Ser Gly Val Leu Gly Pro
                565                 570                 575

Gly Val Leu Gly Pro Tyr Ala Ser Ala Ala Ala Ala Ala Gly Pro Gly
            580                 585                 590

Ser Gly Val Leu Gly Pro Gly Ala Ser
        595                 600


<210> SEQ ID NO 34
<211> LENGTH: 601
<212> TYPE: PRT
<213> ORGANISM: Artificial Sequence
<220> FEATURE:
<223> OTHER INFORMATION: PRT965

<400> SEQUENCE: 34

Met His His His His His His Ser Ser Gly Ser Ser Gly Pro Gly Thr
1               5                   10                  15

Ser Gly Pro Tyr Gly Pro Gly Ala Ser Ala Ala Ala Ala Ala Gly Ala
            20                  25                  30

Asn Gly Pro Gly Ser Gly Thr Ser Gly Pro Gly Ala Ser Gly Ala Tyr
        35                  40                  45

Gly Pro Gly Thr Ser Gly Pro Gly Thr Ser Gly Pro Gly Ser Ser Ala
    50                  55                  60

Ala Ala Ala Ala Gly Pro Gly Ala Tyr Gly Pro Gly Thr Ser Gly Pro
65                  70                  75                  80

Ser Ala Ser Ala Ala Ala Ala Ala Gly Pro Gly Ser Gly Thr Ser Gly
                85                  90                  95

Pro Gly Ala Ser Gly Ala Tyr Gly Pro Gly Thr Ser Gly Pro Gly Thr
            100                 105                 110

Ser Gly Pro Gly Ser Ser Ala Ala Ala Ala Ala Gly Ala Tyr Gly Ser
        115                 120                 125

Gly Pro Gly Thr Ser Gly Pro Tyr Gly Ser Ala Ala Ala Ala Ala Gly
    130                 135                 140

Pro Gly Ser Gly Ala Tyr Gly Ala Gly Pro Tyr Gly Pro Gly Ala Ser
145                 150                 155                 160

Gly Pro Gly Ala Tyr Gly Pro Gly Thr Ser Gly Pro Ser Ala Ser Ala
                165                 170                 175

Ala Ala Ala Ala Gly Ser Gly Thr Ser Gly Pro Gly Ala Tyr Gly Pro
            180                 185                 190

Tyr Ala Ser Ala Ala Ala Ala Ala Gly Ala Tyr Gly Ser Gly Pro Gly
        195                 200                 205

Thr Ser Gly Pro Tyr Gly Pro Gly Ala Ser Gly Ser Gly Thr Ser Gly
    210                 215                 220

Pro Gly Thr Ser Gly Pro Tyr Ala Ser Ala Ala Ala Ala Ala Gly Pro
225                 230                 235                 240

Gly Thr Ser Gly Pro Tyr Gly Pro Gly Ser Ser Ala Ala Ala Ala Ala
                245                 250                 255

Gly Ala Tyr Gly Tyr Gly Pro Gly Thr Ser Gly Pro Tyr Gly Pro Gly
            260                 265                 270

Ala Ser Gly Ala Asn Gly Pro Gly Ser Gly Ala Tyr Gly Pro Gly Thr
        275                 280                 285

Ser Gly Pro Gly Ala Ser Ala Ala Ala Ala Ala Gly Pro Gly Thr Ser
```

```
    290                 295                 300

Gly Pro Tyr Gly Pro Gly Ala Ser Ala Ala Ala Ala Ala Gly Ala Tyr
305                 310                 315                 320

Gly Pro Gly Thr Ser Gly Pro Gly Ala Tyr Gly Pro Gly Ser Ser Gly
                325                 330                 335

Pro Gly Thr Ser Gly Pro Tyr Gly Pro Gly Ser Ser Ala Ala Ala Ala
            340                 345                 350

Ala Gly Ala Tyr Gly Pro Gly Thr Ser Gly Pro Tyr Gly Pro Gly Ala
        355                 360                 365

Ser Ala Ala Ala Ala Ala Gly Ala Tyr Thr Ser Gly Pro Gly Thr Ser
    370                 375                 380

Gly Pro Tyr Gly Pro Gly Ala Ser Gly Pro Gly Thr Ser Gly Pro Tyr
385                 390                 395                 400

Gly Pro Gly Ala Ser Ala Ala Ala Ala Ala Gly Pro Gly Ala Tyr Gly
                405                 410                 415

Pro Gly Thr Ser Gly Pro Ser Ala Ser Ala Ala Ala Ala Ala Gly Ala
            420                 425                 430

Tyr Gly Ser Gly Pro Gly Ala Tyr Gly Pro Tyr Gly Pro Gly Ala Ser
        435                 440                 445

Gly Pro Gly Ser Gly Thr Ser Gly Ala Gly Pro Tyr Gly Pro Gly Ala
    450                 455                 460

Ser Ala Ala Ala Ala Ala Gly Ala Tyr Gly Pro Gly Thr Ser Gly Pro
465                 470                 475                 480

Tyr Gly Pro Gly Ala Ser Ala Ala Ala Ala Ala Gly Pro Gly Ser Gly
                485                 490                 495

Ala Tyr Gly Pro Gly Ala Ser Gly Ala Asn Gly Pro Gly Ser Gly Ala
            500                 505                 510

Tyr Gly Pro Gly Thr Ser Gly Pro Gly Ala Ser Ala Ala Ala Ala Ala
        515                 520                 525

Gly Ala Tyr Thr Ser Gly Pro Gly Thr Ser Gly Pro Tyr Gly Pro Gly
    530                 535                 540

Ala Ser Ala Ala Ala Ala Ala Gly Ala Tyr Gly Ser Gly Pro Gly Thr
545                 550                 555                 560

Ser Gly Pro Tyr Gly Pro Gly Ala Ser Gly Ser Gly Thr Ser Gly Pro
                565                 570                 575

Gly Thr Ser Gly Pro Tyr Ala Ser Ala Ala Ala Ala Ala Gly Pro Gly
            580                 585                 590

Ser Gly Thr Ser Gly Pro Gly Ala Ser
        595                 600


<210> SEQ ID NO 35
<211> LENGTH: 601
<212> TYPE: PRT
<213> ORGANISM: Artificial Sequence
<220> FEATURE:
<223> OTHER INFORMATION: PRT889

<400> SEQUENCE: 35

Met His His His His His His Ser Ser Gly Ser Ser Gly Pro Gly Val
1               5                   10                  15

Leu Gly Pro Tyr Gly Pro Gly Ala Ser Ala Ala Ala Ala Ala Gly Ile
            20                  25                  30

Asn Gly Pro Gly Ser Gly Val Leu Gly Pro Gly Ile Ser Gly Ile Tyr
        35                  40                  45

Gly Pro Gly Val Leu Gly Pro Gly Val Leu Gly Pro Gly Ser Ser Ala
```

```
    50                  55                  60

Ala Ala Ala Ala Gly Pro Gly Ile Tyr Gly Pro Gly Val Leu Gly Pro
65                  70                  75                  80

Ser Ala Ser Ala Ala Ala Ala Ala Gly Pro Gly Ser Gly Val Leu Gly
                85                  90                  95

Pro Gly Ala Ser Gly Ile Tyr Gly Pro Gly Val Leu Gly Pro Gly Val
            100                 105                 110

Leu Gly Pro Gly Ser Ser Ala Ala Ala Ala Ala Gly Ile Tyr Gly Ser
        115                 120                 125

Gly Pro Gly Val Leu Gly Pro Tyr Gly Ser Ala Ala Ala Ala Ala Gly
    130                 135                 140

Pro Gly Ser Gly Ile Tyr Gly Ile Gly Pro Tyr Gly Pro Gly Ala Ser
145                 150                 155                 160

Gly Pro Gly Ile Tyr Gly Pro Gly Val Leu Gly Pro Ser Ala Ser Ala
                165                 170                 175

Ala Ala Ala Ala Gly Ser Gly Val Leu Gly Pro Gly Ile Tyr Gly Pro
            180                 185                 190

Tyr Ala Ser Ala Ala Ala Ala Ala Gly Ile Tyr Gly Ser Gly Pro Gly
        195                 200                 205

Val Leu Gly Pro Tyr Gly Pro Gly Ile Ser Gly Ser Gly Val Leu Gly
    210                 215                 220

Pro Gly Val Leu Gly Pro Tyr Ala Ser Ala Ala Ala Ala Ala Gly Pro
225                 230                 235                 240

Gly Val Leu Gly Pro Tyr Gly Pro Gly Ser Ser Ala Ala Ala Ala Ala
                245                 250                 255

Gly Ile Tyr Gly Tyr Gly Pro Gly Val Leu Gly Pro Tyr Gly Pro Gly
            260                 265                 270

Ala Ser Gly Ile Asn Gly Pro Gly Ser Gly Ile Tyr Gly Pro Gly Val
        275                 280                 285

Leu Gly Pro Gly Ile Ser Ala Ala Ala Ala Ala Gly Pro Gly Val Leu
    290                 295                 300

Gly Pro Tyr Gly Pro Gly Ala Ser Ala Ala Ala Ala Ala Gly Ile Tyr
305                 310                 315                 320

Gly Pro Gly Val Leu Gly Pro Gly Ile Tyr Gly Pro Gly Ser Ser Gly
                325                 330                 335

Pro Gly Val Leu Gly Pro Tyr Gly Pro Gly Ser Ser Ala Ala Ala Ala
            340                 345                 350

Ala Gly Ile Tyr Gly Pro Gly Val Leu Gly Pro Tyr Gly Pro Gly Ile
        355                 360                 365

Ser Ala Ala Ala Ala Ala Gly Ile Tyr Val Leu Gly Pro Gly Val Leu
    370                 375                 380

Gly Pro Tyr Gly Pro Gly Ala Ser Gly Pro Gly Val Leu Gly Pro Tyr
385                 390                 395                 400

Gly Pro Gly Ala Ser Ala Ala Ala Ala Ala Gly Pro Gly Ile Tyr Gly
                405                 410                 415

Pro Gly Val Leu Gly Pro Ser Ala Ser Ala Ala Ala Ala Ala Gly Ile
            420                 425                 430

Tyr Gly Ser Gly Pro Gly Ile Tyr Gly Pro Tyr Gly Pro Gly Ile Ser
        435                 440                 445

Gly Pro Gly Ser Gly Val Leu Gly Ile Gly Pro Tyr Gly Pro Gly Ala
    450                 455                 460

Ser Ala Ala Ala Ala Ala Gly Ile Tyr Gly Pro Gly Val Leu Gly Pro
465                 470                 475                 480
```

```
Tyr Gly Pro Gly Ile Ser Ala Ala Ala Ala Ala Gly Pro Gly Ser Gly
                485                 490                 495

Ile Tyr Gly Pro Gly Ala Ser Gly Ile Asn Gly Pro Gly Ser Gly Ile
            500                 505                 510

Tyr Gly Pro Gly Val Leu Gly Pro Gly Ile Ser Ala Ala Ala Ala Ala
        515                 520                 525

Gly Ile Tyr Val Leu Gly Pro Gly Val Leu Gly Pro Tyr Gly Pro Gly
    530                 535                 540

Ala Ser Ala Ala Ala Ala Ala Gly Ile Tyr Gly Ser Gly Pro Gly Val
545                 550                 555                 560

Leu Gly Pro Tyr Gly Pro Gly Ile Ser Gly Ser Gly Val Leu Gly Pro
                565                 570                 575

Gly Val Leu Gly Pro Tyr Ala Ser Ala Ala Ala Ala Ala Gly Pro Gly
            580                 585                 590

Ser Gly Val Leu Gly Pro Gly Ala Ser
        595                 600


<210> SEQ ID NO 36
<211> LENGTH: 601
<212> TYPE: PRT
<213> ORGANISM: Artificial Sequence
<220> FEATURE:
<223> OTHER INFORMATION: PRT916

<400> SEQUENCE: 36

Met His His His His His His Ser Ser Gly Ser Ser Gly Pro Gly Val
1               5                   10                  15

Ile Gly Pro Tyr Gly Pro Gly Ala Ser Ala Ala Ala Ala Ala Gly Leu
            20                  25                  30

Asn Gly Pro Gly Ser Gly Val Ile Gly Pro Gly Leu Ser Gly Leu Tyr
        35                  40                  45

Gly Pro Gly Val Ile Gly Pro Gly Val Ile Gly Pro Gly Ser Ser Ala
    50                  55                  60

Ala Ala Ala Ala Gly Pro Gly Leu Tyr Gly Pro Gly Val Ile Gly Pro
65                  70                  75                  80

Ser Ala Ser Ala Ala Ala Ala Ala Gly Pro Gly Ser Gly Val Ile Gly
                85                  90                  95

Pro Gly Ala Ser Gly Leu Tyr Gly Pro Gly Val Ile Gly Pro Gly Val
            100                 105                 110

Ile Gly Pro Gly Ser Ser Ala Ala Ala Ala Ala Gly Leu Tyr Gly Ser
        115                 120                 125

Gly Pro Gly Val Ile Gly Pro Tyr Gly Ser Ala Ala Ala Ala Ala Gly
    130                 135                 140

Pro Gly Ser Gly Leu Tyr Gly Leu Gly Pro Tyr Gly Pro Gly Ala Ser
145                 150                 155                 160

Gly Pro Gly Leu Tyr Gly Pro Gly Val Ile Gly Pro Ser Ala Ser Ala
                165                 170                 175

Ala Ala Ala Ala Gly Ser Gly Val Ile Gly Pro Gly Leu Tyr Gly Pro
            180                 185                 190

Tyr Ala Ser Ala Ala Ala Ala Ala Gly Leu Tyr Gly Ser Gly Pro Gly
        195                 200                 205

Val Ile Gly Pro Tyr Gly Pro Gly Leu Ser Gly Ser Gly Val Ile Gly
    210                 215                 220

Pro Gly Val Ile Gly Pro Tyr Ala Ser Ala Ala Ala Ala Ala Gly Pro
225                 230                 235                 240
```

```
Gly Val Ile Gly Pro Tyr Gly Pro Gly Ser Ser Ala Ala Ala Ala Ala
                245                 250                 255

Gly Leu Tyr Gly Tyr Gly Pro Gly Val Ile Gly Pro Tyr Gly Pro Gly
            260                 265                 270

Ala Ser Gly Leu Asn Gly Pro Gly Ser Gly Leu Tyr Gly Pro Gly Val
        275                 280                 285

Ile Gly Pro Gly Leu Ser Ala Ala Ala Ala Ala Gly Pro Gly Val Ile
    290                 295                 300

Gly Pro Tyr Gly Pro Gly Ala Ser Ala Ala Ala Ala Ala Gly Leu Tyr
305                 310                 315                 320

Gly Pro Gly Val Ile Gly Pro Gly Leu Tyr Gly Pro Gly Ser Ser Gly
                325                 330                 335

Pro Gly Val Ile Gly Pro Tyr Gly Pro Gly Ser Ser Ala Ala Ala Ala
            340                 345                 350

Ala Gly Leu Tyr Gly Pro Gly Val Ile Gly Pro Tyr Gly Pro Gly Leu
        355                 360                 365

Ser Ala Ala Ala Ala Ala Gly Leu Tyr Val Ile Gly Pro Gly Val Ile
    370                 375                 380

Gly Pro Tyr Gly Pro Gly Ala Ser Gly Pro Gly Val Ile Gly Pro Tyr
385                 390                 395                 400

Gly Pro Gly Ala Ser Ala Ala Ala Ala Ala Gly Pro Gly Leu Tyr Gly
                405                 410                 415

Pro Gly Val Ile Gly Pro Ser Ala Ser Ala Ala Ala Ala Ala Gly Leu
            420                 425                 430

Tyr Gly Ser Gly Pro Gly Leu Tyr Gly Pro Tyr Gly Pro Gly Leu Ser
        435                 440                 445

Gly Pro Gly Ser Gly Val Ile Gly Leu Gly Pro Tyr Gly Pro Gly Ala
    450                 455                 460

Ser Ala Ala Ala Ala Ala Gly Leu Tyr Gly Pro Gly Val Ile Gly Pro
465                 470                 475                 480

Tyr Gly Pro Gly Leu Ser Ala Ala Ala Ala Ala Gly Pro Gly Ser Gly
                485                 490                 495

Leu Tyr Gly Pro Gly Ala Ser Gly Leu Asn Gly Pro Gly Ser Gly Leu
            500                 505                 510

Tyr Gly Pro Gly Val Ile Gly Pro Gly Leu Ser Ala Ala Ala Ala Ala
        515                 520                 525

Gly Leu Tyr Val Ile Gly Pro Gly Val Ile Gly Pro Tyr Gly Pro Gly
    530                 535                 540

Ala Ser Ala Ala Ala Ala Ala Gly Leu Tyr Gly Ser Gly Pro Gly Val
545                 550                 555                 560

Ile Gly Pro Tyr Gly Pro Gly Leu Ser Gly Ser Gly Val Ile Gly Pro
                565                 570                 575

Gly Val Ile Gly Pro Tyr Ala Ser Ala Ala Ala Ala Ala Gly Pro Gly
            580                 585                 590

Ser Gly Val Ile Gly Pro Gly Ala Ser
        595                 600


<210> SEQ ID NO 37
<211> LENGTH: 601
<212> TYPE: PRT
<213> ORGANISM: Artificial Sequence
<220> FEATURE:
<223> OTHER INFORMATION: PRT918

<400> SEQUENCE: 37
```

```
Met His His His His His His Ser Ser Gly Ser Ser Gly Pro Gly Val
1               5                   10                  15

Phe Gly Pro Tyr Gly Pro Gly Ala Ser Ala Ala Ala Ala Ala Gly Ile
            20                  25                  30

Asn Gly Pro Gly Ser Gly Val Phe Gly Pro Gly Ile Ser Gly Ile Tyr
        35                  40                  45

Gly Pro Gly Val Phe Gly Pro Gly Val Phe Gly Pro Gly Ser Ser Ala
    50                  55                  60

Ala Ala Ala Ala Gly Pro Gly Ile Tyr Gly Pro Gly Val Phe Gly Pro
65                  70                  75                  80

Ser Ala Ser Ala Ala Ala Ala Ala Gly Pro Gly Ser Gly Val Phe Gly
                85                  90                  95

Pro Gly Ala Ser Gly Ile Tyr Gly Pro Gly Val Phe Gly Pro Gly Val
            100                 105                 110

Phe Gly Pro Gly Ser Ser Ala Ala Ala Ala Ala Gly Ile Tyr Gly Ser
        115                 120                 125

Gly Pro Gly Val Phe Gly Pro Tyr Gly Ser Ala Ala Ala Ala Ala Gly
    130                 135                 140

Pro Gly Ser Gly Ile Tyr Gly Ile Gly Pro Tyr Gly Pro Gly Ala Ser
145                 150                 155                 160

Gly Pro Gly Ile Tyr Gly Pro Gly Val Phe Gly Pro Ser Ala Ser Ala
                165                 170                 175

Ala Ala Ala Ala Gly Ser Gly Val Phe Gly Pro Gly Ile Tyr Gly Pro
            180                 185                 190

Tyr Ala Ser Ala Ala Ala Ala Ala Gly Ile Tyr Gly Ser Gly Pro Gly
        195                 200                 205

Val Phe Gly Pro Tyr Gly Pro Gly Ile Ser Gly Ser Gly Val Phe Gly
    210                 215                 220

Pro Gly Val Phe Gly Pro Tyr Ala Ser Ala Ala Ala Ala Ala Gly Pro
225                 230                 235                 240

Gly Val Phe Gly Pro Tyr Gly Pro Gly Ser Ser Ala Ala Ala Ala Ala
                245                 250                 255

Gly Ile Tyr Gly Tyr Gly Pro Gly Val Phe Gly Pro Tyr Gly Pro Gly
            260                 265                 270

Ala Ser Gly Ile Asn Gly Pro Gly Ser Gly Ile Tyr Gly Pro Gly Val
        275                 280                 285

Phe Gly Pro Gly Ile Ser Ala Ala Ala Ala Ala Gly Pro Gly Val Phe
    290                 295                 300

Gly Pro Tyr Gly Pro Gly Ala Ser Ala Ala Ala Ala Ala Gly Ile Tyr
305                 310                 315                 320

Gly Pro Gly Val Phe Gly Pro Gly Ile Tyr Gly Pro Gly Ser Ser Gly
                325                 330                 335

Pro Gly Val Phe Gly Pro Tyr Gly Pro Gly Ser Ser Ala Ala Ala Ala
            340                 345                 350

Ala Gly Ile Tyr Gly Pro Gly Val Phe Gly Pro Tyr Gly Pro Gly Ile
        355                 360                 365

Ser Ala Ala Ala Ala Ala Gly Ile Tyr Val Phe Gly Pro Gly Val Phe
    370                 375                 380

Gly Pro Tyr Gly Pro Gly Ala Ser Gly Pro Gly Val Phe Gly Pro Tyr
385                 390                 395                 400

Gly Pro Gly Ala Ser Ala Ala Ala Ala Ala Gly Pro Gly Ile Tyr Gly
                405                 410                 415
```

```
Pro Gly Val Phe Gly Pro Ser Ala Ser Ala Ala Ala Ala Ala Gly Ile
            420                 425                 430

Tyr Gly Ser Gly Pro Gly Ile Tyr Gly Pro Tyr Gly Pro Gly Ile Ser
        435                 440                 445

Gly Pro Gly Ser Gly Val Phe Gly Ile Gly Pro Tyr Gly Pro Gly Ala
    450                 455                 460

Ser Ala Ala Ala Ala Ala Gly Ile Tyr Gly Pro Gly Val Phe Gly Pro
465                 470                 475                 480

Tyr Gly Pro Gly Ile Ser Ala Ala Ala Ala Ala Gly Pro Gly Ser Gly
                485                 490                 495

Ile Tyr Gly Pro Gly Ala Ser Gly Ile Asn Gly Pro Gly Ser Gly Ile
            500                 505                 510

Tyr Gly Pro Gly Val Phe Gly Pro Gly Ile Ser Ala Ala Ala Ala Ala
        515                 520                 525

Gly Ile Tyr Val Phe Gly Pro Gly Val Phe Gly Pro Tyr Gly Pro Gly
    530                 535                 540

Ala Ser Ala Ala Ala Ala Ala Gly Ile Tyr Gly Ser Gly Pro Gly Val
545                 550                 555                 560

Phe Gly Pro Tyr Gly Pro Gly Ile Ser Gly Ser Gly Val Phe Gly Pro
                565                 570                 575

Gly Val Phe Gly Pro Tyr Ala Ser Ala Ala Ala Ala Ala Gly Pro Gly
            580                 585                 590

Ser Gly Val Phe Gly Pro Gly Ala Ser
        595                 600


<210> SEQ ID NO 38
<211> LENGTH: 576
<212> TYPE: PRT
<213> ORGANISM: Artificial Sequence
<220> FEATURE:
<223> OTHER INFORMATION: PRT699

<400> SEQUENCE: 38

Met His His His His His His Ser Ser Gly Ser Ser Gly Pro Gly Val
1               5                   10                  15

Leu Gly Pro Tyr Gly Pro Gly Ala Ser Ala Ala Ala Ala Ala Ala Ala
            20                  25                  30

Gly Ser Asn Gly Pro Gly Ser Gly Val Leu Gly Pro Gly Gln Ser Gly
        35                  40                  45

Gln Tyr Gly Pro Gly Val Leu Gly Pro Gly Val Leu Gly Pro Gly Ser
    50                  55                  60

Ser Ala Ala Ala Ala Ala Ala Ala Gly Pro Gly Gln Tyr Gly Pro Gly
65                  70                  75                  80

Val Leu Gly Pro Ser Ala Ser Ala Ala Ala Ala Ala Ala Ala Gly Pro
                85                  90                  95

Gly Ser Gly Val Leu Gly Pro Gly Ala Ser Gly Gln Tyr Gly Pro Gly
            100                 105                 110

Val Leu Gly Pro Gly Val Leu Gly Pro Gly Ser Ser Ala Ala Ala Ala
        115                 120                 125

Ala Ala Ala Gly Ser Tyr Gly Ser Gly Pro Gly Val Leu Gly Pro Tyr
    130                 135                 140

Gly Ser Ala Ala Ala Ala Ala Ala Ala Gly Pro Gly Ser Gly Gln Tyr
145                 150                 155                 160

Gly Gln Gly Pro Tyr Gly Pro Gly Ala Ser Gly Pro Gly Gln Tyr Gly
                165                 170                 175
```

```
Pro Gly Val Leu Gly Pro Ser Ala Ser Ala Ala Ala Ala Ala Ala Ala
            180                 185                 190

Gly Ser Gly Val Leu Gly Pro Gly Gln Tyr Gly Pro Tyr Ala Ser Ala
        195                 200                 205

Ala Ala Ala Ala Ala Ala Gly Ser Tyr Gly Ser Gly Pro Gly Val Leu
    210                 215                 220

Gly Pro Tyr Gly Pro Gly Gln Ser Gly Ser Gly Val Leu Gly Pro Gly
225                 230                 235                 240

Val Leu Gly Pro Tyr Ala Ser Ala Ala Ala Ala Ala Ala Ala Gly Pro
                245                 250                 255

Gly Val Leu Gly Pro Tyr Gly Pro Gly Ser Ser Ala Ala Ala Ala Ala
            260                 265                 270

Ala Ala Gly Ser Tyr Gly Tyr Gly Pro Gly Val Leu Gly Pro Tyr Gly
        275                 280                 285

Pro Gly Ala Ser Gly Gln Asn Gly Pro Gly Ser Gly Gln Tyr Gly Pro
    290                 295                 300

Gly Val Leu Gly Pro Gly Pro Ser Ala Ala Ala Ala Ala Ala Ala Gly
305                 310                 315                 320

Pro Gly Val Leu Gly Pro Tyr Gly Pro Gly Ala Ser Ala Ala Ala Ala
                325                 330                 335

Ala Ala Ala Gly Ser Tyr Gly Pro Gly Val Leu Gly Pro Gly Gln Tyr
            340                 345                 350

Gly Pro Gly Ser Ser Gly Pro Gly Val Leu Gly Pro Tyr Gly Pro Gly
        355                 360                 365

Ser Ser Ala Ala Ala Ala Ala Ala Ala Gly Ser Tyr Gly Pro Gly Val
    370                 375                 380

Leu Gly Pro Tyr Gly Pro Gly Pro Ser Ala Ala Ala Ala Ala Ala Ala
385                 390                 395                 400

Gly Ser Tyr Val Leu Gly Pro Gly Val Leu Gly Pro Tyr Gly Pro Gly
                405                 410                 415

Ala Ser Gly Pro Gly Val Leu Gly Pro Tyr Gly Pro Gly Ala Ser Ala
            420                 425                 430

Ala Ala Ala Ala Ala Ala Gly Pro Gly Gln Tyr Gly Pro Gly Val Leu
        435                 440                 445

Gly Pro Ser Ala Ser Ala Ala Ala Ala Ala Ala Ala Gly Ser Tyr Gly
    450                 455                 460

Ser Gly Pro Gly Gln Tyr Gly Pro Tyr Gly Pro Gly Gln Ser Gly Pro
465                 470                 475                 480

Gly Ser Gly Val Leu Gly Gln Gly Pro Tyr Gly Pro Gly Ala Ser Ala
                485                 490                 495

Ala Ala Ala Ala Ala Ala Gly Ser Tyr Gly Pro Gly Val Leu Gly Pro
            500                 505                 510

Tyr Gly Pro Gly Pro Ser Ala Ala Ala Ala Ala Ala Ala Gly Pro Gly
        515                 520                 525

Ser Gly Gln Tyr Gly Pro Gly Ala Ser Gly Gln Asn Gly Pro Gly Ser
    530                 535                 540

Gly Gln Tyr Gly Pro Gly Val Leu Gly Pro Gly Pro Ser Ala Ala Ala
545                 550                 555                 560

Ala Ala Ala Ala Gly Pro Gly Ser Gly Val Leu Gly Pro Gly Ala Ser
                565                 570                 575
```

<210> SEQ ID NO 39
<211> LENGTH: 576
<212> TYPE: PRT

<213> ORGANISM: Artificial Sequence
<220> FEATURE:
<223> OTHER INFORMATION: PRT698

<400> SEQUENCE: 39

Met His His His His His His Ser Ser Gly Ser Ser Gly Pro Gly Val
1 5 10 15

Leu Gly Pro Tyr Gly Pro Gly Ala Ser Ala Ala Ala Ala Ala Ala Ala
20 25 30

Gly Ser Asn Gly Pro Gly Ser Gly Val Leu Gly Pro Gly Ile Ser Gly
35 40 45

Ile Tyr Gly Pro Gly Val Leu Gly Pro Gly Val Leu Gly Pro Gly Ser
50 55 60

Ser Ala Ala Ala Ala Ala Ala Ala Gly Pro Gly Ile Tyr Gly Pro Gly
65 70 75 80

Val Leu Gly Pro Ser Ala Ser Ala Ala Ala Ala Ala Ala Ala Gly Pro
85 90 95

Gly Ser Gly Val Leu Gly Pro Gly Ala Ser Gly Ile Tyr Gly Pro Gly
100 105 110

Val Leu Gly Pro Gly Val Leu Gly Pro Gly Ser Ser Ala Ala Ala Ala
115 120 125

Ala Ala Ala Gly Ser Tyr Gly Ser Gly Pro Gly Val Leu Gly Pro Tyr
130 135 140

Gly Ser Ala Ala Ala Ala Ala Ala Ala Gly Pro Gly Ser Gly Ile Tyr
145 150 155 160

Gly Ile Gly Pro Tyr Gly Pro Gly Ala Ser Gly Pro Gly Ile Tyr Gly
165 170 175

Pro Gly Val Leu Gly Pro Ser Ala Ser Ala Ala Ala Ala Ala Ala Ala
180 185 190

Gly Ser Gly Val Leu Gly Pro Gly Ile Tyr Gly Pro Tyr Ala Ser Ala
195 200 205

Ala Ala Ala Ala Ala Ala Gly Ser Tyr Gly Ser Gly Pro Gly Val Leu
210 215 220

Gly Pro Tyr Gly Pro Gly Ile Ser Gly Ser Gly Val Leu Gly Pro Gly
225 230 235 240

Val Leu Gly Pro Tyr Ala Ser Ala Ala Ala Ala Ala Ala Ala Gly Pro
245 250 255

Gly Val Leu Gly Pro Tyr Gly Pro Gly Ser Ser Ala Ala Ala Ala Ala
260 265 270

Ala Ala Gly Ser Tyr Gly Tyr Gly Pro Gly Val Leu Gly Pro Tyr Gly
275 280 285

Pro Gly Ala Ser Gly Ile Asn Gly Pro Gly Ser Gly Ile Tyr Gly Pro
290 295 300

Gly Val Leu Gly Pro Gly Pro Ser Ala Ala Ala Ala Ala Ala Ala Gly
305 310 315 320

Pro Gly Val Leu Gly Pro Tyr Gly Pro Gly Ala Ser Ala Ala Ala Ala
325 330 335

Ala Ala Ala Gly Ser Tyr Gly Pro Gly Val Leu Gly Pro Gly Ile Tyr
340 345 350

Gly Pro Gly Ser Ser Gly Pro Gly Val Leu Gly Pro Tyr Gly Pro Gly
355 360 365

Ser Ser Ala Ala Ala Ala Ala Ala Ala Gly Ser Tyr Gly Pro Gly Val
370 375 380

Leu Gly Pro Tyr Gly Pro Gly Pro Ser Ala Ala Ala Ala Ala Ala Ala

```
385                 390                 395                 400

Gly Ser Tyr Val Leu Gly Pro Gly Val Leu Gly Pro Tyr Gly Pro Gly
                405                 410                 415

Ala Ser Gly Pro Gly Val Leu Gly Pro Tyr Gly Pro Gly Ala Ser Ala
            420                 425                 430

Ala Ala Ala Ala Ala Ala Gly Pro Gly Ile Tyr Gly Pro Gly Val Leu
        435                 440                 445

Gly Pro Ser Ala Ser Ala Ala Ala Ala Ala Ala Ala Gly Ser Tyr Gly
    450                 455                 460

Ser Gly Pro Gly Ile Tyr Gly Pro Tyr Gly Pro Gly Ile Ser Gly Pro
465                 470                 475                 480

Gly Ser Gly Val Leu Gly Ile Gly Pro Tyr Gly Pro Gly Ala Ser Ala
                485                 490                 495

Ala Ala Ala Ala Ala Ala Gly Ser Tyr Gly Pro Gly Val Leu Gly Pro
            500                 505                 510

Tyr Gly Pro Gly Pro Ser Ala Ala Ala Ala Ala Ala Ala Gly Pro Gly
        515                 520                 525

Ser Gly Ile Tyr Gly Pro Gly Ala Ser Gly Ile Asn Gly Pro Gly Ser
    530                 535                 540

Gly Ile Tyr Gly Pro Gly Val Leu Gly Pro Gly Pro Ser Ala Ala Ala
545                 550                 555                 560

Ala Ala Ala Ala Gly Pro Gly Ser Gly Val Leu Gly Pro Gly Ala Ser
                565                 570                 575


<210> SEQ ID NO 40
<211> LENGTH: 1190
<212> TYPE: PRT
<213> ORGANISM: Artificial Sequence
<220> FEATURE:
<223> OTHER INFORMATION: PRT966

<400> SEQUENCE: 40

Met His His His His His His Ser Ser Gly Ser Ser Gly Pro Gly Val
1               5                   10                  15

Phe Gly Pro Tyr Gly Pro Gly Ala Ser Ala Ala Ala Ala Ala Gly Ile
            20                  25                  30

Asn Gly Pro Gly Ser Gly Val Phe Gly Pro Gly Ile Ser Gly Ile Tyr
        35                  40                  45

Gly Pro Gly Val Phe Gly Pro Gly Val Phe Gly Pro Gly Ser Ser Ala
    50                  55                  60

Ala Ala Ala Ala Gly Pro Gly Ile Tyr Gly Pro Gly Val Phe Gly Pro
65                  70                  75                  80

Ser Ala Ser Ala Ala Ala Ala Ala Gly Pro Gly Ser Gly Val Phe Gly
                85                  90                  95

Pro Gly Ala Ser Gly Ile Tyr Gly Pro Gly Val Phe Gly Pro Gly Val
            100                 105                 110

Phe Gly Pro Gly Ser Ser Ala Ala Ala Ala Ala Gly Ile Tyr Gly Ser
        115                 120                 125

Gly Pro Gly Val Phe Gly Pro Tyr Gly Ser Ala Ala Ala Ala Ala Gly
    130                 135                 140

Pro Gly Ser Gly Ile Tyr Gly Ile Gly Pro Tyr Gly Pro Gly Ala Ser
145                 150                 155                 160

Gly Pro Gly Ile Tyr Gly Pro Gly Val Phe Gly Pro Ser Ala Ser Ala
                165                 170                 175

Ala Ala Ala Ala Gly Ser Gly Val Phe Gly Pro Gly Ile Tyr Gly Pro
```

```
            180                 185                 190

Tyr Ala Ser Ala Ala Ala Ala Ala Gly Ile Tyr Gly Ser Gly Pro Gly
        195                 200                 205

Val Phe Gly Pro Tyr Gly Pro Gly Ile Ser Gly Ser Gly Val Phe Gly
    210                 215                 220

Pro Gly Val Phe Gly Pro Tyr Ala Ser Ala Ala Ala Ala Ala Gly Pro
225                 230                 235                 240

Gly Val Phe Gly Pro Tyr Gly Pro Gly Ser Ser Ala Ala Ala Ala Ala
                245                 250                 255

Gly Ile Tyr Gly Tyr Gly Pro Gly Val Phe Gly Pro Tyr Gly Pro Gly
            260                 265                 270

Ala Ser Gly Ile Asn Gly Pro Gly Ser Gly Ile Tyr Gly Pro Gly Val
        275                 280                 285

Phe Gly Pro Gly Ile Ser Ala Ala Ala Ala Ala Gly Pro Gly Val Phe
    290                 295                 300

Gly Pro Tyr Gly Pro Gly Ala Ser Ala Ala Ala Ala Ala Gly Ile Tyr
305                 310                 315                 320

Gly Pro Gly Val Phe Gly Pro Gly Ile Tyr Gly Pro Gly Ser Ser Gly
                325                 330                 335

Pro Gly Val Phe Gly Pro Tyr Gly Pro Gly Ser Ser Ala Ala Ala Ala
            340                 345                 350

Ala Gly Ile Tyr Gly Pro Gly Val Phe Gly Pro Tyr Gly Pro Gly Ile
        355                 360                 365

Ser Ala Ala Ala Ala Ala Gly Ile Tyr Val Phe Gly Pro Gly Val Phe
    370                 375                 380

Gly Pro Tyr Gly Pro Gly Ala Ser Gly Pro Gly Val Phe Gly Pro Tyr
385                 390                 395                 400

Gly Pro Gly Ala Ser Ala Ala Ala Ala Ala Gly Pro Gly Ile Tyr Gly
                405                 410                 415

Pro Gly Val Phe Gly Pro Ser Ala Ser Ala Ala Ala Ala Ala Gly Ile
            420                 425                 430

Tyr Gly Ser Gly Pro Gly Ile Tyr Gly Pro Tyr Gly Pro Gly Ile Ser
        435                 440                 445

Gly Pro Gly Ser Gly Val Phe Gly Ile Gly Pro Tyr Gly Pro Gly Ala
    450                 455                 460

Ser Ala Ala Ala Ala Ala Gly Ile Tyr Gly Pro Gly Val Phe Gly Pro
465                 470                 475                 480

Tyr Gly Pro Gly Ile Ser Ala Ala Ala Ala Ala Gly Pro Gly Ser Gly
                485                 490                 495

Ile Tyr Gly Pro Gly Ala Ser Gly Ile Asn Gly Pro Gly Ser Gly Ile
            500                 505                 510

Tyr Gly Pro Gly Val Phe Gly Pro Gly Ile Ser Ala Ala Ala Ala Ala
        515                 520                 525

Gly Ile Tyr Val Phe Gly Pro Gly Val Phe Gly Pro Tyr Gly Pro Gly
    530                 535                 540

Ala Ser Ala Ala Ala Ala Ala Gly Ile Tyr Gly Ser Gly Pro Gly Val
545                 550                 555                 560

Phe Gly Pro Tyr Gly Pro Gly Ile Ser Gly Ser Gly Val Phe Gly Pro
                565                 570                 575

Gly Val Phe Gly Pro Tyr Ala Ser Ala Ala Ala Ala Ala Gly Pro Gly
            580                 585                 590

Ser Gly Val Phe Gly Pro Gly Ala Ser Gly Pro Gly Val Phe Gly Pro
        595                 600                 605
```

```
Tyr Gly Pro Gly Ala Ser Ala Ala Ala Ala Ala Gly Ile Asn Gly Pro
    610                 615                 620

Gly Ser Gly Val Phe Gly Pro Gly Ile Ser Gly Ile Tyr Gly Pro Gly
625                 630                 635                 640

Val Phe Gly Pro Gly Val Phe Gly Pro Gly Ser Ser Ala Ala Ala Ala
                645                 650                 655

Ala Gly Pro Gly Ile Tyr Gly Pro Gly Val Phe Gly Pro Ser Ala Ser
            660                 665                 670

Ala Ala Ala Ala Ala Gly Pro Gly Ser Gly Val Phe Gly Pro Gly Ala
        675                 680                 685

Ser Gly Ile Tyr Gly Pro Gly Val Phe Gly Pro Gly Val Phe Gly Pro
    690                 695                 700

Gly Ser Ser Ala Ala Ala Ala Ala Gly Ile Tyr Gly Ser Gly Pro Gly
705                 710                 715                 720

Val Phe Gly Pro Tyr Gly Ser Ala Ala Ala Ala Ala Gly Pro Gly Ser
                725                 730                 735

Gly Ile Tyr Gly Ile Gly Pro Tyr Gly Pro Gly Ala Ser Gly Pro Gly
            740                 745                 750

Ile Tyr Gly Pro Gly Val Phe Gly Pro Ser Ala Ser Ala Ala Ala Ala
        755                 760                 765

Ala Gly Ser Gly Val Phe Gly Pro Gly Ile Tyr Gly Pro Tyr Ala Ser
    770                 775                 780

Ala Ala Ala Ala Ala Gly Ile Tyr Gly Ser Gly Pro Gly Val Phe Gly
785                 790                 795                 800

Pro Tyr Gly Pro Gly Ile Ser Gly Ser Gly Val Phe Gly Pro Gly Val
                805                 810                 815

Phe Gly Pro Tyr Ala Ser Ala Ala Ala Ala Ala Gly Pro Gly Val Phe
            820                 825                 830

Gly Pro Tyr Gly Pro Gly Ser Ser Ala Ala Ala Ala Ala Gly Ile Tyr
        835                 840                 845

Gly Tyr Gly Pro Gly Val Phe Gly Pro Tyr Gly Pro Gly Ala Ser Gly
    850                 855                 860

Ile Asn Gly Pro Gly Ser Gly Ile Tyr Gly Pro Gly Val Phe Gly Pro
865                 870                 875                 880

Gly Ile Ser Ala Ala Ala Ala Ala Gly Pro Gly Val Phe Gly Pro Tyr
                885                 890                 895

Gly Pro Gly Ala Ser Ala Ala Ala Ala Ala Gly Ile Tyr Gly Pro Gly
            900                 905                 910

Val Phe Gly Pro Gly Ile Tyr Gly Pro Gly Ser Ser Gly Pro Gly Val
        915                 920                 925

Phe Gly Pro Tyr Gly Pro Gly Ser Ser Ala Ala Ala Ala Ala Gly Ile
    930                 935                 940

Tyr Gly Pro Gly Val Phe Gly Pro Tyr Gly Pro Gly Ile Ser Ala Ala
945                 950                 955                 960

Ala Ala Ala Gly Ile Tyr Val Phe Gly Pro Gly Val Phe Gly Pro Tyr
                965                 970                 975

Gly Pro Gly Ala Ser Gly Pro Gly Val Phe Gly Pro Tyr Gly Pro Gly
            980                 985                 990

Ala Ser Ala Ala Ala Ala Ala Gly  Pro Gly Ile Tyr Gly  Pro Gly Val
        995                 1000                1005

Phe Gly  Pro Ser Ala Ser Ala  Ala Ala Ala Ala Gly  Ile Tyr Gly
    1010                1015                1020
```

```
Ser Gly  Pro Gly Ile Tyr Gly  Pro Tyr Gly Pro Gly  Ile Ser Gly
    1025                1030                1035

Pro Gly  Ser Gly Val Phe Gly  Ile Gly Pro Tyr Gly  Pro Gly Ala
    1040                1045                1050

Ser Ala  Ala Ala Ala Ala Gly  Ile Tyr Gly Pro Gly  Val Phe Gly
    1055                1060                1065

Pro Tyr  Gly Pro Gly Ile Ser  Ala Ala Ala Ala Ala  Gly Pro Gly
    1070                1075                1080

Ser Gly  Ile Tyr Gly Pro Gly  Ala Ser Gly Ile Asn  Gly Pro Gly
    1085                1090                1095

Ser Gly  Ile Tyr Gly Pro Gly  Val Phe Gly Pro Gly  Ile Ser Ala
    1100                1105                1110

Ala Ala  Ala Ala Gly Ile Tyr  Val Phe Gly Pro Gly  Val Phe Gly
    1115                1120                1125

Pro Tyr  Gly Pro Gly Ala Ser  Ala Ala Ala Ala Ala  Gly Ile Tyr
    1130                1135                1140

Gly Ser  Gly Pro Gly Val Phe  Gly Pro Tyr Gly Pro  Gly Ile Ser
    1145                1150                1155

Gly Ser  Gly Val Phe Gly Pro  Gly Val Phe Gly Pro  Tyr Ala Ser
    1160                1165                1170

Ala Ala  Ala Ala Ala Gly Pro  Gly Ser Gly Val Phe  Gly Pro Gly
    1175                1180                1185

Ala Ser
    1190


<210> SEQ ID NO 41
<211> LENGTH: 590
<212> TYPE: PRT
<213> ORGANISM: Artificial Sequence
<220> FEATURE:
<223> OTHER INFORMATION: Met-PRT917

<400> SEQUENCE: 41

Met Gly Pro Gly Leu Ile Gly Pro Tyr Gly Pro Gly Ala Ser Ala Ala
1               5                   10                  15

Ala Ala Ala Gly Val Asn Gly Pro Gly Ser Gly Leu Ile Gly Pro Gly
            20                  25                  30

Val Ser Gly Val Tyr Gly Pro Gly Leu Ile Gly Pro Gly Leu Ile Gly
        35                  40                  45

Pro Gly Ser Ser Ala Ala Ala Ala Ala Gly Pro Gly Val Tyr Gly Pro
    50                  55                  60

Gly Leu Ile Gly Pro Ser Ala Ser Ala Ala Ala Ala Ala Gly Pro Gly
65                  70                  75                  80

Ser Gly Leu Ile Gly Pro Gly Ala Ser Gly Val Tyr Gly Pro Gly Leu
                85                  90                  95

Ile Gly Pro Gly Leu Ile Gly Pro Gly Ser Ser Ala Ala Ala Ala Ala
            100                 105                 110

Gly Val Tyr Gly Ser Gly Pro Gly Leu Ile Gly Pro Tyr Gly Ser Ala
        115                 120                 125

Ala Ala Ala Ala Gly Pro Gly Ser Gly Val Tyr Gly Val Gly Pro Tyr
    130                 135                 140

Gly Pro Gly Ala Ser Gly Pro Gly Val Tyr Gly Pro Gly Leu Ile Gly
145                 150                 155                 160

Pro Ser Ala Ser Ala Ala Ala Ala Ala Gly Ser Gly Leu Ile Gly Pro
                165                 170                 175
```

-continued

```
Gly Val Tyr Gly Pro Tyr Ala Ser Ala Ala Ala Ala Ala Gly Val Tyr
            180                 185                 190

Gly Ser Gly Pro Gly Leu Ile Gly Pro Tyr Gly Pro Gly Val Ser Gly
        195                 200                 205

Ser Gly Leu Ile Gly Pro Gly Leu Ile Gly Pro Tyr Ala Ser Ala Ala
    210                 215                 220

Ala Ala Ala Gly Pro Gly Leu Ile Gly Pro Tyr Gly Pro Gly Ser Ser
225                 230                 235                 240

Ala Ala Ala Ala Ala Gly Val Tyr Gly Tyr Gly Pro Gly Leu Ile Gly
                245                 250                 255

Pro Tyr Gly Pro Gly Ala Ser Gly Val Asn Gly Pro Gly Ser Gly Val
            260                 265                 270

Tyr Gly Pro Gly Leu Ile Gly Pro Gly Val Ser Ala Ala Ala Ala Ala
        275                 280                 285

Gly Pro Gly Leu Ile Gly Pro Tyr Gly Pro Gly Ala Ser Ala Ala Ala
    290                 295                 300

Ala Ala Gly Val Tyr Gly Pro Gly Leu Ile Gly Pro Gly Val Tyr Gly
305                 310                 315                 320

Pro Gly Ser Ser Gly Pro Gly Leu Ile Gly Pro Tyr Gly Pro Gly Ser
                325                 330                 335

Ser Ala Ala Ala Ala Ala Gly Val Tyr Gly Pro Gly Leu Ile Gly Pro
            340                 345                 350

Tyr Gly Pro Gly Val Ser Ala Ala Ala Ala Ala Gly Val Tyr Leu Ile
        355                 360                 365

Gly Pro Gly Leu Ile Gly Pro Tyr Gly Pro Gly Ala Ser Gly Pro Gly
    370                 375                 380

Leu Ile Gly Pro Tyr Gly Pro Gly Ala Ser Ala Ala Ala Ala Ala Gly
385                 390                 395                 400

Pro Gly Val Tyr Gly Pro Gly Leu Ile Gly Pro Ser Ala Ser Ala Ala
                405                 410                 415

Ala Ala Ala Gly Val Tyr Gly Ser Gly Pro Gly Val Tyr Gly Pro Tyr
            420                 425                 430

Gly Pro Gly Val Ser Gly Pro Gly Ser Gly Leu Ile Gly Val Gly Pro
        435                 440                 445

Tyr Gly Pro Gly Ala Ser Ala Ala Ala Ala Ala Gly Val Tyr Gly Pro
    450                 455                 460

Gly Leu Ile Gly Pro Tyr Gly Pro Gly Val Ser Ala Ala Ala Ala Ala
465                 470                 475                 480

Gly Pro Gly Ser Gly Val Tyr Gly Pro Gly Ala Ser Gly Val Asn Gly
                485                 490                 495

Pro Gly Ser Gly Val Tyr Gly Pro Gly Leu Ile Gly Pro Gly Val Ser
            500                 505                 510

Ala Ala Ala Ala Ala Gly Val Tyr Leu Ile Gly Pro Gly Leu Ile Gly
        515                 520                 525

Pro Tyr Gly Pro Gly Ala Ser Ala Ala Ala Ala Ala Gly Val Tyr Gly
    530                 535                 540

Ser Gly Pro Gly Leu Ile Gly Pro Tyr Gly Pro Gly Val Ser Gly Ser
545                 550                 555                 560

Gly Leu Ile Gly Pro Gly Leu Ile Gly Pro Tyr Ala Ser Ala Ala Ala
                565                 570                 575

Ala Ala Gly Pro Gly Ser Gly Leu Ile Gly Pro Gly Ala Ser
            580                 585                 590
```

<210> SEQ ID NO 42
<211> LENGTH: 587
<212> TYPE: PRT
<213> ORGANISM: Artificial Sequence
<220> FEATURE:
<223> OTHER INFORMATION: Met-PRT1028

<400> SEQUENCE: 42

Met Gly Pro Gly Ile Phe Gly Pro Tyr Gly Pro Gly Ala Ser Ala Ala
1 5 10 15

Ala Ala Ala Gly Thr Gly Pro Gly Ser Gly Ile Phe Gly Pro Gly Thr
20 25 30

Ser Gly Thr Tyr Gly Pro Gly Ile Phe Gly Pro Gly Ile Phe Gly Pro
35 40 45

Gly Ser Ser Ala Ala Ala Ala Ala Gly Pro Gly Thr Tyr Gly Pro Gly
50 55 60

Ile Phe Gly Pro Ser Ala Ser Ala Ala Ala Ala Ala Gly Pro Gly Ser
65 70 75 80

Gly Ile Phe Gly Pro Gly Ala Ser Gly Thr Tyr Gly Pro Gly Ile Phe
85 90 95

Gly Pro Gly Ile Phe Gly Pro Gly Ser Ser Ala Ala Ala Ala Ala Gly
100 105 110

Thr Tyr Gly Ser Gly Pro Gly Ile Phe Gly Pro Tyr Gly Ser Ala Ala
115 120 125

Ala Ala Ala Gly Pro Gly Ser Gly Thr Tyr Gly Thr Gly Pro Tyr Gly
130 135 140

Pro Gly Ala Ser Gly Pro Gly Thr Tyr Gly Pro Gly Ile Phe Gly Pro
145 150 155 160

Ser Ala Ser Ala Ala Ala Ala Ala Gly Ser Gly Ile Phe Gly Pro Gly
165 170 175

Thr Tyr Gly Pro Tyr Ala Ser Ala Ala Ala Ala Ala Gly Thr Tyr Gly
180 185 190

Ser Gly Pro Gly Ile Phe Gly Pro Tyr Gly Pro Gly Thr Ser Gly Ser
195 200 205

Gly Ile Phe Gly Pro Gly Ile Phe Gly Pro Tyr Ala Ser Ala Ala Ala
210 215 220

Ala Ala Gly Pro Gly Ile Phe Gly Pro Tyr Gly Pro Gly Ser Ser Ala
225 230 235 240

Ala Ala Ala Ala Gly Thr Tyr Gly Tyr Gly Pro Gly Ile Phe Gly Pro
245 250 255

Tyr Gly Pro Gly Ala Ser Gly Thr Gly Pro Gly Ser Gly Thr Tyr Gly
260 265 270

Pro Gly Ile Phe Gly Pro Gly Thr Ser Ala Ala Ala Ala Ala Gly Pro
275 280 285

Gly Ile Phe Gly Pro Tyr Gly Pro Gly Ala Ser Ala Ala Ala Ala Ala
290 295 300

Gly Thr Tyr Gly Pro Gly Ile Phe Gly Pro Gly Thr Tyr Gly Pro Gly
305 310 315 320

Ser Ser Gly Pro Gly Ile Phe Gly Pro Tyr Gly Pro Gly Ser Ser Ala
325 330 335

Ala Ala Ala Ala Gly Thr Tyr Gly Pro Gly Ile Phe Gly Pro Tyr Gly
340 345 350

Pro Gly Thr Ser Ala Ala Ala Ala Ala Gly Thr Tyr Ile Phe Gly Pro
355 360 365

Gly Ile Phe Gly Pro Tyr Gly Pro Gly Ala Ser Gly Pro Gly Ile Phe

```
    370                 375                 380

Gly Pro Tyr Gly Pro Gly Ala Ser Ala Ala Ala Ala Ala Gly Pro Gly
385                 390                 395                 400

Thr Tyr Gly Pro Gly Ile Phe Gly Pro Ser Ala Ser Ala Ala Ala Ala
                405                 410                 415

Ala Gly Thr Tyr Gly Ser Gly Pro Gly Thr Tyr Gly Pro Tyr Gly Pro
            420                 425                 430

Gly Thr Ser Gly Pro Gly Ser Gly Ile Phe Gly Thr Gly Pro Tyr Gly
        435                 440                 445

Pro Gly Ala Ser Ala Ala Ala Ala Ala Gly Thr Tyr Gly Pro Gly Ile
    450                 455                 460

Phe Gly Pro Tyr Gly Pro Gly Thr Ser Ala Ala Ala Ala Ala Gly Pro
465                 470                 475                 480

Gly Ser Gly Thr Tyr Gly Pro Gly Ala Ser Gly Thr Gly Pro Gly Ser
                485                 490                 495

Gly Thr Tyr Gly Pro Gly Ile Phe Gly Pro Gly Thr Ser Ala Ala Ala
            500                 505                 510

Ala Ala Gly Thr Tyr Ile Phe Gly Pro Gly Ile Phe Gly Pro Tyr Gly
        515                 520                 525

Pro Gly Ala Ser Ala Ala Ala Ala Ala Gly Thr Tyr Gly Ser Gly Pro
    530                 535                 540

Gly Ile Phe Gly Pro Tyr Gly Pro Gly Thr Ser Gly Ser Gly Ile Phe
545                 550                 555                 560

Gly Pro Gly Ile Phe Gly Pro Tyr Ala Ser Ala Ala Ala Ala Ala Gly
                565                 570                 575

Pro Gly Ser Gly Ile Phe Gly Pro Gly Ala Ser
            580                 585


<210> SEQ ID NO 43
<211> LENGTH: 601
<212> TYPE: PRT
<213> ORGANISM: Artificial Sequence
<220> FEATURE:
<223> OTHER INFORMATION: PRT917

<400> SEQUENCE: 43

Met His His His His His His Ser Ser Gly Ser Ser Gly Pro Gly Leu
1               5                   10                  15

Ile Gly Pro Tyr Gly Pro Gly Ala Ser Ala Ala Ala Ala Ala Gly Val
            20                  25                  30

Asn Gly Pro Gly Ser Gly Leu Ile Gly Pro Gly Val Ser Gly Val Tyr
        35                  40                  45

Gly Pro Gly Leu Ile Gly Pro Gly Leu Ile Gly Pro Gly Ser Ser Ala
    50                  55                  60

Ala Ala Ala Ala Gly Pro Gly Val Tyr Gly Pro Gly Leu Ile Gly Pro
65                  70                  75                  80

Ser Ala Ser Ala Ala Ala Ala Ala Gly Pro Gly Ser Gly Leu Ile Gly
                85                  90                  95

Pro Gly Ala Ser Gly Val Tyr Gly Pro Gly Leu Ile Gly Pro Gly Leu
            100                 105                 110

Ile Gly Pro Gly Ser Ser Ala Ala Ala Ala Ala Gly Val Tyr Gly Ser
        115                 120                 125

Gly Pro Gly Leu Ile Gly Pro Tyr Gly Ser Ala Ala Ala Ala Ala Gly
    130                 135                 140

Pro Gly Ser Gly Val Tyr Gly Val Gly Pro Tyr Gly Pro Gly Ala Ser
```

```
145                 150                 155                 160

Gly Pro Gly Val Tyr Gly Pro Gly Leu Ile Gly Pro Ser Ala Ser Ala
                165                 170                 175

Ala Ala Ala Ala Gly Ser Gly Leu Ile Gly Pro Gly Val Tyr Gly Pro
            180                 185                 190

Tyr Ala Ser Ala Ala Ala Ala Ala Gly Val Tyr Gly Ser Gly Pro Gly
        195                 200                 205

Leu Ile Gly Pro Tyr Gly Pro Gly Val Ser Gly Ser Gly Leu Ile Gly
    210                 215                 220

Pro Gly Leu Ile Gly Pro Tyr Ala Ser Ala Ala Ala Ala Ala Gly Pro
225                 230                 235                 240

Gly Leu Ile Gly Pro Tyr Gly Pro Gly Ser Ser Ala Ala Ala Ala Ala
                245                 250                 255

Gly Val Tyr Gly Tyr Gly Pro Gly Leu Ile Gly Pro Tyr Gly Pro Gly
            260                 265                 270

Ala Ser Gly Val Asn Gly Pro Gly Ser Gly Val Tyr Gly Pro Gly Leu
        275                 280                 285

Ile Gly Pro Gly Val Ser Ala Ala Ala Ala Ala Gly Pro Gly Leu Ile
    290                 295                 300

Gly Pro Tyr Gly Pro Gly Ala Ser Ala Ala Ala Ala Ala Gly Val Tyr
305                 310                 315                 320

Gly Pro Gly Leu Ile Gly Pro Gly Val Tyr Gly Pro Gly Ser Ser Gly
                325                 330                 335

Pro Gly Leu Ile Gly Pro Tyr Gly Pro Gly Ser Ser Ala Ala Ala Ala
            340                 345                 350

Ala Gly Val Tyr Gly Pro Gly Leu Ile Gly Pro Tyr Gly Pro Gly Val
        355                 360                 365

Ser Ala Ala Ala Ala Ala Gly Val Tyr Leu Ile Gly Pro Gly Leu Ile
    370                 375                 380

Gly Pro Tyr Gly Pro Gly Ala Ser Gly Pro Gly Leu Ile Gly Pro Tyr
385                 390                 395                 400

Gly Pro Gly Ala Ser Ala Ala Ala Ala Ala Gly Pro Gly Val Tyr Gly
                405                 410                 415

Pro Gly Leu Ile Gly Pro Ser Ala Ser Ala Ala Ala Ala Ala Gly Val
            420                 425                 430

Tyr Gly Ser Gly Pro Gly Val Tyr Gly Pro Tyr Gly Pro Gly Val Ser
        435                 440                 445

Gly Pro Gly Ser Gly Leu Ile Gly Val Gly Pro Tyr Gly Pro Gly Ala
    450                 455                 460

Ser Ala Ala Ala Ala Ala Gly Val Tyr Gly Pro Gly Leu Ile Gly Pro
465                 470                 475                 480

Tyr Gly Pro Gly Val Ser Ala Ala Ala Ala Ala Gly Pro Gly Ser Gly
                485                 490                 495

Val Tyr Gly Pro Gly Ala Ser Gly Val Asn Gly Pro Gly Ser Gly Val
            500                 505                 510

Tyr Gly Pro Gly Leu Ile Gly Pro Gly Val Ser Ala Ala Ala Ala Ala
        515                 520                 525

Gly Val Tyr Leu Ile Gly Pro Gly Leu Ile Gly Pro Tyr Gly Pro Gly
    530                 535                 540

Ala Ser Ala Ala Ala Ala Ala Gly Val Tyr Gly Ser Gly Pro Gly Leu
545                 550                 555                 560

Ile Gly Pro Tyr Gly Pro Gly Val Ser Gly Ser Gly Leu Ile Gly Pro
                565                 570                 575
```

```
Gly Leu Ile Gly Pro Tyr Ala Ser Ala Ala Ala Ala Ala Gly Pro Gly
            580                 585                 590

Ser Gly Leu Ile Gly Pro Gly Ala Ser
        595                 600


<210> SEQ ID NO 44
<211> LENGTH: 598
<212> TYPE: PRT
<213> ORGANISM: Artificial Sequence
<220> FEATURE:
<223> OTHER INFORMATION: PRT1028

<400> SEQUENCE: 44

Met His His His His His His Ser Ser Gly Ser Ser Gly Pro Gly Ile
1               5                   10                  15

Phe Gly Pro Tyr Gly Pro Gly Ala Ser Ala Ala Ala Ala Ala Gly Thr
            20                  25                  30

Gly Pro Gly Ser Gly Ile Phe Gly Pro Gly Thr Ser Gly Thr Tyr Gly
        35                  40                  45

Pro Gly Ile Phe Gly Pro Gly Ile Phe Gly Pro Gly Ser Ser Ala Ala
    50                  55                  60

Ala Ala Ala Gly Pro Gly Thr Tyr Gly Pro Gly Ile Phe Gly Pro Ser
65                  70                  75                  80

Ala Ser Ala Ala Ala Ala Ala Gly Pro Gly Ser Gly Ile Phe Gly Pro
                85                  90                  95

Gly Ala Ser Gly Thr Tyr Gly Pro Gly Ile Phe Gly Pro Gly Ile Phe
            100                 105                 110

Gly Pro Gly Ser Ser Ala Ala Ala Ala Ala Gly Thr Tyr Gly Ser Gly
        115                 120                 125

Pro Gly Ile Phe Gly Pro Tyr Gly Ser Ala Ala Ala Ala Ala Gly Pro
    130                 135                 140

Gly Ser Gly Thr Tyr Gly Thr Gly Pro Tyr Gly Pro Gly Ala Ser Gly
145                 150                 155                 160

Pro Gly Thr Tyr Gly Pro Gly Ile Phe Gly Pro Ser Ala Ser Ala Ala
                165                 170                 175

Ala Ala Ala Gly Ser Gly Ile Phe Gly Pro Gly Thr Tyr Gly Pro Tyr
            180                 185                 190

Ala Ser Ala Ala Ala Ala Ala Gly Thr Tyr Gly Ser Gly Pro Gly Ile
        195                 200                 205

Phe Gly Pro Tyr Gly Pro Gly Thr Ser Gly Ser Gly Ile Phe Gly Pro
    210                 215                 220

Gly Ile Phe Gly Pro Tyr Ala Ser Ala Ala Ala Ala Ala Gly Pro Gly
225                 230                 235                 240

Ile Phe Gly Pro Tyr Gly Pro Gly Ser Ser Ala Ala Ala Ala Ala Gly
                245                 250                 255

Thr Tyr Gly Tyr Gly Pro Gly Ile Phe Gly Pro Tyr Gly Pro Gly Ala
            260                 265                 270

Ser Gly Thr Gly Pro Gly Ser Gly Thr Tyr Gly Pro Gly Ile Phe Gly
        275                 280                 285

Pro Gly Thr Ser Ala Ala Ala Ala Ala Gly Pro Gly Ile Phe Gly Pro
    290                 295                 300

Tyr Gly Pro Gly Ala Ser Ala Ala Ala Ala Ala Gly Thr Tyr Gly Pro
305                 310                 315                 320

Gly Ile Phe Gly Pro Gly Thr Tyr Gly Pro Gly Ser Ser Gly Pro Gly
                325                 330                 335
```

-continued

```
Ile Phe Gly Pro Tyr Gly Pro Gly Ser Ser Ala Ala Ala Ala Ala Gly
            340                 345                 350

Thr Tyr Gly Pro Gly Ile Phe Gly Pro Tyr Gly Pro Gly Thr Ser Ala
        355                 360                 365

Ala Ala Ala Ala Gly Thr Tyr Ile Phe Gly Pro Gly Ile Phe Gly Pro
    370                 375                 380

Tyr Gly Pro Gly Ala Ser Gly Pro Gly Ile Phe Gly Pro Tyr Gly Pro
385                 390                 395                 400

Gly Ala Ser Ala Ala Ala Ala Ala Gly Pro Gly Thr Tyr Gly Pro Gly
                405                 410                 415

Ile Phe Gly Pro Ser Ala Ser Ala Ala Ala Ala Ala Gly Thr Tyr Gly
            420                 425                 430

Ser Gly Pro Gly Thr Tyr Gly Pro Tyr Gly Pro Gly Thr Ser Gly Pro
        435                 440                 445

Gly Ser Gly Ile Phe Gly Thr Gly Pro Tyr Gly Pro Gly Ala Ser Ala
    450                 455                 460

Ala Ala Ala Ala Gly Thr Tyr Gly Pro Gly Ile Phe Gly Pro Tyr Gly
465                 470                 475                 480

Pro Gly Thr Ser Ala Ala Ala Ala Ala Gly Pro Gly Ser Gly Thr Tyr
                485                 490                 495

Gly Pro Gly Ala Ser Gly Thr Gly Pro Gly Ser Gly Thr Tyr Gly Pro
            500                 505                 510

Gly Ile Phe Gly Pro Gly Thr Ser Ala Ala Ala Ala Ala Gly Thr Tyr
        515                 520                 525

Ile Phe Gly Pro Gly Ile Phe Gly Pro Tyr Gly Pro Gly Ala Ser Ala
    530                 535                 540

Ala Ala Ala Ala Gly Thr Tyr Gly Ser Gly Pro Gly Ile Phe Gly Pro
545                 550                 555                 560

Tyr Gly Pro Gly Thr Ser Gly Ser Gly Ile Phe Gly Pro Gly Ile Phe
                565                 570                 575

Gly Pro Tyr Ala Ser Ala Ala Ala Ala Ala Gly Pro Gly Ser Gly Ile
            580                 585                 590

Phe Gly Pro Gly Ala Ser
        595
```

The invention claimed is:

1. A blended yarn consisting of:

a fiber from a modified fibroin derived protein, wherein the fiber from a modified fibroin derived protein is a shrunk fiber, and comprises a domain sequence represented by Formula 1: $[(A)_n \text{ motif-REP}]_m$ wherein in Formula 1, (i) the $(A)_n$ motif represents an amino acid sequence composed of 2 to 27 amino acid residues and the number of alanine residues with respect to a total number of amino acid residues in the $(A)_n$ motif is 83% or more;

(ii) REP represents an amino acid sequence composed of 10 to 200 amino acid residues; m represents an integer of 2 to 300;

(iii) a plurality of the $(A)_n$ motifs may have the same amino acid sequence or amino acid sequences different from each other;

(iv) a plurality of REPs having the same amino acid sequence or amino acid sequences different from each other; and (v) the domain sequence has an amino acid sequence with a reduced content of glycine residues, which corresponds to an amino acid sequence in which at least one or a plurality of glycine residues in at least one GGX motif, wherein X represents an amino acid residue other than glycine, of REP are substituted with other amino acid residues selected from the group of amino acids consisting of valine (V), leucine (L), isoleucine (I), methionine (M), proline (P), phenylalanine (F), tryptophan (W), glutamine (Q), asparagine (N), lysine (K), or glutamic acid (E); and a regenerated cellulose fiber.

2. The blended yarn according to claim 1, wherein a shrinkage rate of the fiber from a modified fibroin derived protein as defined by the following formula is more than 7%:

Shrinkage rate={1−(Length of fiber after being brought into contact with aqueous medium/Length of fiber before being brought into contact with aqueous medium)}×100(%).

3. The blended yarn according to claim 1, wherein an amount of the fiber from a modified fibroin derived protein is 5% to 40% by mass.

4. The blended yarn according to claim 1, wherein the fiber from a modified fibroin derived protein is a modified spider silk fibroin fiber.

5. The blended yarn according to claim 1, wherein the regenerated cellulose fiber is a lyocell fiber.

6. A knitted or woven body of the blended yarn according to claim 1.

7. A method for manufacturing a knitted or woven body, comprising steps of:

blend-spinning a fiber from a modified fibroin derived protein and a regenerated cellulose fiber to obtain the blended yarn of claim 1; and knitted or weaving the blended yarn to obtain an unprocessed knitted or woven body.

8. The manufacturing method according to claim 7, wherein a shrinkage rate of the fiber from a modified fibroin derived protein as defined by the following formula is more than 7%:

Shrinkage rate={1−(Length of fiber from a modified fibroin derived protein after being brought into contact with aqueous medium/Length of fiber before being brought into contact with aqueous medium)}×100(%).

9. The manufacturing method according to claim 7, further comprising bringing the unprocessed knitted or woven body into contact with an aqueous medium to shrink the fiber from a modified fibroin derived protein contained in the unprocessed knitted or woven body.

10. The manufacturing method according to claim 7, wherein in the step of obtaining the blended yarn, the fiber from a modified fibroin derived protein and the regenerated cellulose fiber are blend-spun so that an amount of the fiber from a modified fibroin derived protein in the blended yarn becomes 5% to 40% by mass.

11. The manufacturing method according to claim 7, wherein the modified fibroin derived protein is derived from a spider silk fibroin protein.

12. The manufacturing method according to claim 7, wherein the regenerated cellulose fiber is a lyocell fiber.

13. The blended yarn according to claim 1, wherein the fiber from a modified fibroin derived protein comprises a domain sequence represented by Formula 1: $[(A)_n \text{ motif-REP}]_m$, and the domain sequence has an amino acid sequence with a reduced content of $(A)_n$ motifs, which corresponds to an amino acid sequence in which at least one or a plurality of $(A)_n$ motifs are deleted, as compared with a naturally occurring fibroin, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

14. The blended yarn according to claim 1, wherein the fiber from a modified fibroin derived protein comprises a domain sequence represented by Formula 1: $[(A)_n \text{ motif-REP}]_m$, and the domain sequence has an amino acid sequence comprising a region having a locally high hydropathy index, which corresponds to an amino acid sequence in which one or a plurality of amino acid residues in REP are substituted with an amino acid residue having a high hydropathy index and/or one or a plurality of amino acid residues having a high hydropathy index is inserted into REP, as compared with a naturally occurring fibroin, wherein in Formula 1, the $(A)_n$ motif represents an amino acid sequence composed of 2 to 27 amino acid residues and the number of alanine residues with respect to a total number of amino acid residues in the $(A)_n$ motif is 83% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

15. The blended yarn according to claim 1, wherein the fiber from a modified fibroin derived protein comprises a domain sequence represented by Formula 1: $[(A)_n \text{ motif-REP}]_m$ or Formula 2: $[(A)_n \text{ motif-REP}]_m$-$(A)_n$ motif, and the domain sequence has an amino acid sequence with a reduced content of glutamine residues, which corresponds to an amino acid sequence in which one or a plurality of glutamine residues in REP are deleted or substituted with other amino acid residues, as compared with a naturally occurring fibroin, wherein in Formula 1 and Formula 2, the $(A)_n$ motif represents an amino acid sequence composed of 2 to 27 amino acid residues and the number of alanine residues with respect to a total number of amino acid residues in the $(A)_n$ motif is 80% or more;

REP represents an amino acid sequence composed of 10 to 200 amino acid residues;

m represents an integer of 2 to 300;

a plurality of the $(A)_n$ motifs may have the same amino acid sequence or amino acid sequences different from each other; and a plurality of REPs may have the same amino acid sequence or amino acid sequences different from each other.

16. The blended yarn according to claim 1, wherein the modified fibroin derived protein has a limiting oxygen index (LOI) value of 26.0 or more.

17. The blended yarn according to claim 1, wherein the modified fibroin derived protein has a maximum hygroscopic heat generation, as determined according to the following formula A, of the derived protein is more than 0.025° C./g:

Maximum hygroscopic heat generation={(Highest temperature of a sample when the sample has been transferred to a high humidity environment after being placed in a low humidity environment until a temperature of the sample reaches equilibrium)−(Temperature of the sample when the sample is being transferred to the high humidity environment after being placed in the low humidity environment until the temperature of the sample reaches equilibrium)} (° C.)/Sample weight (g), Formula A:

wherein in Formula A, the low humidity environment means an environment of a temperature of 20° C. and a relative humidity of 40%, and the high humidity environment means an environment of a temperature of 20° C. and a relative humidity of 90%.

* * * * *